United States Patent [19]

Inouye et al.

[11] Patent Number: 4,919,047

[45] Date of Patent: Apr. 24, 1990

[54] MULTICOLOR PRINTING PRESS

[75] Inventors: Yoshinori Inouye, Ohtsu; Minoru Ueda, Koga; Kosuke Yotsuzuka, Ohtsu, all of Japan

[73] Assignee: Toray Industries, Inc., Tokyo, Japan

[21] Appl. No.: 900,794

[22] Filed: Aug. 27, 1986

[30] Foreign Application Priority Data

Aug. 27, 1985 [JP] Japan ..... 60-189096
Aug. 30, 1985 [JP] Japan ..... 60-192498

[51] Int. Cl.[5] ..... B41F 5/02; B41F 7/08; B41F 31/30

[52] U.S. Cl. ..... 101/175; 101/477; 101/492; 101/177; 101/352

[58] Field of Search ..... 101/142, 143, 144, 145, 101/350, 351, 352, 363, 364, 207, 208–210, 137, 477, 492, 177, 175

[56] References Cited

U.S. PATENT DOCUMENTS

| | | | |
|---|---|---|---|
| 3,746,957 | 7/1973 | Forster et al. | 101/202 |
| 3,858,508 | 1/1975 | Kaneko et al. | 101/132 |
| 4,127,067 | 11/1978 | Dahlgren et al. | 101/350 X |
| 4,141,293 | 2/1979 | Corse | 101/181 |
| 4,211,167 | 7/1980 | Corse | 101/148 |
| 4,355,576 | 10/1982 | Ohlsson | 101/217 X |
| 4,357,872 | 11/1982 | Simeth et al. | 101/350 |
| 4,358,996 | 11/1982 | Ohlsson | 101/217 |
| 4,384,518 | 5/1983 | Albin | 101/363 |
| 4,434,716 | 3/1984 | Ishii et al. | 101/144 |
| 4,452,139 | 6/1984 | Dahlgren et al. | 101/350 |
| 4,479,433 | 10/1984 | Macphee et al. | 101/364 |
| 4,538,518 | 9/1985 | Dahlgren et al. | 101/350 |
| 4,590,855 | 5/1986 | Schommer et al. | 101/157 |
| 4,616,564 | 10/1986 | Faddis et al. | 101/143 |

FOREIGN PATENT DOCUMENTS

| | | |
|---|---|---|
| 56-150550 | 11/1981 | Japan . |
| 56-165264 | 10/1982 | Japan . |
| 58 94467 | 6/1983 | Japan . |

*Primary Examiner*—J. Reed Fisher
*Attorney, Agent, or Firm*—Lowe, Price, LeBlanc, Becker & Shur

[57] ABSTRACT

A multicolor printing press incorporating a plurality of plate cylinders (3, 4) capable of winding dampening-waterless plates (50) onto themselves at the predetermined positions of the printing press body (1). The multicolor printing press is provided with a plurality of inking devices (7, 8) and plate feeding/discharging devices (5, 6) which are commonly made available for these plate cylinders (3, 4) so that these devices can individually be mounted onto and removed from the positions of printing press body (1) opposite the plate cylinders (3, 4), thus allowing the printing plate (50) to be automatically fed to and discharged from the plate cylinders (3, 4) and the printing operation to be quickly and easily changed as required.

19 Claims, 122 Drawing Sheets

710
714
715
750

714
715
750
710

714
715
750
710

710
714
715
750

710
715
750
714

FIG. 56(a)
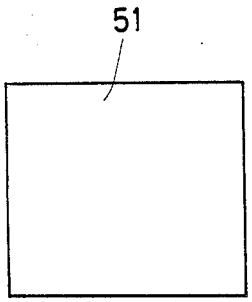
FIG. 56(c)
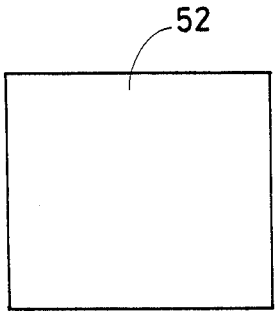
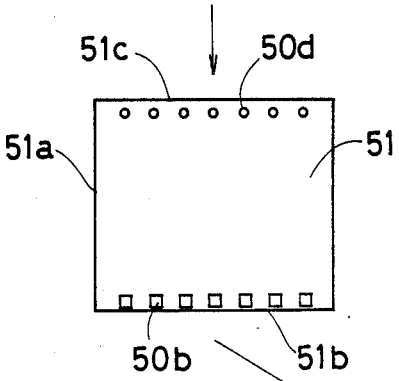
FIG. 56(b)
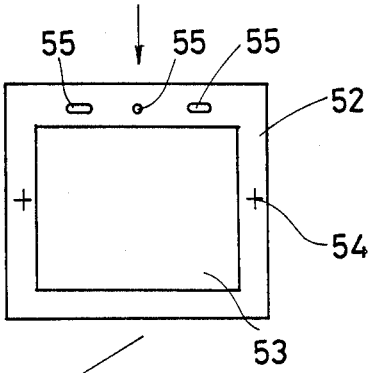
FIG. 56(d)
FIG. 56(e) Exposure
FIG. 56(f) Development

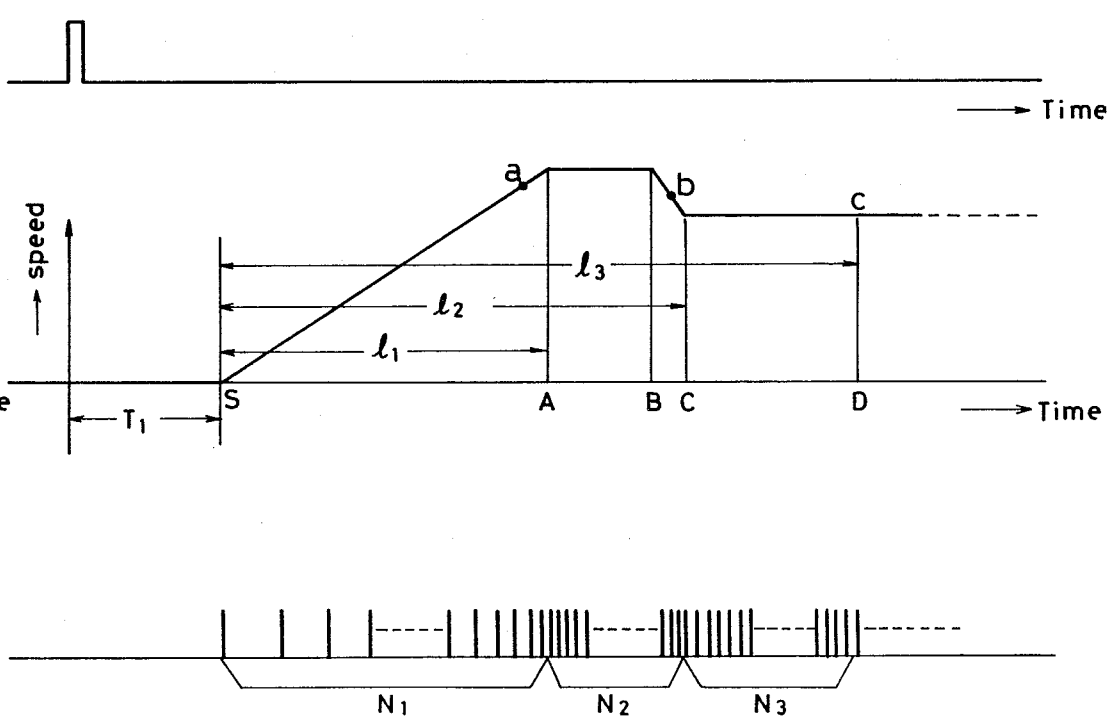
FIG. 64 (a) Reference pulse(Z)
FIG. 64 (b) Plate-feeding roller speed curve
FIG. 64 (c) PROM data FIG. 72(a)
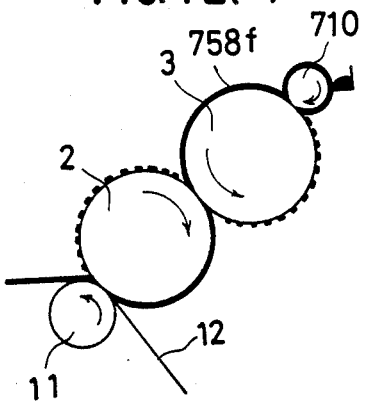
FIG. 72(b)
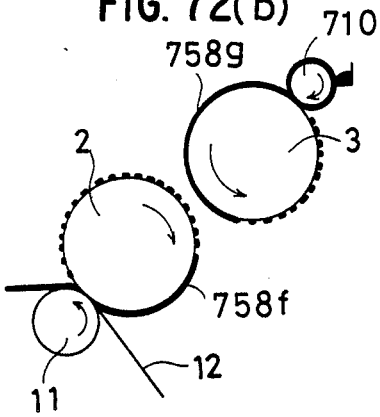
FIG. 72(c)
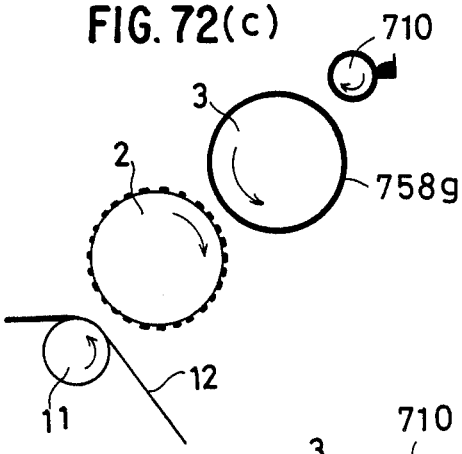
FIG. 72(d)
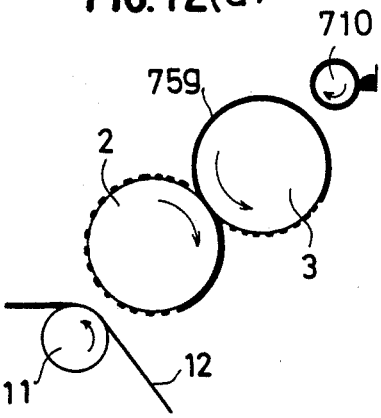
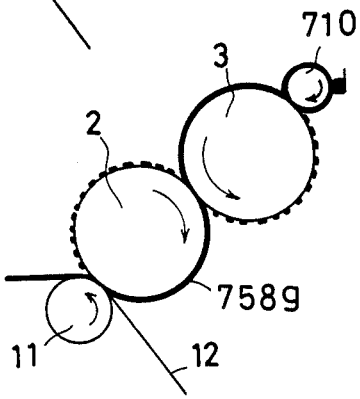
FIG. 72(e)

1403
1430
1433
1434
1431

MAXIMUM SUCTION WIDTH

MINIMUM SUCTION WIDTH

A SIGNAL OUTPUTTED FROM REFERENCE ROTARY ENCODER

VOLTAGE OBTAIND BY F-V CONVERSION OF A SIGNAL

VOLTAGE OBTAINED BY F-V CONVERSION OF OUTPUT SIGNAL FROM PULSE SIGNAL PROCESSING UNIT

MULTICOLOR PRINTING PRESS

BACKGROUND OF THE INVENTION

1. Field of the Invention

The present invention relates to a multicolor printing press, more particularly, to a multicolor printing press capable of executing multicolor printing operation using dampening waterless plates. (i.e. "a waterless planographic plate": a waterless planographic plate is described in detail, for example, in Japanese Patent Laying-Open Gazette No. 94504/1973 and No. 50102/1975.)

2. Description of the Prior Art

Structurally, any of conventional multicolor printing presses incorporating a plurality of plate cylinders disposes plate cylinders in positions close to each other, and thus, it cannot provide space enough for installing dampening arrangement, inking device, and the plate feeding/discharging device altogether in the periphery of each plate cylinder. For example, those multicolor printing machines disclosed by the official publications in conjunction with the Japanese Patent Laying-Open Gazette No. 165264/1982, No. 152504/1979 and No. 8204/1978, merely provide the inking device and the dampening arrangement in the periphery of each plate cylinder, whereas these provide no space needed for installing the plate feeding/discharging device. As a result, any of these multicolor printing presses oblige an operator to manually wind the printing plates onto the plate cylinders, after the inking device and the dampening arrangement is departed from the plate cylinder. Actually, any conventional multicolor printing press cannot automatically feed and discharge plates due to structural disadvantage.

SUMMARY OF THE INVENTION

The present invention overcomes all the problems inherent to conventional multicolor printing presses by effectively providing a novel multicolor printing press capable of executing multicolor printing operation using dampening-waterless plates.

The multicolor printing press according to the present invention is comprised of a plurality of plate cylinders, inking devices and the plate feeding/discharging devices which are respectively set to the designated positions of the multicolor printing press body. Each inking device is commonly made available for individual plate cylinder and set to the printing press body so that each of these inking devices can freely be mounted onto and removed from it for correctly dealing with the corresponding plate cylinder. Likewise, each of these plate feeding/discharging devices commonly deals with the corresponding plate cylinder, while being set to the printing press body so that each can freely be mounted onto and removed from it.

The primary object of the present invention is to provide a useful multicolor the printing press capable of automatically feeding and discharging printing plates.

The second object of the present invention is to provide a useful multicolor printing press ideally suited for use in the printing of a small number of prints by quickly and easily allowing change of the printable content.

In particular, the multicolor printing press according to the present invention uses dampening-waterless plates, thus dispensing with the dampening arrangement otherwise inherently needed for any conventional multicolor printing press. This provides the printing press with additional space allowance, thus allowing a plurality of inking devices and plate feeding/discharging devices for dealing with the corresponding plate cylinders so that printing plates can either be mounted onto or removed from the plate cylinders automatically. In addition, since these inking devices and plate feeding-/discharging devices are set to the printing press body so that they can freely be mounted onto and removed from the printing press body, it is possible for an operator to easily change ink and printing plates are required.

These and other objects, features, aspects and advantages of the present invention will become more apparent from the following detailed description of the present invention when taken in conjunction with the accompanying drawings.

BRIEF DESCRIPTION OF THE DRAWINGS

FIG. 35(*b*) is an enlarged diagram concerning a part of FIG. 35(*a*);

Figure 53:
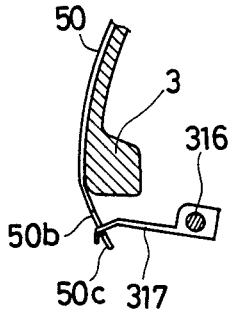
Figure 53D:
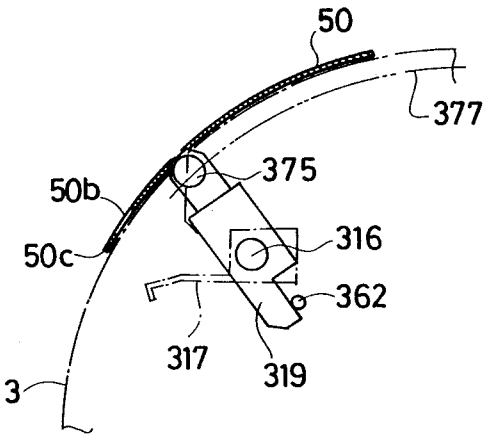
Figure 53C:
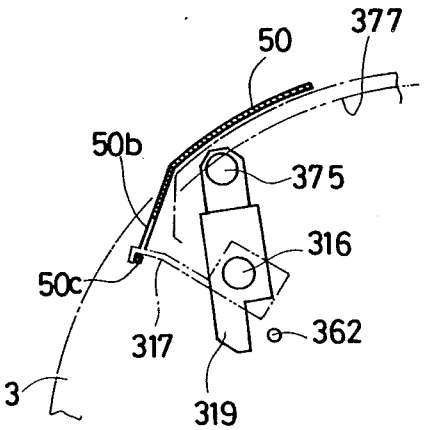
Figure 53B:
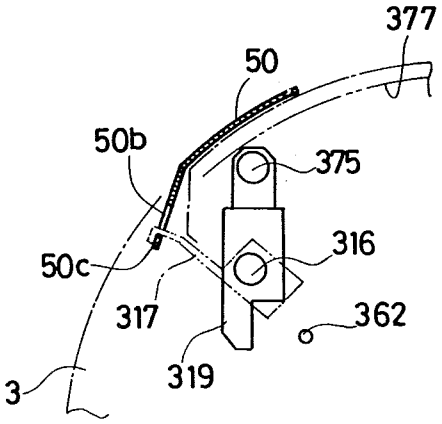
Figure 54:
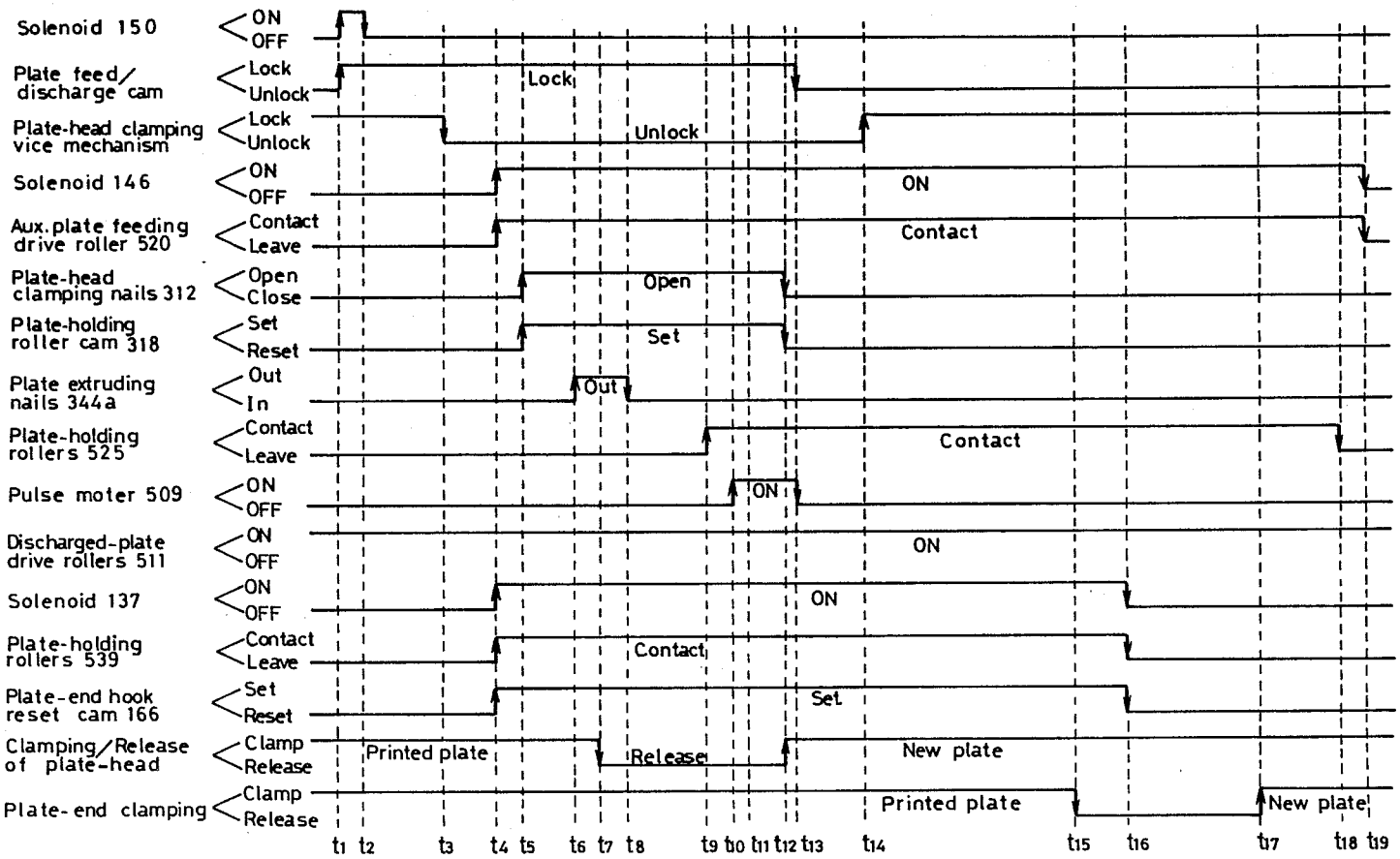
Figure 55:
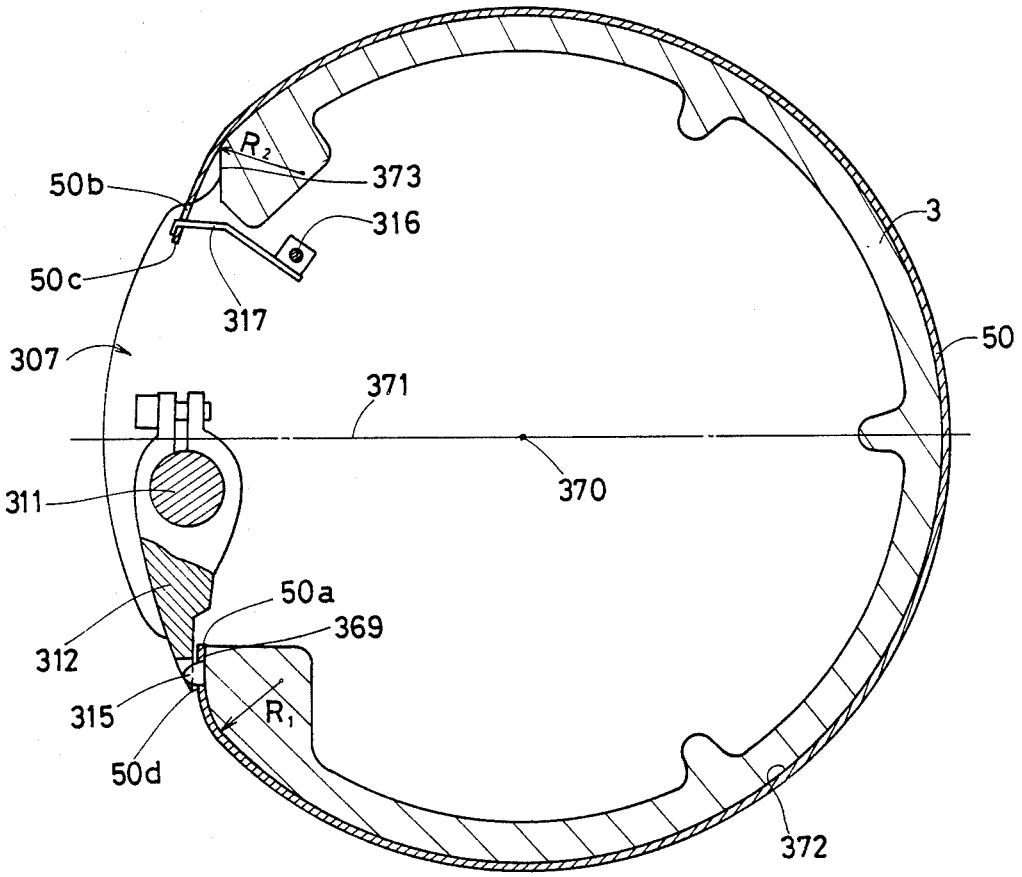
Figure 57A:
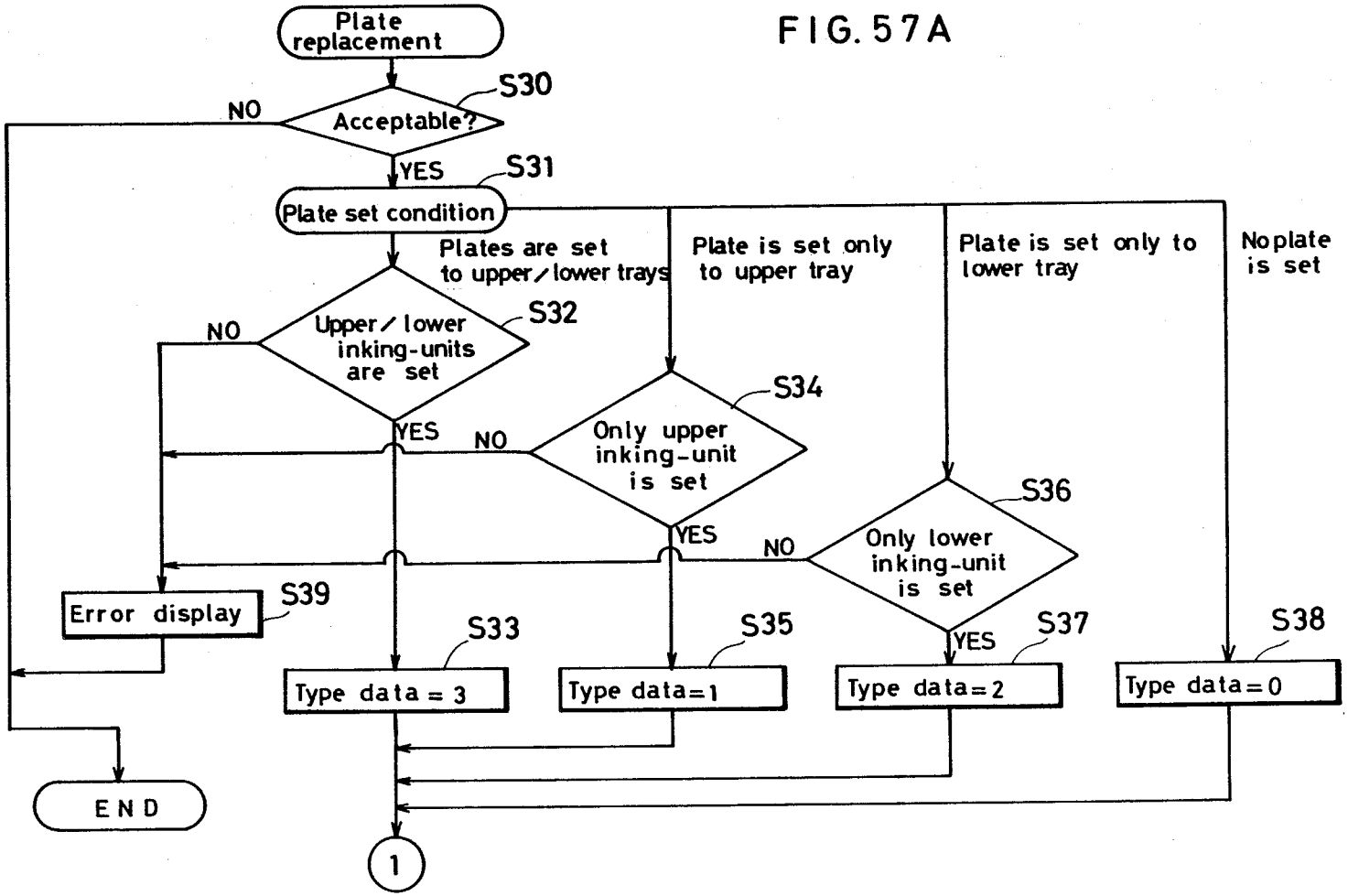
Figure 57B:
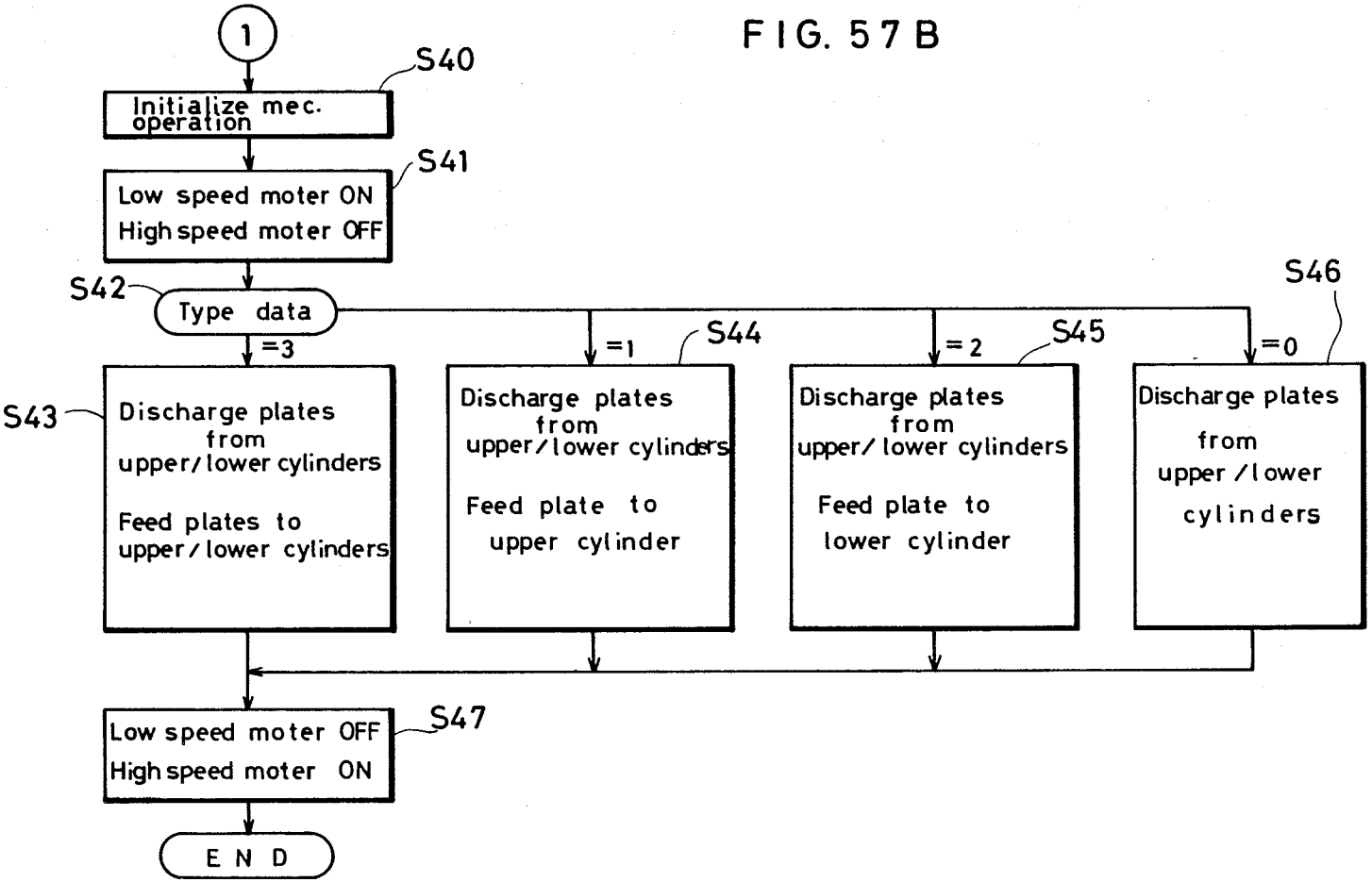
Figure 58:
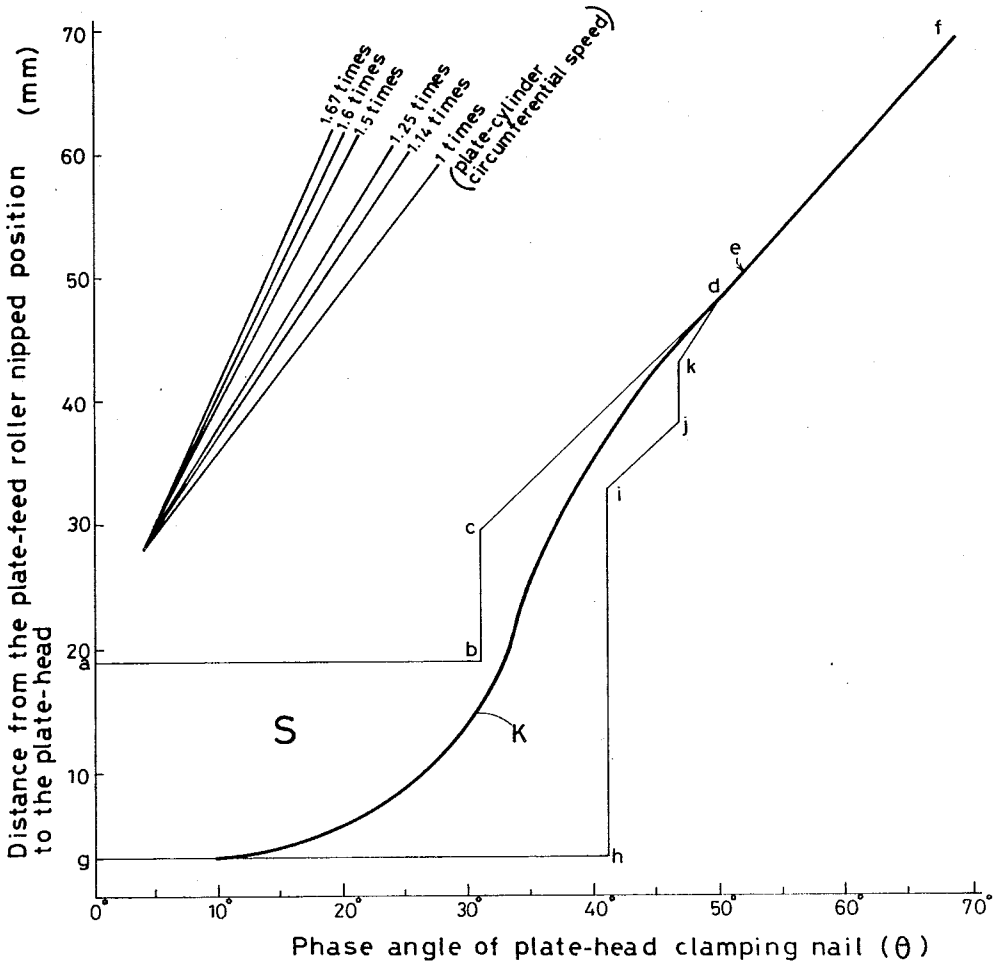
Figure 59:
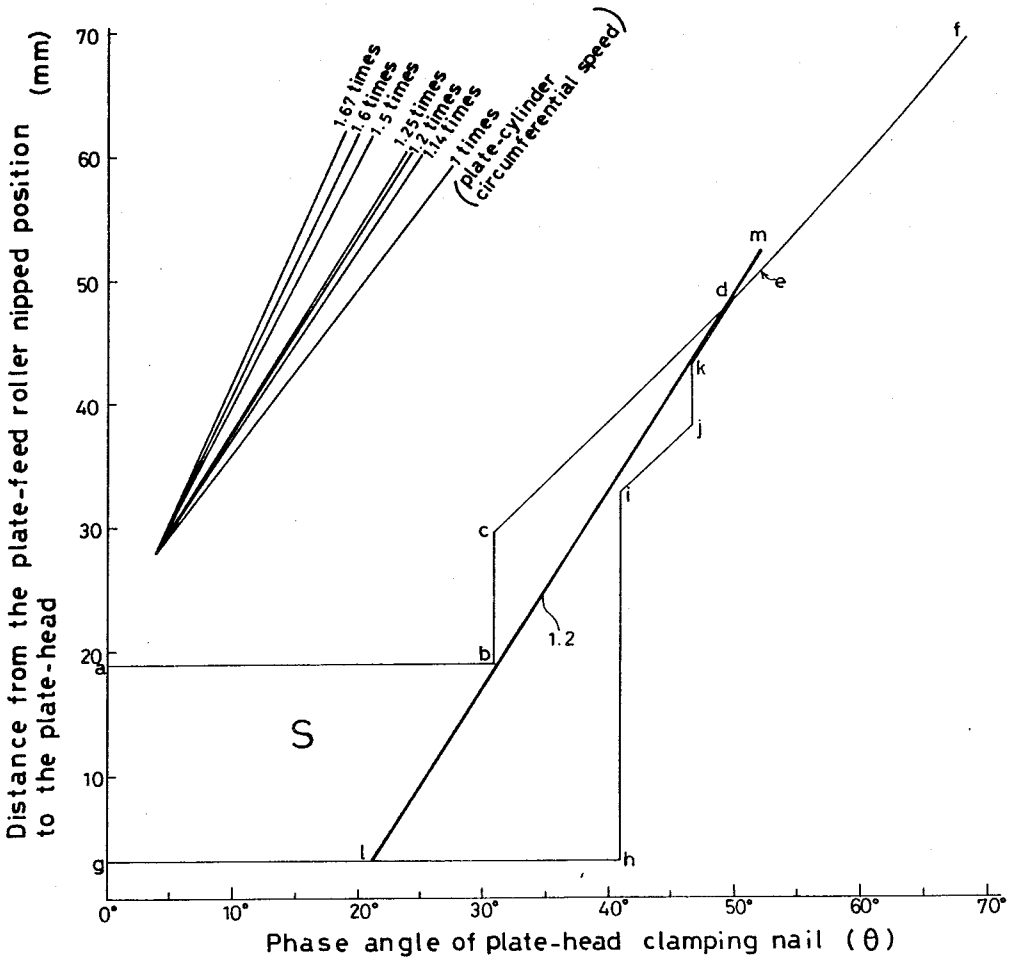
Figure 60:
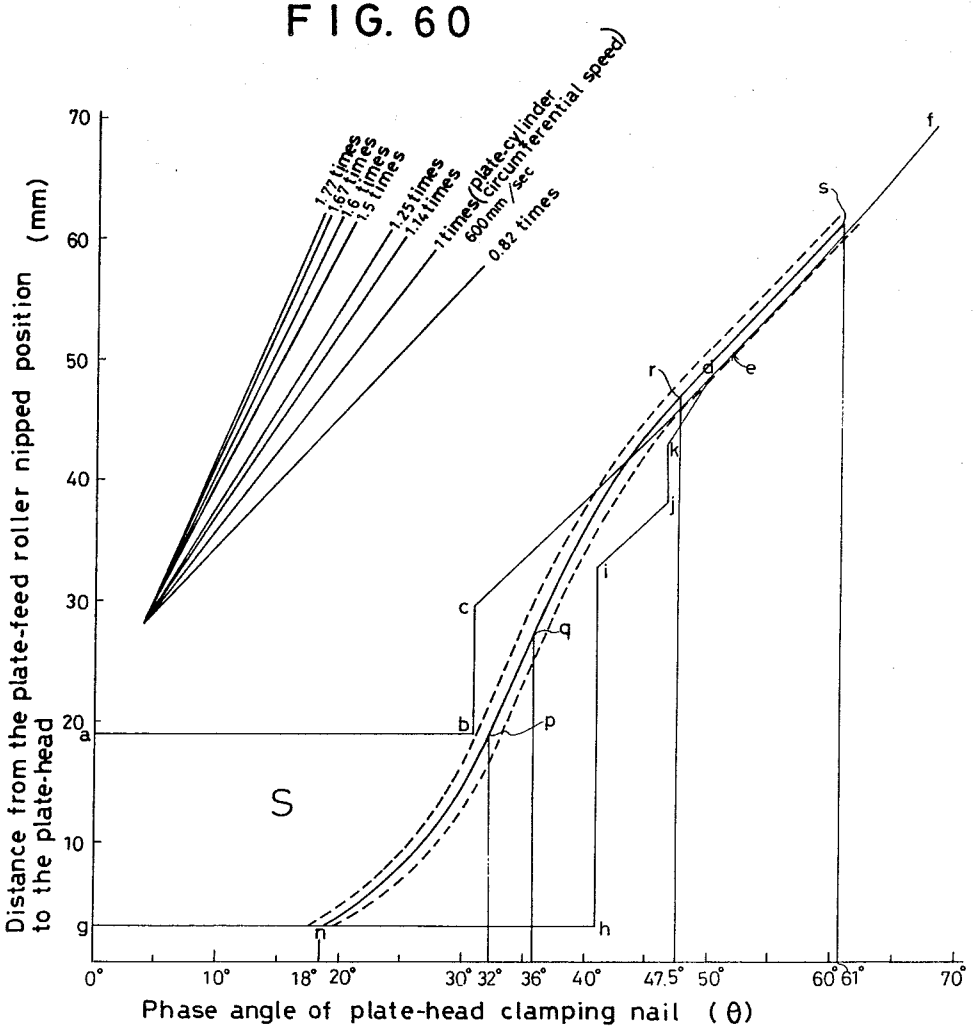
Figure 61:
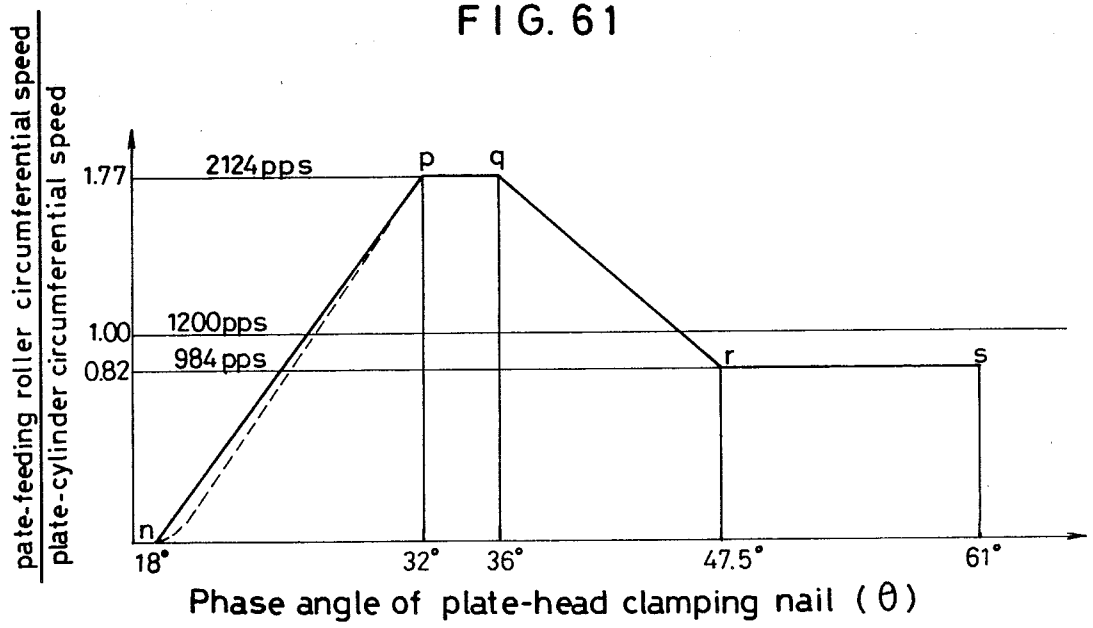
Figure 62:
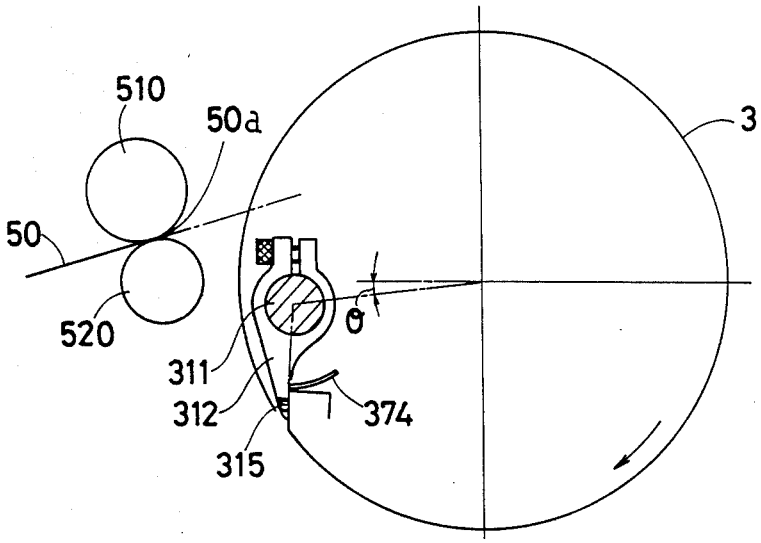
Figure 62:
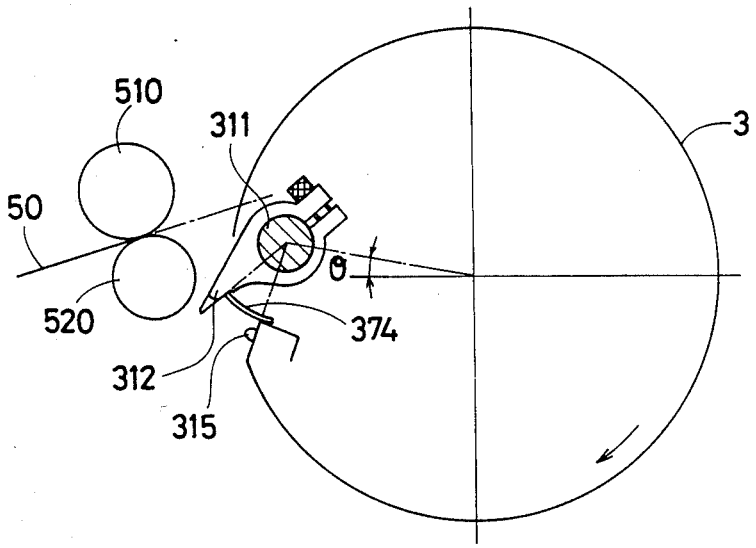
Figure 62:
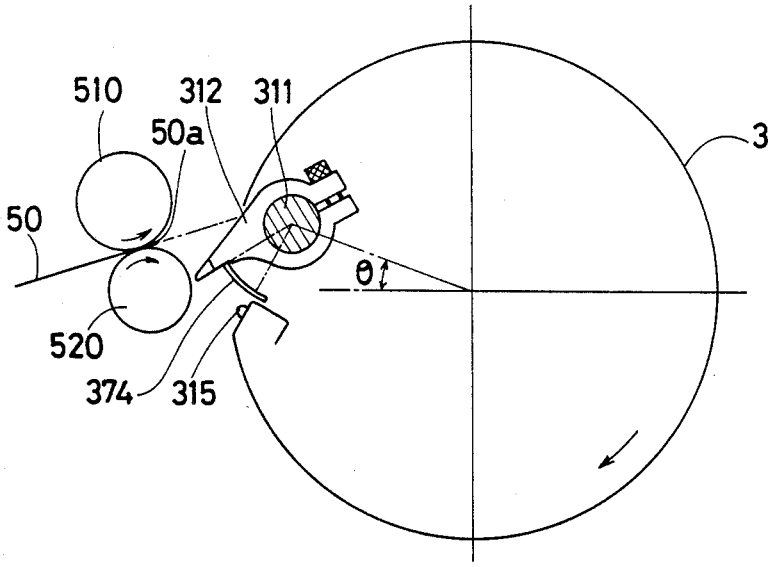
Figure 62:
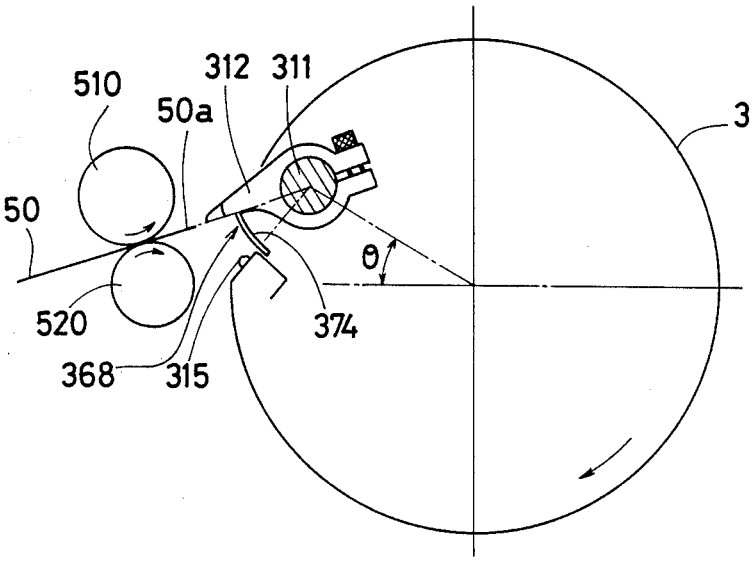
Figure 62:
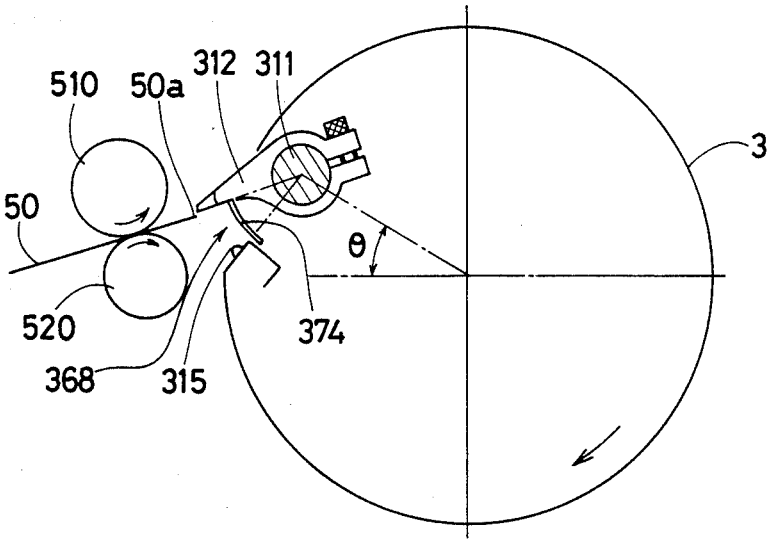
Figure 62:
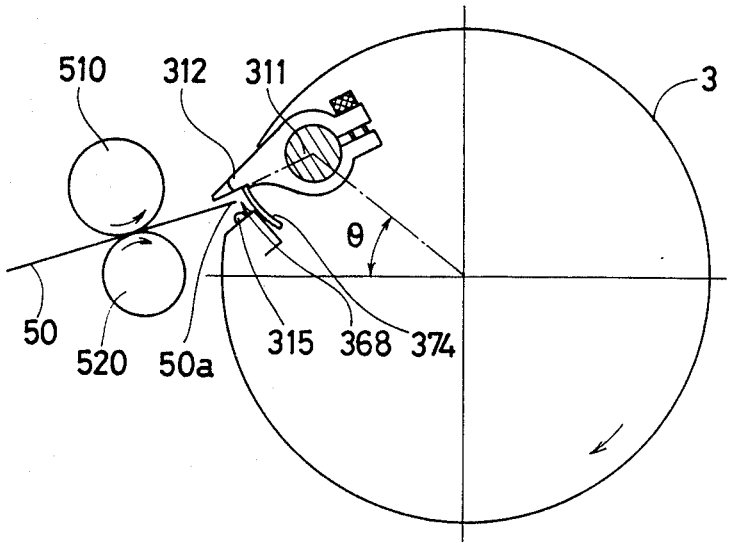
Figure 62:
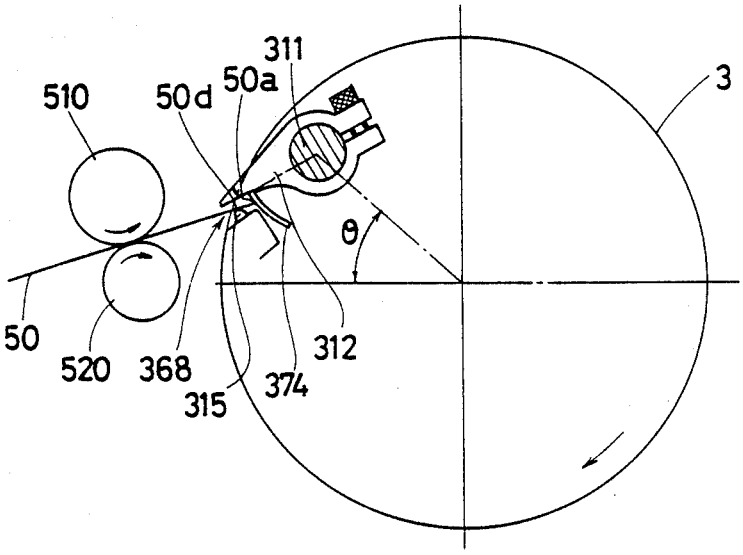
Figure 62:
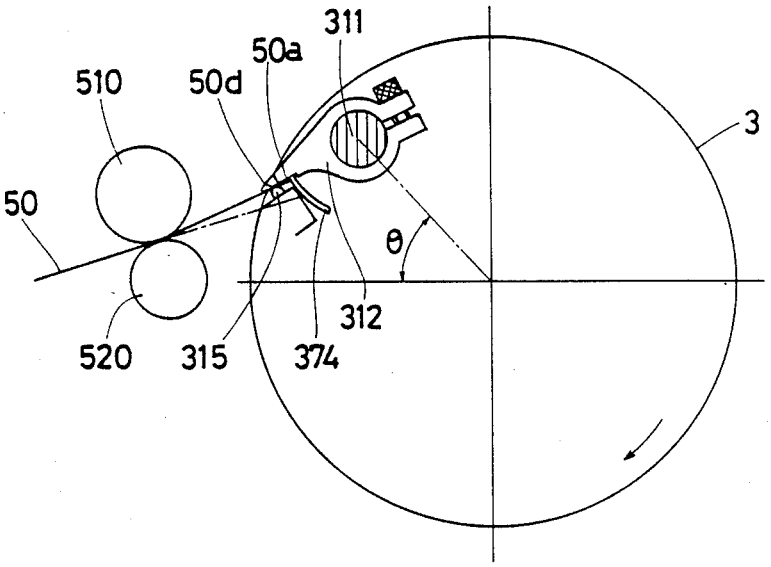
Figure 62:
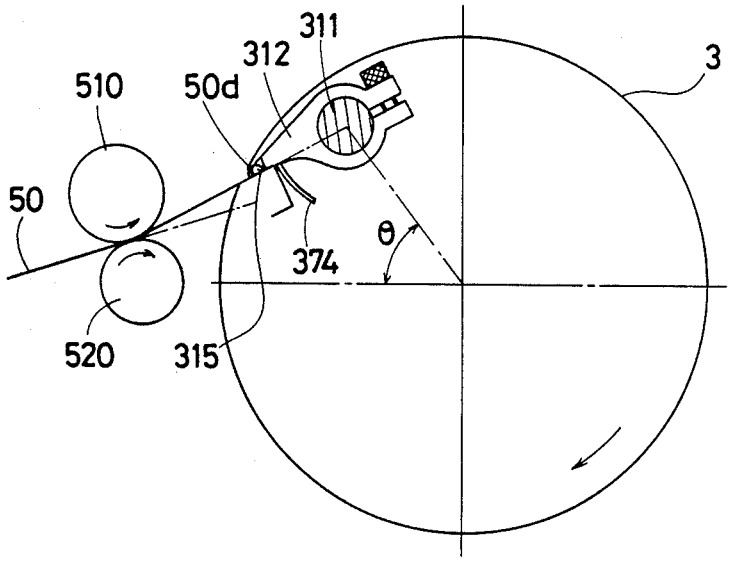
Figure 62:
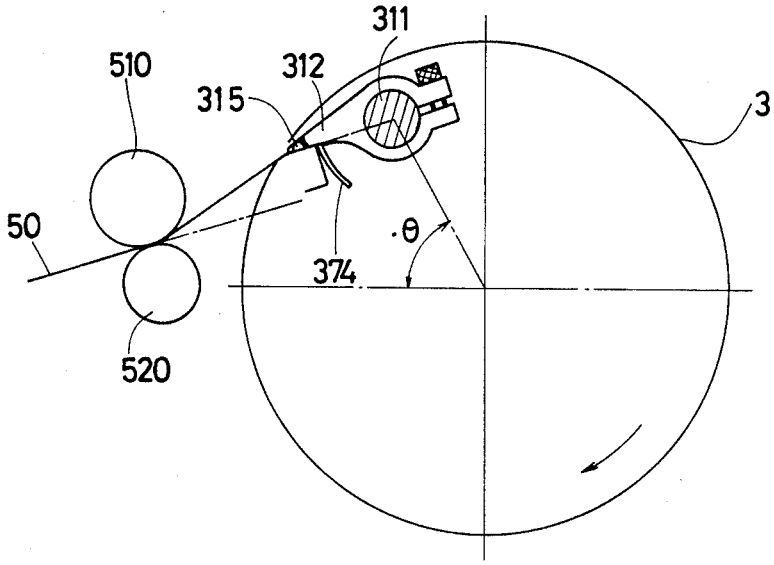
Figure 63:
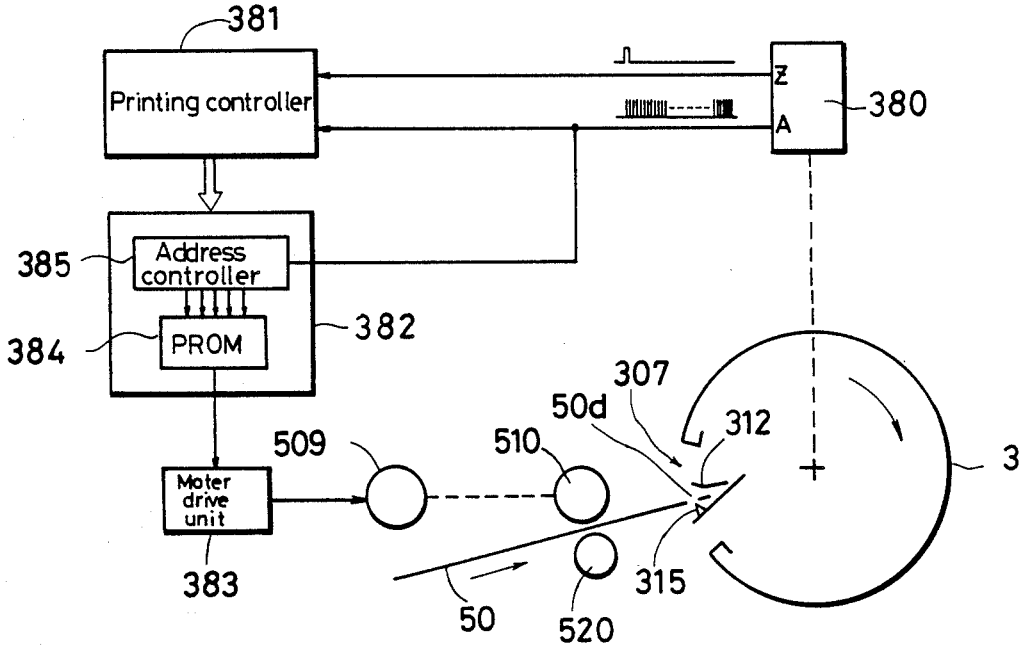
Figure 65:
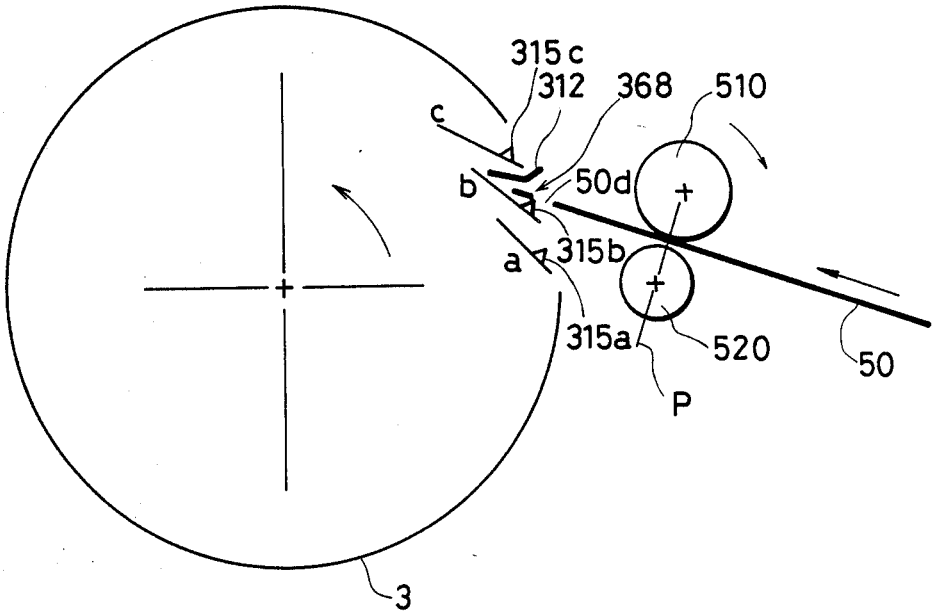
Figure 66:
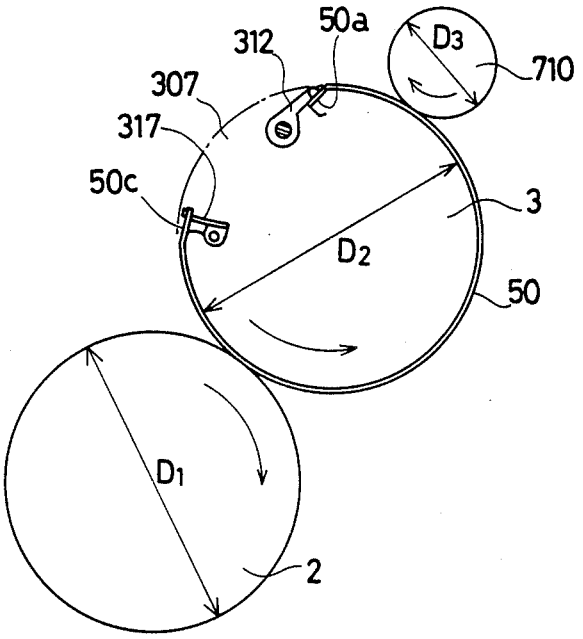
Figure 67:
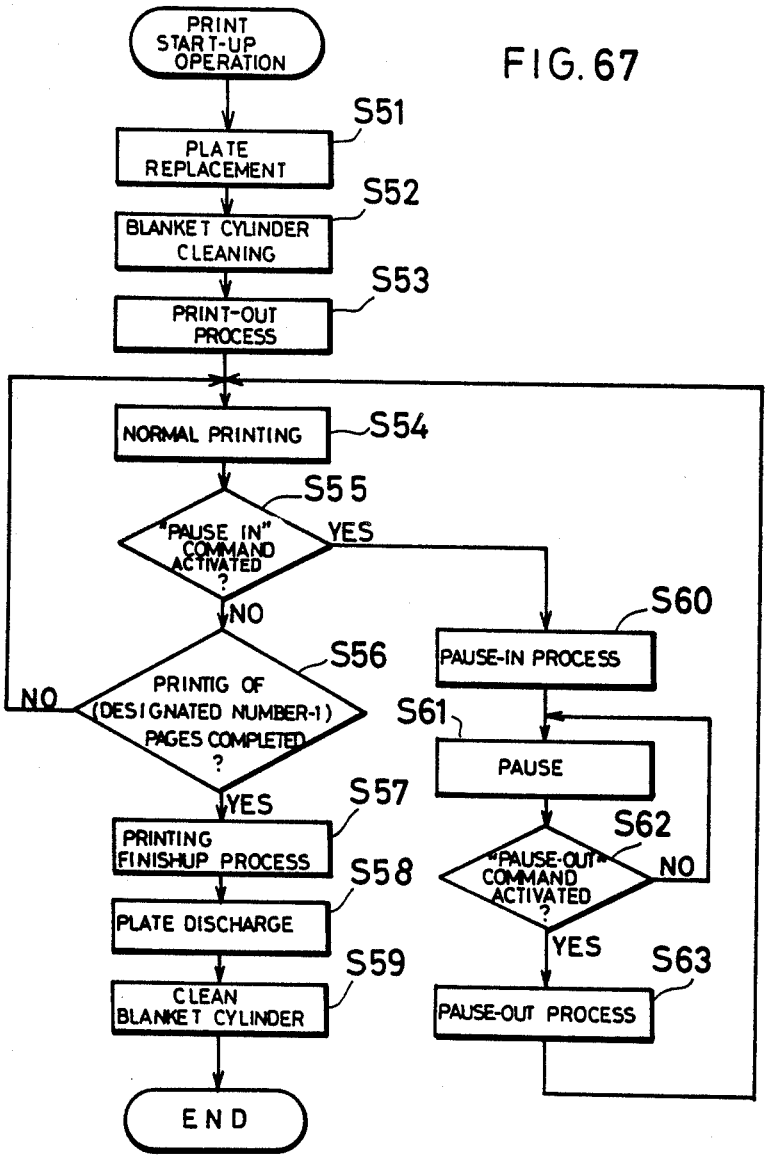
Figure 68A:
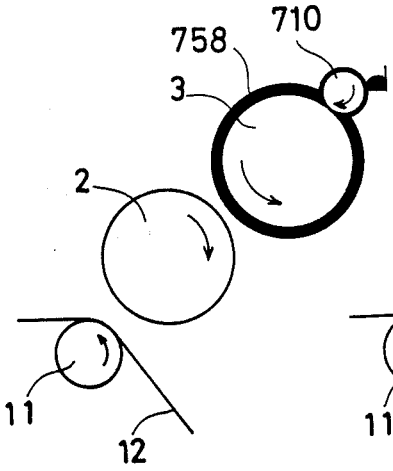
Figure 68B:
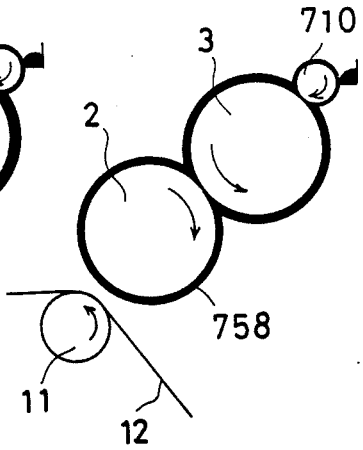
Figure 68C:
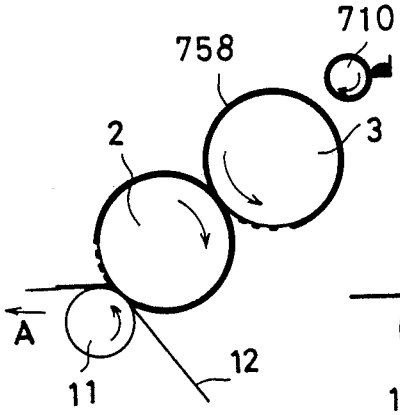
Figure 68D:
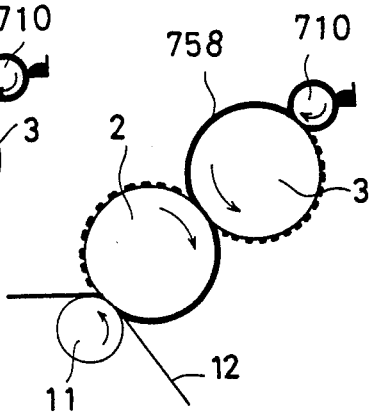
Figure 69A:
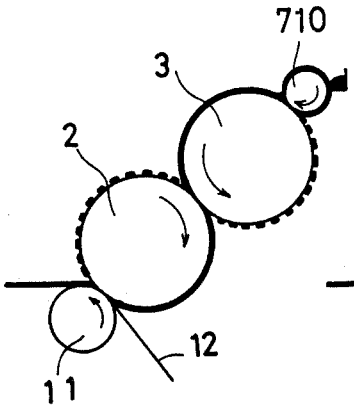
Figure 69B:
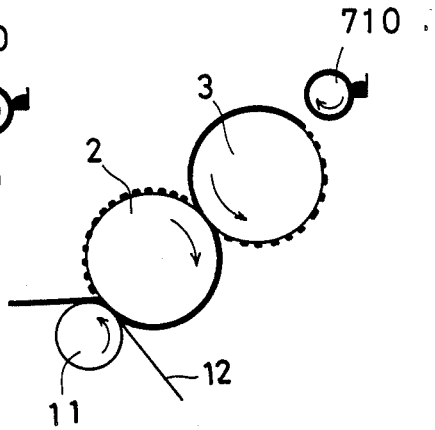
Figure 69C:
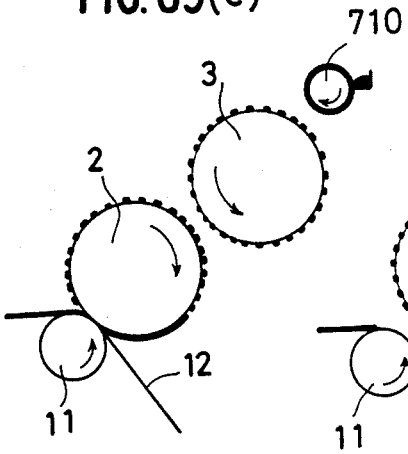
Figure 69D:
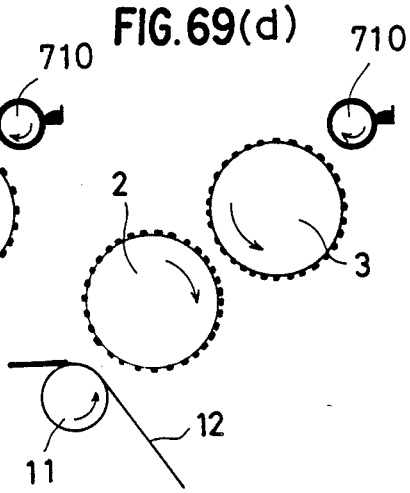
Figure 70A:
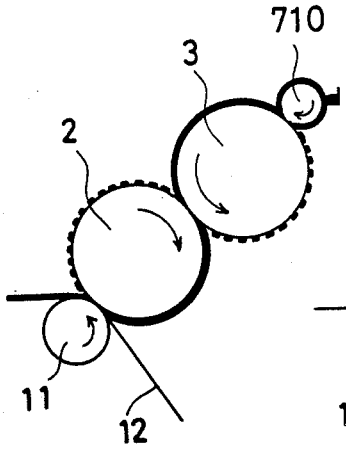
Figure 70B:
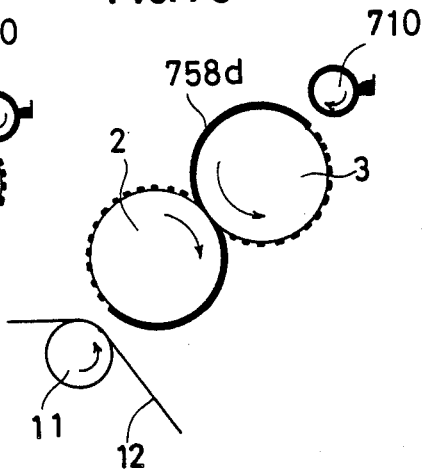
Figure 70C:
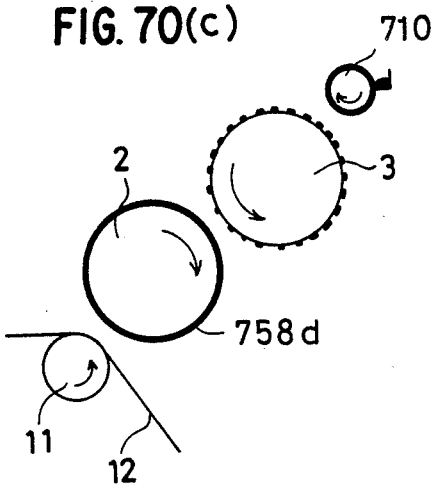
Figure 71A:
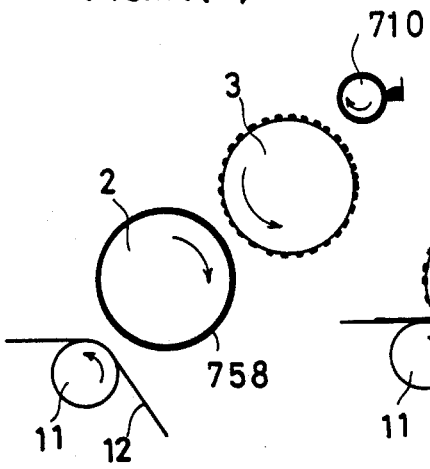
Figure 71B:
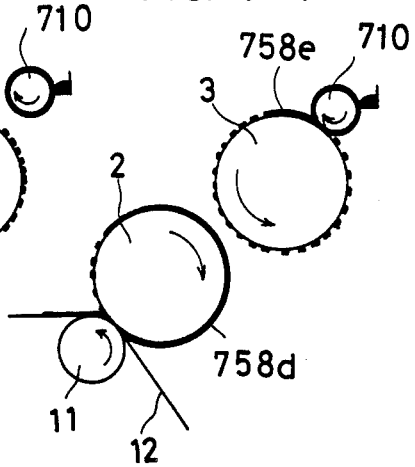
Figure 71C:
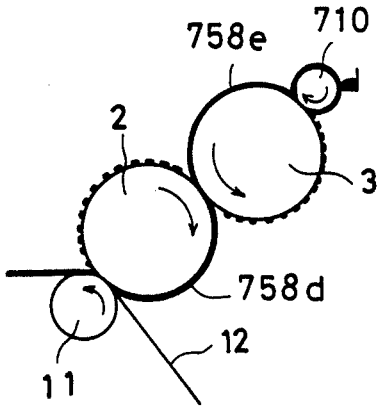
Figure 73A:
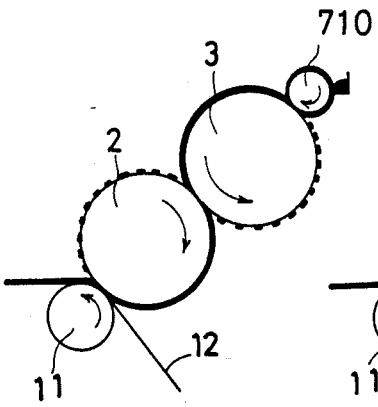
Figure 73B:
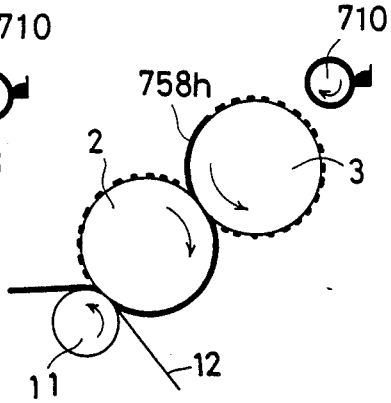
Figure 73C:
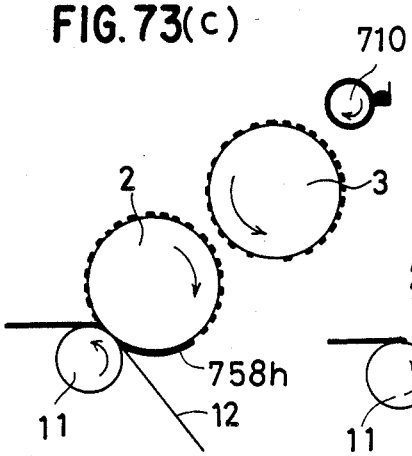
Figure 73D:
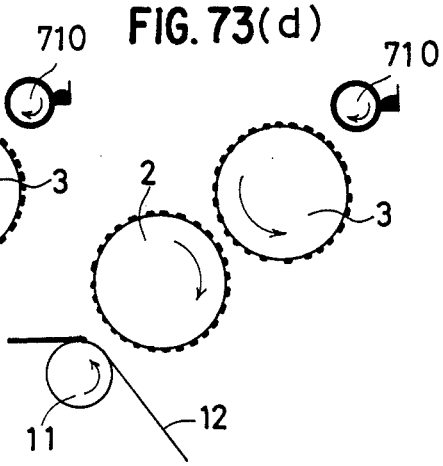
Figure 73E:
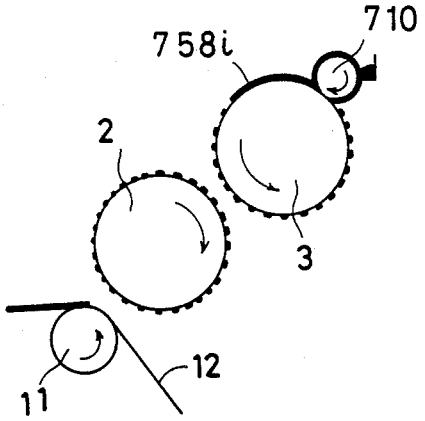
Figure 73F:
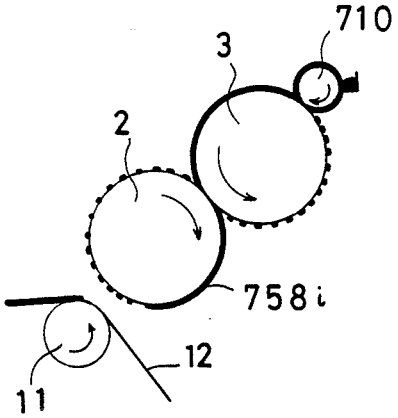
Figure 73G:
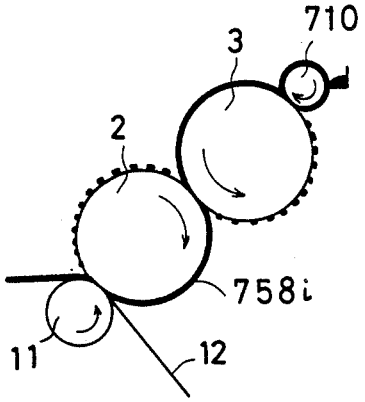
Figure 74:
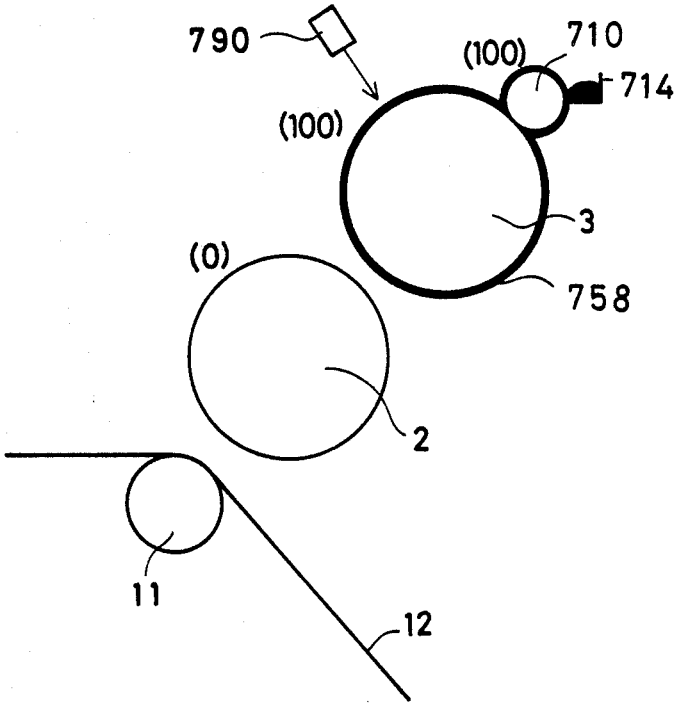
Figure 75:
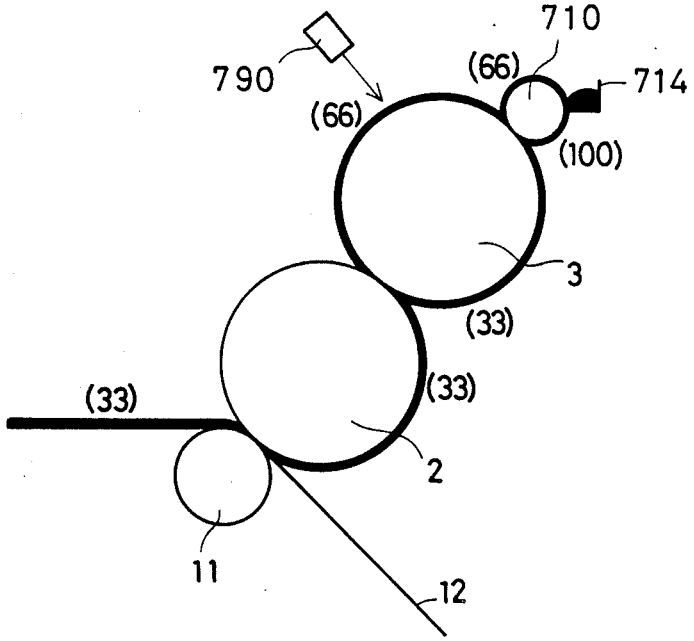

48, 49, 50(*a*) and (*b*), 51(*a*) and (*b*), 52 and 53(*a*) respectively explain the operations of the plate-end-hook-operating mechanism;

FIGS. 53(*b*), (*c*) and (*d*) respectively explain the operations of the mechanism for detecting deviated and/or clamped plate;

FIG. 54 is a timing chart denoting the operations of the plate feeding and discharging mechanism;

FIG. 55 is a sectional view of the plate cylinder;

FIG. 56 is a chart denoting the manufacturing process of the printing plate;

FIGS. 57A and 57B are flowcharts denoting the operations of a microprocessor in such a case a plate-replacing command signal is generated;

FIG. 58 denotes a track of a plate-head generated by an ideal control method;

FIG. 59 is a characteristics chart denoting a track of a plate-head generated by a conventional control method;

FIG. 60 is a characteristic chart denoting a track of a plate-head generated by a control method embodied by the present invention;

FIG. 61 is a chart denoting characteristics for controlling a plate-forwarding speed needed for realizing the plate-head track shown in FIG. 60;

FIGS. 62(*a*) through (*j*) respectively explain the operations for holding a plate-head;

FIG. 63 is a simplified block diagram of an automatic plate-feeding controller;

FIGS. 64(*a*) through (*c*) are respectively the timing charts explaining the control operations of an automatic plate-feeding controller;

FIG. 65 explains a plate-feeding operation executed by the automatic plate-feeding controller shown in FIG. 64;

FIG. 66 is a diagram denoting the relationship between a plate-cylinder, a blanket cylinder, and a form roller in the case of executing normal printing operations;

FIG. 67 is an operation flowchart describing the summarized printing operations to be done when the printing-activation command is generated;

FIGS. 68(*a*) through (*d*) respectively denote the summarized operations executed when the print-out step is underway;

FIGS. 69(*a*) through (*d*) respectively denote the summarized operations executed during the print-completed step;

FIGS. 70(*a*) through (*c*) respectively denote the summarized operations to be executed as an example of pose-in step;

FIG. 71(*a*) through (*c*) respectively denote the summarized operations executed as an example of pose-out step;

FIGS. 72(*a*) through (*e*) respectively denote the summarized operation of still further example of the pose-in and pose-out steps;

FIGS. 73(*a*) through (*g*) respectively denote the summarized operation of still further example of the pose-in and pose-out steps;

FIG. 74 denotes the ideal ink-film thickness after completing the film-thickness provision step;

FIG. 75 denotes the ideal ink-film thickness while normal printing operation is underway.

Figure 78A:
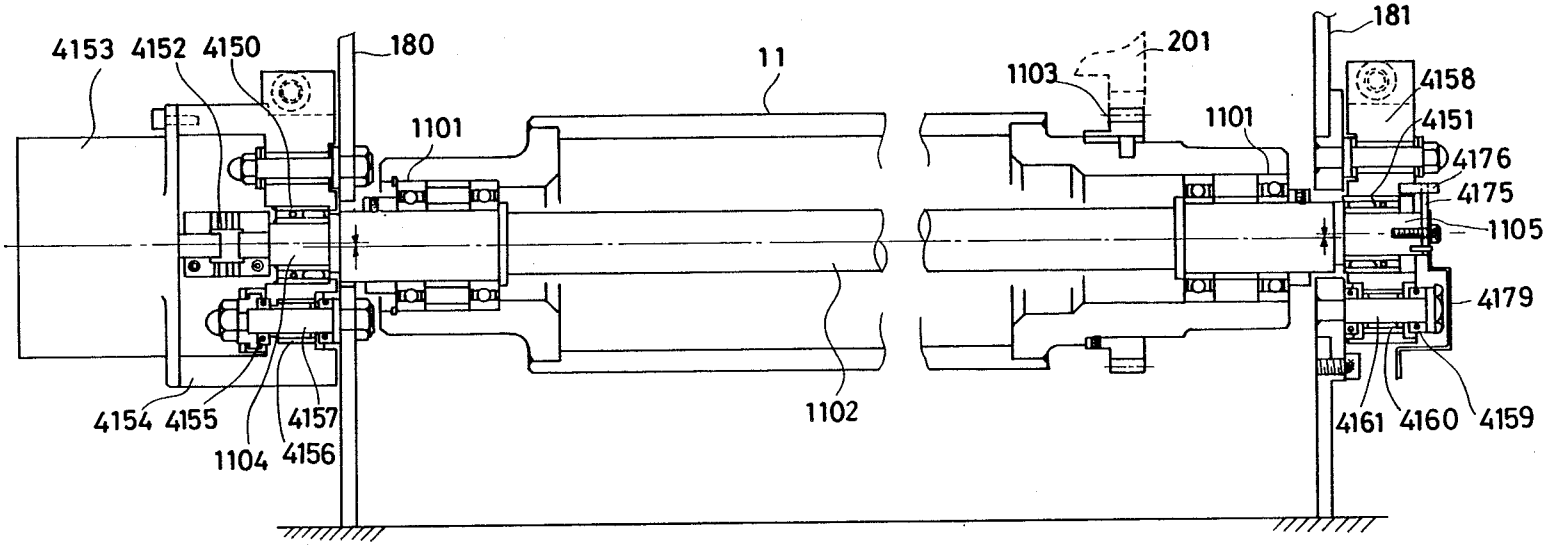
Figure 78B:
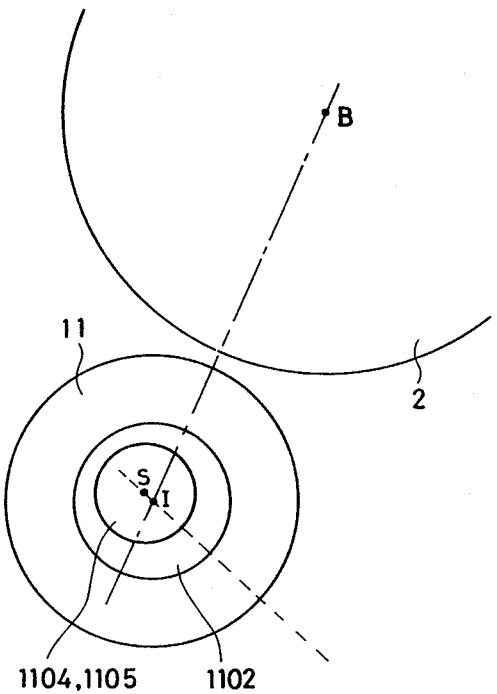
Figure 78B:
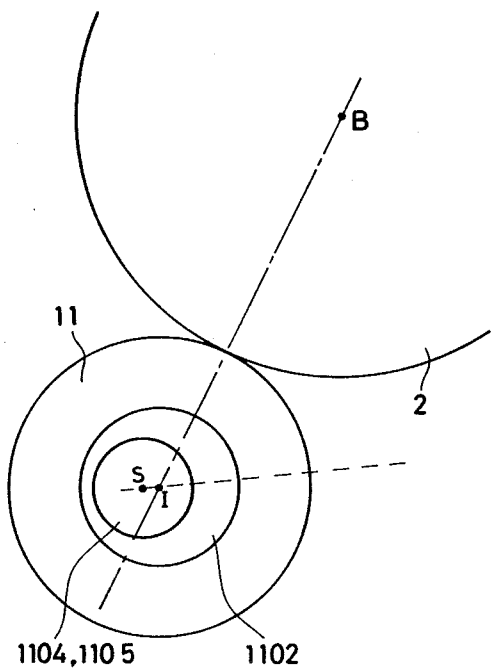
Figure 78B:
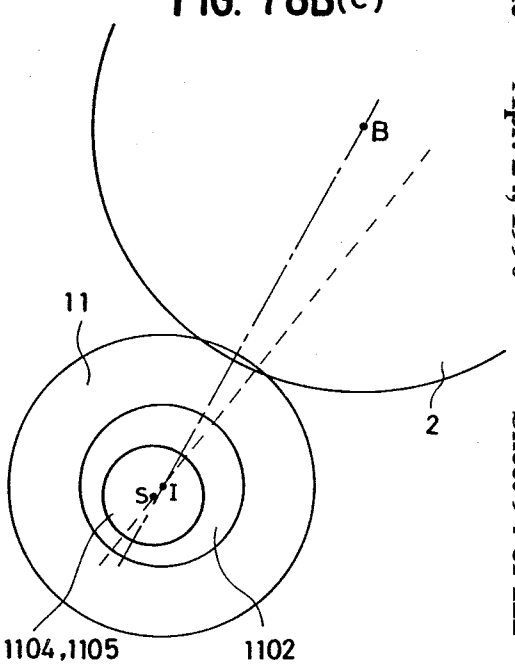
Figure 79A:
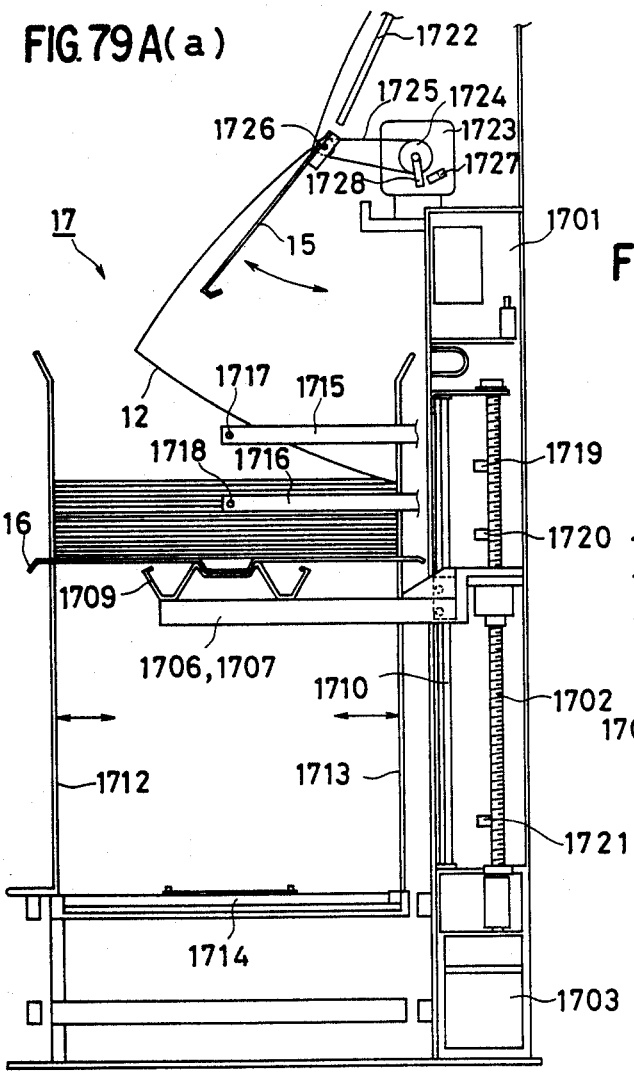
Figure 79A:
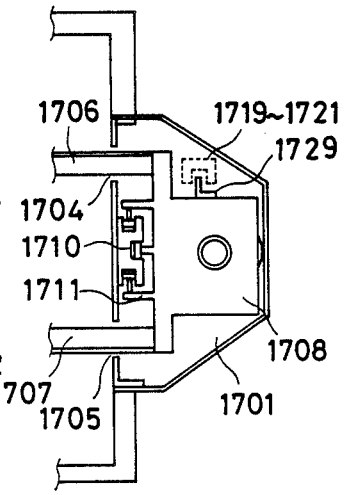
Figure 80:
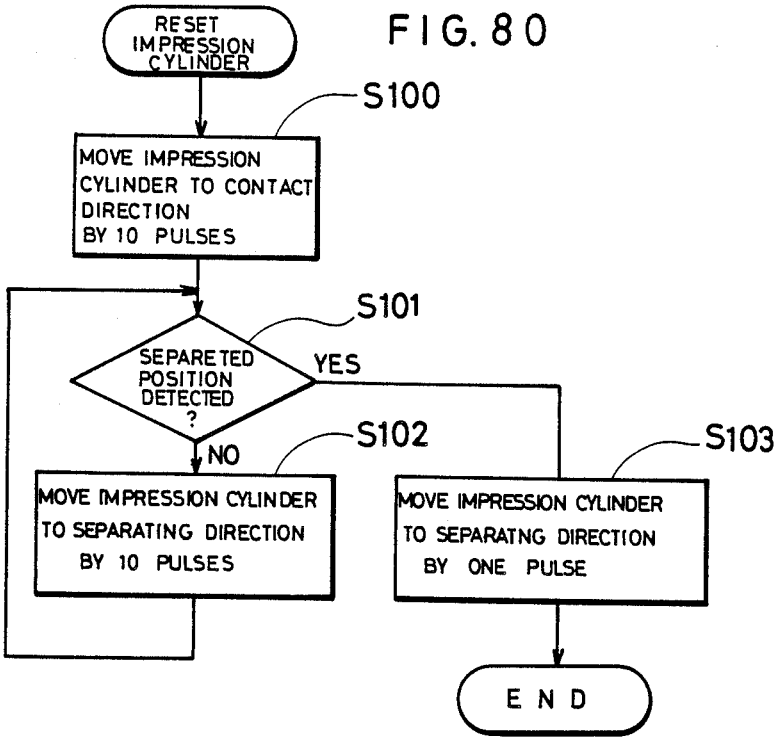
Figure 81:
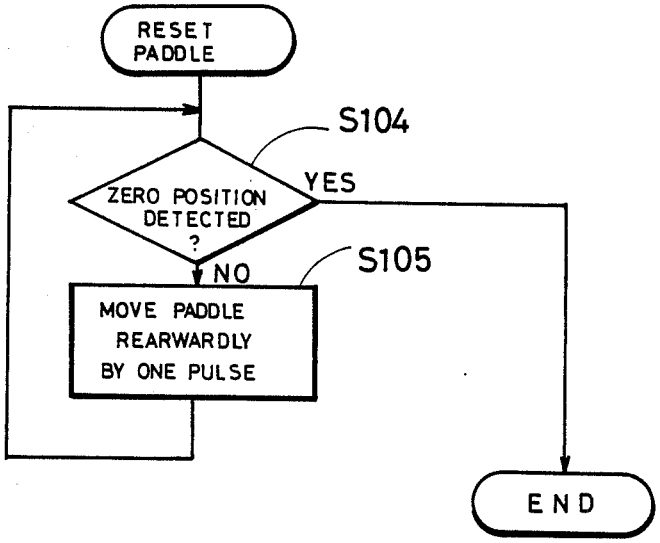
Figure 82:
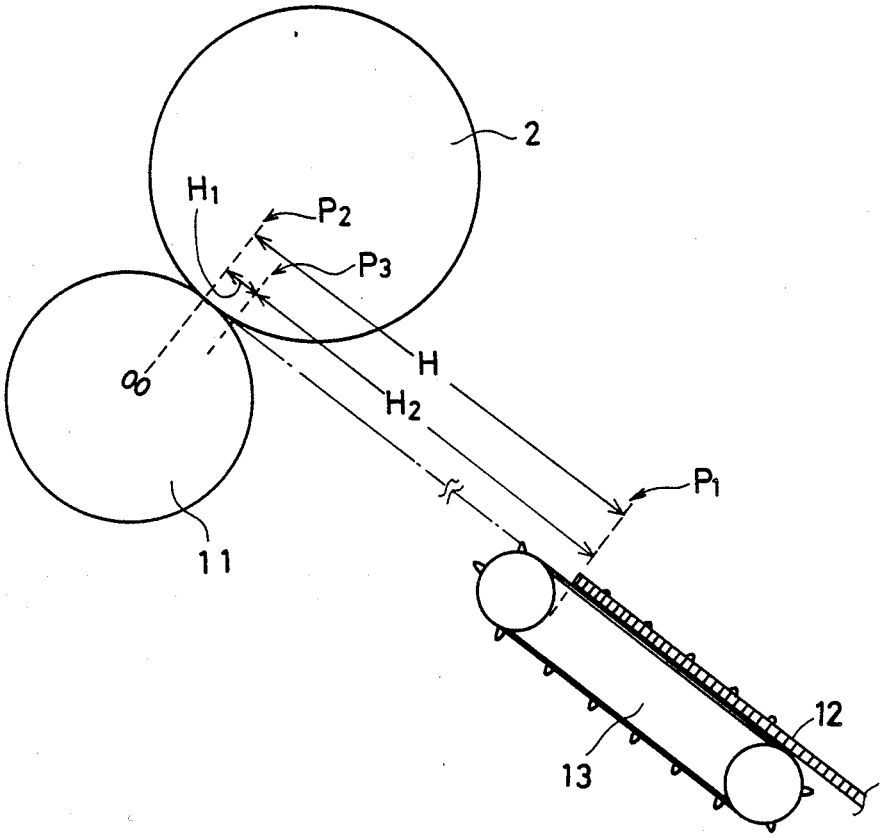
Figure 83:
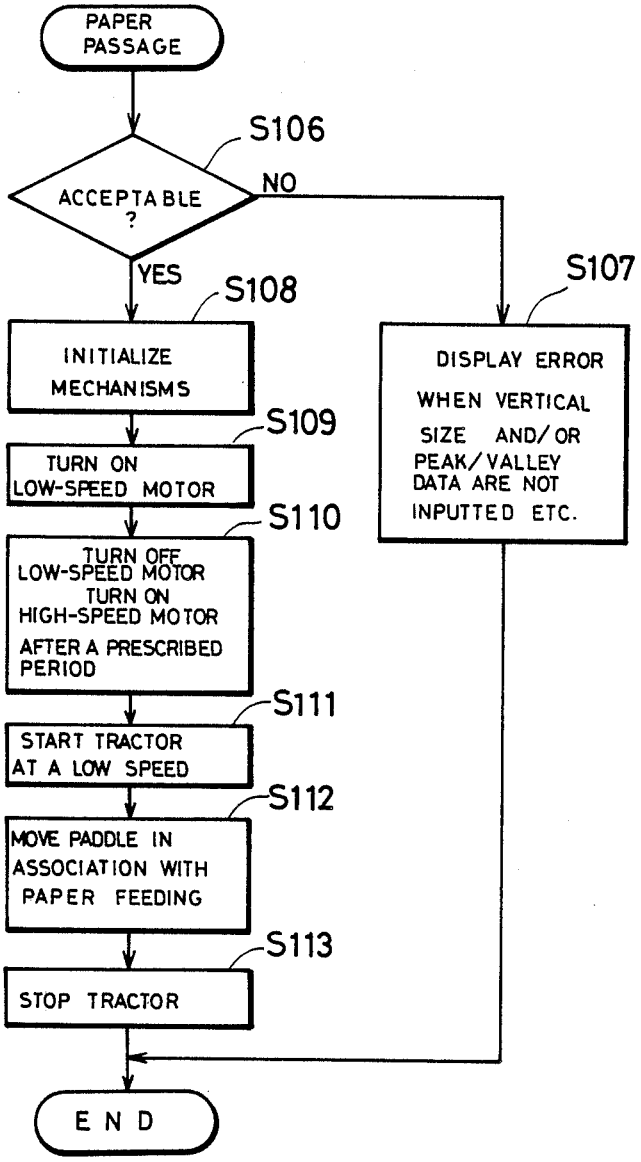
Figure 84:
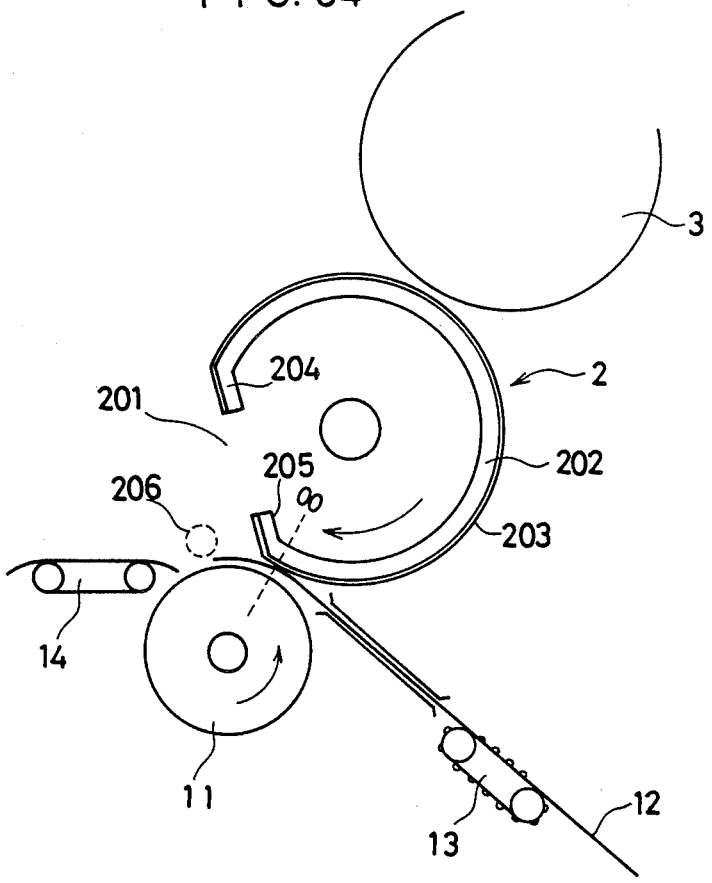
Figure 85:
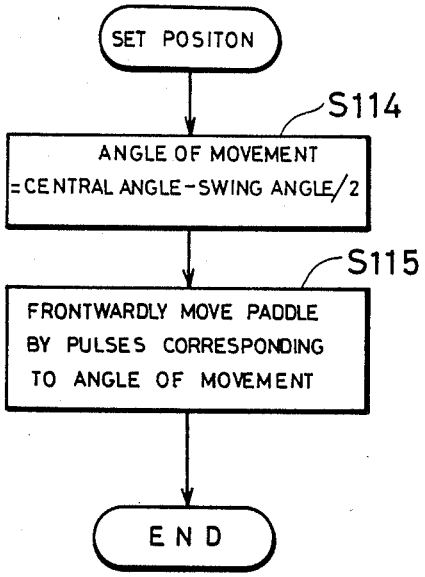
Figure 86:
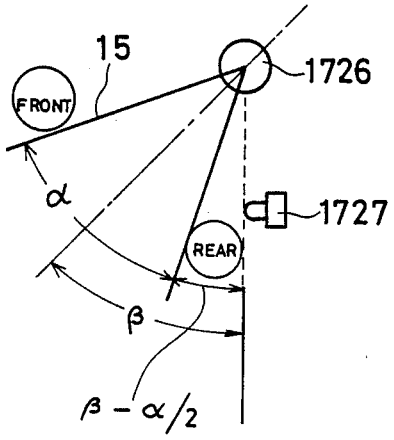
Figure 87A:
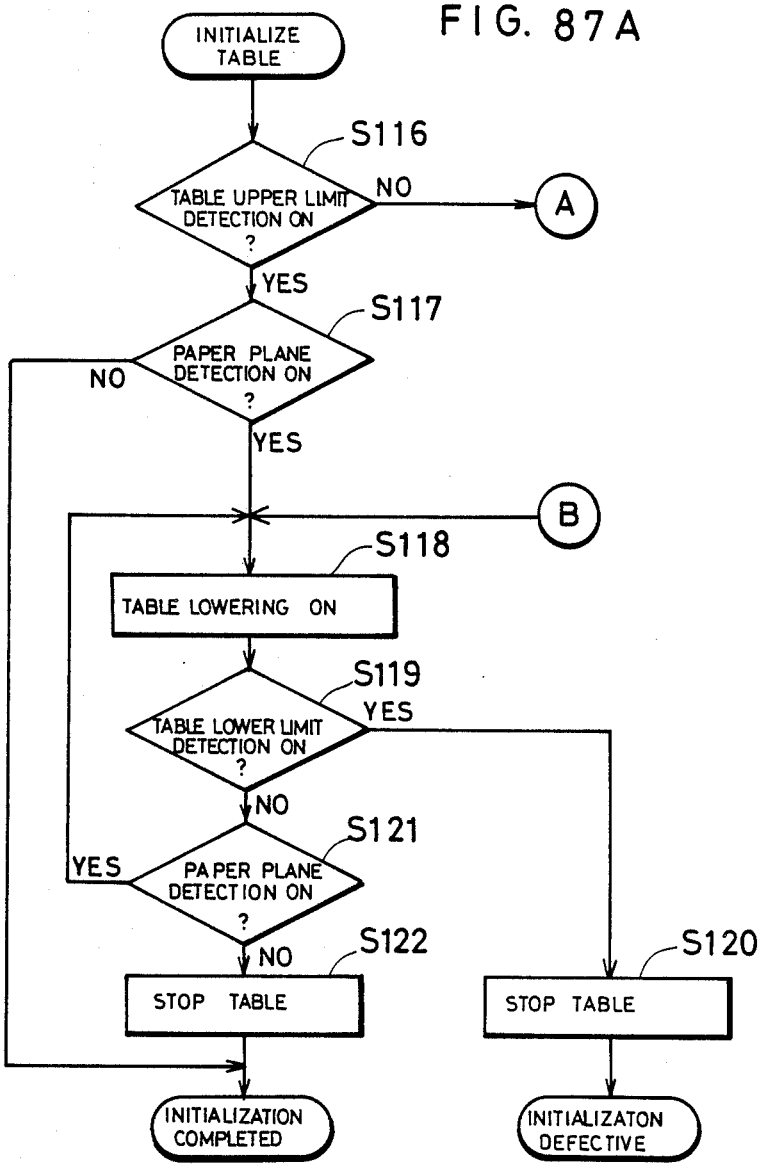
Figure 89:
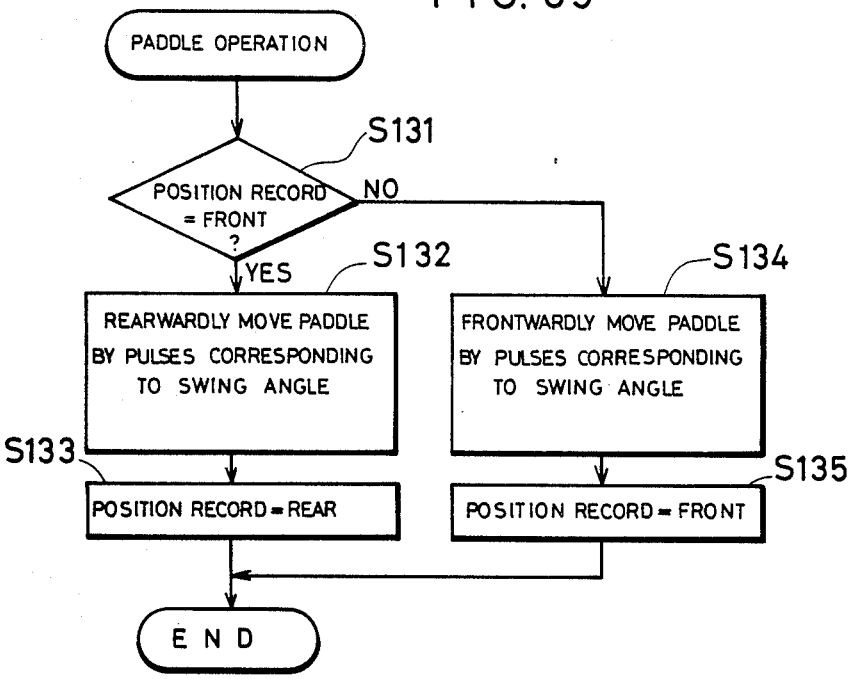
Figure 90:
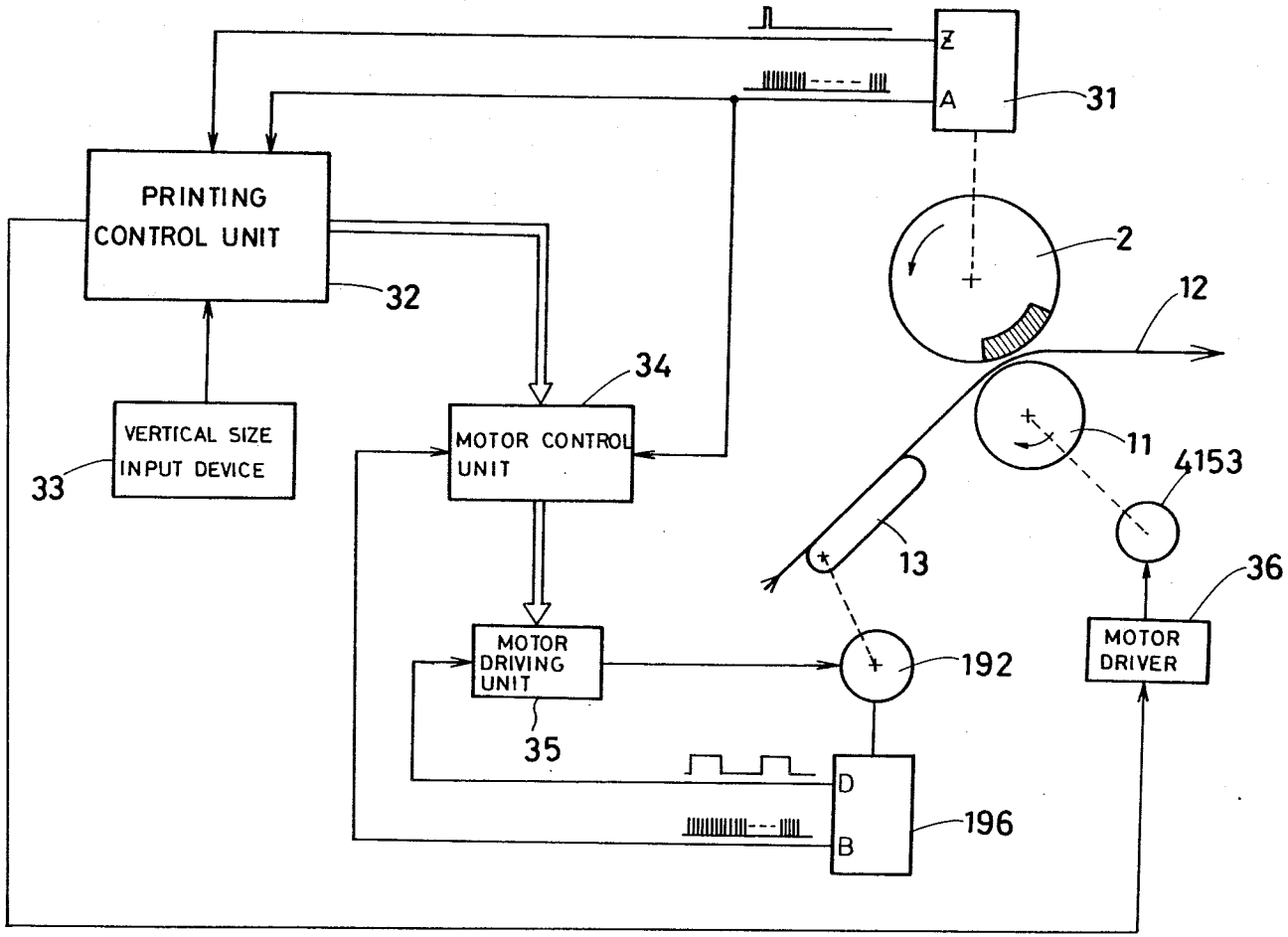
Figure 91:
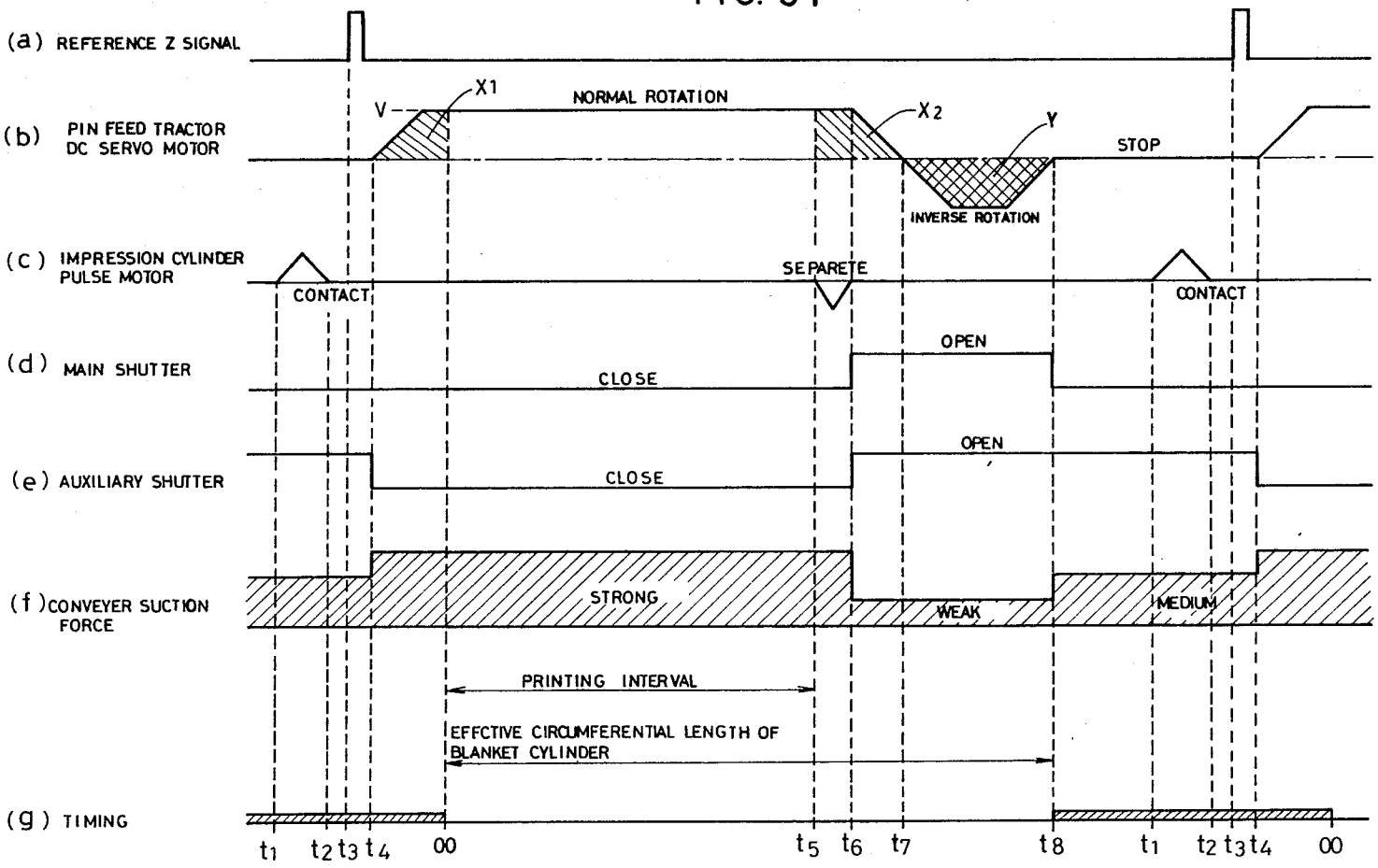
Figure 92:
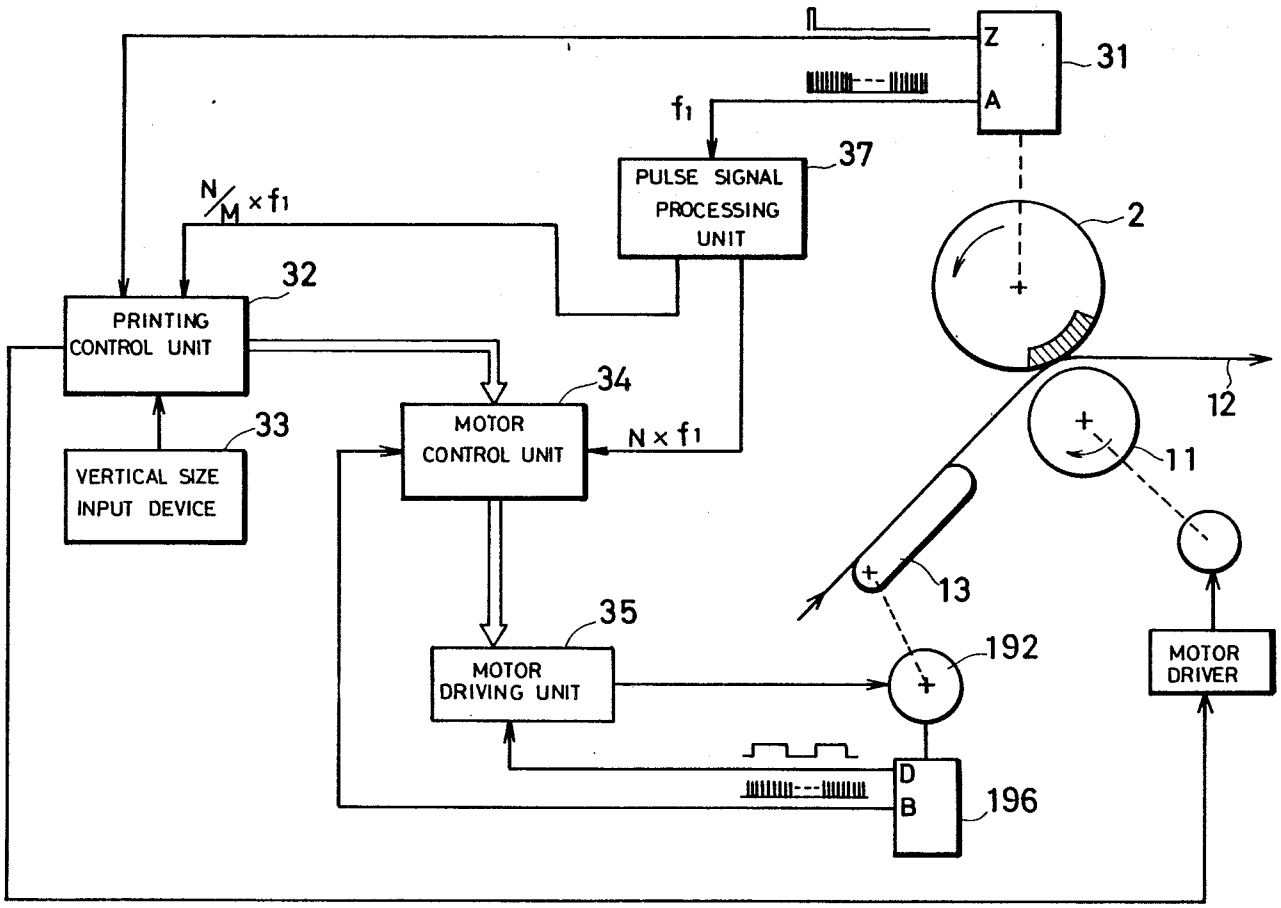
Figure 93:
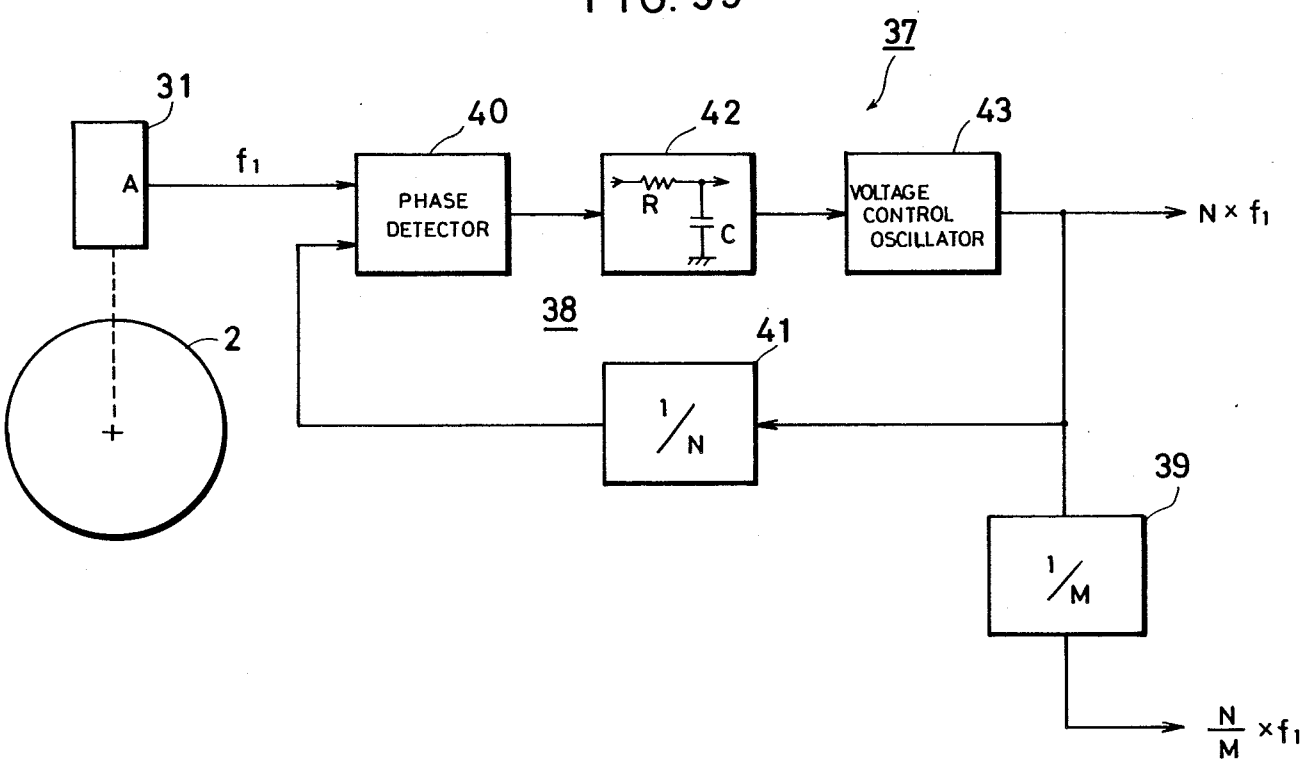
Figure 95:
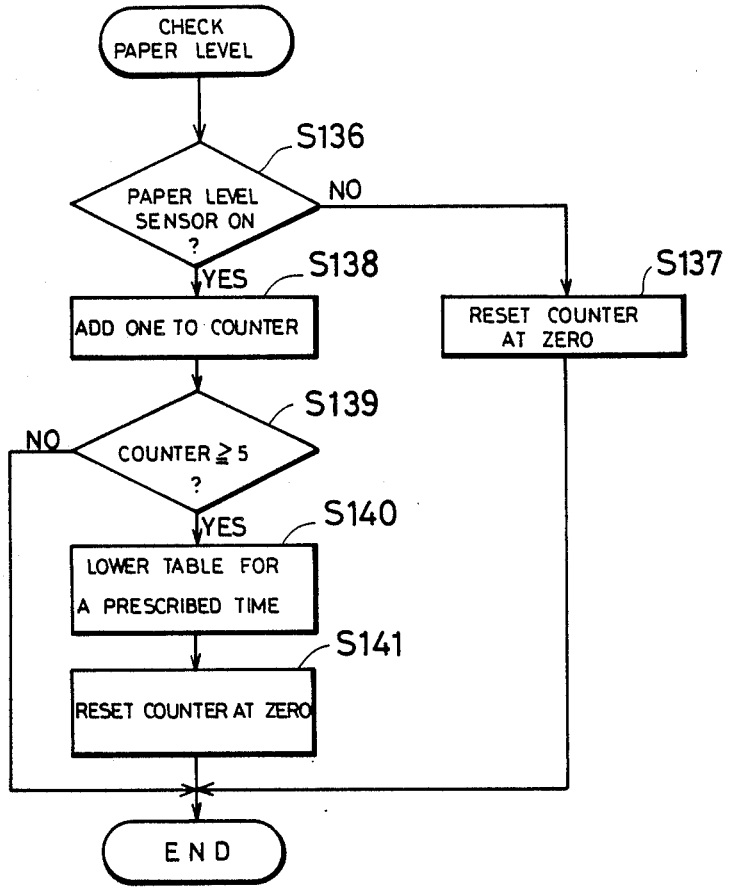

FIGS. 76A through F and" after "76E" insert (*a*) and (*b*) 76E are mechanical explanatory diagrams of a pin feed tractor;

FIGS. 77A to 77G are mechanical explanatory diagrams of a suction conveyer;

FIGS. 78A, 78B (*a*), (*b*) and (*c*), 78C and 78D are explanatory diagrams of a mechanism for making an impression cylinder in contact with/separated from a blanket cylinder;

FIGS. 79A (*a*) and (*b*), 79B 79C and 79D are mechanical explanatory diagrams of a folder;

FIG. 80 is a flow chart showing operation for resetting the impression cylinder;

FIG. 81 is a flow chart showing operation for resetting a paddle;

FIG. 82 is an explanatory diagram of a paper end set position;

FIG. 83 is a flow chart showing operation for paper passage;

FIG. 84 is an explanatory diagram of paper passage through a clearance between the blanket cylinder and the impression cylinder;

FIG. 85 is a flow chart showing operation for setting the paddle in position;

FIG. 86 is an explanatory diagram typically showing set position and swinging angle of the paddle;

FIGS. 87A and B are respectively flow charts showing operation for setting a delivery table in an initial position;

FIGS. 88(*a*) through (*h*) are respectively explanatory diagrams typically showing the manner of paper end setting;

FIG. 89 is a flow chart showing operation for swinging the paddle;

FIG. 90 is a block diagram showing intermittent feed control for the continuous paper;

FIG. 91 is a timing chart showing operation for intermittently feeding the continuous paper;

FIG. 92 is a block diagram showing an example of application of a pulse signal processing unit for attaining high printing position accuracy;

FIG. 93 is a block diagram showing the pulse signal processing unit in detail;

FIG. 94 is an explanatory diagram showing frequency variation before and after signal processing by the pulse signal processing unit;

FIG. 95 is a flow chart showing operation for serially lowering the delivery table.

Figure 96:
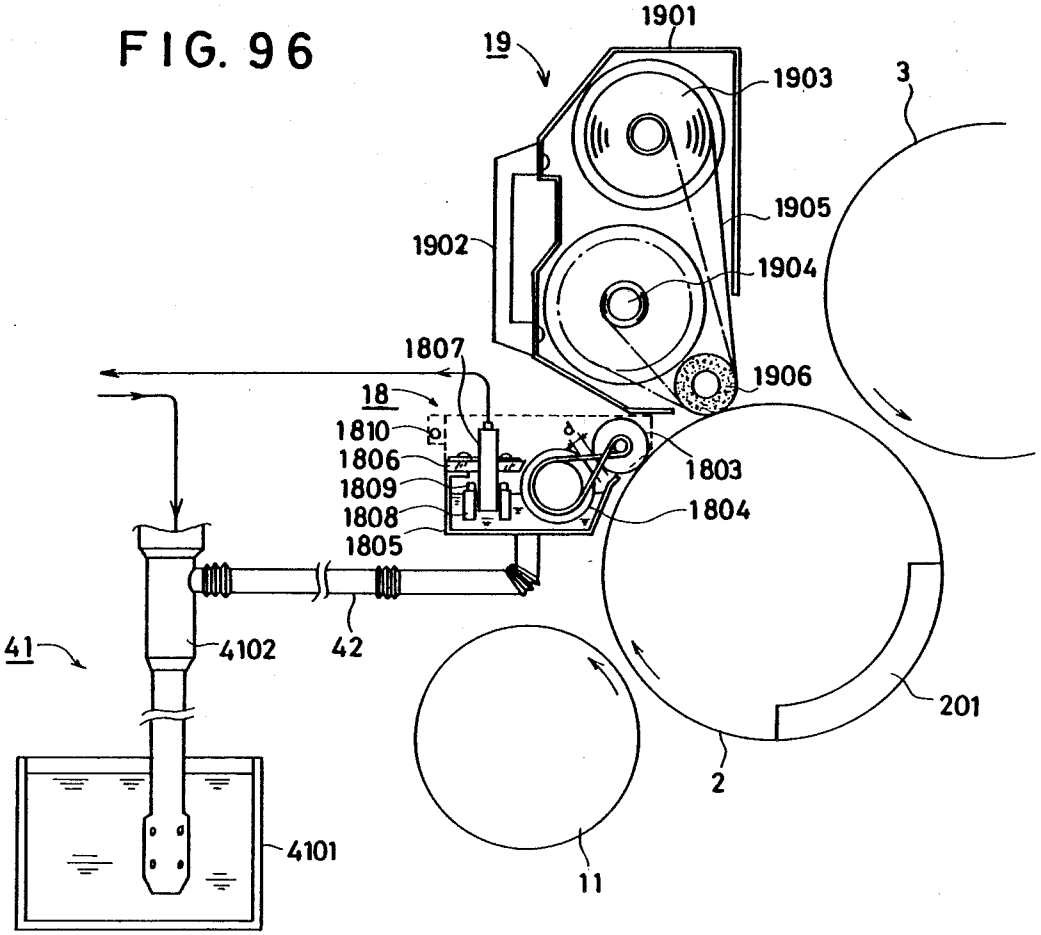
Figure 97:
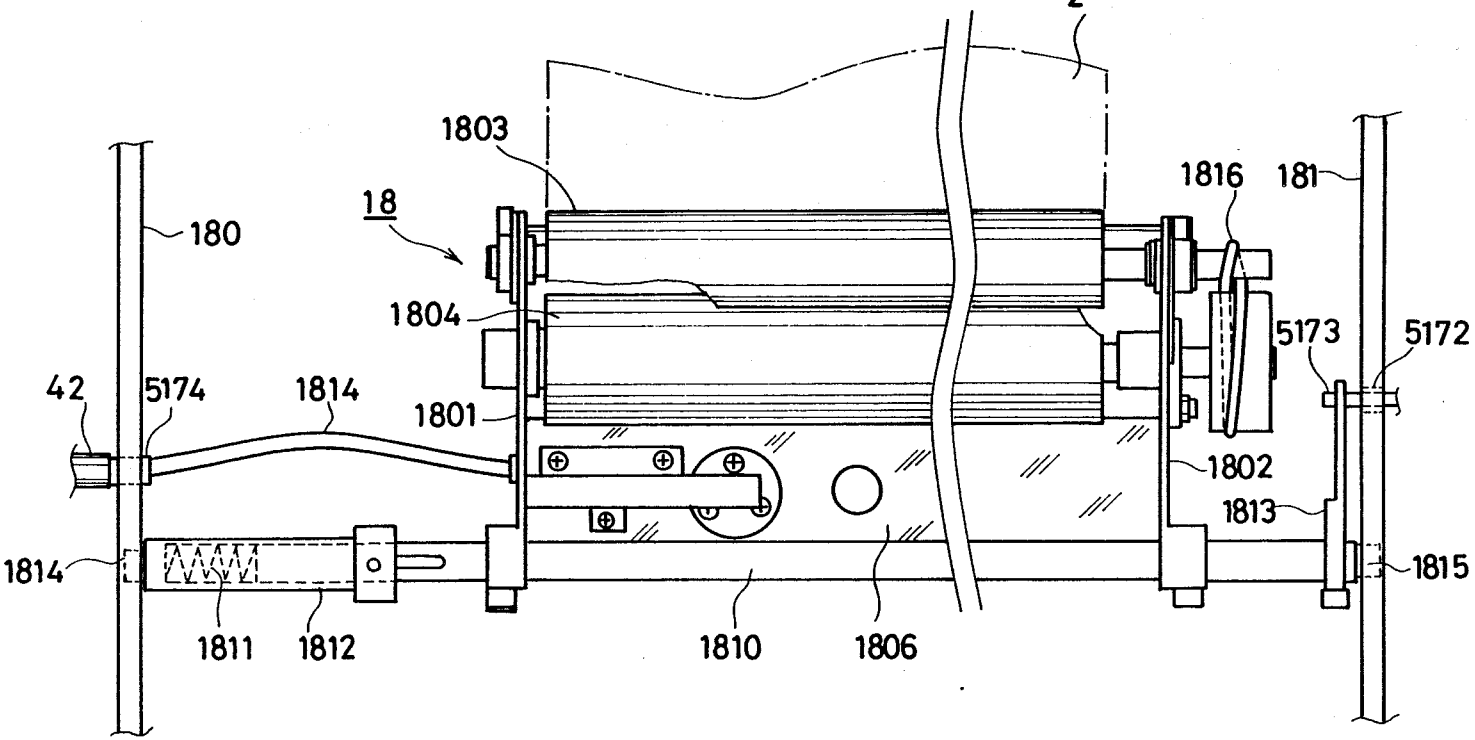
Figure 98:
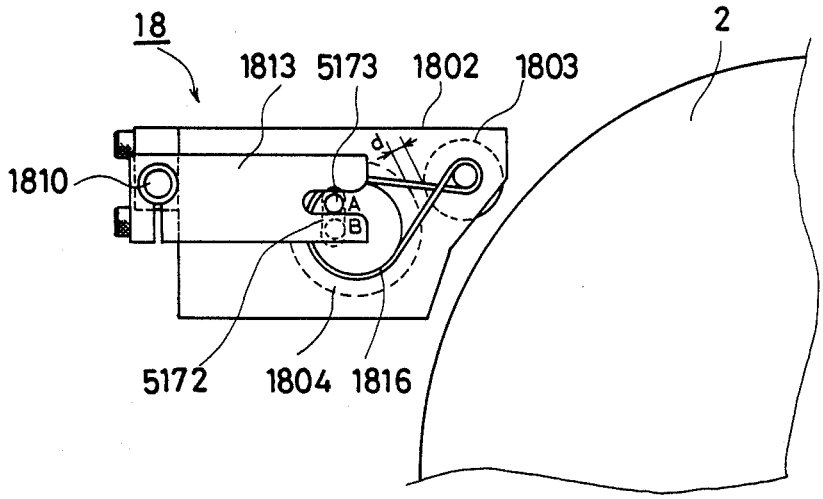
Figure 99:
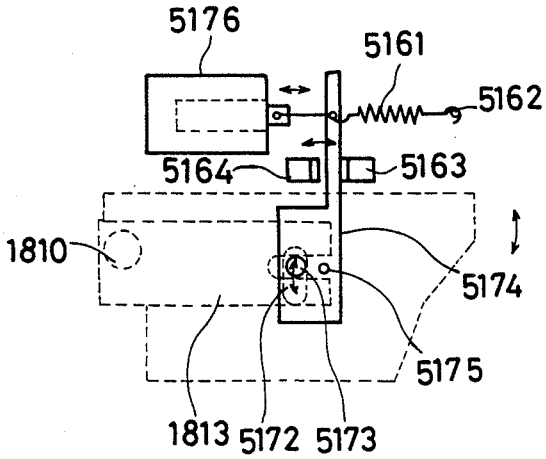
Figure 100:
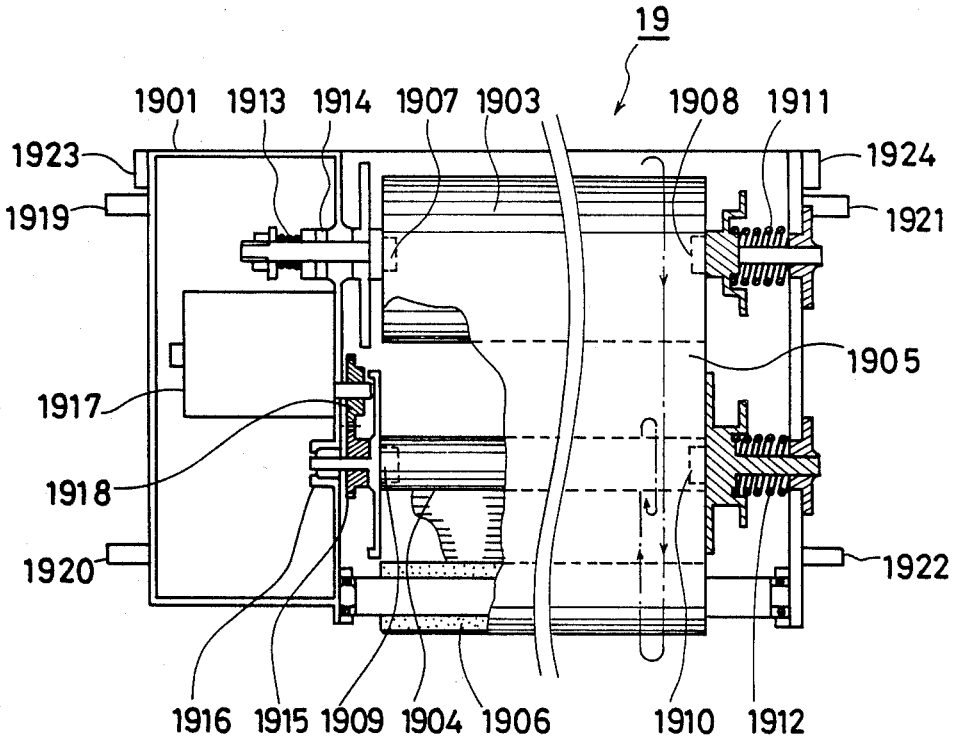
Figure 101:
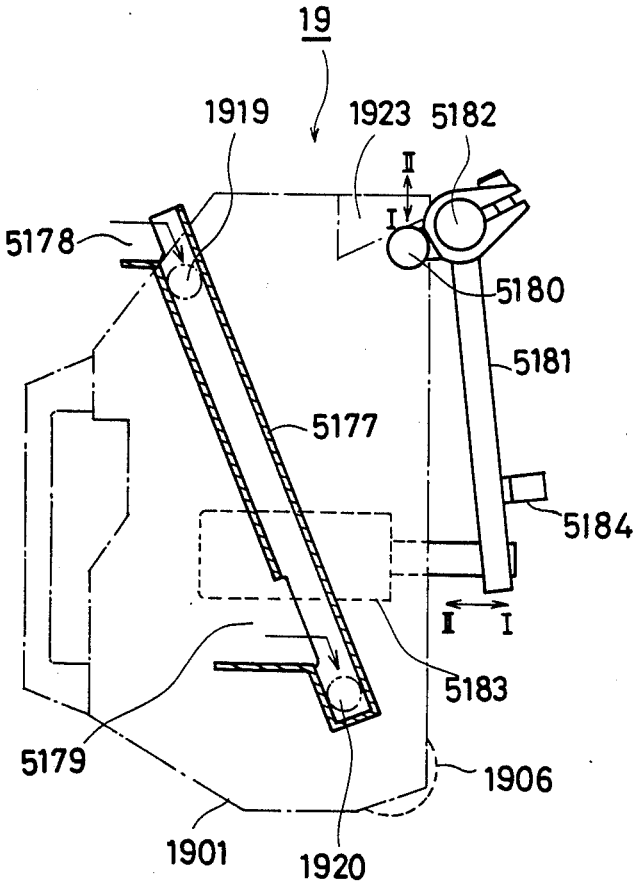
Figure 102:
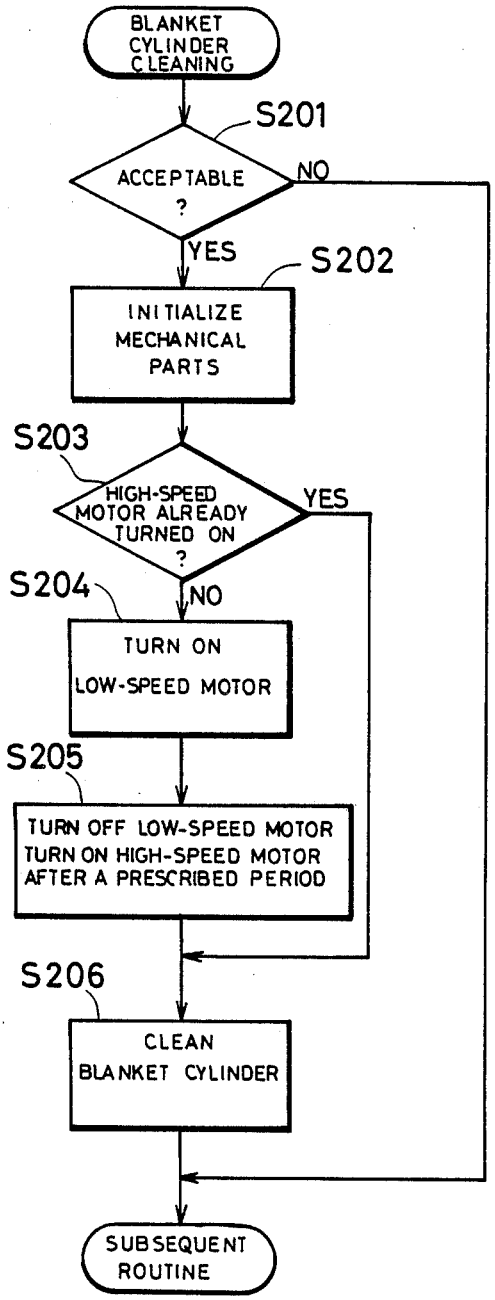
Figure 103:
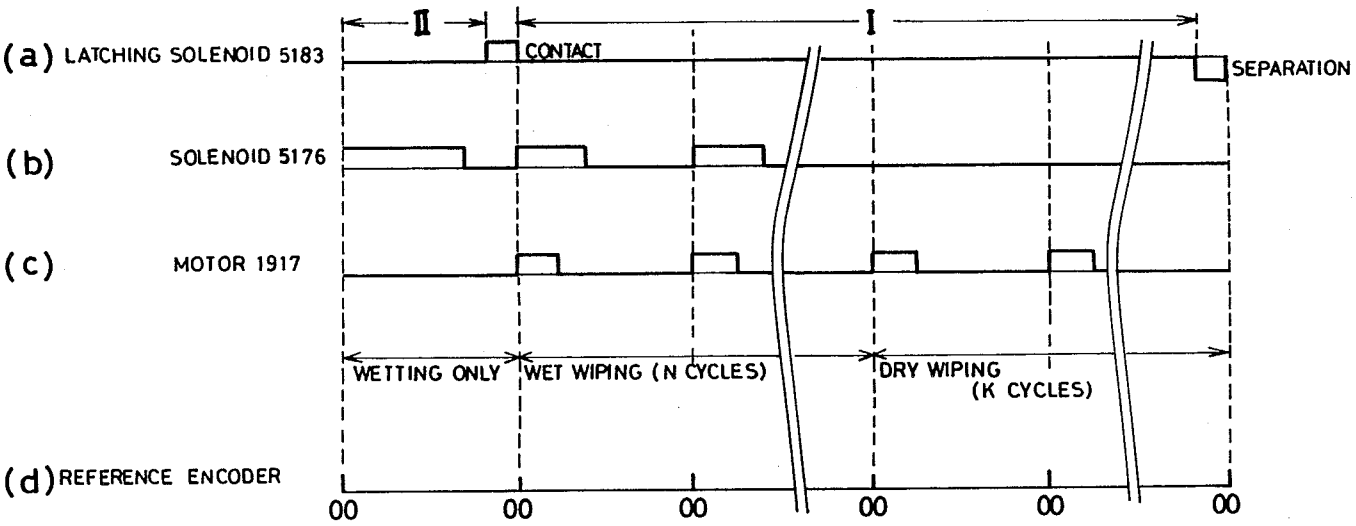

FIG. 96 is an explanatory diagram showing a blanket cylinder cleaning mechanism;

FIG. 97 is a mechanical explanatory diagram of a detergent solution feeding unit;

FIG. 98 is an explanatory diagram showing a state in which the detergent solution feeding unit is mounted on a printing press body;

FIG. 99 is an explanatory diagram showing a contact-/separation mechanism for the detergent solution feeding unit;

FIG. 100 is an explanatory developed plan view showing the mechanism of a wiping unit;

FIG. 101 is an explanatory diagram showing a state in which the wiping unit is mounted on the printing press;

FIG. 102 is a flow chart showing the operation for cleaning a blanket cylinder; and FIG. 103 is a timing chart showing the operation for cleaning the blanket cylinder.

DESCRIPTION OF THE PREFERRED EMBODIMENTS

A. Entire Structure

Figure 1:
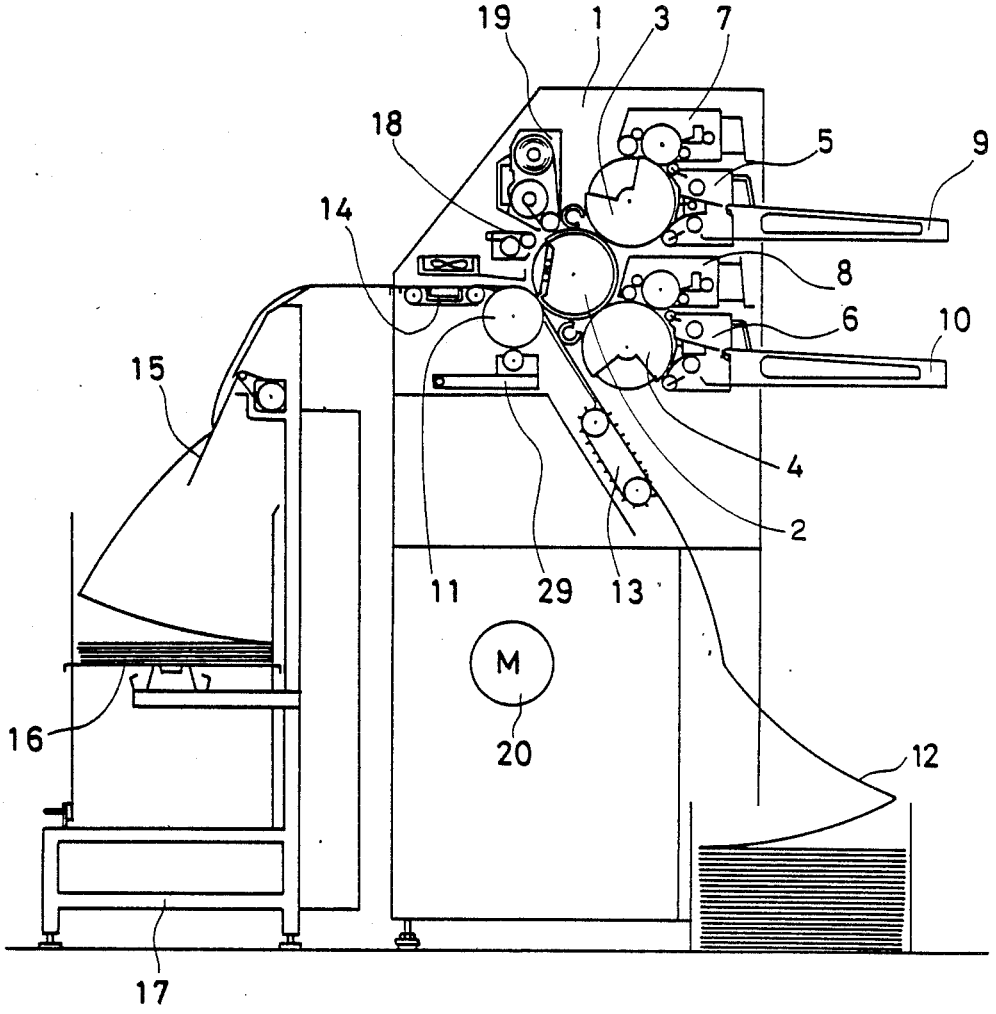
FIG. 1 is a sectional diagram of the multicolor printing press according to one of the preferred embodiments of the present invention.

FIG. 1 is a schematic sectional view showing a multicolor offset printing press to which an apparatus for intermittently feeding continuous paper according to the present invention is applied for enabling printing on the continuous paper. As shown in FIG. 1, a blanket cylinder 2 is arranged substantially in a central position of a printing press body 1, and plate cylinders 3 and 4 are contactably arranged at the back of upper and lower portions of the blanket cylinder 2. Detachably mounted on backward positions of the plate cylinders 3 and 4 are plate feeding/discharging units 5 and 6 for enabling automatic plate feeding to/discharging from corresponding ones of the plate cylinders 3 and 4 and inkingunits 7 and 8 for inking plates wound around corresponding one of the plate cylinders 3 and 4, while plate feeding/discharging trays 9 and 10 are detachably mounted on the plate feeding/discharging units 5 and 6 respectively.

On the other hand, an impression cylinder 11 is arranged in front of the lower portion of the blanket cylinder 2 to be in contact with/separated from the blanket cylinder 2, and a pin feed tractor 13 and a suction conveyer 14 are arranged in front and at the back of the lower portion of the impression cylinder 11 respectively to control feeding of continuous paper 12 inserted between the impression cylinder 11 and the blanket cylinder 2. The pin feed tractor 13 and the suction conveyer 14 are adapted to control intermittent feeding of the continuous paper 12 in relation to the timing of contact-/separation of the impression cylinder 11 and the blancket cylinder 2, for performing printing on the continuous paper 12. Provided in front of the printing press body 1 is a folder 17 having a swing guide 15 and a delivery table 16 for alternately folding the printed continuous paper 12 and receiving the same.

Detachably mounted on an upper front position of the blanket cylinder 2 are a detergent solution feeding unit 18 for feeding a detergent solution to the blanket cylinder 2 and a wiping unit 19 for wiping out the detergent solution respectively. Further, an impression cylinder cleaning unit 29 is arranged under the impression cylinder 11 for cleaning the surface thereof.

A main motor 20 is provided in a lower space of the printing press body 1 to drive the blanket cylinder 2 and the suction conveyer 14 through, e.g., belts while the blanket cylinder 2, the plate cylinders 3 and 4 and the impression cylinder 11 are mechanically interlocked by gears arranged to be engaged at single end portions of the said cylinders, to form a driving system through the main motor 20. Driving units or actuators such as pulse motors and solenoids are mounted on the remaining mechanical portion at need, and sensors and switches are appropriately mounted on prescribed portions as data input means for controlling driving timing for the driving system.

Figure 2:
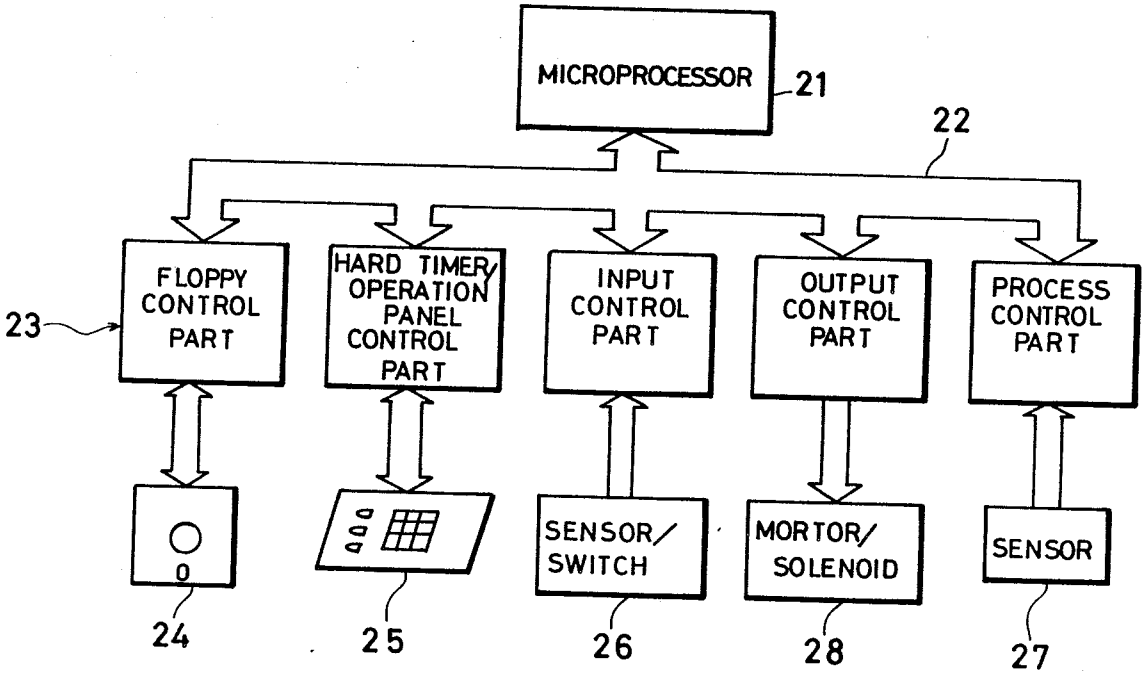
FIG. 2 is a simplified block diagram of the operation control system used for multicolor printing press shown in FIG. 1.

FIG. 2 schematically shows a control system employed in the printing press, in which a microprocessor 21 is connected with external units 24 to 28 through a control bus 22 and respective control parts 23. A system program is stored in an external memory unit 24 such as a floppy disk, to be supplied to the microprocessor 21 for starting the system. An operator supplies a command through an operation panel 25 provided on the side portion of the printing press body 1 for example, so that the microprocessor 21 fetches required data from sensor/switch means 26 and sensor 27 to appropriately drive a driving system 28 formed by motors, solenoids and the like in accordance with the system program.

Next, constitution and operation related to the plate feeding and discharging unit are described below.

The constitution and operations of mechanical components of the multicolor printing press related to the present invention are described below.

B. Mechanism related to inking operation

(a) Constitution

(1) Constitution of the inking unit

Figure 3:
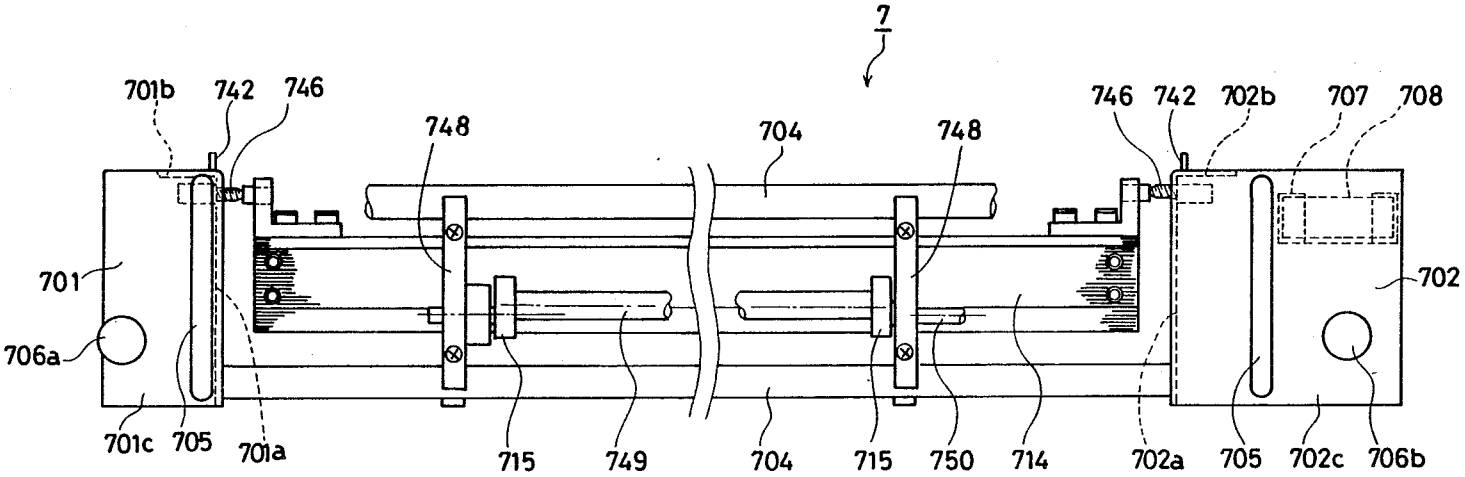
FIG. 3(*a*) through (*i*) are respectively the diagrams denoting the constitution of the inking unit employed for the printing press related to the present invention.
Figure 3B:
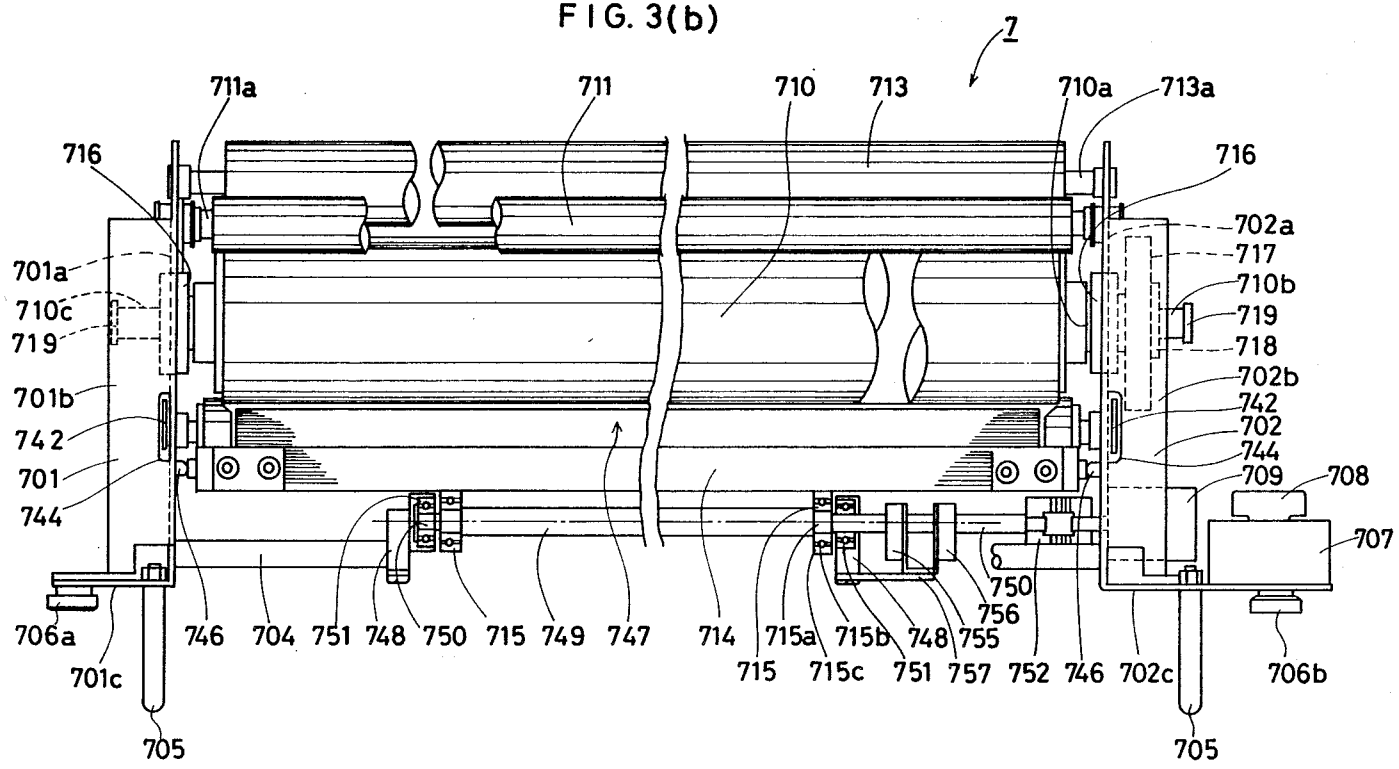
Figure 3:
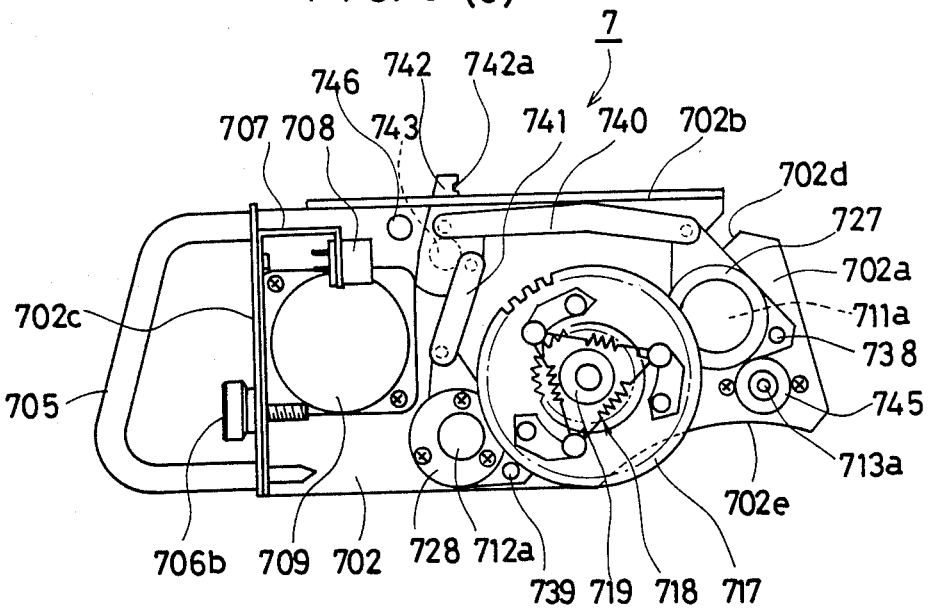
Figure 3:
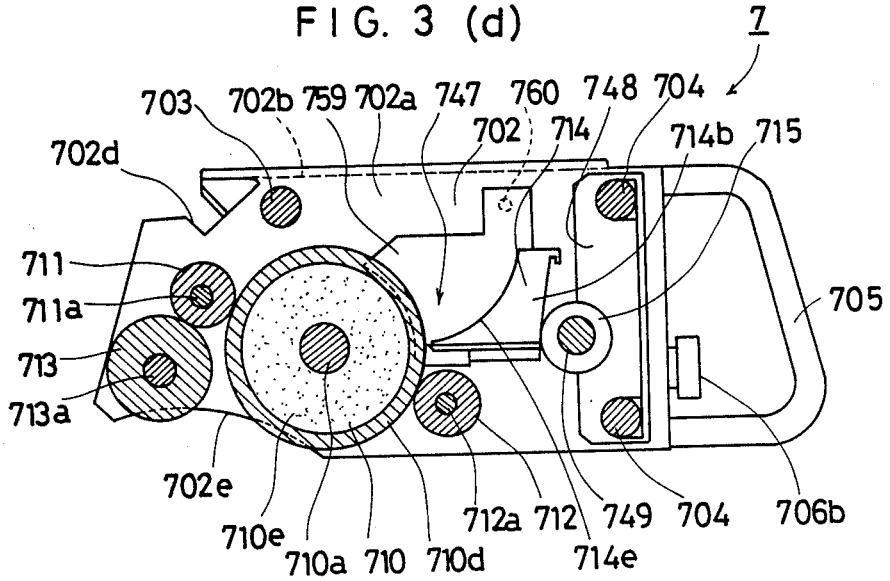
Figure 3E:
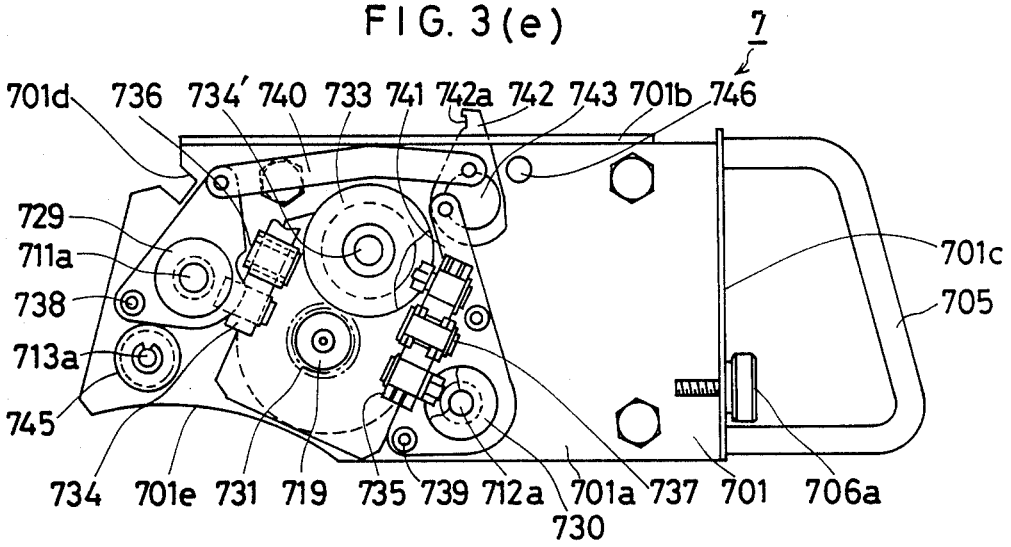
Figure 3F:
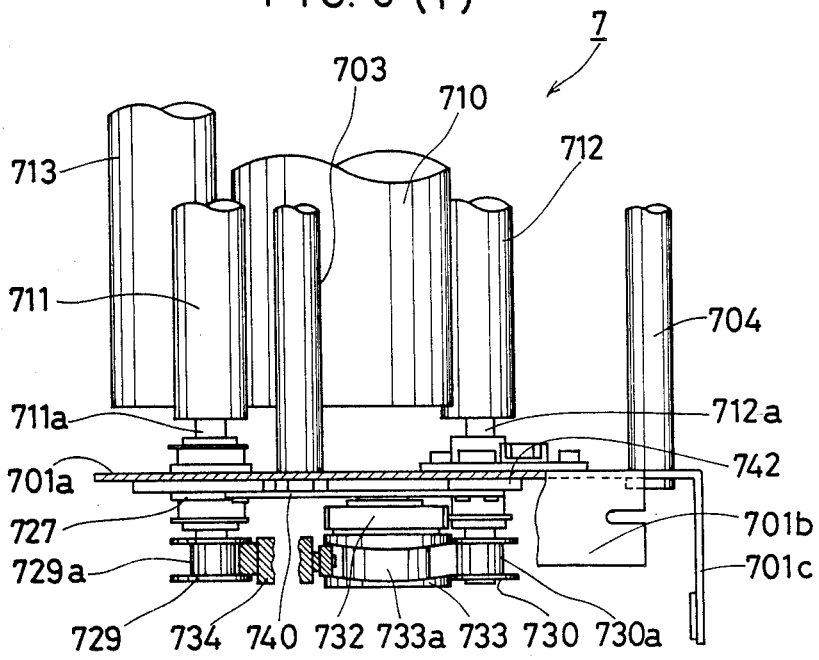
Figure 3G:
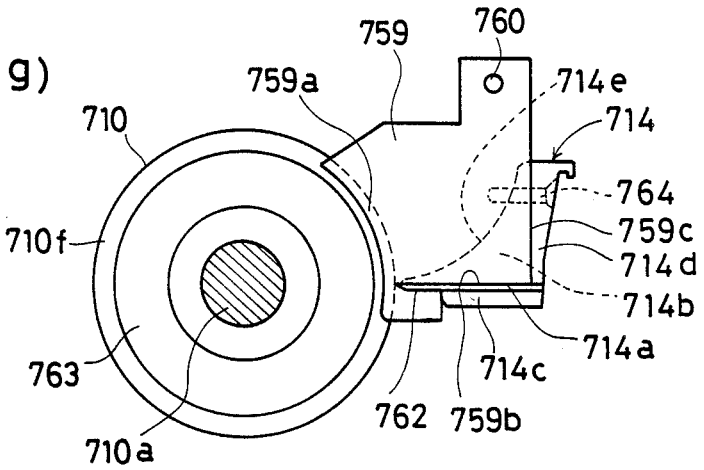
Figure 3H:
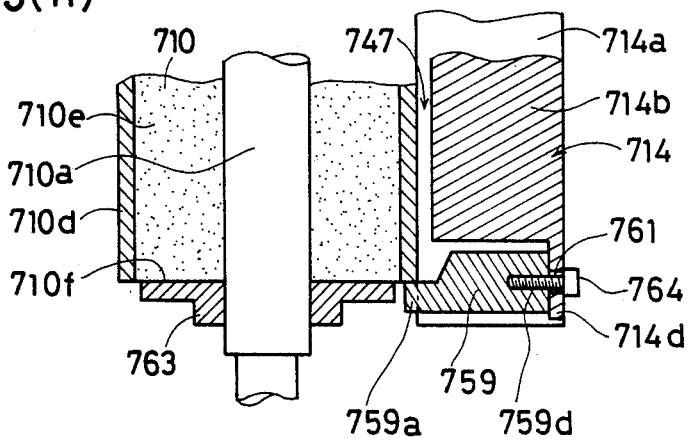
Figure 3I:
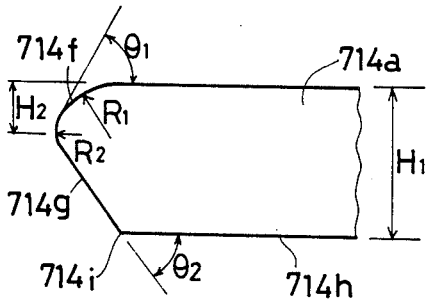

FIG. 3(*a*) denotes the front view of an inking unit, (*b*) denotes the plain view of the inking unit, (*c*) denotes the right-side view, (*d*) denotes the sectional view, (*e*) denotes the left-side view and (*f*) denotes the sectional view of the plain surface of the inking unit, respectively.

The connector shafts 703 and 704 shown in FIG. 3(*d*) are set between the lateral panel 701*a* and 702*a* of the left and right frames 701 and 702 being opposite from each other as shown in FIG. 3(*a*) and (*b*), thus making up the frame structure. Rail members 701*b* and 702*b* are outwardly set to the upper edge of the lateral panels 701*a* and 702*a* of the left and right frames 701 and 702. Stopper members 701*c* and 702*c* are outwardly set to the front edge of the lateral panels 701*a* and 702*a*. The notches 701*d* and 702*d* shown in FIG. 3(*d*) and (*e*) for engaging a driving lever (to be described later on) for driving the inking unit is set to the upper rear-end of the lateral panels 701*a* and 702*a*, in which the notches 701*d* and 702*d* are respectively notched in the direction of the front of the tilted rear part. Arc portions 701*e* and 702*e* are respectively provided in the lower rear edge of the lateral panels 701*a* and 702*a* so that these arc portions can correctly match the external surface of the plate cylinder 3. Handles 705 and screws 706*a* and 706*b* for fixing the inking unit 7 are respectively set to the front of the stopper members 701*c* and 702*c*. A connector 708 is set to the back surface of the stopper member 702*c* via a metal 707. A pulse motor 709 is installed to the external surface of the lateral panel 702*a* for controlling the amount of pushing of doctor blade, while this pulse motor 709 is connected to the connector 708 via a cable (not shown).

As shown in FIG. 3(*d*), a variety of mechanical components are installed between the left and right frames 701 and 702, which include a rubber-made form roller 710, metallic ink distributing rollers 711 and 712, a rubber-made auxiliary form roller 713, a doctor blade 714, and an eccentric roller 715, respectively.

The form roller 710 which also works as a ink fountain roller is installed to the bearings 716 secured to the designated positions of the lateral panels 710*a* and 720*a* via both ends of the roller shaft 710*a* so that it can freely rotate. An inking gear 717 and an form-roller reverse-turn prevention mechanism 718 are respectively set to the right edge of the shaft 710*a* of the form roller 710. The bearings 719 for regulating shaft-to-shaft distance are respectively secured to the right-edge extended part 710*b* and the left-edge extended part 710*c* of the shaft 710*a*. The form roller 710 is provided with double layers consisting of hard external layer 710*d* shown in FIG. 3(*d*) and internal layer 710*e* made of soft rubber so that the deformation of the form roller 710 will not be concentrated on a specific local area while pushing doctor blade 714.

Figure 4A:
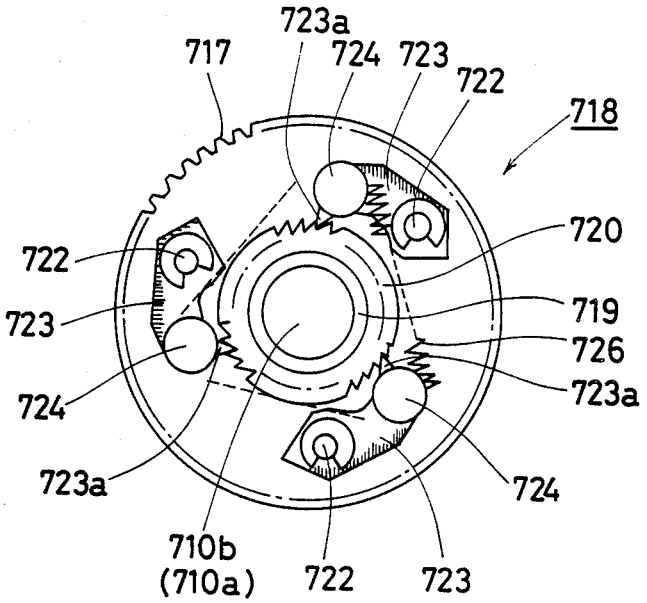
FIGS. 4(*a*) and (*b*) are respectively the diagrams denoting the constitution of the reverse-rotation prevention mechanism applied to form roller.
Figure 4:
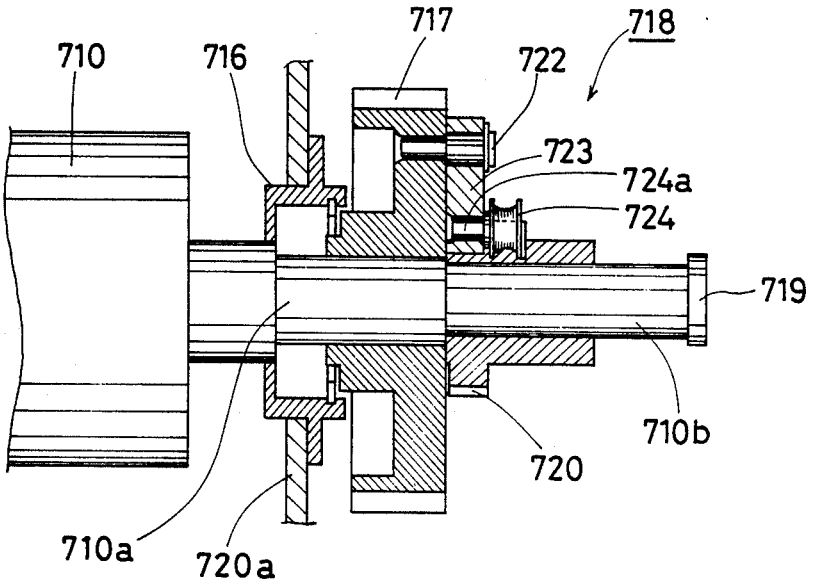

FIGS. 4(*a*) and (*b*) respectively denote the details of the form roller reverse-turn prevention mechanism 718, in which an inking gear 717 is set to the shaft 710*a* so that it can freely rotate itself, whereas a rachet wheel 720 is secured to the shaft 710*a* without rotating itself. Three pieces of pivot pins 722 are provided on the external surface of the inking gear 717 so that these pins surround the rachet wheel 720. The arms 723 whose tip ends are respectively provided with the latchet nails 723*a* are connected to these pivot pins 722 so that the arms 723 can freely rotate themselves. Spring-receiving members 724 are respectively yet to the tip-ends of the arms 723 by means of stationary pins 724*a*. Tension coil springs 726 are respectively set between the spring-receiving members 724 of adjacent arms 723. This allows each arm 723 to be inwardly energized for rotating themselves pivoting the pins 722 to allow rachet nails 723*a* of these arms 723 to be engaged with the rachet wheel 720.

The form-roller reverse-turn prevention mechanism 718 causes the rachet nails 723*a* of the arms 723 to be engaged with the rachet wheel 720 during the printing operation when the inking gear 717 is rotated counterclockwise as shown in FIG. 4(*a*) by the engaged plate-cylinder gear to be described later on. This causes the rotation force of the inking gear 717 to be transmitted to the roller shaft 710*a* to rotate the form roller 710 in the counterclockwise direction. Conversely, when the inking gear 717 is rotated clockwise as shown in FIG. 4(*a*) by the externally applied manual operation in such a situation no printing operation is underway, the rachet nails 723*a* of the arms 723 are disengaged from the rachet wheel 720. This causes the inking gear 717 to rotate without effect against the rachet wheel 720 to prevent the rotation force from the inking gear 717 from being transmitted to the roller shaft 710*a* that the form roller 710 can securely remain still. In other words, the form-roller reverse-turn prevention mechanism 718 causes the rotation force from the inking gear 717 to be transmitted to the form roller 710 while the printing operation is underway, and conversely, it effectively prevents the form roller 710 from reversing the direction of its rotation while no printing is executed.

See FIG. 3 again. Both ends of the roller shaft 711*a* of the ink distributing roller 711 are secured to the bearings 727 shown in FIG. 3(*c*) installed to the lateral panels 701*a* and 702*a* so that the ink distributing roller 711 can freely rotate and oscillate itself in the direction of the roller shaft 711*a*. Likewise, both ends of the roller shaft 712*a* of the other ink distributing roller 712 are secured to the bearings 728 installed to the lateral panels 701*a* and 702*a* so that the ink distributing roller 712 can freely rotate and oscillate itself in the direction of the roller shaft 712*a*. The surfaces of these ink distributing rollers 711 and 712 are complete with smoothly and finely processed concave and convex by applying blast processing using spherical beads made of glass beads for example.

These ink distributing rollers 711 and 712 oscillate themselves in the direction of the roller shaft in conjunction with the rotation of the form roller 710. This mechanism is described below. As shown in FIGS. 3(*d*) and (*f*), the cams 729 and 730 having a groove are respectively installed to the left end of the ink distributing rollers 711 and 712. On the other hand, a gear 731 is secured to the left end of the roller shaft 710*a* of the form roller 710, while a cam 733 having a gear 732 engaged with the gear 731 is held pivoting a pivot pin 734' set to the lateral panel 701*a* so that it can freely rotate. The cam 733 is provided with a circumferential groove 733*a* inclined in the direction of cam shaft along its external circumference. In addition, cam followers 734 and 735 are respectively set between the circumferential groove 733*a* of cam 733 and the circumferential grooves 729*a* and 730*a* of cams 729 and 730 so that these cam followers 734 and 735 are respectively in position across these grooves, while the center positions of these cam followers 734 and 735 are respectively held by the bearings 736 and 737 secured to the lateral panel 701*a* so that the cam followers 734 and 735 can freely rotate themselves.

According to the mechanism for oscillating the ink distributing rollers 711 and 712, when the form roller 710 is rotated, the cam 733 also rotates itself via the gear 731 and 732. This causes the cam followers 734 and 735 to respectively oscillate themselves pivoting the bearings 736 and 737 due to the function of the circumferential groove 733*a*, thus causing the cams 729 and 730 to oscillate themselves in the direction of the roller shaft 710*a*. As a result, the ink distributing rollers 711 and 712 are driven so that they can be oscillated in the direction of the roller shaft 710*a*.

On the other hand, the bearings 727 and 728 shown in FIGS. 3(*c*) and (*f*) supporting the ink distributing rollers 711 and 712 are respectively installed to the lateral panels 701*a* and 702*a* so that they can freely rotate pivoting the bolts 738 and 739. These bearings 727 and 728 are respectively connected to the operation levers 742 via the links 740 and 741. The operation levers 742 are secured to the lateral panels 701*a* and 702*a* pivoting the fulcrum pins 743 so that they can freely rotate. The upper end of the operation levers 742 projects in the upper direction of rail members 701*b* and 702*b* through the slits 744 shown in FIG. 3(*b*) provided for the rail members 701*b* and 702*b*, while the tip ends of which are provided with the concaves 742*a* for securing spring means.

When the spring-engaging concave 742*a* is inserted to the left part shown in FIG. 3(*c*), the operation lever 742 falls itself to the left pivoting the fulcrum pin 743. This causes the bearing 727 to rotate counterclockwise pivoting the bolt 738 via the link 740, and as a result, the external surface of the ink distributing roller 711 to be simultaneously pressed against the external surfaces of the form roller 710 and the auxiliary form roller 713. Simultaneously, the bearing 728 is rotated clockwise pivoting the bolt 739 via the link 741 so that the external surface of the ink distributing roller 712 can be pressed against the external surface of the form roller 710. While the printing operation is underway and the state of pressing these rollers is present, in accordance with the rotation of the form roller 710, the ink distributing rollers 711 and 712 rotate accompanying oscillation in the direction of the roller shaft 710*a*. This causes the thickness of ink film on the form roller 710 to become uniform. When the spring-engaging concave 742*a* is freed while the state of pressing these rollers is present, due to the elastic force of form roller 710, the ink distributing rollers 711 and 712 are respectively brought back to their original positions, thus releasing the form roller 710 from the pressure generated by the ink distributing rollers 711 and 712.

Both ends of the shaft 713*a* shown in FIGS. 3(*c*) and (*e*) of the auxiliary form roller 713 are secured to the bearing 745 set to the predetermined positions of the lateral panels 701*a* and 702*a* so that the roller 713 can freely rotate. The external surface of the auxiliary form roller 713 remains in contact with the external surface of the ink distributing roller 711 to allow ink from the external surface of the form roller 710 to be transferred into the external surface of the auxiliary form roller 713 via the ink distributing roller 711.

As shown in FIGS. 3(*d*), (*g*) and (*h*), both ends of the doctor blade 714 are provided with edge-sealing plate 759. Doctor blade 714 is held so that it can freely rotate pivoting the bearing holes 760 by engaging the pivot pins 746 shown in FIG. 3(*a*) secured to the lateral panels 701*a* and 702*a* with the bearing holes 760 set to the upper part of the external surface of the edge-sealing plates 759, thus eventually forming the ink-pooling space 747 surrounded by the doctor blade 714, the form roller 710, and the edge-sealing plate 759, respectively.

The blade holder 714*b* of the doctor blade 714 is set to the upper surface of the blade board 714*a*, whereas the bottom surface of which is provided with the blade supporter 714*c*. The doctor blade 714 is thus assembled by connecting the blade board 714*a*, the blade holder 714*b*, and the blade supporter 714*c* to each other by screw means. The flanges 714*d* are set to the rear position of both ends of the blade holder 714*b*. The flanges 714*d* are provided with the horizontally extended lengthy hole 761 used for adjusting the installation position of the edge-sealing plates 759. The edge-sealing plates 759 are provided with the blade-securing grooves 762 in their bottom parts, while the front edges 759*a* are made the arc portions so that they correctly come into contact with the external portions of the roller edge surfaces 710*f*. The edge-sealing plates 759 are held in order that they can freely slide their positions in the direction of width while preventing ink from leakage between the edge-sealing plates 759 and the doctor blade 714 by causing the bottom surfaces 759*b* of the edge-sealing plates 759 to remain in contact with the upper surface of the blade 714 in the state in which the tip of the blade board 714*a* is engaged with the blade-securing grooves 762 and the rear surfaces 759*c* of the edge-sealing plates 759 being in contact with the front surfaces of the flanges 714*d*. The screws 764 set to the lengthy holes 761 of the doctor blade 714 are inserted into the screw holes 759*d* in the rear surfaces of the edge-sealing plates 759. The edge-sealing plates 759 freely slide their position in the direction of width by loosening the screws 764. Conversely, when fastening the edge-sealing plates 759 with screws 764 at the optionally set position of the edge-sealing plates 759 after sliding themselves to them, the edge-sealing plates 759 are secured to the doctor blade 714 at the slide-terminated position. The edge-sealing plates 759 can be set to the positions where the front edges 759*a* of the edge-sealing plates 759 contact with the external portions of the roller edge surfaces 710*f* by slight pressure through position adjustment. If the front edges 759*a* of the edge-sealing plates 759 are pressed the external portions of the roller edge surfaces 710*f* by strong pressure, the external edge surfaces 710*f* of the form roller 710 wear by the friction against the front edges 759*a* of the edge-sealing plates 759 when the form roller 710 continuously rotates at a very high speed. Note that, since ink for use with a dampening waterless plate is highly viscosity, even the slightest contact with the edge-sealing plates 759 effectively prevents ink from leakage between the edge-sealing plates 759 and the form roller 710. On the other hand, both ends of the form roller 710 are respectively provided with the disc-shaped holding plates 763 which are secured to the roller shaft 710*a* as shown in FIGS. 3(*g*) and (*h*). These holding plates 763 securely press the entire area of the roller edge surfaces 710*f* except for the edge portions, thus the border condition is properly adjusted so that the foundary condition of the edge and the center of the form roller 710 remains almost equal to each other.

Using the constitution thus far described, the holding plates 763 securely prevent the roller edge surfaces 710*f* from externally expanding themselves to cause deformation when the doctor blade 714 is pressed against the form roller 710. At the same time, no space is generated between the roller edge surfaces 710*f* and the front edges 759*a* of the edge-sealing plates 759, thus eventually preventing ink form leakage outside.

Further details of the doctor blade 714 are described below. The inside surface 714*a*, in other words, the front surface of the blade holder 714*b*, of the doctor blade 714 is formed so that it inclines downwards in the direction of the form roller 710, and the inside surface 714*e* is made the ink-repellant surface. The ink-repellant surface is realized by either bonding or coating ink-repellant materials such as silicon rubber or fluoride resins for example onto the surface of the bladeholder 714*b*. By the effect of the ink-repellant surface, ink stored in the ink-pooling space 747 is repelled by the inside surface 714*b*, thus causing ink to flow downward over the inside surface 714*b* due to the effect of gravity. As a result, even when the consumable amount of ink varies in the direction of the length of roller depending on the printable patterns of a printing plate, it is possible for the system to accurately adjust the amount of ink so that the amount of ink can constantly be held uniform in the direction of the width of the doctor blade 714, thus allowing the system to execute the printing operation using the specific ink concentration which is constantly uniform in the direction of the width of the doctor blade 714. Namely, the ink-repellant surface of the inside surface 714 prevents ink stored in the ink-pooling space 747 from locally disappearing by spending much ink in position involved many printable patterns of a printing plate. In addition, since no ink remains over the inside surface 714*e*, the system can use ink without waste, thus allowing the doctor blade 714 to be easily cleaned after completing the needed printing operation.

FIG. 3(*i*) denotes the enlarged sectional view of the front edge of the blade board 714*a*. The blade-pressing part 714*f* is provided by the "R" finish applied to the upper tip-end corner of the blade board 714*a*. The ink-flow regulative part 714*g* is formed by cutting the lower tip-end corner of the blade board 714*a* obliquely so that the lower tip-end corner can be connected to the blade pressing part 714*f*. The corner portion where the ink-flow regulative part 714*g* and the bottom side 714*h* of the doctor blade 714*a* cross each other is used for the ink-splitting part 714*i*.

Referring again to FIG. 3(*d*), a pair of metals 748 are secured to the connector shaft 704 set between the frame lateral panels 701*a* and 702*a* at the specific intervals in the horizontal direction. These metals 748 support a pair of eccentric rollers 715 at the specific intervals in the horizontal direction. As shown in FIGS. 3(*a*) and (*b*), these eccentric rollers 715 are respectively provided with the bearings which hold the external wheels 715*c* in the external circumference of the internal wheels 715*a* via balls 715*b*, while the internal wheels 715*a* of these eccentric rollers 715 are respectively connected to the connection shaft 749. The center of the rotation of the connection shaft 749, the internal wheels 715*a*, and the external wheels 715*c* correctly match each other. A rotation drive shaft 750 is connected to the external surface of the internal wheels 715*a* of these eccentric rollers 715. The center of the drive shaft 750 is eccentrically provided against the center of the rotation of the eccentric rollers 715 and the connection shaft 749, while are the drive shaft 750 is held by the bearings 751 secured to the metals 748 so that the drive shaft 750 can freely rotate. The drive shaft 750 is driven by the pulse motor 709 which is connected to it via the coupling unit 752 shown to the right.

As shown in FIG. 3(*b*), when the pulse motor 709 rotates the drive shaft 750 counterclockwise within the predetermined range, the internal wheels 715*a* also rotates counterclockwise eccentrically against the center of the rotation of the drive shaft 750. When the eccentric rotation of the internal wheels 715*a* are activated, the external wheels 715*c* of the eccentric rollers 715 start to eccentrically move their center positions under the condition in which the external surfaces of the external wheels 715*c* remain in contact with the back surface of doctor blade 714 to constrain their rotations. This causes the doctor blade 714 to be pushed to the left direction in FIG. 3(*d*). Conversely, when the pulse motor 709 rotates the drive shaft 750 clockwise (see FIG. 3(*d*)) within the predetermined range, the external wheels 715*c* of the eccentric rollers 715 move their cetral position to the right direction in FIG. 3(*d*). As a result, due to the elastic force generated by rubber of the form roller 710, the doctor blade 714 is compulsorily brought back to the right direction in FIG. 3(*d*) with its back surface being pressed against the eccentric rollers 715. Thus, it is possible for the system to properly adjust the pushing amount of the doctor blade 714 against the form roller 710 by causing the pulse motor 709 to properly control the amount of the rotation of the rotation drive shaft 750. In the primary preferred embodiment of the present invention, the pushing amount of the doctor blade 714 against the form roller 710 is accurately controlled by means of electronic devices, the detail of which is described later on.

Figure 5:
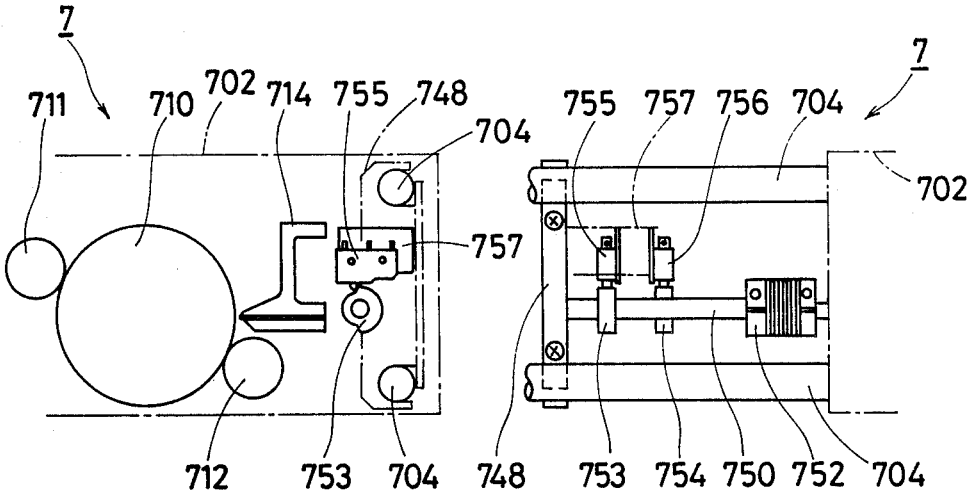
FIGS. 5(*a*) and (*b*) are respectively a diagram denoting constitution of the main parts of the inking unit.

FIG. 5 denotes the sectional and front views of the main components of the inking unit 7, in which the mechanism needed for controlling the pushing amount of the doctor blade 714 is concretely shown. As shown in FIG. 5, the origin-detection cam 753 and the pushing-limit detection cam 754 are respectively installed to the rotation drive shaft 750. In addition, the origin-detection limit switch 755 and the pushing-limit detection switch 756 to be activated by these cams 753 and 754 are respectively installed to the metal 748 via the metal part 757. These limit switches 755 and 756 are respectively and electrically connected to the connector 708 shown in FIG. 3(*b*).

(2) Constitution of the mechanical structure securing the inking unit

Figure 6:
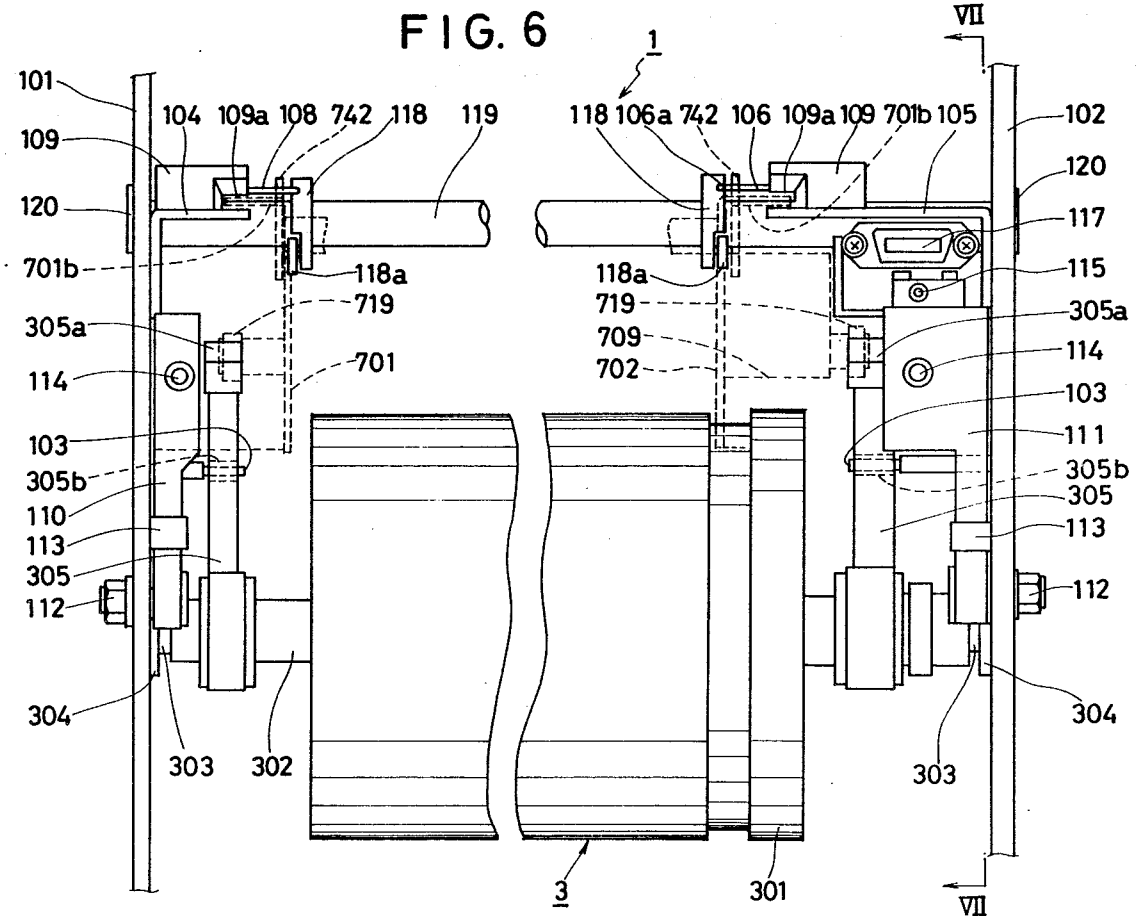
FIG. 6 is a rear view of a part of the printing press before installing the inking unit.
Figure 7:
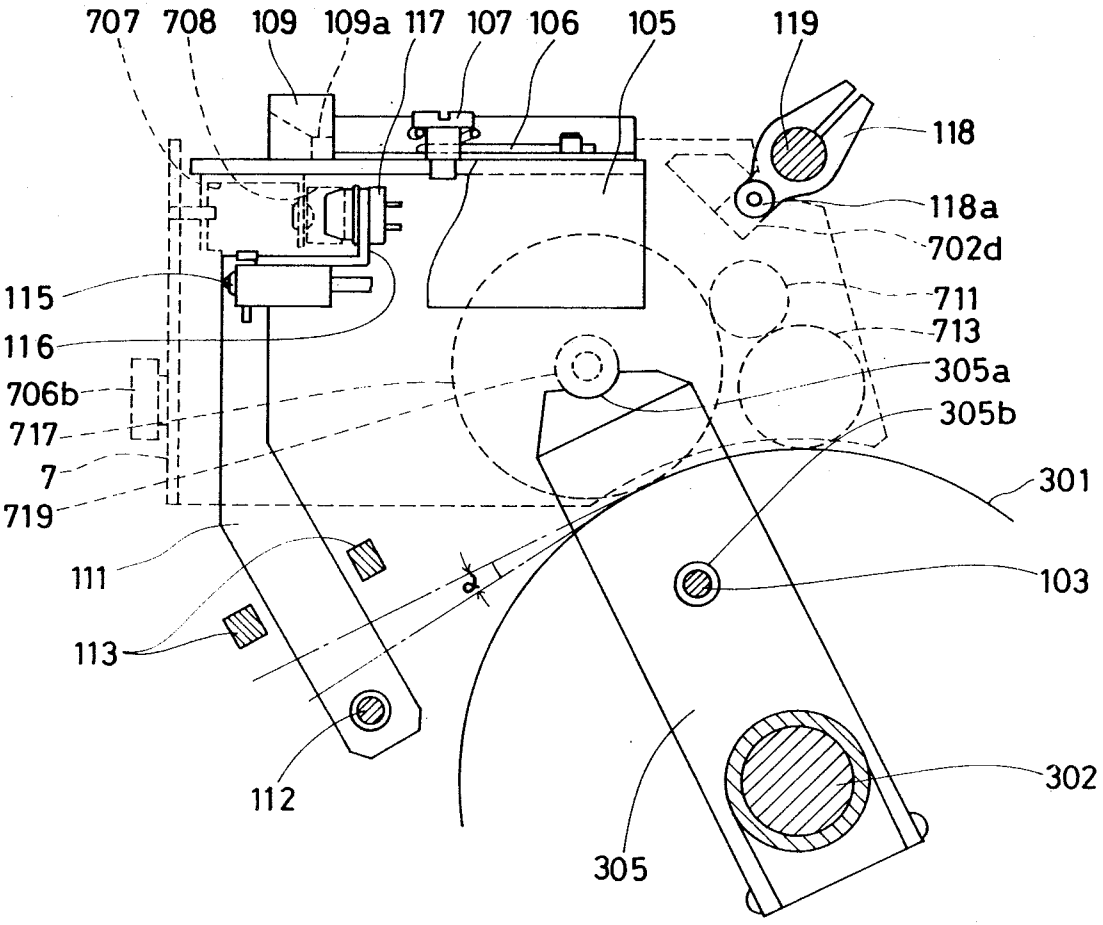
FIG. 7 is a sectional view of a part of the rear view of the printing press taken on line VII through VII shown in FIG. 6.

Next, the constitution of the mechanical structure securing the inking unit 7 is described below. FIG. 6 denotes the rear surface of the printing press body 1 before mounting the inking unit 7 onto it. FIG. 7 denotes the sectional view of the mechanical structure taken on line VII through VII shown in FIG. 6.

Figure 8:
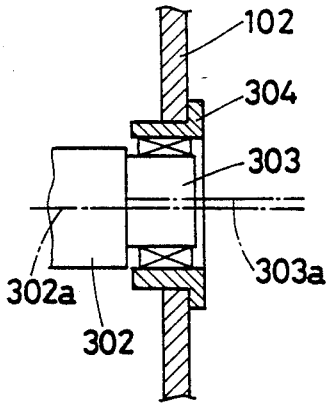
FIG. 8 is a sectional view denoting the mechanism in which a plate-cylinder supporting shaft is held by the printing press so that is can freely rotating eccentrically.

The plate-cylinder gear 301 is secured to the right of the plate cylinder 3, while both of these are held by the plate-cylinder supporting shaft 302 so that they can freely rotate themselves. As shown in FIG. 8, both ends of the plate-cylinder supporting shaft 302 mount the eccentric shaft 303 having the rotation center 303*a* which is eccentrically positioned against the center 302*a* of the plate-cylinder supporting shaft 302. These eccentric shafts 303 are respectively latched by the bearings 304 set to the left and right lateral panels 101 and 102 of the printing press body 1. The plate cylinder 3 is rotated by engaging the plate-cylinder gear 301 with the blanket cylinder gear set to the right of the blanket cylinder 2. The plate cylinder 3 either comes into contact with or leaves the blanket cylinder 2 by rotating the eccentric shaft 303 either clockwise or counterclockwise withing a specific angle range using the pulse motor 709 for example.

A pair of shaft-to-shaft distance regulating members 305 are installed to both sides of the plate cylinder 3. The bottom ends of these members 305 are held by the plate-cylinder supporting shaft 302 so that they can freely rotate themselves. The upper ends of the shaft-to-shaft distance regurating members 305 are respectively provided with concaves 305*a* for latching the shaft-to-shaft distance regulating bearings 719. In addition, the positioning-pin insertion holes 305*b* are respectively provided in approximately middle positions of these shaft-to-shaft distance regulating members 305. These positioning-pin insertion holes 305*b* respectively allow passage of positioning pins 103 set to the internal surfaces of the left and right lateral panels 101 and 102, thus allowing the shaft-to-shaft distance regulating members 305 to be stably held in position. Note that the diameter of these positioning-pin insertion holes 305*b* is wider than that of the positioning pins 103. This allows the plate cylinder 3 to smoothly come into contact with and depart from the blanket cylinder 2 in conjunction with the eccentric rotation of the plate-cylinder supporting shaft 302 without being disturbed by the presence of these shaft-to-shaft distance regulating members 305.

Figure 9:
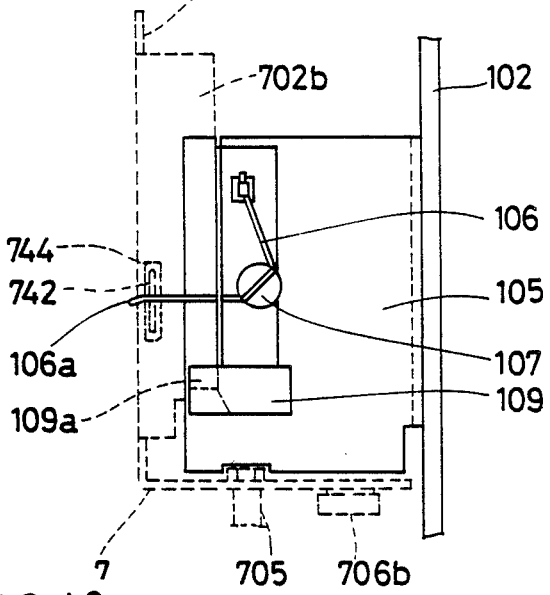
FIG. 9 is a plain view of area in the periphery of a rail receiving member of the printing press.

On the other hand, a pair of rail-receiving members 104 and 105 are installed to the internal surfaces of the left and right lateral panels 101 and 102 in positions being opposite form each other, in which these members 104 and 105 respectively guide the installation of the inking unit 7. As shown in FIG. 9, the torsion coil spring 106 is secured to the upper surface of the rail-receiving member 105 by the screw 107. When installing the inking unit 7 to the printing press 1, the tip end 106*a* of the torsion coil spring 106 is set to the position for engaging with the operation lever 742. Likewise, the upper surface postion of the rail-receiving member 104 is provided with torsion coil spring 108. The stopper members 109 are respectively set to the front edge of the upper surfaces of the rail-receiving members 104 and 105. The inking unit 7 can be held in drawn-out condition when the upper surfaces of rear edges of rail members 701*b* and 702*b* of the inking unit 7 are engaged with the bottom surfaces of the notch portions of these stopper members 109.

A pair of the inking-unit supporting arms 110 and 111 are respectivly installed to the internal surfaces of the left and right lateral panels 101 and 102 pivoting the bolts 112 so that these arms 110, 111 can freely rotate. The range of the rotation of these arms 110 and 111 is regulated within a specific area in which the rotation regulating members 113 respectively projecting themselves from the internal surfaces of the left and right lateral panels 101 and 102 do not disturb the operations of the inking unit 7 for coming into contact with and depart from the plate cylinder 3. The position of bolt 112, in other words, the center of the rotation of these arms 110 and 111 is disposed in the position inner than the pressure angle, i.e., 15.50° in this preferred embodiment. As a result, when the plate-cylinder gear 301 while mounting the inking unit 7, the inking gear 717 is energized in the direction of engaging itself with gear 301 of the plate cylinder 3. The screw holes 114 are provided in the front surfaces of the inking-unit supporting arms 110 and 111 for dealing with the screws 706*a* and 706*b* securing the inking unit 7. A limit switch 115 is set to the upper position of the screw hole 114 of the inking-unit supporting arm 111 for detecting that the mounting of the inking unit 7 is completed. In addition, a connector 117 is set to the inking-unit supporting arm 111 via the metal part 116. The connector 117 is connected to the microprocessor 21 via the control parts 23 shown in FIG. 2.

Figure 10:
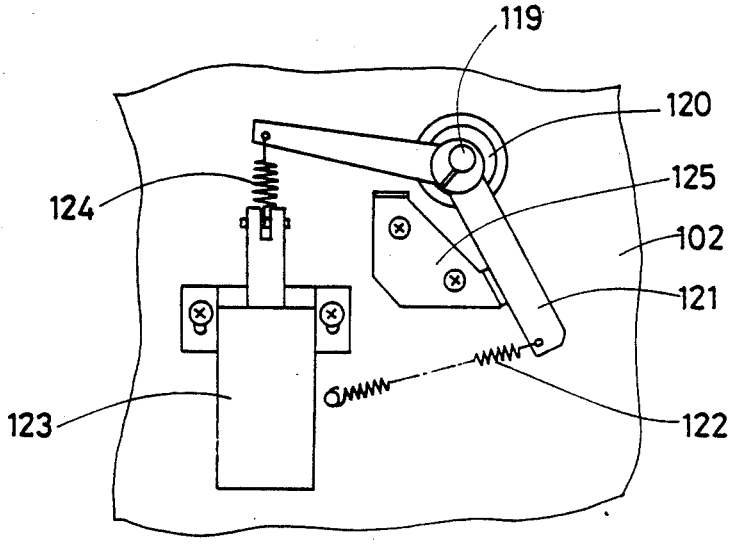
FIG. 10 is a schematic diagram of the mechanism for driving the driving lever needed for mounting and removing inking unit onto and form a plate cylinder.

On the other hand, a pair of drive levers 118 are set to the rear positions of the rail-receiving members 104 and 105 at specific intervals in the horizontal direction for allowing the inking unit 7 to either come into contact with or depart from the plate cylinder 3. The tip-ends of these levers 118 are respectively provided with the bearings 118*a* to be engaged with the notches 701*d* and 702*d*. Both ends of the drive shaft 119 securing the base of the drive lever 118 are respectively held by the bearings 120 installed the left and right lateral panels 101 and 102 so that the drive shaft 119 can freely rotate itself. The link 121 shown in FIG. 10 is connected to the right edge of the drive shaft 119, which is outside of the right lateral panel 102. The spring 122 causing the link 121 to rotate clockwise is set between an end of the link 121 and the right lateral panel 102. The solenoid 123 that rotates the link 121 counterclockwise is secured to the right lateral panel 102, while the solenoid 123 and the other end of the link 121 are connected to each other via the spring 124. The stopper 125 for regulating the range of the rotation of the link 121 is set to the right lateral panel 102. When the power is fed to the solenoid 123, the link 121 is driven so that it rotates counterclockwise as shown in FIG. 10. This causes the lever 118 to be also rotated in the counterclockwise direction in FIG. 7 before being set to the position at which the inking unit 7 comes into contact with the plate cylinder 3. Next, when the power is OFF from the solenoid 123, due to energized force from the spring 122, the link 121 restores its clockwise rotational position as shown in FIG. 10. This causes the lever 118 to also rotate clockwise before eventually returning to the position where inking unit 7 is departed from the plate cylinder 3.

(b) Operation needed for mounting inking unit

Next, the procedure needed for mounting the inking unit 7 onto the printing press body 1 is described below. The inking unit 7 is mounted onto the designated position of the printing press body 1 while all the cylinders are apart from each other. Concretely, the plate cylinder 3 remains apart from the blanket cylinder 2. Likewise, the lever 118 for causing the inking unit 7 to either come into contact with or leave the plate cylinder 3 remains in the clockwise rotation position shown in FIG. 7 where the departure operation from the plate cylinder 3 is executed.

Figure 11:
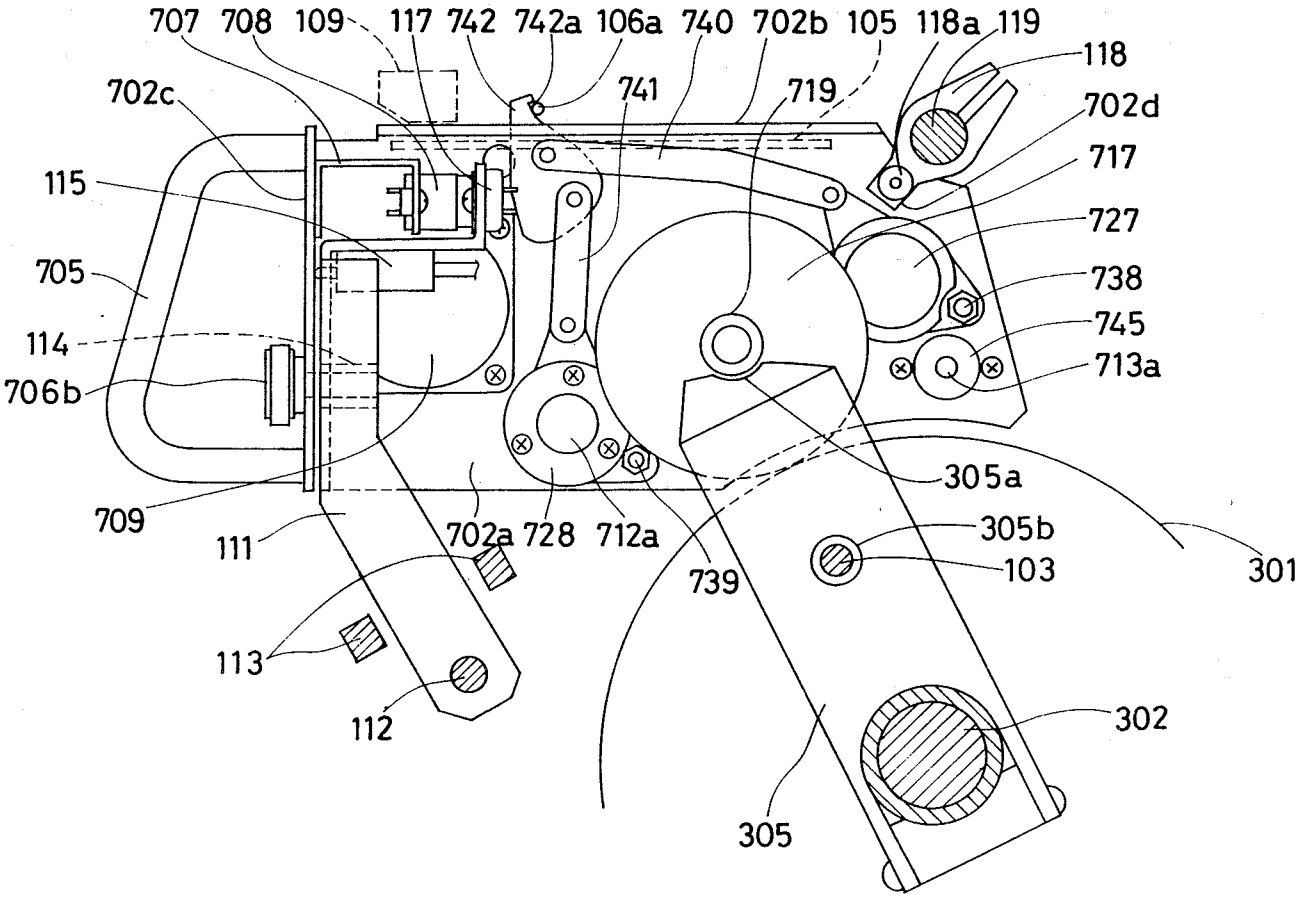
FIGS. 11(*a*) through (*c*) respectively denote the inking-unit installed conditions.
Figure 11:
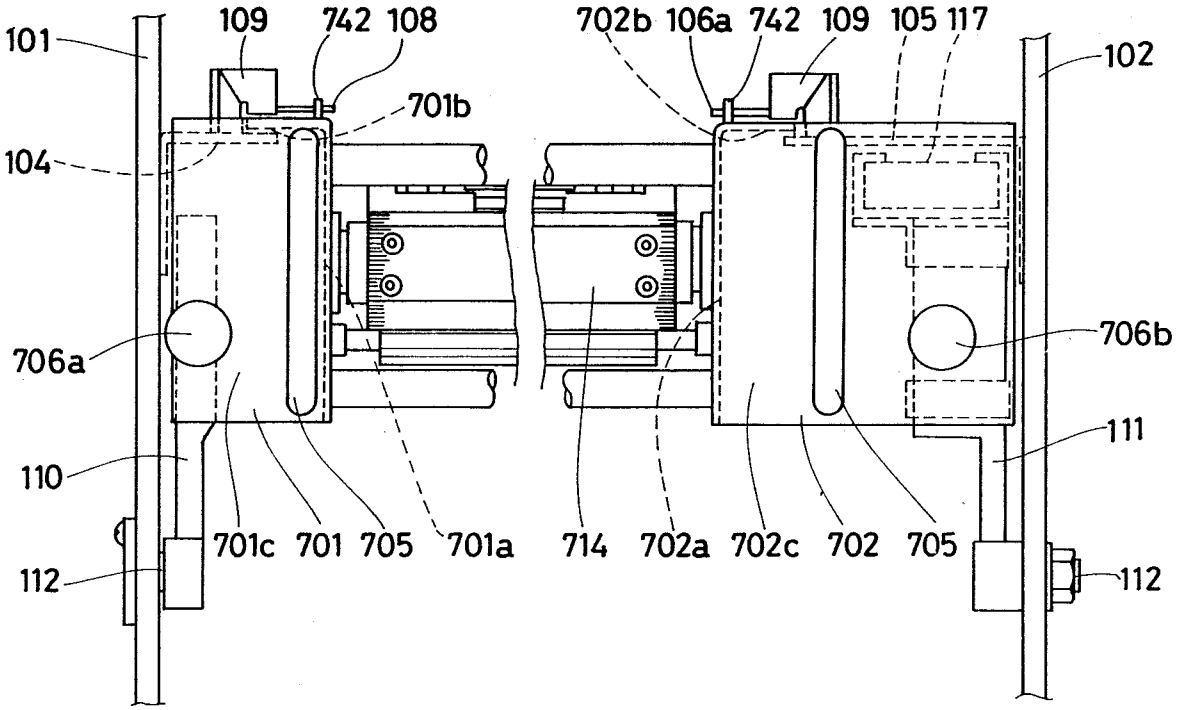
Figure 11C:
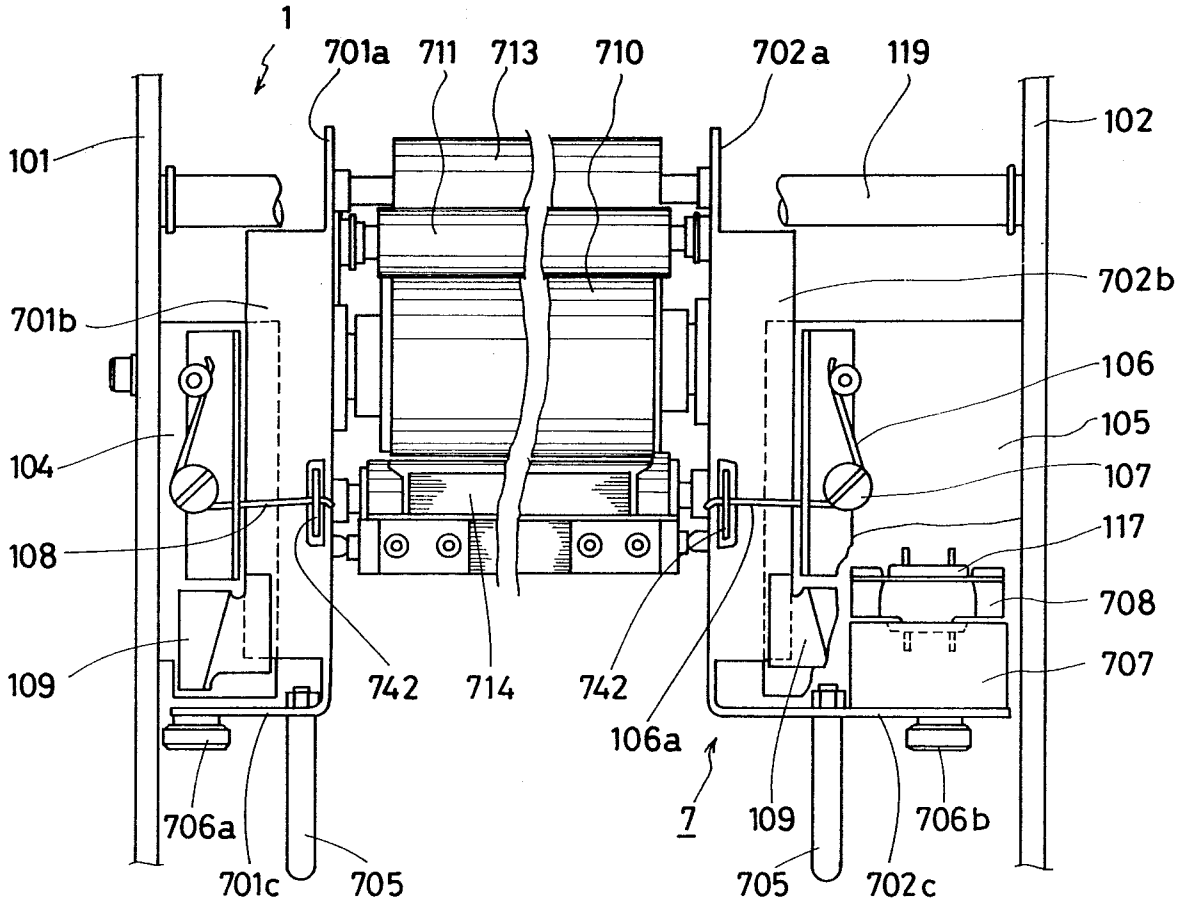

To mount the inking unit 7 onto the designated position of the printing press body 1, first, an operator manually lifts the inking unit 7 by holding the handles 705 with both hands, and then he mounts the rear edge of rail members 701*b* and 702*b* of the inking unit 7 onto the front edges of the rail-receiving members 104 and 105. Then, the operator places the inking unit 7 into the farthest position of the printing press body 1 by sliding the rail members 701*b* and 702*b* through the rail-receiving members 104 and 105. When the inking unit 7 is inserted into the farthest position of the printing press body 1, as shown in FIG. 11(*a*), the bearings 118*a* of the levers 118 are engaged with the notches 701*d* and 702*d* of the inking unit 7 to cause the rear end of the inking unit 7 to slightly raise its position. As a result, the rear edges of the rail membes 701*b* and 702*b* respectively raise their positions from the rail-receiving members 104 and 105. Next, the operator secures the inking-unit supporting arms 110 and 111 with the screws 706*a* and 706*b* by inserting these into the holes 114 of these arms 110 and 111. Consequently, the stopper members 701*c* and 702*c* of the inking unit 7 are pulled into the direction of these arms 110 and 111 so that these stopper members 701*c* and 702*c* are slightly lifted the bolts 112. This causes the front edges of the rail members 701*b* and 702*b* to respectively raise their positions from rail-receiving members 104 and 105. Thus, when the rail members 701*b* and 702*b* are respectively placed in positions above the rail-receiving members 104 and 105 being apart from each other, it allows the system to have the inking unit 7 come into contact with the plate cylinder 3 in the ensuing step.

As soon as the inking unit 7 is correctly installed at the printing press body 1, the limit switch 115 turns ON by being pressed by the stopper member 702*c*, thus allowing the limit switch 115 to deliver the mounted-inking-unit detected signal to the microprocessor 21 shown in FIG. 2, and at the same time, the connector 708 set to the inking unit 7 is connected to the connector 117 installed to the inking-device supporting arm 111. As a result, the motors and switches of the inking unit 7 are electrically connected to the microprocessor 21 shown in FIG. 2. The operation levers 742 set to both sides of the inking unit 7 are pressed by the springs 106 and 108 set to the rail-receiving members 104 and 105 so that these levers 742 are rotated counterclockwise as shown in FIG. 11(*a*). This causes the ink distributing rollers 711 and 712 to be respectively pressed against the form roller 710 under the predetermined pressure via the link mechanism described earlier. This also causes the inking gear 717 to be engaged with the plate-cylinder gear 301 and the shaft-to-shaft distance regulating bearings 719 to be set to the positions above the bearing-latching concaves 305*a* of the shaft-to-shaft distance regulating members 305.

The inking unit 7 can be removed from the printing press body 1 by reversing the procedure done for mounting it. When the inking unit 7 is removed, the connectors 708 and 117 are disconnected from each other. And the limit switch 115 turn OFF, and at the same time, the operation lever 742 restores its rising posture. This releases the pressure applied to the form roller 710 from the ink distributing rollers 711 and 712.

The inking unit 8 has the constitution exactly identical to that of the inking unit 7 and can be mounted onto and removed from the printing press body 1 by applying the same procedure as that is designated for the inking unit 7.

(c) Operations

(I) Operations for causing the inking unit to come into contact with and leave the plate cylinder When either the plate feeding and discharging operation or the cleaning operation of the blanket cylinder 2 is done, the inking unit 7 installed to the printing press body 1 needs to release its form roller 710 from the plate cylinder 3. Conversely, the form roller 710 should correctly held in contact with the plate cylinder 3 while the printing operation is underway.

Operations of the inking unit 7 for coming into contact with and departing from the plate cylinder 3 are executed by controlling the rotation of the lever 118 engaged with the notch portions 701*d* and 702*d* of the inking unit 7 by means of the solenoid 123 shown in FIG. 10. Concretely, in case of causing the inking unit 7 to come into contact with the plate cylinder 3, power is fed to the solenoid 123. This causes the link 121 to be rotated in the counterclockwise direction in FIG. 10 to allow the lever 118 to also rotate in the counterclockwise direction in FIG. 11(*a*). This also causes the inking unit 7 to be rotated clockwise pivoting the bolts 112 of the arms 110 and 111, and as a result, the form roller 710 and the auxiliary form roller 713 are respectively brought into contact with the printing plate (not shown) wound on the plate cylinder 3. When this state is present, the shaft-to-shaft distance regulating bearings 719 are held by the bearing-latching concaves 305*a* of the shaft-to-shaft shaft distance regulating members 305, and as a result, the distance between the roller shaft 701*a* and the plate-cylinder supporting shaft 302 is held constant. Consequently, the width needed for nipping the printing plate between the form roller 710 and the plate cylinder 3 is remaind at a specific value ideally suited for executing ink transference while the printing operation is underway. To activate the departure of the inking unit 7 from the plate cylinder 3, the operator should merely cut off the power from the solenoid 123 shown in FIG. 10 to cause the lever 118 shown in FIG. 11 to rotate clockwise before eventually allowing the inking unit 7 to leave the plate cylinder 3 by reversing the procedure described above.

The inking unit 8 comes into contact with or departs from the plate cylinder 3 using the same procedure as that is applied to the inking unit 7.

(II) Normal printing operation using inking unit 7

Figure 12:
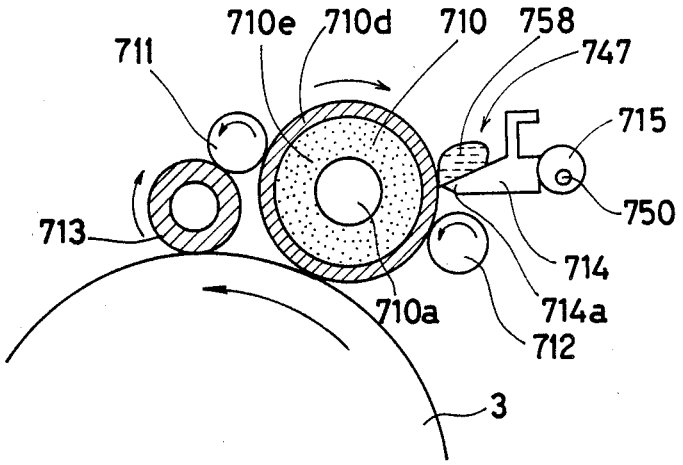
FIG. 12 is a diagram denoting normal printing operation using the inking unit.

Normally, the printing operation is executed by the printing press using the inking unit 7 (or 8) which remains in contact with the plate cylinder 3 (or 4). Since the plate cylinder 3 is rotated counterclockwise during the normal printing operation as shown in FIG. 12, the form roller 710 is rotated in the clockwise direction in FIG. 12 via the inking gear 717 engaged with the plate-cylinder gear 301 (see FIG. 11). This causes the ink distributing rollers 711 and 712 to respectively rotate in the counterclockwise direction while oscillating themselves in the direction of the shaft, thus rotating the auxiliary form roller 713 clockwise.

As a result, ink supplied from the ink-pooling space 747 generates ink film having a specific thickness corresponding to the pushing amount of the front edge of the doctor blade 714 over the specific area of the external surface of the form roller 710 immediately after allowing passage of the doctor blade 714. The ink film thickness is then levelled uniformly by the ink distributing roller 712 through its oscillating movement in the shaft direction to eventually allow ink 758 to be transferred onto the printing elements of the printing plate wound on the plate cylinder 3. Ink which still remains on the form roller 710 is again pressed by ink distributing roller 711 to level out the film thickness before being transferred onto the printing plate wound on the plate cylinder 3 over again via the auxiliary form roller 713. Residual ink from these transferring operations onto the ink distributing roller 711 is then collected into the ink-pooling space 747 for application to the next printing operation.

(III) Operation for controlling the pushing amount of the doctor blade

Figures 13A, 13B, 13C, 13D, 13E:
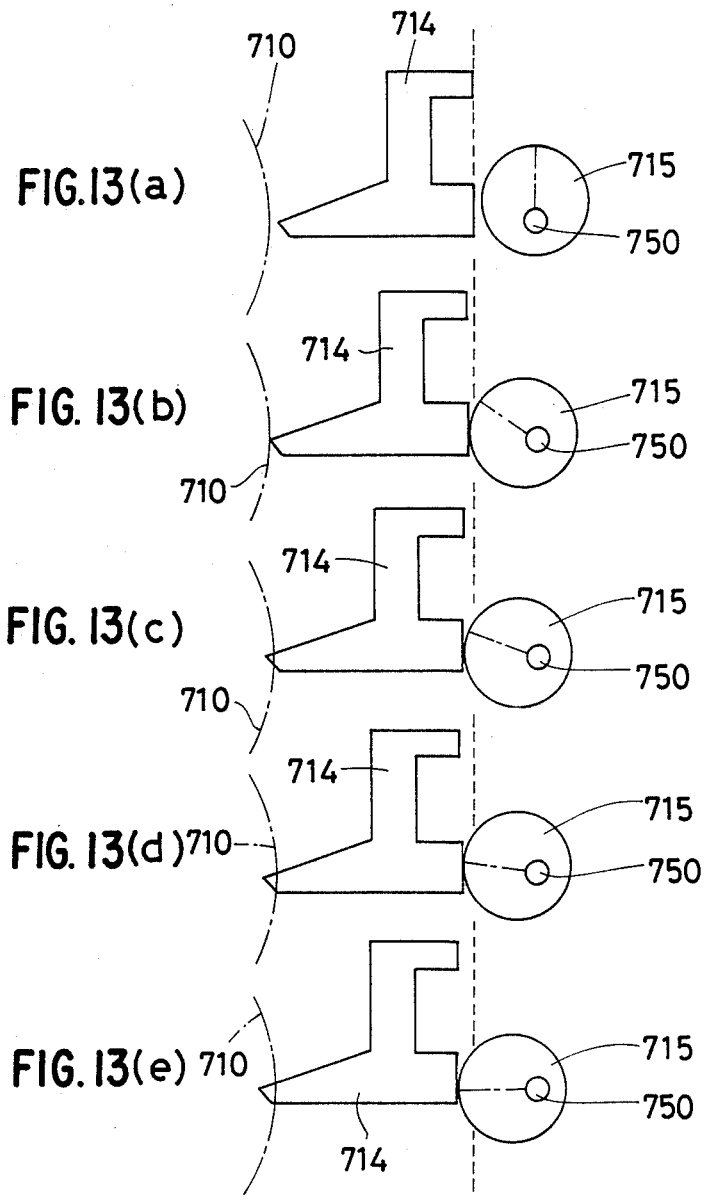
FIG. 13 is a diagram denoting the pushing operation of a doctor blade.

Next, the operation for controlling the pushing amount of the doctor blade 714 is described below. FIG. 13 denotes the pushing operation of the doctor blade 714 in conjunction with the eccentric rotation of the eccentric roller 715. FIG. 13(*a*) denotes the state before the pushing operation is done. When the eccentric roller 715 eccentrically rotates counterclockwise while the state shown in FIG. 13(*a*) is present, the doctor blade 714 then comes into contact with the form roller 710 at its rotation position shown in FIG. 13(*b*). Then, as the eccentric roller 715 increases its rotation, the pushing amount of the doctor blade 714 to the form roller 710 gradually increases as shown in FIG. 13(*c*). The doctor blade 714 is then led to the predetermined pushing limit position in the rotation position of the eccentric roller 715 shown in FIG. 13(*d*). When the eccentric roller 715 continues its eccentric rotation, as shown in FIG. 13(*e*), the pushing amount of the doctor blade 714 against the form roller 710 eventually reaches the maximum.

Figure 14:
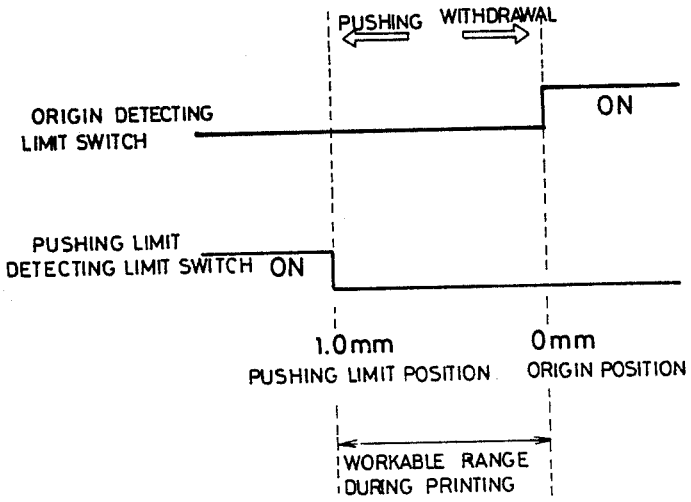
FIG. 14 is a chart denoting the operative conditions of the original-point detecting limit-switch and doctor-blade pushing-limit detecting limit-switch against the doctor-blade pushing condition.

The above describes the principle of the pushing operation of the doctor blade 714 to the form roller 710. In this preferred embodiment, the microprocessor 21 shown in FIG. 2 controls the pushing operation of the doctor blade 714 so that the pushing operation against the form roller 710 shown in FIGS. 13(*b*) through (*d*) can accurately be done. More particularly, the rotation position shown in FIG. 13(*b*) is set to the origin position, whereas the other rotation position shown in FIG. 13(*d*) is set to the pushing limit position. The sensor means comprised of the origin-detection limit switch 755 and the pushing-limit detection limit switch 756 is installed to the position opposite from the rotation drive shaft 750 as shown in FIG. 5. In addition, the origin-detection cam 753 and the pushing limit detection cam 754 for operating these limit switches 755 and 756 are also installed to the rotation drive shaft 750. The origin-detection limit switch 755 is activated in the rotation range shown in FIGS. 13(*a*) and (*b*), whereas the pushing limit detection switch 756 is activated in the rotation range shown in FIGS. 13(*d*) and (*e*). FIG. 14 is the chart denoting the relationship between the operative conditions of these limit switches 755 and 756 and the pushing state of the doctor blade 714. As described earlier, the rotation of the rotation drive shaft 750, i.e., the rotation of the eccentric roller 715, is generated by the pulse motor 709 shown in FIG. 3(*b*), which is controlled by the microprocessor 21 shown in FIG. 2.

Figure 15:
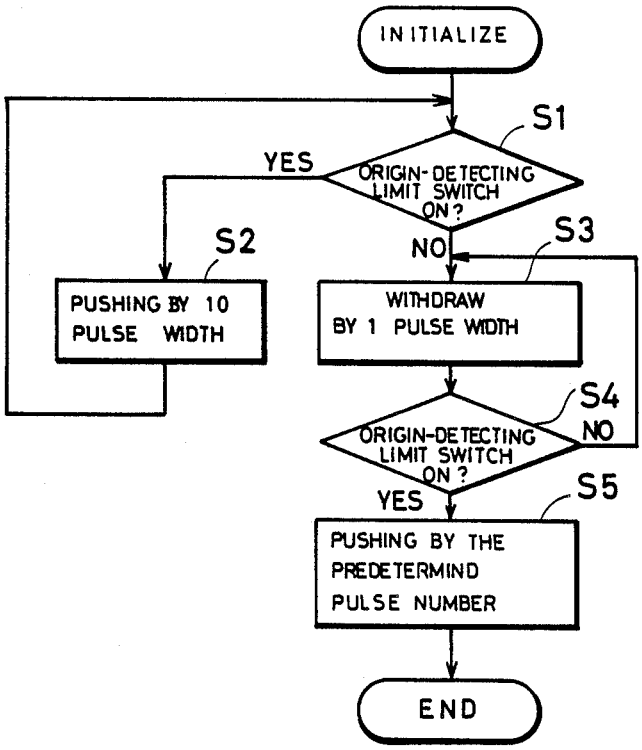
FIG. 15 is a flowchart describing the operations needed for controlling the doctor-blade pushing amount while the inking unit is mounted on the printing press.

FIG. 15 is the flowchart describing the operation of the microprocessor 21 about the control of the pushing amount of the doctor blade 714 in the case of setting the inking unit 7 (or 8) to the printing press body 1. When the inking unit 7 is installed to the printing press body 1, in the step S1, the microprocessor 21 shown in FIG. 2 jadges whether the origin-detection limit switch 755 is activated, or not. Assume that the eccentric roller 715 is at its rotating position in the range shown in FIGS. 13(*a*) and (*b*), then the origin-detection limit switch 755 is activated as shown in FIG. 14. When the step S2 is entered, the pulse motor 709 is driven in the counterclockwise direction in FIG. 13 by the amount corresponding to 10 pulses. Note that the preferred embodiment is designed so that the pulse motor 709 rotates counterclockwise by 0.05 mm of the distance corresponding to 45 pulses. The system operation mode then returns to the step S1, in which the microprocessor 21 again judges whether the origin-detecting limit switch 755 is activated, or not. These serial operations are repeatedly executed until the origin-detection limit switch 755 turns OFF, in other words, until the rotating position of the eccentric roller 715 exceeds the origin position shown in FIG. 13(*b*).

If the rotating eccentric roller 715 exceeds the origin position or the rotating eccentric roller 715 is already past the origin position by the setting of the inking unit 7, then the operation mode proceeds to the step S3. When the step S3 is entered, the pulse motor 709 is driven in the clockwise direction in FIG. 13 to allow the doctor blade 714 to withdraw by a specific amount corresponding to one pulse due to elastic force of rubber surrounding the surface of the form roller 710. The system operation mode then proceeds to step S4.

When the step S4 is activated, the microprocessor 21 shown in FIG. 2 again judges whether the origin-detection limit switch 755 is activated, or not. If the origin-detection limit switch 755 still remains OFF, the system operation mode returns to the step S3, in which those serial operations mentioned above are repeatedly executed until the origin-detection limit switch 755 turns ON, in other words, until the eccentric roller 715 exactly reaches the origin position shown in FIG. 13(*b*).

When the eccentric roller 715 reaches the origin position, the operation mode proceeds to the step S5, in which the pulse motor 709 causes the doctor blade 714 to push against the form roller 710 by a specific amount corresponding to the predetermined number of pulse. For example, as shown in FIG. 13(*c*), the doctor blade 714 is pushed against the form roller 710 until the doctor blade reaches the standard position. Needless to say that the standard pushing position is optionally available by setting the number of pulses at an optimum value.

Figure 16:
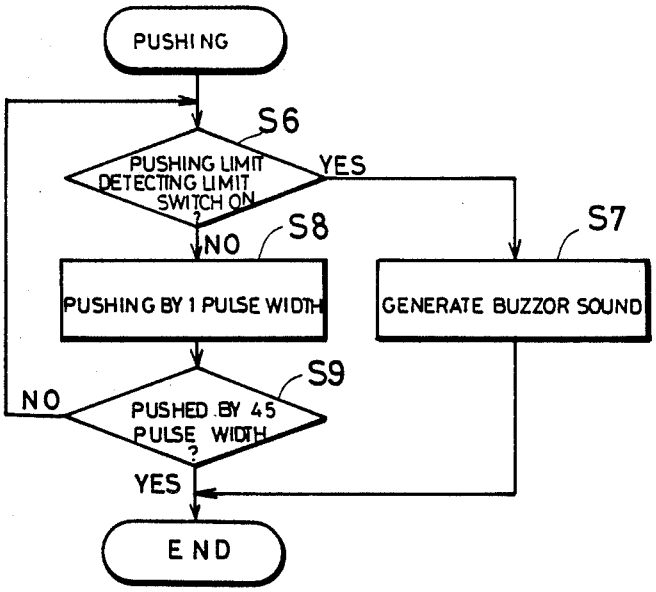
FIG. 16 is a flowchart describing the operations needed for controlling the doctor-blade pushing amount when the pushing command is generated by the operator's key operation.
Figure 17:
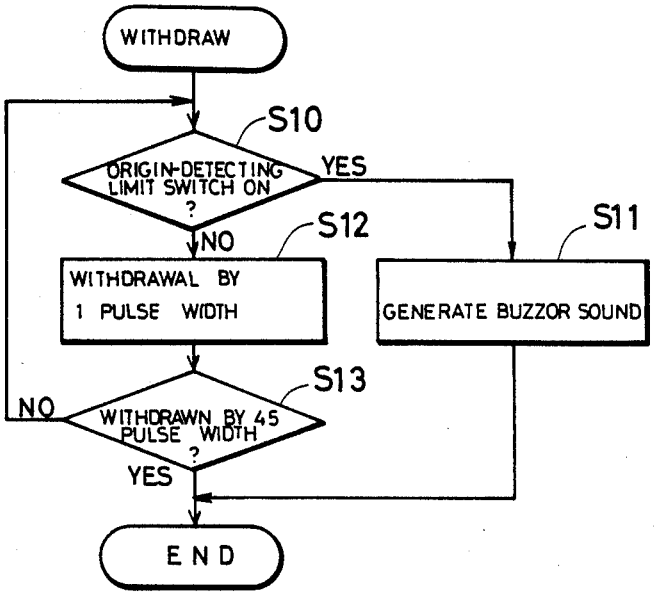
FIG. 17 is the flowchart describing the operations needed for controlling the doctor-blade pushing amount when the doctor-blade withdrawal command is generated by the operator's key operation.

FIGS. 16 and 17 are respectively the flowcharts describing the operations executed by the microprocessor 21 shown in FIG. 2, in which, if the desired concentration cannot be achieved by the standard pushinbg position of the doctor blade 714, the microprocessor 21 then executes those serial operations shown in these flowcharts in conjunction with the operation of either "press-forward" or "withdrawal" key of the operation panel 25 shown in FIG. 2 performed by the operator.

Concretely, when the operator depresses the "press-forward" key, the microprocessor 21 judges in the step S6 whether the pushing-limit detection switch 756 is activated, or not. If it is activated, in other words, if the eccentric roller 715 exceeds the pushig limit position, i.e., when eccentric roller 715 is at the position between the position shown in FIG. 13(*d*) and the position shown in FIG. 13(*e*), any further pushing operation should be inhibited. To securely prevent any further pushing operation from being executed, the operation mode then proceeds to the step S7 to terminate the printing process by means of a buzzor. Conversely, when the microprocessor 21 judges in the step S6 that the eccentric roller 715 doesn't exceed the pushing limit position, the operation mode then proceeds to the step S8. When the step S8 is entered, the pushing operation is executed by pulse motor 709 by a specific amount corresponding to one pulse. The operation mode then proceeds to the step S9, in which the microprocessor 21 judges whether the pushing operation is executed by 0.05 mm of the distance (corresponding to 45 pulses), or not. If this is not implemented, the operation mode again returns to the step S6 to repeat those serial operations described above until the doctor blade 714 eventually executes the pushing operation by the amount corresponding to 45 pulses. After activating the pushing operation corresponding to 45 pulses to cause the doctor blade 714 to push by 0.05 mm of the distance, the pushing process is the completed. Since each key operation allows the doctor blade 714 to push by 0.05 mm of the distance, desired pressure-applicable distance is achieved by following up key operations by x-times corresponding to it.

Conversely, when the operator depresses "withdrawal" key, the microprocessor 21 first judges in the step S10 whether the origin-detection limit switch 755 is activated, or not. If it is activated, i.e., when the eccentric roller 715 is exactly at the origin-position or past the origin position (i.e., the eccentric roller 715 is at the position between the position shown in FIG. 13(*a*) and the position shown in FIG. 13(*b*)), any further withdrawal movement should be inhibited. To achieve this, the operation mode proceeds to the step S11 to terminate the withdrawal operation of the doctor blade 714 while ringing the buzzer. If the origin-detection limit switch 755 remains OFF during the step S10, the operation mode proceeds to the step S12, in which the pulse motor 709 causes the doctor blade 714 to withdraw its position by a specific amount corresponding to one pulse from the form roller 710. The operation mode then proceeds to the step S13, in which the microprocessor 21 judges whether the doctor blade 714 has withdrawn its position by 0.05 mm of the distance corresponding to the width of 45 pulses, or not. If this operation is not implemented, the operation mode returns to the step S10, in which those serial operations are repeatedly executed until the doctor blade 714 executes its withdrawal operation corresponding to the width of 45 pulses. When the doctor blade 714 has withdrawn its position by 0.05 mm from the form roller 710, the withdrawal operation is thus completed. Since each key operation allows the doctor blade 714 to withdraw its position by 0.05 mm of the distance, the desired withdrawal distance is achieved by following up key operations by x-times corresponding to it. Although this preferred embodiment typically suggests the amount of the movement of the doctor blade 714 per key operation to be 0.05 mm corresponding to the width of 45 pulses for example, it is also possible for the system reflecting the present invention to optionally vary the suggested value as required.

Since the preferred embodiment allows the doctor blade 714 to adequately adjust the pushing amount against the form roller 710 by causing pulse motor 709 to accurately control the rotation of the eccentric roller 715 which is eccentric against the drive shaft 750, it is possible for the system to finely adjust the pushing amount of the doctor blade 714 using simplified structural means. In other words, the printing press reflecting the present invention can securely perform fine adjustment of the thickness of ink film formed onto the surface of the form roller 710 and yet accurately control the concentration of all the printable objects as well. Furthermore, the printing mechanism related to the present invention selects optimum phases of the eccentric roller 715 in order that the leg length of the moment affecting the drive shaft 750 by the repellent force from the form roller 710 can be shortened in accordance with the increase of the pushing amount of the doctor blade 714, and thus, even when the repellent force from the form roller 710 intensifies itself relative to the increased the pushing amount of the doctor blade 714, the rotation of the eccentric roller 715 driven by the pulse motor 709 remains free from obstruction. In addition, since the rotation angle of the eccentric roller 715 per pulse is constant, it is possible for the system to finely adjust the pushing amount of the doctor blade 714 against variable rotation angles in such portions close to the rotation angle when the concentration applied to the printing operation is controlled by using the eccentric roller 715 in the state of the moment described above. In addition, as shown in FIG. 13(*e*), since there is the mechanical pushing limit position of the doctor blade 714 in the position slightly deeper than said pushing limit position for detecting, even when the drive shaft 750 abnormally operates, the form roller 710 is prevented from incurring irreparable concavity.

(IV) Function of the holding plate

As shown in FIGS. 3(*g*) and (*h*), the holding plates 763 are secured to the roller shaft 710*a* in both ends of the form roller 710. The area except for the edge portions of the roller edge surface 710*f* of the form roller 710 is tightly pressed by these holding plates 763, thus allowing the boundary conditions related to the roller edge portion to be properly adjusted so that conditions of the roller edges are almost equivalent to the center portion of the roller. The front edge 759*a* of the edge-sealing plate 759 secured to the edge of the doctor blade 714 remains in contact with the edge portions of the roller edge surface 710*f*.

As a result, when the doctor blade 714 is pushed against the form roller 710, the holding plates 763 respectively prevent roller edge surfaces 710*f* from externally being expanded to cause deformation. This eliminates even the slightest gap between the roller edge surface 710*f* and the front edge 759*a* of the edge-sealing plate 759 to completely prevent ink from leaking outside. In addition, since the edge-sealing plates 759 are respectively capable of sliding themselves in the direction of the width of the doctor blade 714 so that they can freely be adjusted as required, the dimensional tolerance of the length of the form roller 710 can securely and easily be corrected. The elastic material such as rubber makes up the form roller itself, thus ensuring ink to be smoothly transferred onto the printing plate during the printing operation.

(V) Function of the inside surface of the doctor blade

As shown in FIG. 3(*d*), the inside surface 714*e* of the doctor blade 714 inclines itself downward in the direction of the form roller 710, while the inside surface 714*a* itself is made the ink-repellent surface. This allows ink from the ink-pooling space 747 to flow downward over the inside surface 714*e* by effect of the gravity while being repelled from the inside surface 714*e*. As a result, even when the consumable amount of ink in the direction of the roller length varies depending on the printed patterns of a printing plate, the amount of ink is properly adjusted so that the amount of ink is constantly uniform in the direction of the width of the doctor blade 714, thus making it possible for the system to execute the printing operation using uniformly provided ink concentration in the direction of the width of the doctor blades 714. Namely, the ink-repellant surface of the inside surface 714 prevents ink stored in the ink-pooling space 747 from locally disappearing by spending much ink in the position involved many printable patterns of a printing plate. In addition, since no ink remains over the inside surface of the doctor blade 714, the system can effectively use ink without waste, and the doctor blade 714 can easily be cleaned after completing the needed printing operation.

Figure 18:
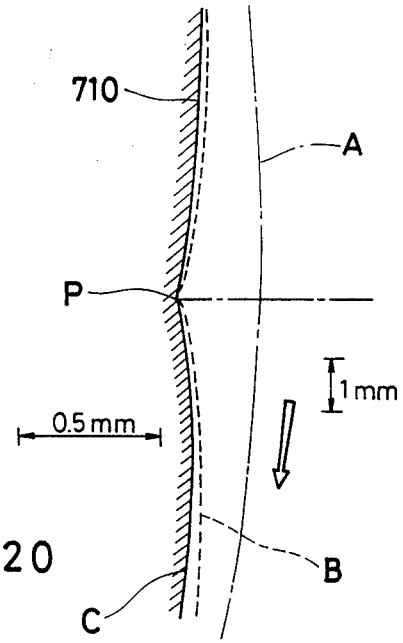
FIG. 18 denotes the state in which the form roller deforms itself due to the pushing operation of the doctor blade.

(VI) Function of the double-layer constitution of form roller and the doctor blade As shown in FIG. 3(*d*), the form roller 710 is complete with double-layer constitution comprised of hard external layer 710*d* and soft internal layer 710*e*. FIG. 18 denotes the state of the double-layer form roller 710 deformed by receiving pressing force from the doctor blade 714. Note that the deformed condition of the form roller 710 shown in FIG. 18 has the vertical/horizontal ratio varied intentionally for better understanding the deformed state. In FIG. 18, the curved line A denotes the configuration of the form roller 710 when it is in the still condition without receiving pressing force from the doctor blade 714. The curved line B denotes deformation took place on the surface of the form roller 710 when it received pressing force from the doctor blade 714 while being held in the still condition. The curved line C denotes deformation took place with the rotating form roller 710 which came into contact with the doctor blade 714 generating the predetermined pressing force. As is pressed against the doctor blade 714, in which the form roller 710 has the double-layer constitution whose external surface is made of rubber material harder than that is applied to the internal layer, the deformation took place with the form roller 710 also affected the internal substance, thus in turn effectively preventing local deformation from occurrence, which otherwise normally takes place with any conventional single-layer rollers. In other words, since the deformation of the form roller 710 spreads over the entire surface of the doctor blade 714 from the pressure-applying part P in the center position, no bulge can be generated. As a result, unevenness of the thickness of the ink film formed on the surface of the form roller 710 is minimized to allow formation of ideal ink film having the thickness being uniform in the direction of the roller shaft.

Figure 19:
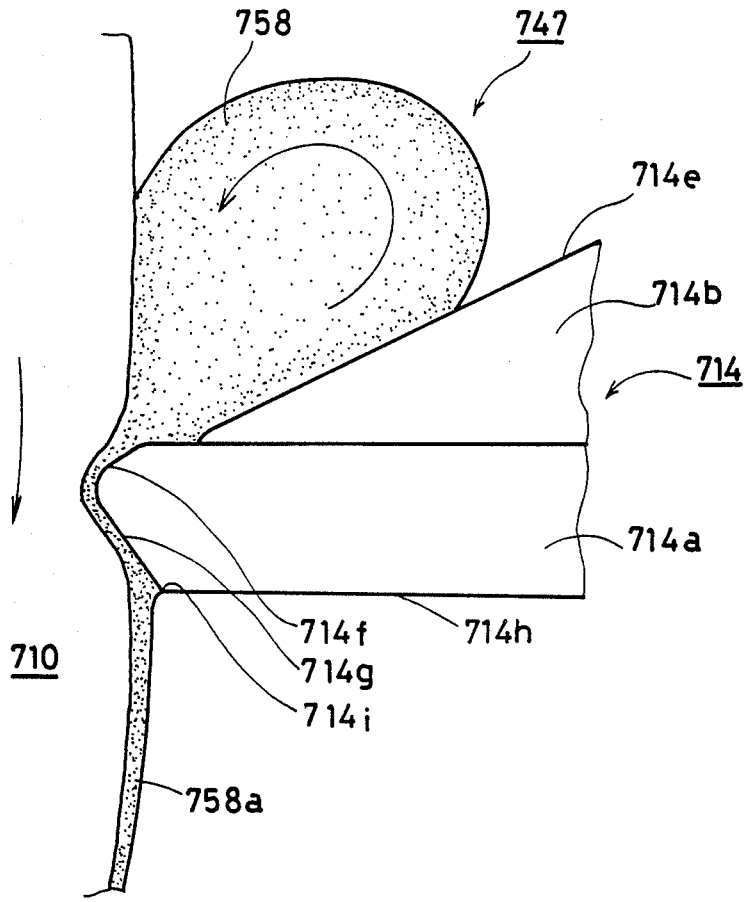
FIG. 19 denotes the functions of the form roller and the doctor blade.

On the other hand, as shown in FIG. 3(*i*), the front edge of the blade board 714*a* forms the blade-pressing part 714*f*, the ink-flow regulative part 714*g* and the ink-splitting part 714*i*, respectively. Function of the doctor blade 714 is described below. As shown in FIG. 19, when the form roller 710 is rotated in the arrowed direction with the front edge of the blade board 714*a* being pressed against the surface of the form roller 710, since the blade-pressing part 714*f* is complete with "R" finish, ink 758 stored in the ink-pooling space 747 smoothly passes through the path between the blade-pressing part 714*f* and the surface of the form roller 710 before being delivered to the ink-flow regulative part 714*g*. Next, ink 758 passes through the path between the linear ink-flow regulating part 714*g* and the surface of the form roller 710 so that the flow of ink 758 can be regulated. This results in the formation of ink film 758*a* which is uniform in the direction of the width of the form roller 710 and stable as time goes by. When ink 758 flows out of the ink-flow regulating area of the ink-flow regulating part 714*g*, the ink-splitting part 714*i* prevents ink 758 from falling down to the blade bottom side 714*h*, thus preventing ink 758 from flowing out of the doctor blade 714.

After actually executing experiments using the form roller 710, ink 758, and the blade board 714*a* in accordance with the following conditions, quite satisfactory results were produced.

(1) The double-layer form roller 710 comprised of 50° and 27° of the rubber hardness in its external and internal layers and has 80 mm of the diameter.

(2) Ink 758 provided with 500 through 3000 poise of viscosity for use with a dampening waterless plate.

(3) The blade board 714*a* shown in FIG. 3(*i*) made of specially hardened steel (HWD−2FG) having the dimensions shown below. The total height $H_1=0.6$ mm, height of the blade-pressing part 714*f* $H_2=0.2$ mm, the upper curve radius of the blade-pressing part $R_1=0.26$ mm, the front curve radius of the blade-pressing part 714*f* R2=0.12 mm, the angle $\theta_1=60°$, and angle $\theta_2=53°$.

Other data includes the following: The diameter of the form roller 710=60.5 mm, the diameter of the roller shaft 710*a*=20 mm. The internal layer 710*e* secured to the external surface of the roller shaft 710*a* is of 15 mm of the thickness, while the internal layer itself is made of nitrile rubber having 20° of hardness. The external layer 710*d* secured to the external surface of the internal layer 710*e* is of 5.25 mm of the thickness, while the external layer 710*d* is also made of nitrile rubber having 30° of hardness.

Either natural rubber, synthesis rubber, or thermoplastic high-polymer elastmer, and the like, is made available for making up the form roller 710. The composition of the form roller 710 is not limitative of these materials mentioned above. Likewise, the composition of ink 758 and the blade board 714*a* is also not limitative of those which are mentioned above.

Figure 20:
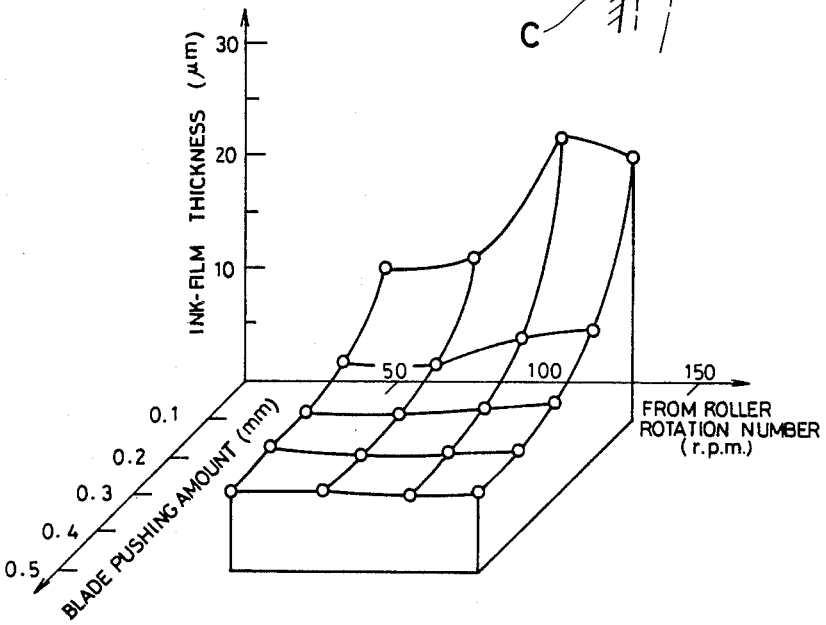
FIG. 20 is the three-dimensional chart denoting the relationship between the number of the rotation of the form roller, the pushing amount of the doctor blade, and the thickness of the ink-film applied.

FIG. 20 is the chart denoting the relationship between the number of the rotation of the form roller 710, the pushing amount of the doctor blade 714, and the thickness of the ink film shown for example. As is clear from this chart, the thickness of ink film slowly varies in the range between 5 micrometers through 10 micrometers against 0.2 through 0.5 mm of the pushing amount of the doctor blade 714, while the thickness of ink film is not substantially affected by the number of the rotation of the form roller 710. This in turn indicates that stable ink film which is easily controllable can be generated by providing the pushing amount of the doctor blade 714 within the range suggested above.

In the preferred embodiment described above, the double-layer form roller 710 is made available. However, the spirit and scope of the present invention doesn't define the use of the double-layer form roller, but it may be of any multi-layer constitution providing the external layers with specific hardness which is significantly greater than that of the internal layers.

(VII) Effect of the form-roller reverse-turn prevention mechanism

As was described earlier. in conjunction with "(1) Constitution of the inking unit", only the counterclockwise rotation force of the inking gear 717 shown in FIG. 4(*a*) is transmitted to the roller shaft 710*a* of the form roller 710, thus inhibiting the transmission of the clockwise rotation force. This makes up part of the function of the form-roller reverse-rotation preventing mechanism 718 shown in FIG. 4. As a result, when the inking gear 717 is rotated counterclockwise by means of the plate-cylinder gear 301 during the printing operation, the form roller 710 rotates counterclockwise so that the normal printing operation can be executed. Conversely, if the plate cylinder 3 is manually rotated by operators either by their carelessness or for maintenance services or inspection of the mechanism in the direction reversing the direction of the rotation needed for executing normal printing operation, the plate cylinder 3 drives the inking gear 717 clockwise via the plate-cylinder gear 301. However, when this happens, since the rotation force of the inking gear 717 cannot be transmitted to the roller shaft 710*a*, due to the pressing force from the doctor blade 714, the form roller 710 stands still. Since the mechanism 718 shown above securely inhibits the reverse turn of the form roller 710, it eventually prevents a large quantify of ink from flowing onto the plate surface.

In the preferred embodiment described above, the rachet wheel 720, the arms 723 provided with the rachet nails 723*a* and the springs 726 respectively make up the one-direction rotation-force transmission mechanism for transmitting the counterclockwise rotation force of the inking gear 717 to the roller shaft 710*a* as well as for inhibiting transmission of the clockwise rotation force. Needless to say that the one-direction rotation-force transmission mechanism is not always comprised of those mechanical components mentioned above. The form-roller reverse-rotation preventing mechanism can also be applied not only to the printing press using the doctor blade related to this embodiment, but it is also effectively made available for the printing press using reverse rollers.

(VIII) Effect of the mechanism for feeding and releasing pressing force to and from the ink distributing roller The function of the mechanism for feeding and releasing pressing force to and from the ink distributing rollers 711 and 712 shown in FIG. 3 is already explained in the preceding descriptions "(1) Constitution of the inking unit" and "(b) Operation needed for mounting the inking unit", respectively. When the inking unit 7 is mounted onto the printing press body 1, the operation levers 742 provided on both sides of the inking unit 7 are respectively pressed by the springs 106 and 108 so that they can be rotated in the counterclockwise direction in FIG. 11(*a*) by falling themselves. As a result, the ink distributing rollers 711 and 712 are respectively pressed against the form roller 710 at a specific pressure via the link mechanism described earlier. This causes the thickness of ink film on the form roller 710 to be uniformly levelled by the ink distributing rollers 711 and 712 during the printing operation. When the inking unit 7 is removed from the printing press body 1 after completing the printing operation, the pressure applied to the operation levers 742 from the springs 106 and 108 is cancelled, thus causing the ink distributing rollers 711 and 712 to be brought back to the original positions by the elastic force from rubber so that the pressure from these ink distributing rollers 711 and 712 against the form roller 710 is cancelled. As a result, even when the inking unit 7 is laid off for some while in the state mentioned above, the form roller 710 is prevented from incurring deformation permanently.

Consequently, the mechanism for feeding and discharging pressure to and from the ink distributing rollers 711 and 712 causes both rollers 711 and 712 to automatically come into contact with and leave the form roller 710 in conjunction with the mounting and removal operations of the inking unit 7 onto and from the printing press body 1. This eventually allows operators to dispense with those operations for causing the ink distributing rollers 711 and 712 to come into contact with or leave the form roller 710 automatically, thus making it possible for the operators to simplify the entire operations.

The preferred embodiment described above makes up the roller operating mechanism for causing the ink distributing rollers 711 and 712 to come into contact with the form roller 710 using the link mechanism comprised of the operation lever 742 and the links 740 and 741. However, the roller-operating mechanism may also be made up with any mechanical parts other than those which are described above. Likewise, any means other than the springs 106 and 108 may also be used for making up the mechanical parts operating the roller-operating mechanism.

(IX) Effect of the shaft-to-shaft distance regulating member

Function of the shaft-to-shaft distance regulating member 305 shown in FIG. 7 is described below. As was described earlier in the preceding section "(I) Operation for causing inking unit to come into contact with and leave the plate cylinder", when the form roller 710 and the auxiliary form roller 713 are brought into contact with the plate cylinder 3 by rotating the inking unit 7 pivoting the bolt 112 via the lever 118 towards the plate cylinder 3, the shaft-to-shaft distance regulating bearings 719 of the inking unit 7 are engaged with the bearing-locking concaves 305*a* of the shaft-to-shaft distance regulating members 305. This allows the distance between the roller shaft 710*a* of the form roller 710 and the plate-cylinder holding shaft 302 to remain constant. As a result, it is possible for the system to keep the contact pressure, i.e., the nipping width, between the form roller 710, the auxiliary form roller 713, against the plate cylinder 3 can be held at an optimum value for transferring ink during the printing operation. Since the auxiliary form roller 713 executes the same function as the main form roller 710, the following description refers only to the function of the main form roller 710.

The shaft-to-shaft distance regulating member 305 directly regulates the distance between the roller shaft 710*a* of the form roller 710 and the plate-cylinder supporting shaft 302. As a result, the contact pressure between the form roller 710 and the plate cylinder 3 can be held constant without being affected by the timing needed for the contact and departure operations executed between the plate cylinder 3 and the form rolelr 710. For example, to effectively control the ink concentration when either starting with or completing the printing operation, even when thoese operations mentioned below are executed, like the case of executing normal printing operation, the shaft-to-shaft distance regulating member 305 allows the contact pressure between the form roller 710 and the plate cylinder 3 to remain constant. These operations include such cases in which the plate cylinder 3 is brought into contact with and departs from the blanket cylinder 2 while the form roller 710 remains in contact with the plate cylinder 3, or the form roller 710 is brought into contact with and/or departs from the plate cylinder 3 which remains in contact with the blanket cylinder 2, or the form roller 710 is brought into contact with and/or departs from the plate cylinder 3 which is apart from the blanket cylinder 2. Consequently, it is possible for the printing system to satisfactorily transfer ink onto the surface of the printing plate, thus significantly improving the printing performances.

It should be noted that the preferred embodiment doesn't define the constitution of the shaft-to-shaft distance regulating member 305 described above, but it may be of any mechanical parts that are capable of maintaining the contact pressure between the form roller 710 and the plate cylinder 3 constant.

(X) Function of ink distributing rollers

As was described earlier in the preceding section "(1) Constitution of the inking unit", surfaces of the ink distributing rollers 711 and 712 are respectively provided with smoothly finished minimal concaves and convexes via the blast step using the spherical beads. Since the surfaces of the ink distributing rollers 711 and 712 are respectively provided with fine concaves and convexes, even when the impurities such as paper dust, atmospheric dust, or uneven ink components for example, are present in the prepared ink, when the ink distributing rollers 711 and 712 respectively oscillate in the direction of the roller shaft, due to the presence of fine concaves and convexes on the surface of the ink distributing rollers 711 and 712, the impurities are evenly disposed in the direction of the roller shaft, i.e., in the direction of the width, thus forming a smooth ink film uniform in the direction of the width throughout the surface of the form roller 710 to allow the printing operation to be satisfactorily done using ink concentration which is uniform in the direction of the width of the form roller 710. Furthermore, since the surfaces of the ink distributing rollers 711 and 712 are provided with fine concaves and convexes which are smoothly finished with blast process using the spherical beads, surface of the rubber-made form roller 710 is free from incurring damage, and thus no trace of the damage will present on the printing matters.

Figure 21:
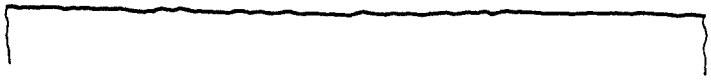
FIGS. 21 through 23 respectively denote the typical patterns of the surface condition of the ink-distributing roller.
Figure 22:
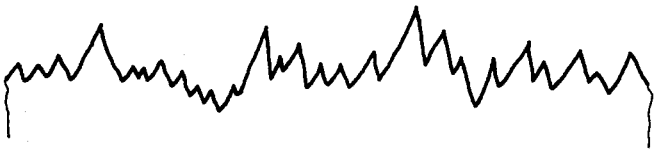
Figure 23:
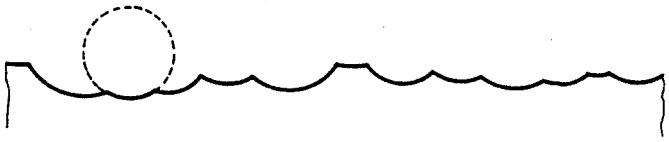
Figure 24:
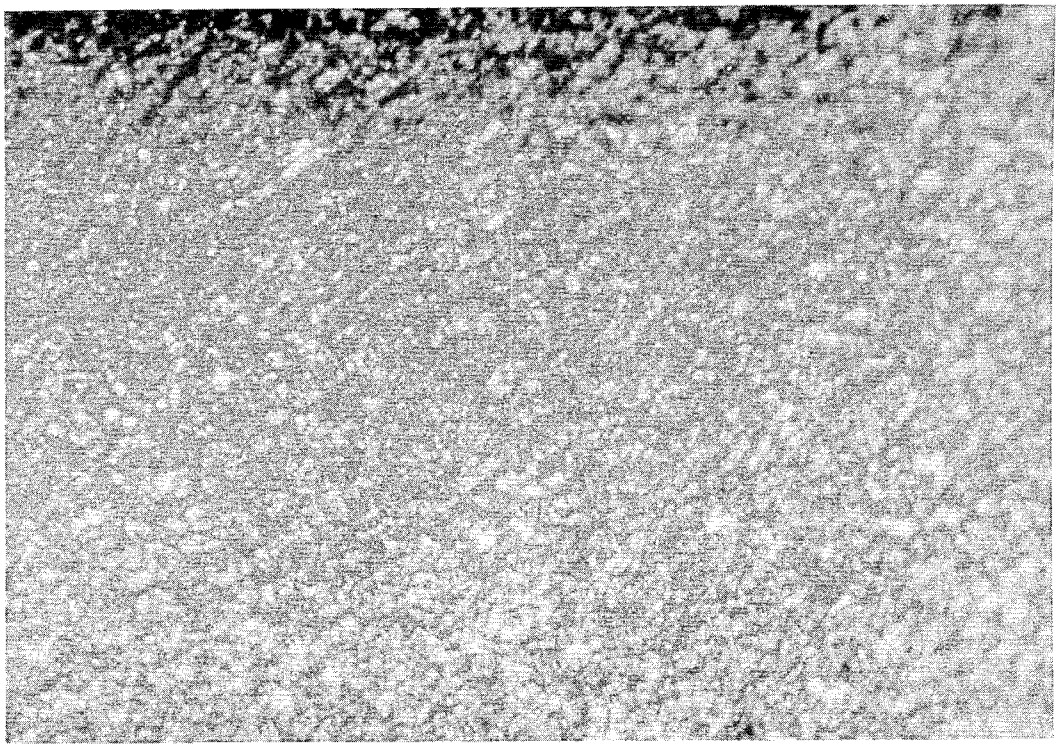
FIGS. 24 and 25 respectively denote actual surface conditions of the ink distributing roller.
Figure 25:
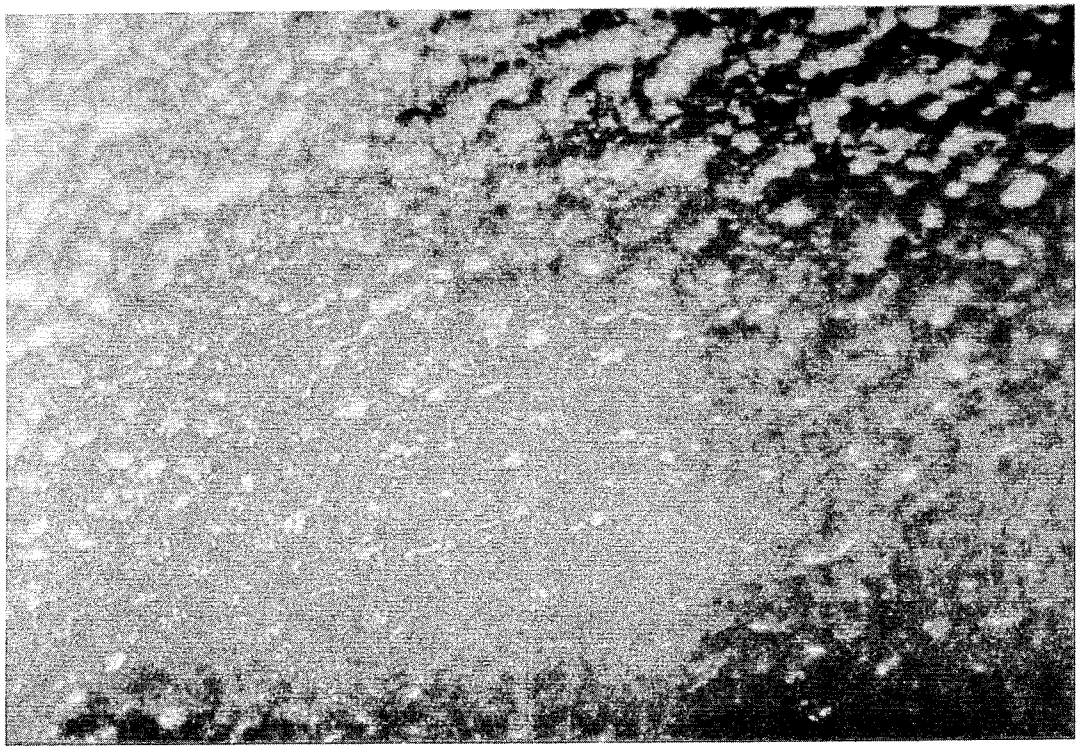

FIGS. 21 through 23 are respectively the sectional views of the surfaces of the ink-distributing rollers 711 and 712, which are shown in the style of pattern. Of these, FIG. 21 denotes the surface of a conventional ink distributing roller whose surface is smoothly finished by mechanical means. FIG. 22 denotes the surface of the ink-distributing roller whose surface is alundum by being blast-finished using the particles having sharp peak angles each other. FIG. 23 denotes the surface of the ink distributing roller according to the preferred embodiment of the present invention, which is provided with smoothly finished fine concaves and convexes via blast step using the spherical glass beads without sharp angles. FIGS. 24 and 25 respectively denote the state of the surface of the ink distributing roller. Of these, FIG. 24 denotes the surface of the ink distributing roller whose surface is alundumly finished by blast step using the particles each having sharp peak-angles having 210 micrometers of diameter. FIG. 24 corresponds to FIG. 22. FIG. 25 denotes the surface of the ink distributing roller whose surface is provided with smoothly finished fine concaves and convexes via blast step using the spherical glass beads each having 350 micrometers of diameter. FIG. 25 corresponds to FIG. 23.

According to the experiments, when applying the conventional ink distributing roller shown in FIG. 21, the presence of the impurities in ink didn't make the thickness of the ink film uniform in the direction of the width of the tested roller. Conversely, when applying those ink distributing rollers shown for the comparative examples in FIGS. 22 and 24, independent of the presence and absence of the impurities in ink, the thickness of the ink film was uniformly disposed in the direction of the roller width. However, surfaces of both ink distributing rollers incurred damage. On the other hand, when applying the ink distributing rollers shown in FIGS. 23 and 25, independent of the presence and absence of the impurities in ink, the thickness of the ink film was uniformly disposed in the direction of the roller width, and yet, the surfaces of these ink distributing rollers were free from incurring damage.

Also, according to the experiments, the most ideal result was achieved by applying the stainless-steel made the ink distributing roller which was blast-steped using the spherical glass beads each having 350 micrometers diameter. It should be noted however that the materials of the ink distributing roller and the spherical beads and the particle diameters are not limitative of those which are cited above. Likewise, the number of the ink distributing rollers is not limitative of two pieces employed for the preferred embodiment described above, but the number may be one piece or more than three pieces as required.

(XI) Remaining ink detection mechanism

Figure 26:
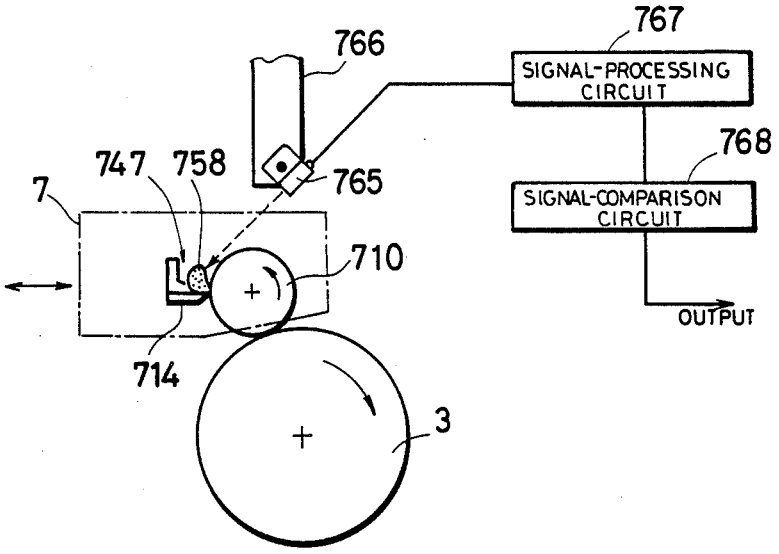
FIG. 26 is a simplified block diagram of the mechanism for detecting remaining ink amount.

The multicolor printing press related to the present invention incorporates a mechanism for automatically detecting ink amount remaining in the inking units 7, 8. FIG. 26 is the simplified block diagram of the remaining ink detection system of the inking unit 7. Since the inking unit 8 is provided with the remaining ink detection system identical to that of the inking unit 7, descriptin of which is deleted. As shown in FIG. 26, a reflective photoelectric sensor 765 (which substantially corresponds to sensor switch 26 of FIG. 2) is installed to the frame 766 of the printing press body 1 so that it detects ink remaining inside of the inking unit 7. The reflective photoelectric sensor 765 is comprised of light-projector and light-receiver which are integrally combined together. When the inking unit 7 is set to the predetermined position, the focus of the reflective photo-electric sensor 765 correctly detects ink 758 inside of the ink-pooling space 747 at the position preliminarily set.

The output signal from the photoelectric sensor 765 containing the electric signal related to varied amount of ink is then delivered to the signal-processing circuit 767 which substantially corresponds to the microprocessor 21 of FIG. 2. The signal-processing circuit 767 processes the signal from the photoelectric sensor 765 so that it can be converted into the signal corresponding to the varied amount of ink for facilitating the ensuing signal-comparison process. The signal processed in the signal-processing circuit 767 is delivered to the signal-comparison circuit 768 which substantially corresponds to the microprocessor 21 of FIG. 2. The signal-comparison circuit 768 compares the signal from the signal-processing circuit 767 to the predetermined detection level (voltage), and if the signal is below the detection level, i.e., if the remaining amount of ink is less than the predetermined value, the signal comparison-circuit 768 outputs a signal advising the system of this result. This output signal is then delivered to the alarm-driving circuit (corresponding to the output controller 23 shown in FIG. 2) for example for activating alarm unit which substantially corresponds to motor/-solenoid 28 of FIG. 2 so that alarm sound can be generated to warn the operators that the remaining amount of ink is less than the specific level.

Figure 27:
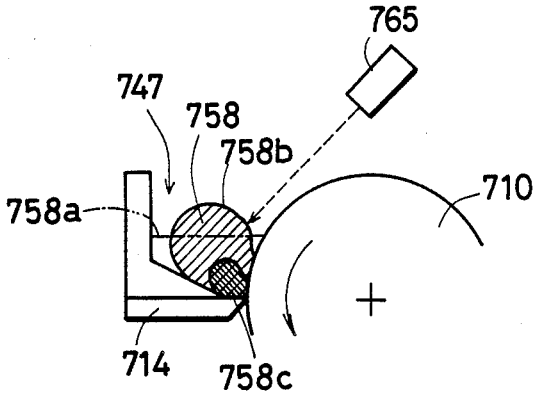
FIG. 27 denotes the relationship between the flow movement of ink and a sensor.

FIG. 27 denotes the relationship between the flowing movement of ink 758 and the photoelectric sensor 765 while the printing operation is laid off and underway. Referring now to FIG. 27, the movement of ink 758 in the ink-pooling space 747 is described below. While the printing operation is laid off, i.e., while the rotation ofthe form roller 710 stops, as shown by the reference numeral 758*a* denoting horizontal broken line, the upper surface of ink 758 is horizontal. When the printing operation is underway, i.e., while the form roller 710 rotates, due to viscosity of ink itself, ink 758 also rotates following the rotation of the form roller 710 before becoming the bar-like shape which remains unchanged even when the amount of ink is reduced to a negligible level. The reference numeral 758*b* denotes the bar-like shape when a large amount of ink is present, whereas the reference numeral 758*c* denotes the bar-like shape when a small amout of ink is present, respectively.

Figure 28:
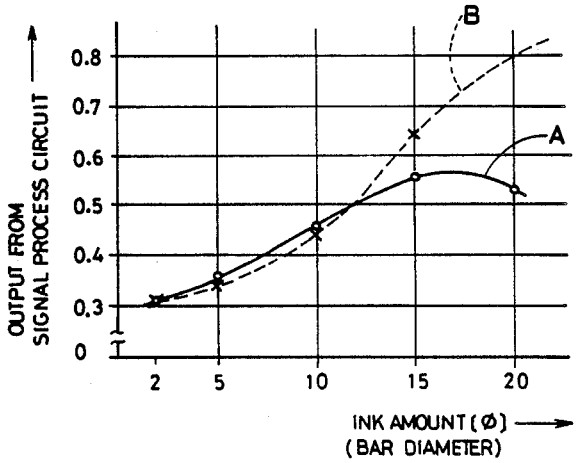
FIG. 28 is a chart denoting the relationship between variation of the ink amount and the output voltage from a signal-processing circuit.

FIG. 28 is the graphical chart denoting the variable signal output from the signal processing circuit 767 of FIG. 26 in response to the variable amount of ink stored in the ink-pooling space 747. The curved line A denotes characteristics while the printing operation is laid off, whereas the curved line B denotes characteristics while the printing operation is underway. The amount of ink is denoted in terms of the diameter of the bar-like ink while the printing operation is underway.

The curved line B shows its curve in FIG. 28 on the following grounds. When there is a sufficient amount of ink, the light projected from the sensor 765 reflects against the ink surface, thus causing majority of the reflected light (diffusion light) to be back to the light-receiver of the photoelectric sensor 765, which is then detected by this sensor 765. Conversely, when the amount of ink decreases, the direction of reflection on the ink surface varies, thus causing the amount of light received by the sensor 765 gradually decreases. When ink 758 completely exhausts, the light projected from the sensor 765 is no longer reflected against the ink surface, but it is then reflected fromthe metal surface of the doctor blade 714. This light reflected from the metal surface of the doctor blade 714 is reflected to a position where the photoelectric sensor 765 cannot receive it by large part. As a result, the output voltage from the signal-processing circuit 767 gradually lowers relative to the decreased amount of ink while the printing operation is underway, and finally the output voltage becomes the characteristic B shown in FIG. 28.

If an optimum voltage value made available for detection level of the signal-comparison circuit 768 shown in FIG. 26 is provided, the amount of ink corresponding to the voltage value shown in FIG. 28 can be detected. For example, when setting 0.35 V for the voltage detection level of the signal-comparison circuit 768, about 5 mm $\phi$ of the ink amount corresponding to 0.35 V of the voltage output form the signal-processing circuit 767 shown in FIG. 28 is determined. Concretely, if the ink amount decreases below this value, the signal-comparison circuit 768 output the signal for generating alarm sound warning the operators that the remaining amount of ink is less than the designated level. If any value other than 0.5 mm $\phi$ should be set, an specific voltage value corresponding to the desired ink amount may be set as the detection level of the signal-comparison circuit 768.

On the other hand, as shown in FIG. 27, since the ink surface 758*a* is flat while the printing operation is inactivated, the light reflecting direction on the ink surface is different from that is shown durign the printing operation. When this condition arises, the characteristics of the signal from the signal-processing circuit 767 dealing with varied ink amount becomes as shown by curved line A of FIG. 28. Although the characteristic curve A doesn't match the characteristic curve B, it is close to the curve B while the ink amount remains negligible. As a result, even when the printing operation is laid off, as in the case of the activated printing operation, the remaining amount of ink can be detected. Concretely, if the remaining amount of ink is less than the predetermined value, a level-detection signal is output from the signal-comparison circuit 768 to eventually generate alarm sound for warning the operators that the amount of ink is less than the designated level.

The photoelectric sensor 765 for detecting the remaining amount of ink is installed to the printing press body 1, it is not necessary to also install the sensors to the inking units 7 and 8, thus reducing cost. Even when replacing inking units 7 or 8, since the photoelectric sensor 765 commonly made available for either of these inking units 7 or 8 correctly detects the remaining amount of ink inside of inking unit 7 or 8, the system can stably detect the remaining amount of ink any time. In addition, since the photoelectric sensor 765 is installed to the printing press body 1, the presence of this sensor 765 doesn't disturb cleaning of the inking unit 7 or 8. This allows operators to easily clean the inking unit 7 or 8. Furthermore, since the photoelectric sensor 765 is free from coming into contact with any adjacent parts, the presence of this sensor 765 doesn't adversely affect the ink distribution inside of the ink-pooling space 747, thus ensuring satisfactory printing performances.

Note that the above preferred embodiment uses the photoelectric sensor 765, however, the present invention doesn't define the use of the photoelectric sensor 765, but it may be of any sensor means which is free from coming into contact with adjacent parts and capable of correctly detecting the remaining amount of ink.

C. Plate feeding and discharging mechanism

(1) Constitution and installation of a plate-feeding/discharging unit

(I) Constitution of a plate feeding/discharging unit

Figure 29:
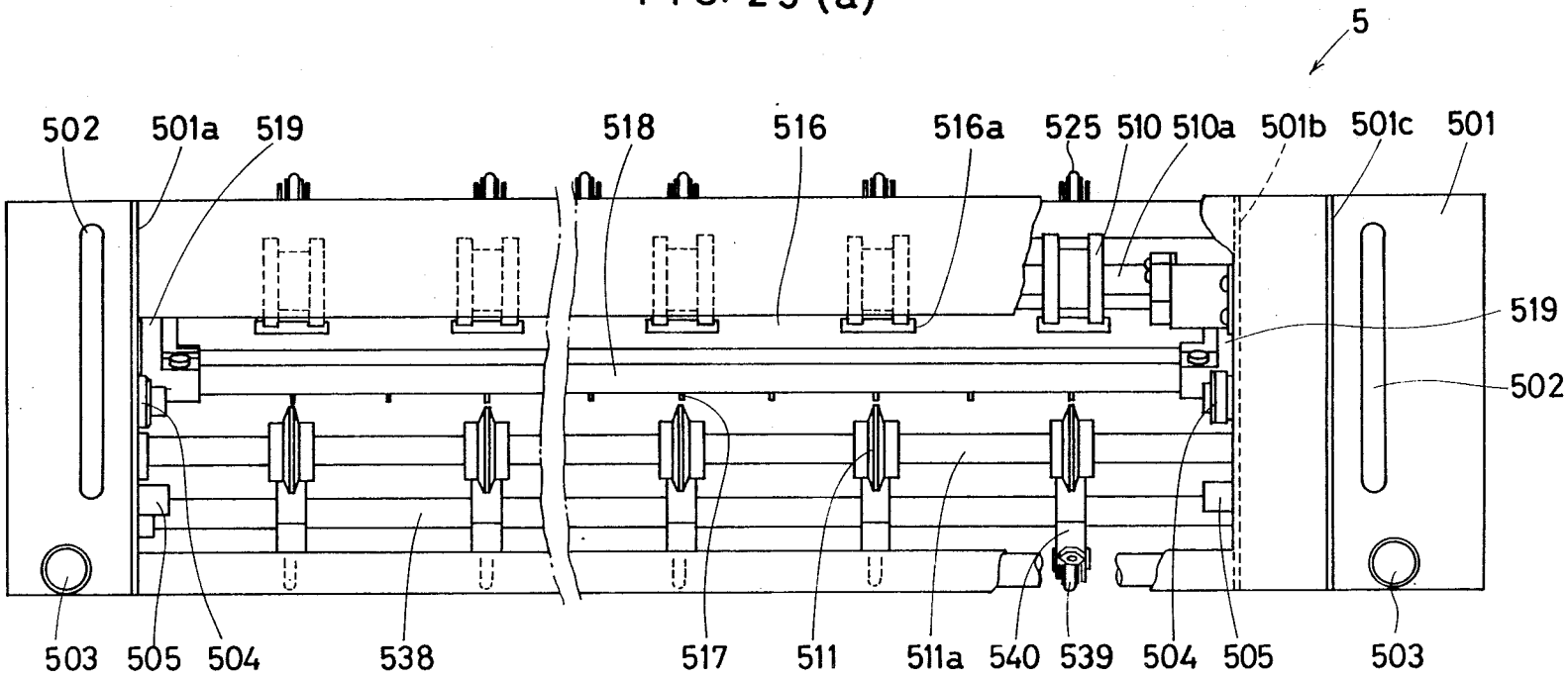
FIGS. 29(*a*) through (*e*) are respectively the diagrams denoting the constitution of a plate feeding/discharging unit.
Figure 29:
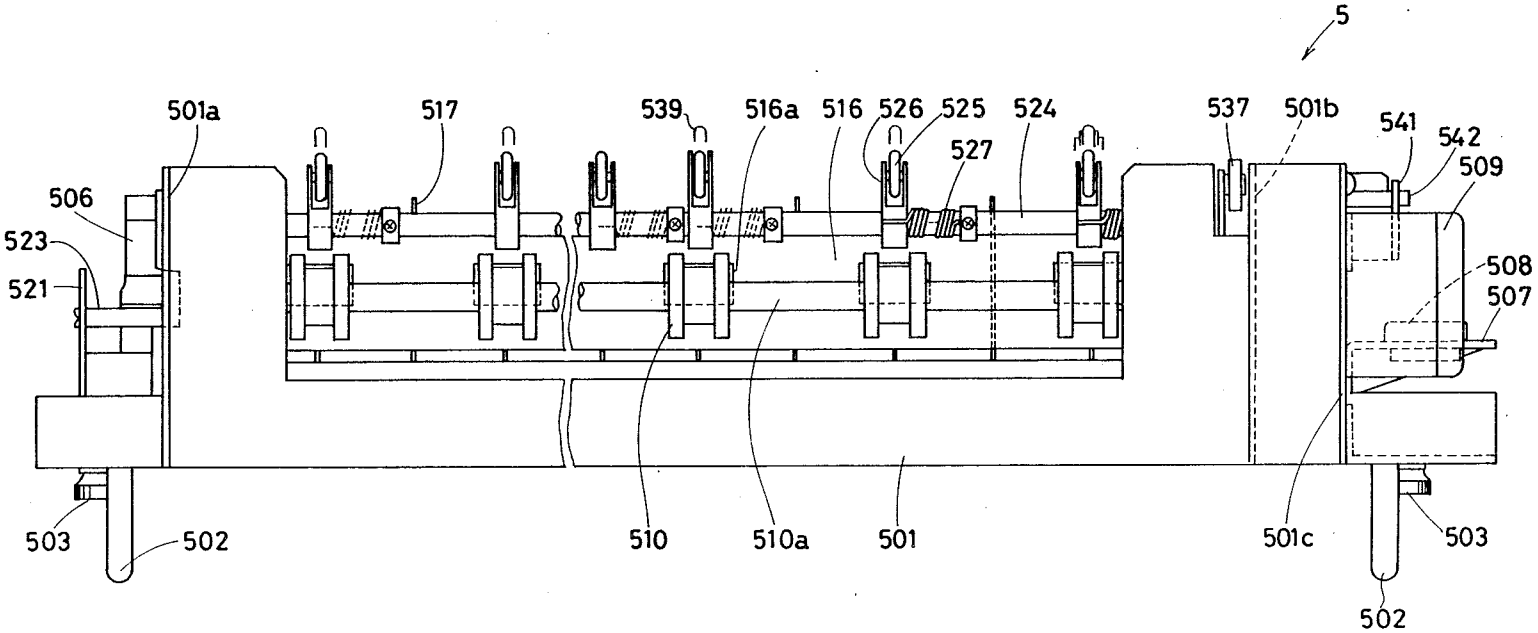
Figure 29C:
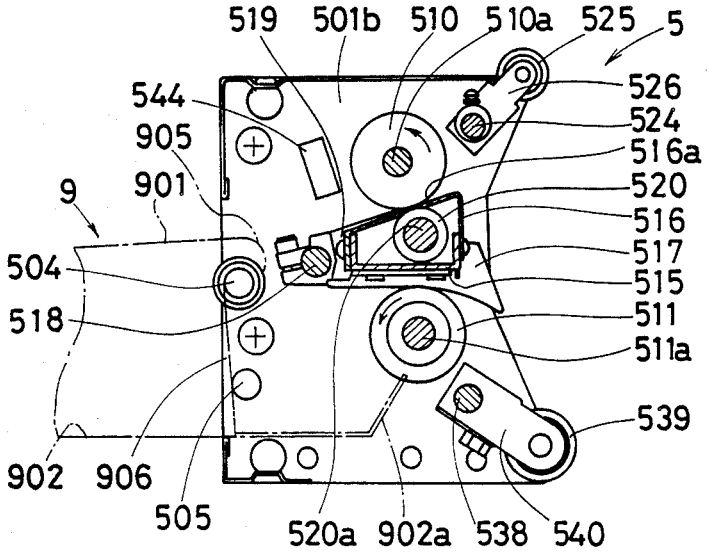
Figure 29D:
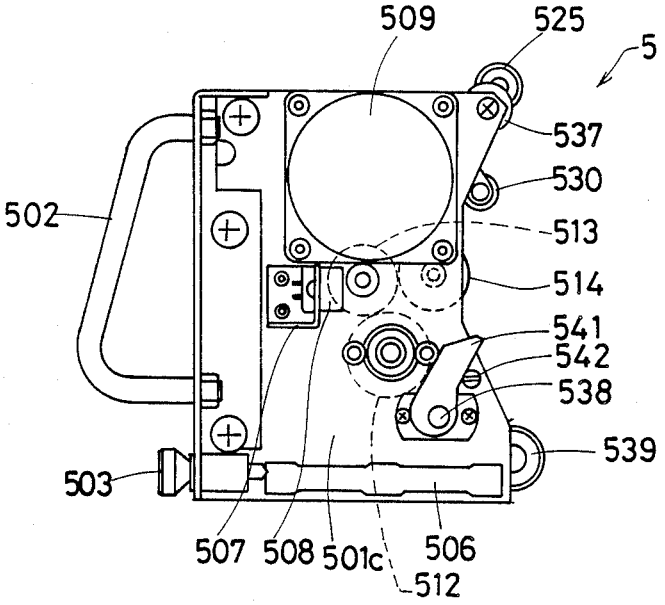
Figure 29:
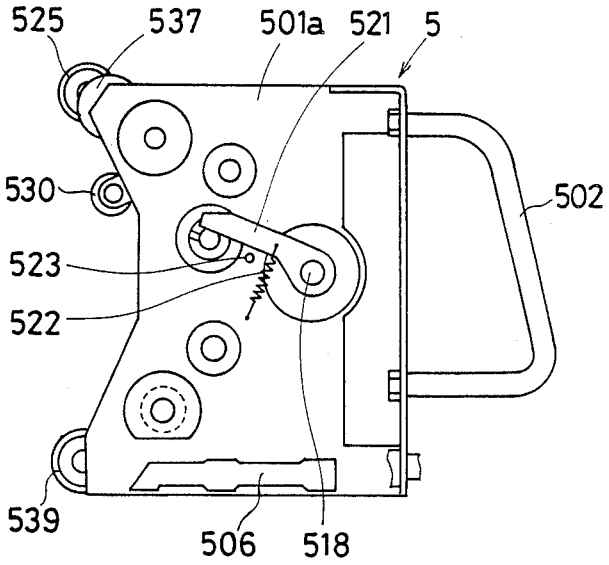

FIG. 29 denotes a plate-feeding/discharging unit. FIG. 29 (*a*) is the front view of the plate feeding/discharging unit. FIG. 29 (*b*) is a plain view, (*c*) is a sectional view, (*d*) is a right lateral view, and (*e*) is a left lateral view, respectively.

The plate feeding/discharging unit 5 is provided with a unit-frame 501 having frame constitution, while this unit-frame 501 is provided with handles 502 and unit-securing screws 503 on both sides of a front surface. In addition, the unit-frame 501 is also provided with left-side board 501*a* and right-partition board 501*b*, which are respectively provided with an engaging pin 504 and a positioning pin 505 for mounting a plate feeding/discharging tray 9 shown in FIG. 1. Unit-installation rails 506 are respectively set to the bottom part of external lateral surfaces of the left-side board 501*a* and the right-side board 501*c*. The external surface of the right-side board 501*c* are provided with connector 508 via installation metal 507 and pulse motor 509 for activating plate-feeding operation, while the pulse motor 509 and the connector 508 are electrically connected to each other via cables (not shown).

The plate-feeding driving rollers 510 and the plate-discharging driving rollers 511 are installed between the left-side board 501*b* and the right-partition board 501*a* of the unit-frame 501. A right end of a roller shaft 510*a* of the plate-feeding driving roller 510 is connected to said pulse motor 509 via shaft-coupling means (not shown). When activating the plate-feeding operation, the plate-feeding driving rollers 510 are driven by said pulse motor 509 so that it rotates counterclockwise as shown in FIG. 29 (*c*). A right-end of shaft 511*a* of the plate-discharging driving rollers 511 extends itself to a position between the right-partition board 501*b* and the right-side board 501*c*, while a gear 512 shown in FIG. 29 (*d*) is installed to the extended right-end of shaft 511*a*. The gear 512 is connected to driving gear 514 via gear 513 installed between the right-partition board 501*b* and the right-side board 501*c*. The driving gear 514 engages with a plate-cyliner gear 301 shown in FIG. 35(*a*) when a plate-feeding/discharging unit 5 is installed to the printing press body 1, thus allowing the plate-discharging driving rollers 511 to rotate counterclockwise as shown in FIG. 29(*c*) in accordance with the rotation of a plate cylinder 3 while feeding or discharging plate.

A supporting metal 515 is set between the left-side board 501*a* and the right-partition board 501*b* in the area between the plate-feeding driving rollers 510 and the plate-discharging driving rollers 511. The plate-feeding start-up board 516 is mounted onto the upper surface of the supporting metal 515, whereas a plate-discharging guide 517 is set to the bottom surface of the supporting metal 515. The plate-feeding start-up board 516*a* is provided with apertures 516 that allow passage of the incoming and outgoing plate-feeding driving rollers 510 in the position corresponding to these driving rollers 510.

A driving shaft 518 capable of freely rotating itself is installed between the left-side board 501*a* and the right-partition board 501*b* in front of the plate-feeding start-up board 516. Supportig arms 519 are set to both ends of the driving shaft 518, whereas auxiliary plate-feeding driving rollers 520 capable of freely rotating themselves are installed between the tip-ends of these supporting arms 519. Operation lever 521 is installed to the left-end of the driving shaft 518 as shown in FIG. 29 (*e*). When the operation lever 521 is operated for causing the supporting arms 519 to be rotated in the clockwise or counterclockwise direction pivoting the driving shaft 518, the auxiliary plate-feeding driving rollers 520 are then driven so that these either come into contact with or depart from the plate-feeding driving roller 510 via apertures 516*a* which allows the incoming and outgoing movement of the auxiliary plate-feeding driving rollers 520. The operation lever 521 is energized by a spring 522 shown in FIG. 29 (*e*) so that the operation lever itself can rotate counterclockwise. More particularly, the auxiliary plate-feeding driving rollers 520 are rotated in the direction of departing from the plate-feeding driving rollers 510. The rotary movement of the operation lever 521 is eventually stopped by stopper pin 523 on the external surface of the left-side board 501*a*, and as a result, the movement of the operation lever 521 is effectively regulated. The operation lever 521 is driven in conjunction with the activated operation of solenoid (to be described later on) provided for the printing press body 1. When this solenoid is activated, the operation lever 521 causes the auxiliary plate-feeding driving rollers 520 to come into contact with the plate-feeding driving rollers 510 so that a printing plate can securely be nipped by the driving rollers 510 and 520 to eventually allow the plate-feeding operation to be started. The auxiliary plate-feeding driving rollers 520 cause gear (not shown) set to the left end of own shaft 520*a* to be engaged with gear (not shown) set to the left end of the plate-feeding driving roller shaft 510*a*. As a result, when plate-feeding driving rollers 510 are rotated counterclockwise as shown in FIG. 29 (*c*) while the plate feeding operation is underway, the auxiliary plate-feeding driving rollers 520 are driven clockwise at the same rotating speed as that of the plate-feeding driving roller 510 to eventually allow the printing plate nipped between the both rollers 510 and 520 to be forwarded in the direction of the plate cylinder, i.e., to the right of FIG. 29 (*c*).

A rotary shaft 524 capable of freely rotating itself is set to the upper rear portion of the unit-frame 501 and between the left-side board 501*a* and the right-partition board 501*b*. A roller-supporting arm 526 latching plate-holding rollers 525 is installed to a rotary shaft 524. The roller supporting arm 526 is energized by torsion coil spring 527 shown in FIG. 29 (*b*) set to the rotary shaft 524 so that the roller supporting arm 526 can be rotated clockwise, i.e., in the direction of pressing the printing plate, while the clockwise rotation of the roller supporting arm 526 is regulated by a stopper mechanism (not shown) at an adequate position.

Figure 30:
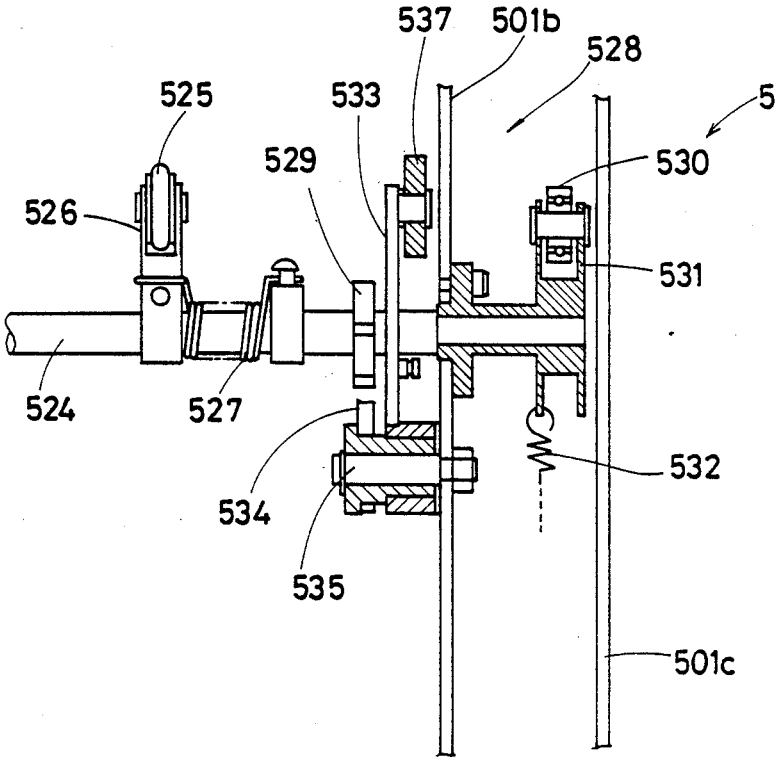
FIGS. 30(*a*) and (*b*) are respectively the diagrams denoting the constitution of the lock mechanism of a plate holding rollers.
Figure 30:
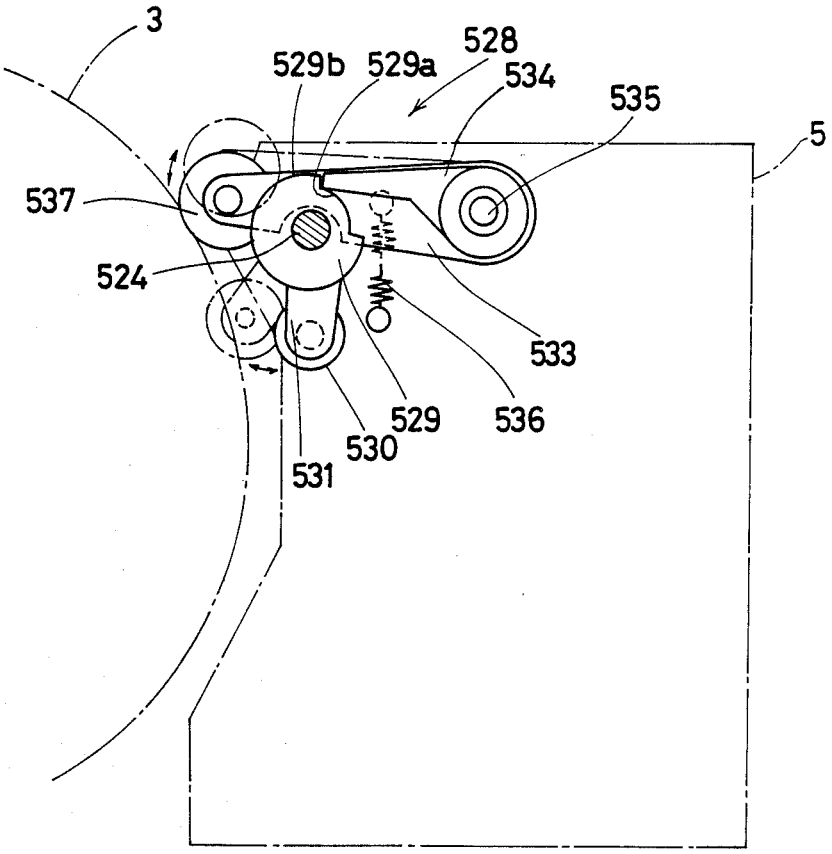

A locking mechanism 528 locking the plate-holding rollers 525 at the designated plate-holding position is installed to the right-end of the rotary shaft 524 as shown in FIG. 30(*a*). The locking mechanism 528 secures the latchet wheel 529 having coupling concave 529(*a*) along the external circumference of the wheel to the rotary shaft 524. Likewise, the locking mechanism 528 secures the plate-holding activation arm 531 to the rotary shaft 524. The plate-holding activation arm 531 freely rotates itself in the range designated by broken line and solid line shown in FIG. 30 (*b*). In addition,the plate-holding activation arm 531 is energized by spring 532 shown in FIG. 30 (*a*) so that it can rotate clockwise as shown in FIG. 30 (*b*). When the arm 531 rotates clockwise, it causes the plate-holding roller 525 to leave the plate cylinder 3 via the rotary shaft 524. On the other hand, an unlocking arm 533 provided with an unlocking roller 537 at its tip end and a latchet 534 are secured to shaft 535 set to the right-partition board 501*b* in the state of integrally being connected to each other so that the integrated unit can freely rotate itself and be rotated counterclockwise by the force energized by a spring 536 as shown in FIG. 30 (*b*). As a result, the tip end of the latchet 534 is pressed against a specific area ranging from the external circumference 529*b* of the latchet wheel 529 to the concave 529*a* so that the tip end of the latchet 534 can freely slide inside of this area.

Next, operation of the locking mechanism 528 is described below. When the plate-holding activation roller 530 is rotated in the counterclockwise direction (see FIG. 30(*b*)) by the plate-holding roller cam 356 shown in FIG. 44 (details will be described later on) set to the plate cylinder 3, the rotary shaft 524 also rotates counterclockwise, thus allowing the plate-holding rollers 525 to be set to the designated plate-holding position. Simultaneously, the latchet wheel 529 also rotates counterclockwise, thus causing the tip end of latchet 534 to move from the external circumference 529*b* of the latchet wheel 529 to the concave 529*a*. When the tip end of latchet 534 reaches the concave 529*a*, due to energized force given by spring 536, the tip end of the latchet 534 falls into the concave 529*a* to stop its movement. As a result, the latchet wheel 529 is prevented from rotating clockwise by the energized force from the spring 532, and thus the plate-holding roller 525 is latched at the plate-holding position. The locked mechanism is released when an unlocking cam 306 (see FIG. 20(*b*)) set to the plate cylinder 3 kicks an unlocking roller 537 upwards. When the unlocking roller 537 is kicked upwards, the unlocking arm 533 rotates clockwise pivoting the shaft 535 as shown in FIG. 30 (*b*). This causes the latchet 534 to also rotate clockwise to disengage the latchet 534 from the concave 529*a*. As a result, due to the energized force from the spring 532, the latchet wheel 529 rotates clockwise together with the rotary shaft 524 and the plate-holding activation arm 531 as shown in FIG. 30 (*b*), thus allowing the plate-holding rollers 525 to return to the original position apart from the plate cylinder 3.

Referring again to FIG. 29, a rotary shaft 538 capable of freely rotating itself is installed to a specific position between the left-side board 501*a* and the right-partition board 501*b* in the lower rear end of the unit-frame 501. A supporting arm 540 that latches the plate-holding rollers 539 are secured to the rotary shaft 538. Due to the energized force from spring means (not shown), the rotary shaft 538 is compulsorily moved in the clockwise direction, i.e., in the direction in which the plate-holding rollers 539 leave the plate cylinder 3 as shown in FIG. 29 (*c*). An operation lever 541 is installed to the right end of the rotary shaft 538 as shown in FIG. 29 (*d*). A stopper pin 542 constraining the clockwise rotation of the operation lever 541 is installed to the external surface of the right-side board 501*c*. When the operation lever 541 is held by the stopper pin 542, the plate-holding rollers 539 are in a position apart from the plate cylinder 3. In conjunction with the activation of solenoid (to be described later on) provided for the printing press body 1, the operation lever 541 is rotated counterclockwise as shown in FIG. 29 (*d*) before eventually being set to a rotating position where the operation lever 541 correctly presses the plate-holding rollers 539 against the plate cylinder 3.

In addition, a sensor 544 for detecting the presence of the printing plate is installed to the upper part of the supporting arm 519 as shown in FIG. 29 (*c*), while the sensor 544 is substantially made of reflective photoelectric sensor means.

Figure 31:
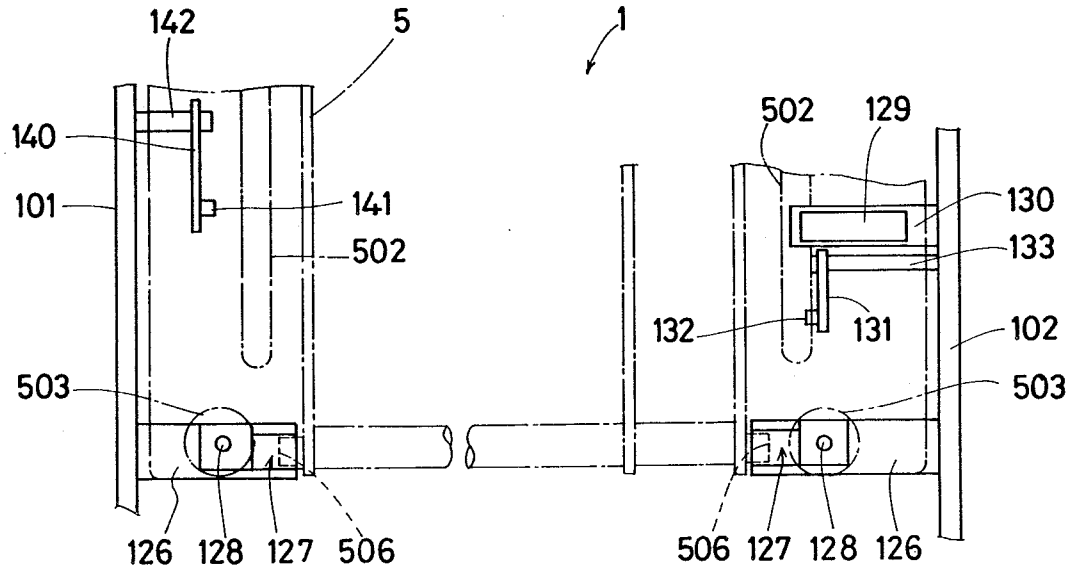
FIGS. 31(*a*) and (*b*) are respectively the diagrams denoting the condition of the plate feeding/discharging unit mounted onto the printing press.
Figure 31B:
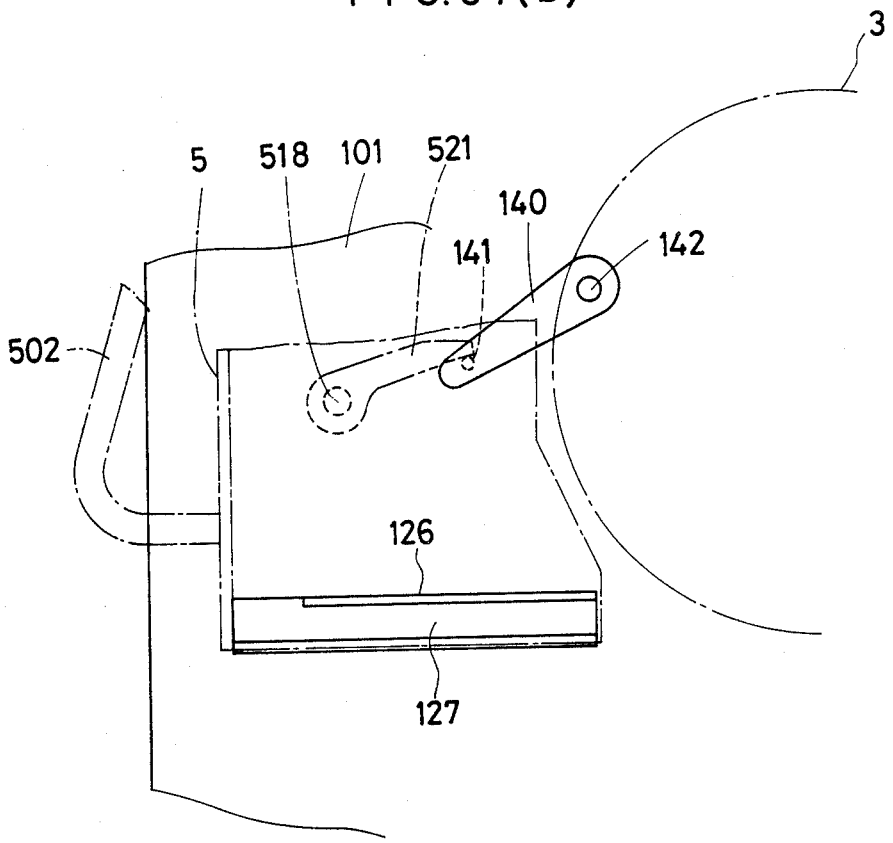

(II) Constitution of component parts allowing installation of the plate feeding/discharging unit Next, a constitution of the component parts allowing the installation of the plate feeding/discharging unit 5 is described below. FIG. 31 (*a*) is a diagram denoting the rear constitution of the printing press body 1, whereas FIG. 31 (*b*) is the internal constitution of the left-side board 101 shown in FIG. 31 (*a*).

As shown here, a pair of the rail-receiving members 126 are secured to the internal surfaces of the left-side board 101 and the right-side board 102. The internal surface of the rail-receiving members 126 are respectively provided with rail-coupling grooves 127 which horizontally extend themselves from the back portion of the printing press towards the portion of this printing press. Screw holes 128 are provided for the front surface of these rail-receiving members 126.

A connector 129 is set to the right-side board 102 via a fixing metal 130 in the upper front position of the right-side rail-receiving member 126. The connector 129 is connected to microprocessor 21 via the control parts 23 shown in FIG. 2.

Figure 33:
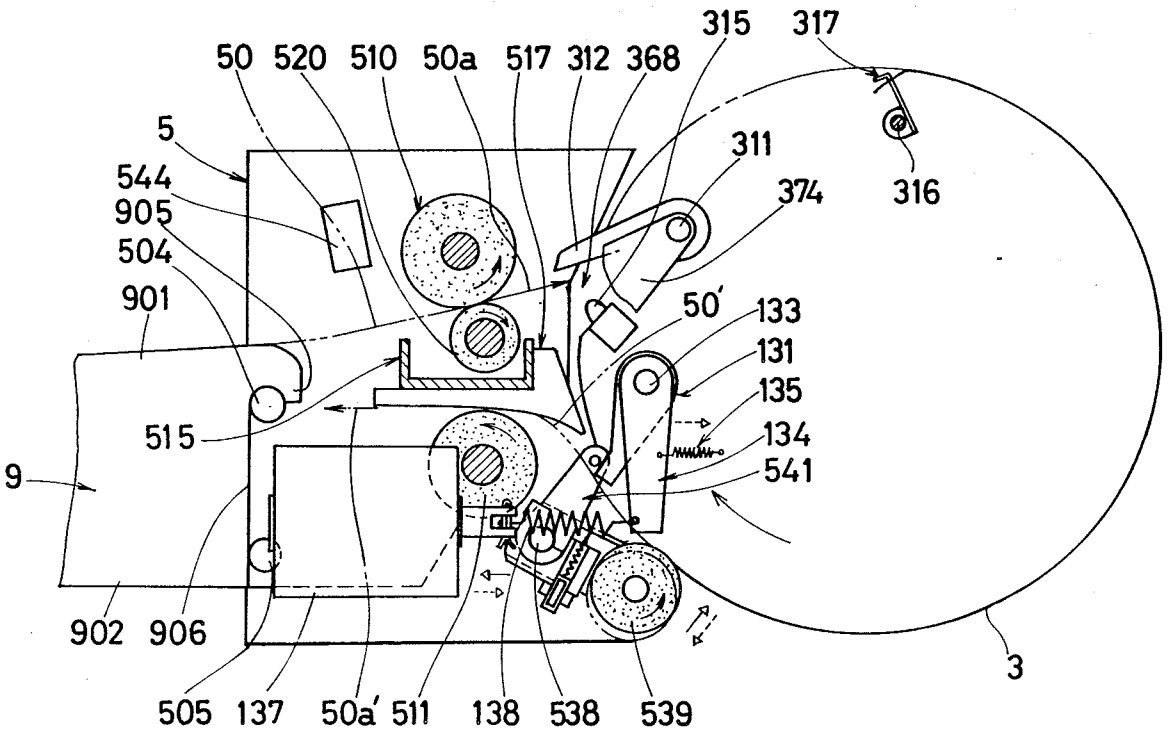
FIG. 33 explains a plate-discharging operation.

A driver lever 131 is provided in the upper rear position of the right-side rail-receiving member 126 for allowing the discharged plate-holding roller 539 to come into contact and depart from the plate cylinder 3. The tip end of the driver lever 131 is provided with a coupling pin 132 to be engaged with the operation lever 541 (shown in FIG. 29(*d*)) of the plate feeding/discharging unit 5, while the driver lever 131 is secured to the driver shaft 133 which is installed to the right-side board 102 and capable of freely rotating itself. The right end of this driver shaft 133 extends to the external portion of the right-side board 102, while the right end of this shaft 133 is provided with a lever 134 shown in FIG. 33 (illustration of the right-side board is deleted here). A spring 135 that energizes the lever 134 for rotating in the counterclockwise direction (see FIG. 33) is set between one end of the lever 134 and the right-side board (not shown in FIG. 33). In addition, to rotate the lever 134 in the clockwise direction, a solenoid 137 is installed to the right-side board (not shown). The solenoid 137 and the lever 134 are respectively connected to each other via a spring 138. When the power is fed to this solenoid 137, the lever 134 is driven so that it rotates in the clockwise direction as shown in FIG. 33, thus causing the lever 131 to also rotate clockwise before eventually being set to the predetermined rotating position for activating operation of the operation lever 541 of the plate feeding/discharging unit 5. When the power is OFF from the solenoid 137, energized force from the spring 135 causes the lever 134 to rotate counterclockwise for returning to the original position. As a result, the driver lever 131 also rotates counterclockwise to return to the predetermined position for inactivating operation of the operation lever 541 of the plate feeding/discharging unit 5.

Figure 32:
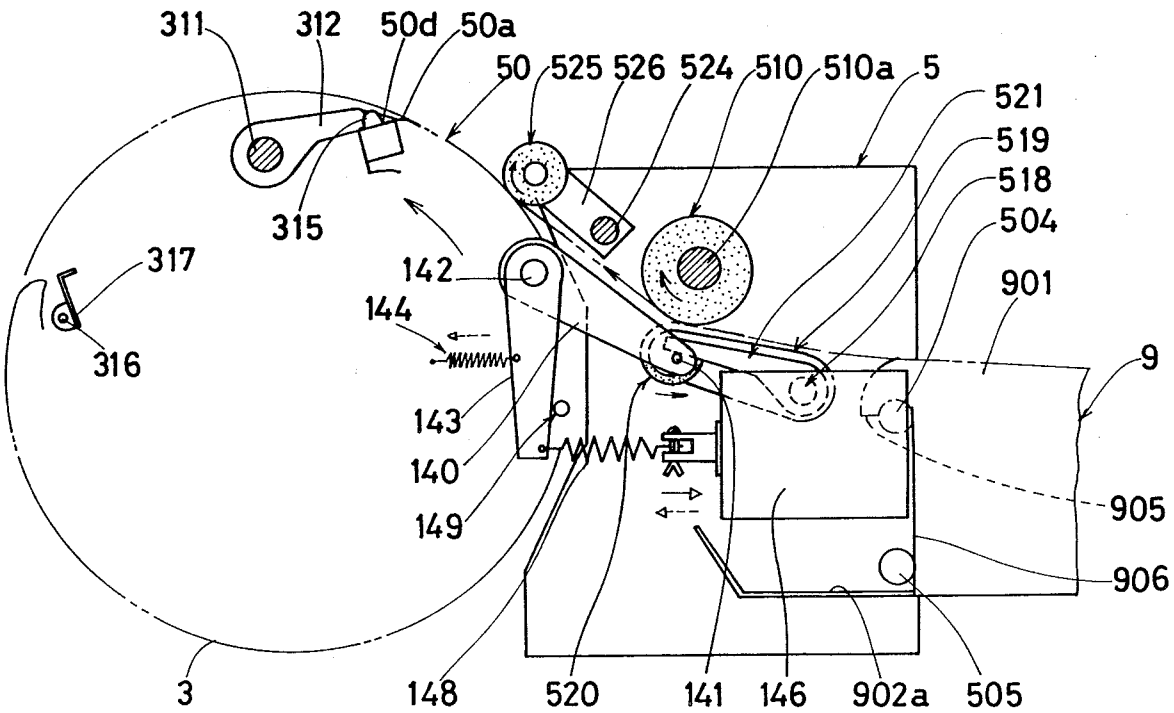
FIG. 32 explains a plate-feeding operation.

On the other hand, the driver lever 140 is installed to the upper position of the left-side rail-receiving member 126 shown in FIG. 31 for allowing the auxiliary plate-feeding driving rollers 520 shown in FIG. 29 of the plate feeding/discharging unit 5 to come into contact with and depart from the plate-feeding driving rollers 510. The tip end of the driver lever 140 is provided with a coupling pin 141 to be engaged with the operation lever 521 of the plate feeding/discharging unit 5, while the driver lever 140 is secured to the drive shaft 142 which is installed to the left-side board 101 and capable of freely rotating itself. The left end of this drive shaft 142 extends to the external portion of the left-side board 101, while the left end of the drive shaft 142 is provided with a lever 143 shown in FIG. 32 (illustration of the left-side board 101 is deleted here). A spring 144 for causing the lever 143 to rotate clockwise (see FIG. 32) is set between one-end of the lever 143 and the left-side board (not shown). A solenoid 146 is installed to the left-side board (not shown) for causing the lever 143 to rotate itself in the counterclockwise direction. The solenoid 146 and the lever 143 are connected to each other via a spring 148. A stopper pin 149 is set to the left-side board (not shown) for constraining the counterclockwise rotation of the lever 143. When the power is fed to the solenoid 146, the lever 143 is rotated in the counterclockwise direction as shown in FIG. 32, and as a result, the driving lever 140 also rotates in the counterclockwise direction before eventually being set to the predetermined rotating position to activate operation of the operation lever 521 of the plate feeding/discharging unit 5. Next, when the power is OFF from the solenoid 146, energized force from the spring 144 causes the lever 143 to turn clockwise before returning to the original position. Consequently, the driver lever 140 also rotates clockwise to return to the predetermined rotation position for relieving the operation lever 521 of the plate feeding/discharging unit 5 from the operative status.

(III) Mounting the plate feeding/discharging unit

Next, procedure needed for mounting the plate feeding/discharging unit 5 onto the printing press is described below. The mounting operation is done while no power is fed to the solenoids 137 and 146 mentioned above.

First, a operator lifts the plate feeding/discharging unit 5 by manually holding the handles 502 with both hands, and then, as shown in FIG. 31, by inserting the rails 506 into the rail-coupling grooves 127 of the rail-receiving members 126, the operator pushes the plate feeding/discharging unit 5 forward into the farthest position. After setting the plate feeding/discharging unit 5 to the farthest position, the operator then fastens the screws 503 into the screw holes 128 of the rail-receiving members 126, thus completing the unit mounting operation.

After installation of the plate feeding/discharging unit 5 in the position, the connector 508 on the part of the unit 5 shown in FIG. 29 is then connected to the connector 129 on the part of the printing press body 1 shown in FIG. 31. This allows the pulse motor 509 and the sensor 544 detecting the presence of the printing plate (which are respectively shown in FIG. 29) to be electrically connected to microprocessor 21 shown in FIG. 2.

In addition, as shown in FIG. 33, the tip end of the operation lever 541 of the plate feeding/discharging unit 5 is engaged with the coupling pin 132 of the driver lever 131 set to the printing press body 1. Thus, when the power is fed to the solenoid 137 while the above condition is present, the driver lever 131 rotates clockwise pivoting the driving shaft 133. As a result, the operation lever 541 is rotated counterclockwise pivoting the rotary shaft 538 so that the plate-holding roller 539 can be set to the plate-holding position. When the power is OFF from the solenoid 137, the plate-holding roller 539 is back to the original position which is apart from the plate cylinder 3 by reversing the operation described above. This operation is shown in FIG. 33.

Next, after completing the installation of the plate feeding/discharging unit 5 to the printing press body 1, as shown in FIG. 32, the tip end of the operation lever 521 of the plate feeding/discharging unit 5 is engaged with the coupling pin 141 of the driver lever 140 provided on the part of the printing press body 1. As a result, when the power is fed to the solenoid 146 while the above condition is present, the driver lever 140 rotates counterclockwise pivoting the drive shaft 142. Consequently, the operation lever 521 is rotated clockwise pivoting the driving shaft 518. This allows the auxiliary plate-feeding driving rollers 520 of the plate feeding/discharging unit 5 to be set to the position in contact with the plate feeding driving rollers 510. When the power is OFF from the solenoid 146, the auxiliary plate-feeding driver rollers 520 are back to the original position which is apart from the plate-feeding driving rollers 510 by reversing the operation described above.

The plate feeding/discharging unit can be removed from the printing press body 1 by reversing the procedure for mounting it.

Note that a plate feeding/discharging unit 6 has a constitution which is identical to that of the plate feeding/discharging unit 5, and likewise, it can be mounted onto and removed from the printing press body 1 by applying the procedure identical to that is applied to the plate feeding/discharging unit 5.

Figure 34:
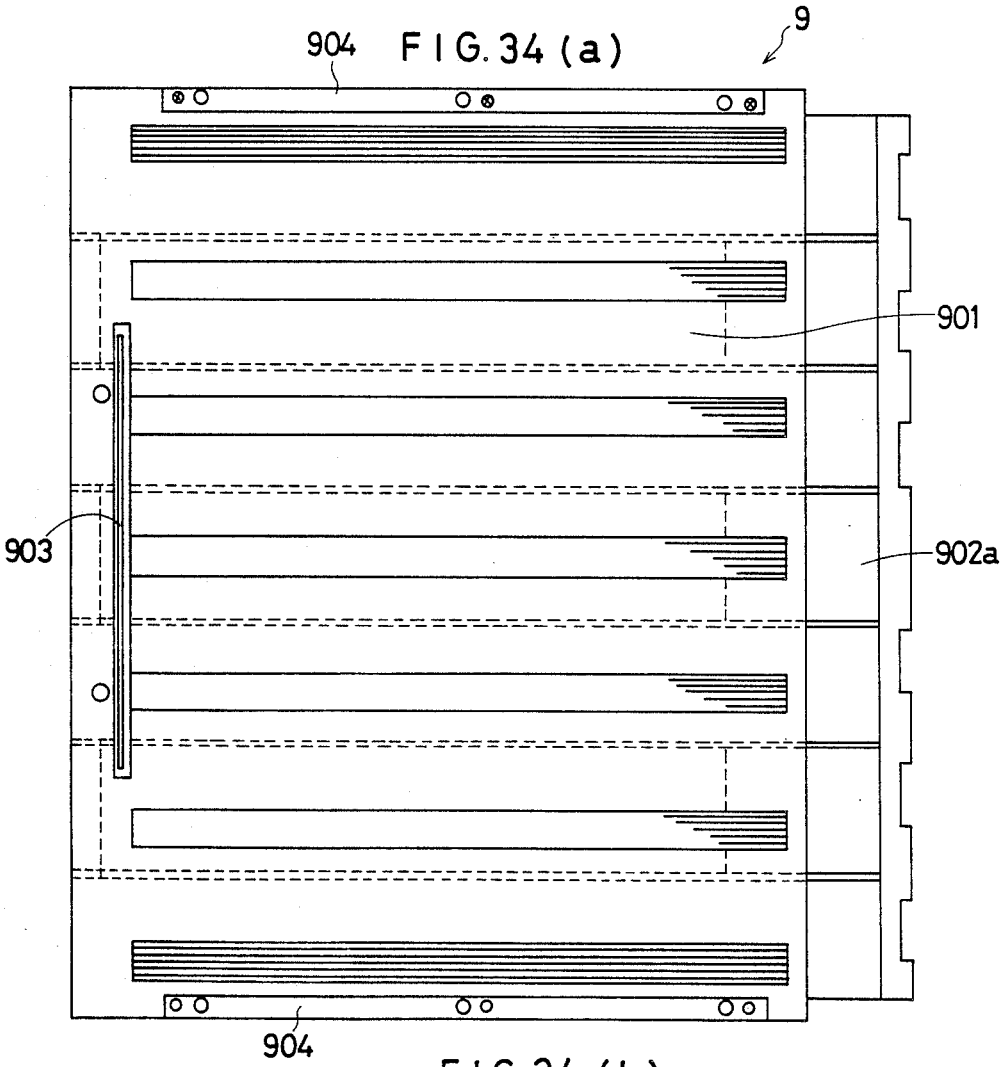
FIGS. 34(*a*) and (*b*) are respectively the constitution of a plate feeding/discharging tray.
Figure 34:
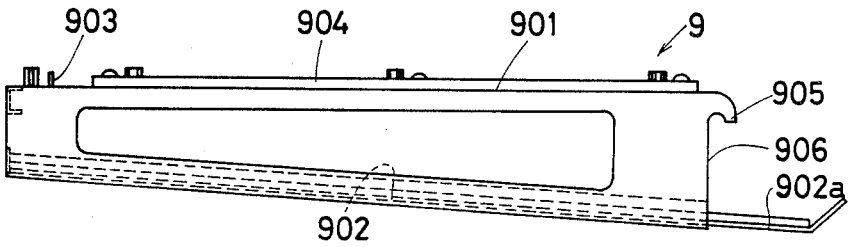
Figure 35:
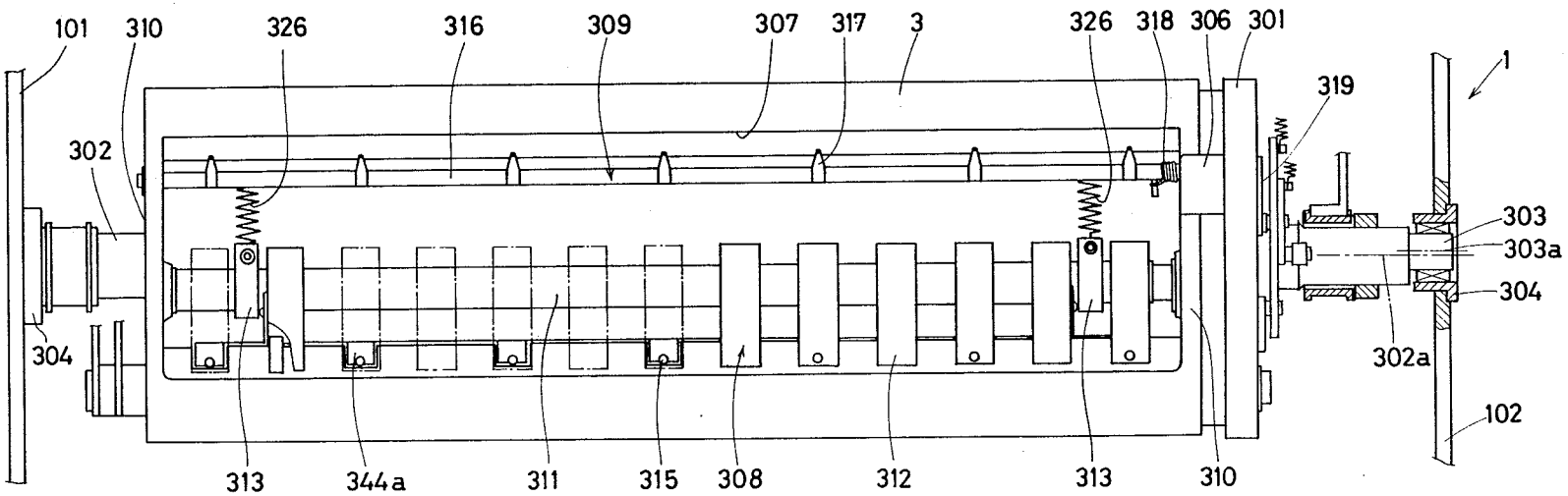
FIG. 35(*a*) is a view of a plate cylinder shown from the rear position of the printing press.
Figure 35B:
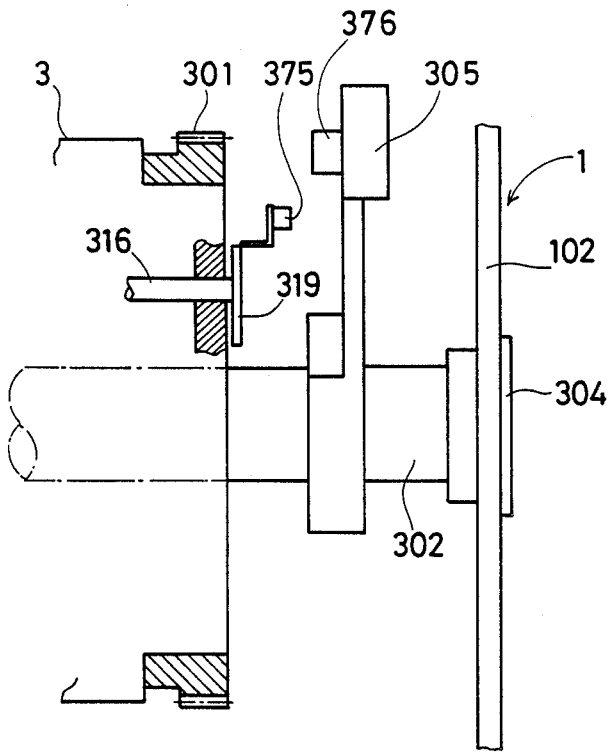

(2) Constitution and the procedure for the installation of a plate-feeding/discharging tray FIG. 34(*a*) is a plain view of a plate feeding/discharging tray 9 and FIG. 35(*b*) denotes its lateral view. An upper part of the plate feeding/discharging tray 9 is provided with a plate-feeding table 901 for forwarding a printing plate for delivery, whereas a lower part of which is provided with plate discharging table 902 for storing a discharged printing plate. An upper rear portion of the plate-feeding table 901 is provided with a plate-end positioning member 903, whereas both sides of an upper surface of the plate-feeding table 901 are respectively provided with lateral positioning members 904 for correctly positioning both sides of the delivered printing plate. Both sides in front edge of the plate feeding/discharging tray 9 are respectively provided with hooks 905 for installing tray.

As shown in FIG. 29(*c*), when installing the plate feed/discharging tray 9 to the printing press body 1, the hooks 905 are first engaged with the engaging pins 504 in the state in which the extended part 902*a* in the front edge of plate-discharging table 902 is fully inserted into the plate feeding/discharging unit 5 so that both sides 906 of the front edge of tray 9 can be engaged with the positioning pins 505. The plate feeding/discharging tray 9 is removed from the printing press body 1 by applying the procedure reversing that is described above.

A plate feeding/discharging tray 10 shown in FIG. 1 has a constitution identical to that of the plate feeding-/discharging tray 9, while it can be mounted onto and removed from the plate feeding/discharging tray 10 by applying the same procedure as that is applied to the plate feeding/discharging tray 9.

(3) Mechanical constitution of the plate cylinder and the printing press body.

FIG. 35 is the diagram of the plate cylinder 3 observed from the back of the printing press body 1. As shown in FIG. 35, the plate-cylinder gear 301 is secured to a right edge of the plate cylinder 3. The plate cylinder 3 is held by a plate cylinder supporting shaft 302 together with the plate-cylinder gear 301 so that it can freely rotate. Both ends of the plate-cylinder supporting shaft 302 are respectively provided with eccentric shafts 303 having the eccentric rotation axis 303*a* against axis 302*a* of the plate-cylinder supporting shaft 302. These eccentric shafts 303 are respectively held by bearings 304 secured to the right and left side boards 101 and 102 of the printing press body 1 so that they can freely rotate themselves. The plate cylinder 3 is rotated by engaging the plate-cylinder gear 301 with the blanket cylinder gear (not shown) set to a right end of the blanket cylinder 2 shown in FIG. 1. The plate cylinder 3 either comes into contact with or departs from the blanket cylinder 2 by causing the eccentric shafts 303 to be driven either clockwise or counterclockwise within a specific angle using a pulse motor for example.

A part of the external circumference of the plate cylinder 3 is provided with an aperture 307 throughout the entire width in the direction of the shaft. A plate-head clamping mechanism 308 and a plate-end holding mechanism 309 are respectively set to one end and the other end inside of the aperture 307 in the direction of the circumference.

Referring now to the accompanying drawings, constitutions of the plate cylinder 3 and the printing press body 1 are described below in accordance with respective mechanical components.

(a) A plate-head clamping mechaism

Figure 36A:
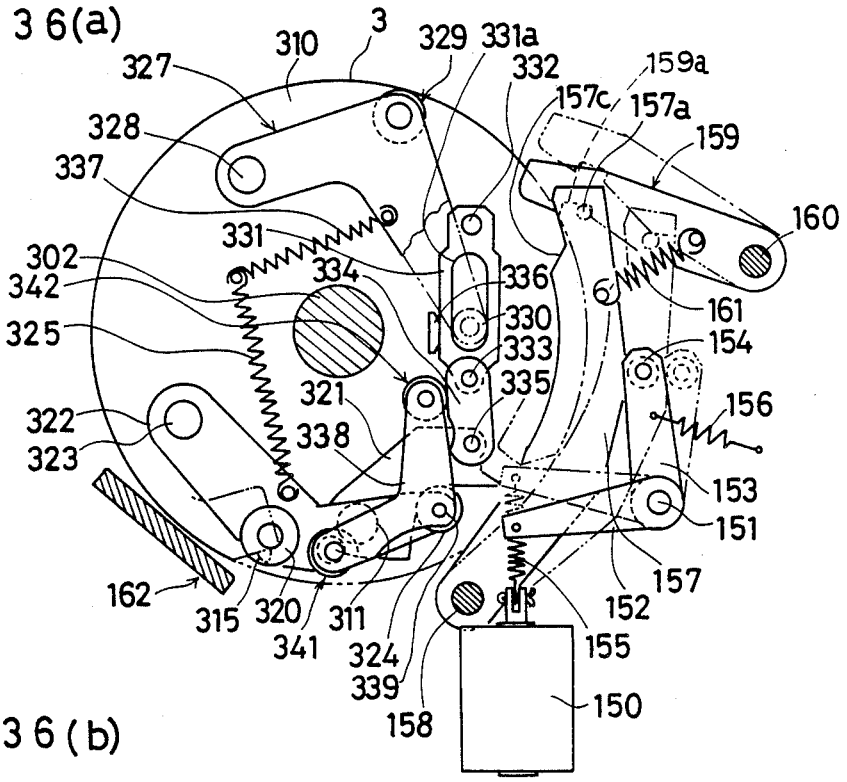
FIGS. 36(*a*) and (*b*) 37(*a*) and (*b*) respectively explain the opening/closing operation of the plate-head holding nails.
Figure 36B:
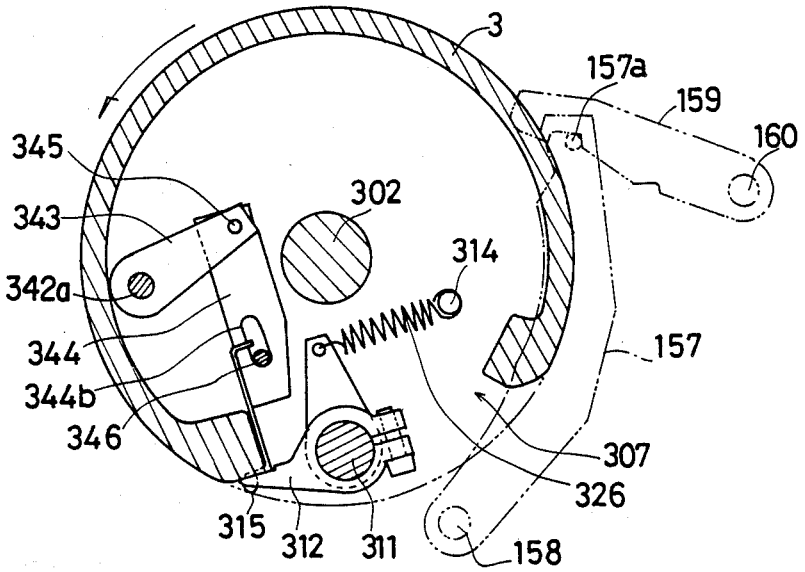

FIGS. 35(*a*), 36(*b*) and 37(*b*) respectively denote a plate-head clamping mechanism 308. A nail shaft 311 capable of freely rotating itself is set between the left and right sides 310 and 310 of the plate cylinder 3. A plurality of plate-head clamping nails 312 are secured to the external circumference of the nail shaft 311 in the equal pitches in shaft orientations of the nail shaft 311. A pair of links 313 are secured to the position close to both ends of the nail shaft 311. A pair of tension springs 326 are set between spring-shoe pins 314 set inside of the plate cylinder 3 and the tip ends of links 313, thus allowing the plate-head clamping nails 312 to be rotated in the clockwise direction, i.e., in the direction of closing nails, pivoting the nail shaft 311, as shown in FIG. 36(*b*). These plate-head clamping nails 312 are opened by operating the plate-head clamping nail operating mechanism (to be described later on) set to the left end of the plate cylinder 3.

On the other hand, plate-head positioning pins 315 project themselves at the positions opposite from the plate-head clamping nails 312 along the aperture edge of the plate cylinder 3. The plate-head clamping mechanism 308 clamps the plate head by closing the plate-head clamping nails 312 by engaging the plate-head positioning pins 315 with pin holes provided for the plate-head portion of the printing plate (not shown).

(b) A plate-end holding mechanism

Figure 51:
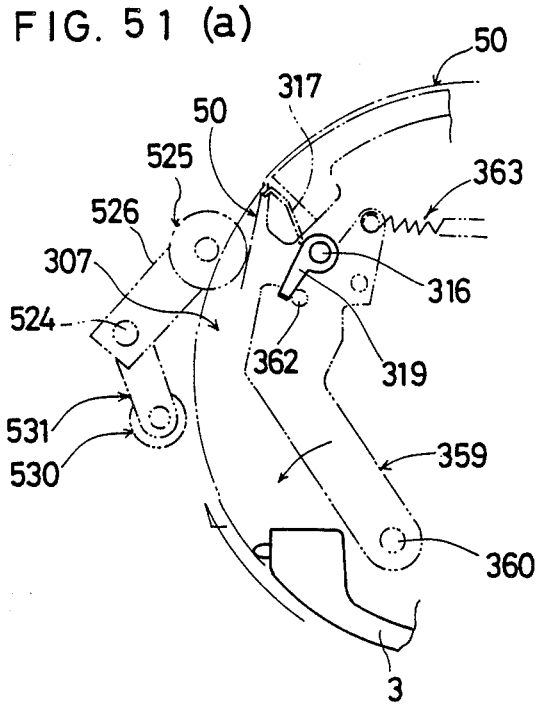
Figure 51:
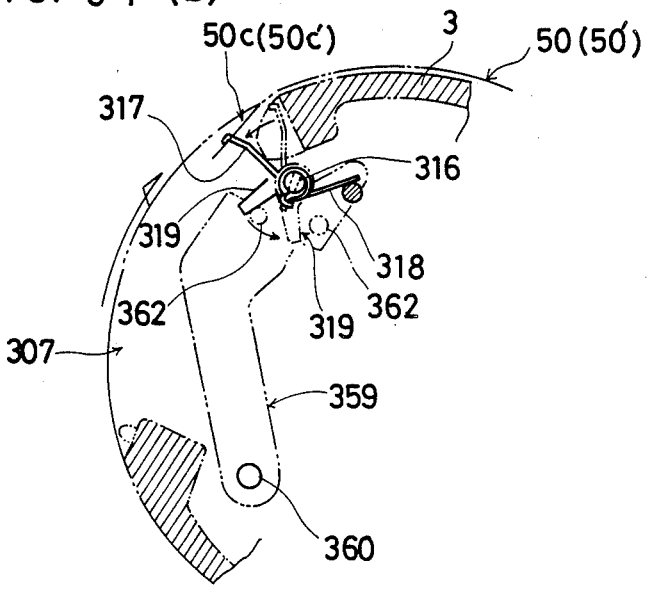

A plate-end holding mechanism 309 is shown in FIGS. 35(*a*) and 25, respectively. A hook shaft 316 is set between the left and right sides 310, 310 of the plate cylinder 3 so that it can freely rotate itself. A plurality of plate-end hooks 317 are secured in equal pitches in shaft orientations of the hook shaft 316. A torsion coil spring 318 is externally set to the position close to the right edge of the hook shaft 316, thus allowing the plate-end hooks 317 to be rotated in the counterclockwise direction, i.e., in the direction of pulling the plate end, pivoting the hook shaft 316, as shown in FIG. 51. In addition, a link 319 is secured to the external position of the plate-cylinder gear 301 in the right edge of the hook shaft 316. The link 319 is rotated either clockwise or counterclockwise by means of a plate-end hook operation mechanism to be described later on, thus making it possible for the plate-end hook 317 to correctly hold and release the plate-end.

(c) A plate feeding/discharging cam mechanism

Figure 37:
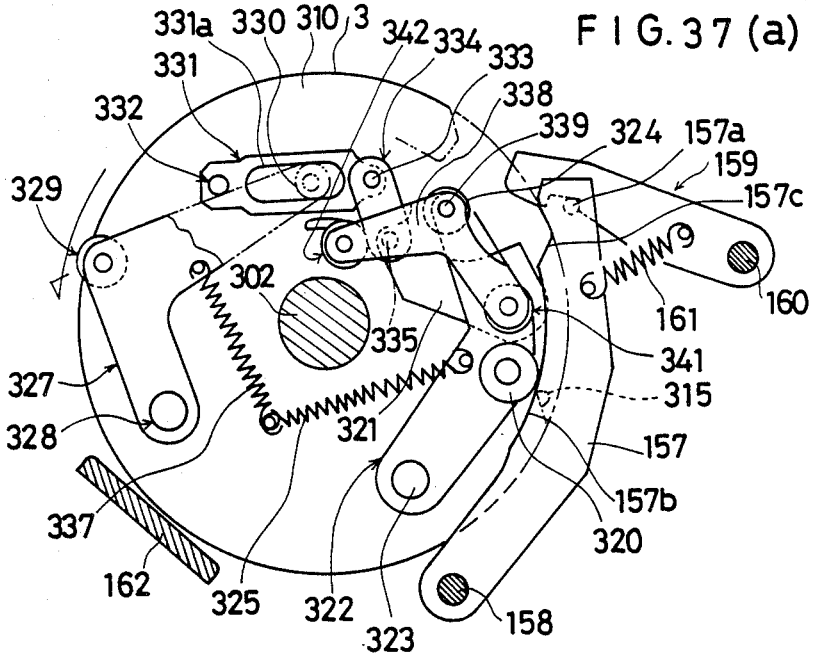
Figure 37:
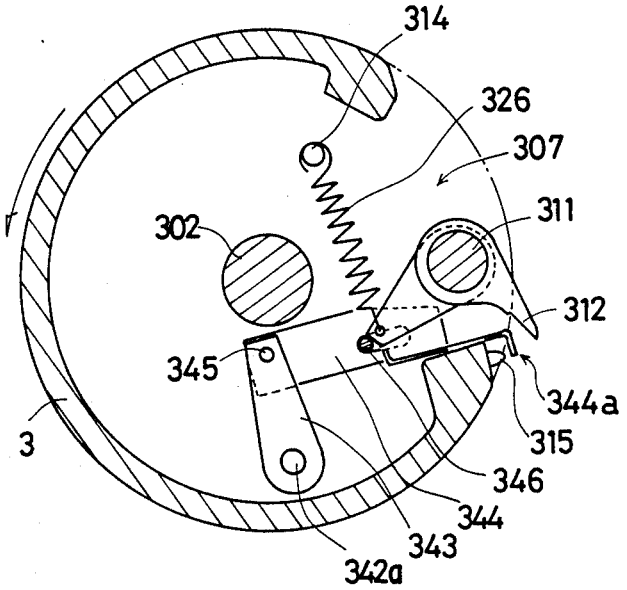

The left-side board 101 of the printing press body 1 is provided with a plate feeding/discharging cam mechanism shown in FIGS. 36 and 37. Note that, to easily understand the constitution, illustration of the left-side board 101 is delected from FIG. 37. The same applies to the ensuing drawings. The plate feeding/dicharging cam mechanism is comprised of the following: A solenoid 150 is secured to the external surface of the left-side board 101. A shaft 151 penetrating the left-side set so that it teside board 101 is set so that it can freely rotate itself. A link 152 and a set-lever 153 are respectively secured to the external and internal edges of the shaft 151. A set-roller 154 is secured to the tip end of the set-lever 153. In addition, a spring 155 is set between the link 152 and the solenoid 150. A spring 156 is set between the set-lever 153 and the left-side board 101 for energizing the set-lever 153 so that it rotates clockwise. On the other hand, a plate feeding/discharging cam 157 capable of freely rotating itself is installed via shaft 158 projecting onto the internal surface of the left-side board 101. In addition, a lock-lever 159 capable of freely rotating itself is installed via another shaft 160 projecting onto the internal surface of the left-side board 101. A tension spring 161 is set between the plate feeding/discharging cam 157 and the lock-lever 159 to energize the lock-lever 159 so that is can rotate counterclockwise. The counterclockwise rotation of the lock-lever 159 is constrained by engaging the lock-lever 159 itself with the locking pin 157*a* set to the tip end of the plate feeding/discharging cam 157.

Next, operation of the plate feeding/discharging cam mechanism is described below. When the solenoid 150 is activated, the link 152 rotates counterclockwise via the spring 155 as shown in FIG. 36(*a*). This causes the set-lever 153 to rotate counterclockwise pivoting the shaft 151 against the energized force from the spring 156. As a result, the set-roller 154 presses the plate feeding/discharging cam 157 so that the plate feeding/discharging cam 157 starts to rotate itself counterclockwise pivoting the shaft 158. When the plate feeding/discharging cam 157 rotates counterclockwise by the predetermined angle, the locking pin 157*a* falls into the groove 159*a* of the lock-lever 159, and as a result, the plate feeding/discharging cam 157 is latched at its rotating position, i.e., the cam 157 is securely locked. When the power is OFF from the solenoid 150 after locking the plate feeding/discharging cam 157, tractive force from the spring 155 is freed, thus allowing the link 152 and the set-lever 153 to respectively rotate clockwise pivoting the shaft 151 by the energized force from the spring 156 before returning to their original positions. While this operation is underway, the plate feeding/discharging cam 157 remains being latched at the locked position mentioned above. The plate feeding/discharging cam 157 is unlocked when the roller 320 set to the plate cylinder 3 kicks the tip end of the lock-lever 159 in conjunction with the counterclockwise rotation of the plate cylinder 3 shown in FIG. 42. More particularly, when the tip end of the lock-lever 159 is kicked upward by the roller 320, the locking pin 157*a* set to the plate feeding/discharging cam 157 is disengaged from the groove 159*a* of the lock-lever 159. This allows the plate feeding/discharging cam 157 to rotate in the clockwise direction due to tensile force from the tension spring 161 before returning to its original position shown in FIG. 43. This completes unlocking operation of the plate feeding/discharging cam 157.

(d) A plate-head clamping nail operation mechanism

As shown in FIGS. 36(*a*) and 37(*a*), the external surface of the left-side part of the plate cylinder 3 is provided with a plate-head clamping nail operation mechanism. This mechanism is comprised of the following: The left-end of the nail shaft 311 shown in FIG. 36(*b*) extends itself up to the outer portion of the left-side part of the plate cylinder 3 shown in FIG. 36(*a*), while a link 321 is connected to the extended portion of the nail shaft 311. Another link 322 is installed to a shaft 323 set to the left-side part of the plate cylinder 3 so that it can freely rotate. Rollers 320 and 324 are respectively installed to the center and tip-end positions of the link 322. A tension spring 325 is installed between the link 322 and the left side 310 to allow the link 322 to rotate counterclockwise pivoting the shaft 323. The counterclockwise rotation of the link 322 is constrained by engaging the roller 324 with the link 321.

Figure 41:
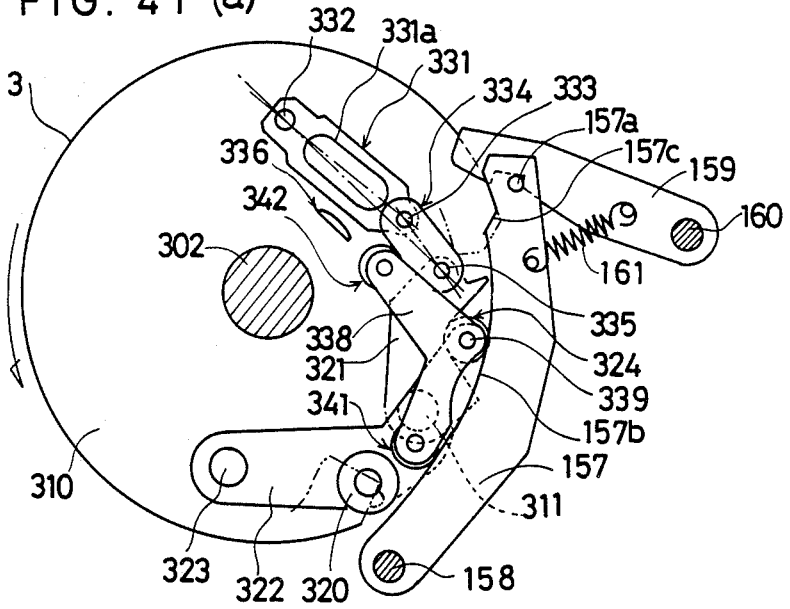
FIGS. 41(*a*), (*b*) and (*c*), 42 and 43 respectively explain the operations of the plate-head holding vice mechanism.
Figure 41:
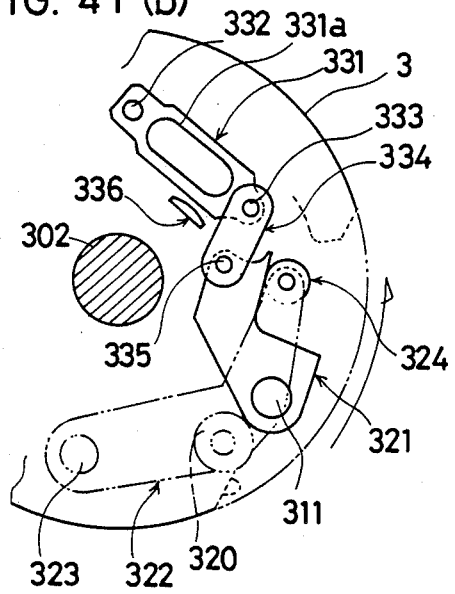
Figure 41:
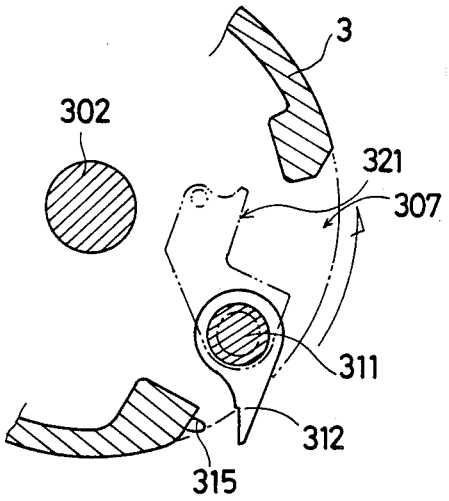
Figure 42:
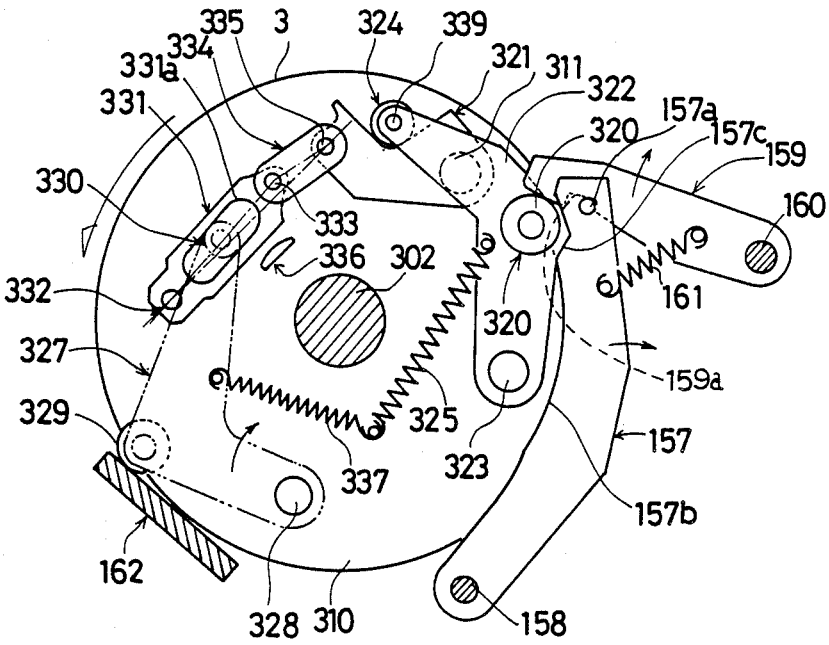

Next, operation of the plate-head clamping nail operation mechanism is described below. First, the plate feeding/discharging cam 157 is locked as shown in FIG. 36(*a*). Next, a plate-head clamping vice mechanism (to be described later on) is unlocked. In conjunction with the counterclockwise rotation of the plate cylinder 3, the roller 320 of the link 322 runs over the cam surface 157*b* of the plate feeding/discharging cam 157 to rotate over the cam surface 157*b* as shown in FIG. 37(*a*). This causes the link 322 to rotate counterclockwise pivoting the shaft 323. As a result, the other link 321 is pressed to the left by roller 324 set to the tip end of the link 322 as shown in FIG. 41(*b*). This causes the nail shaft 311 to also rotate counterclockwise as shown in FIG. 41(*c*). Thus, the nail shaft 311 rotates counterclockwise by overcoming the force from the tension spring 326 shown in FIG. 37(*b*), and as a result, the plate-head clamping nail 312 secured to the nail shaft 311 also rotates counterclockwise, thus eventually allowing the plate-head clamping nail 312 to execute "opening" operation. When the roller 320 of the link 322 reaches the concave 157*c* of the plate feeding/discharging cam 157 by further rotation of the plate cylinder 3 as shown in FIG. 42, the roller 320 falls into the concave 157*c* to disengage the plate feeding/discharging cam 157 from the pressing operation against the link 322. Thus, after being released from the constraint applied by the plate feeding/discharging cam 157, the links 322 and 321 are respectively allowed to rotate clockwise pivoting the shaft 323 and the nail shaft 311, while the nail shaft 311 also rotates clockwise by receiving tensile force from the tension spring 326 shown in FIG. 37. This allows the plate-head clamping nails 312 shown in FIG. 36(*b*) to execute "closing" operation. When the plate cylinder 3 rotates furthermore, as was described earlier, the roller 320 kicks the lock-lever 159 upwards so that the plate feeding/discharging cam 157 can be unlocked.

(e) A plate-head clamping vice mechanism and a vice-releasing mechanism

As shown in FIGS. 36(*a*), 37(*a*), 41 through 43, in addition to the plate-head clamping nail operation mechanism described above, the external surface of the left side 310 of the plate cylinder 3 is provided with a plate-head clamping vice mechanism and a vice-releasing mechanism as well. Of these, the plate-head clamping vice mechanism is comprised of the following: As shown in FIG. 42, a link 327 is installed to the left side 310 of the plate cylinder 3 via a shaft 328 so that it can freely rotate itself. Rollers 329 and 330 are respectively installed to the center and tip-end positions of the link 327. Another link 331 is also installed to the left side 310 via a shaft 332 so that it can freely rotate itself. The link 331 is provided with a lengthy hole 331*a*, with which the roller 330 of the link 327 is engaged so that it can freely slide its position. In addition, another link 334 is connected to the tip end of the link 331 via a pin 333 so that it can freely rotate itself. The other end of the link 334 and the tip end of the link 321 are connected to each other via another pin 335 so that they can freely rotate themselves. A stopper 336 for constraining the clockwise rotation of the link 331 is projectively installed to the inner position of the link 331 of the left side 310 of the plate cylinder 3. In addition, a tension spring 337 buffering the centrifugal force applied to the link 327 relative to the rotation of the plate cylinder 3 is provided between the left side 310 and the link 327. In addition, a plate-head clamping nail locking cam 162 for inwardly placing the roller 329 of the link 327 inside of the plate cylinder 3 is installed to the designated position of the printing press body 1.

Operation of the plate-head clamping nail vice mechanism is described below. As shown in FIG. 42, the plate-head clamping nails 312 are first closed by engaging the roller 320 of the link 322 with the concave 157*c* of the plate feeding/discharging cam 157 before clamping the plate head. Immediately after the plate-head clamping is done, the roller 329 of the link 327 is pressed against the plate-head clamping nail locking cam 162, thus causing the link 327 to rotate clockwise pivoting the shaft 328. When the link 327 rotates clockwise, the roller 330 of the link 327 slides inside of the lengthy hole 331*a* of the link 331, thus allowing the link 331 to rotate in the clockwise direction pivoting the shaft 332. As a result, when the pin 333 moves its position from the position shown in FIG. 42 to the straight line connecting the pin 335 and the shaft 332, the pin 333 forcibly rotates the nail shaft 311 clockwise via the link 321 using the reached position as the top dead center. This delivers enormous pressure to the plate-head clamping nails 312. Now, when the link 331 keeps clockwise rotation to cause the pin 333 to move itself to a position slightly in excess of the top dead center mentioned above as shown in FIG. 43, the link 331 is then caught by the stopper 336 and locks itself. This causes powerful pressure to be continuously and stably delivered to the plate-head clamping nails 312.

On the other hand, the vice-releasing mechanism for unlocking the plate-head clamping nail vice mechanism is comprised of the following: As shown in FIGS. 36(*a*) and 37(*a*), center part of a link 338 is connected to the tip-end of the link 322 via a shaft 339 so that the link 338 can freely rotate itself. Rollers 341 and 342 are respectively set to both ends of the link 338. The shaft 339 is concurrently with the rotary shaft of the roller 324 set to the tip-end of the link 322.

Next, operation of the vice-releasing mechanism is described below. When the plate cylinder 3 rotates to the position shown in FIG. 36(*a*) while the vice mechanism remains being locked, the plate feeding/discharging cam 157 is locked in accordance with the procedure described above. Next, the roller 341 of the link 338 runs over the plate feeding/discharging cam 157 as shown in FIG. 41(*a*). As a result, the link 338 rotates in the clockwise direction pivoting the shaft 339, thus causing the roller 342 set to the edge part of the link 338 to press the link 334 in the direction of the external circumference of the plate cylinder 3. On receipt of pressure, the link 334 rotates clockwise pivoting the pin 335 to simultaneously cause the link 331 to rotate counterclockwise pivoting the shaft 332. As a result, the pin 333 passes through the straight line (i.e., top dead center) connecting the pin 335 and the shaft 332 so that the vice mechanism can be unlocked to allow the link 321 to rotate in the counterclockwise direction pivoting nail shaft 311.

(f) A plate-head extrusion mechanism

Figure 38A:
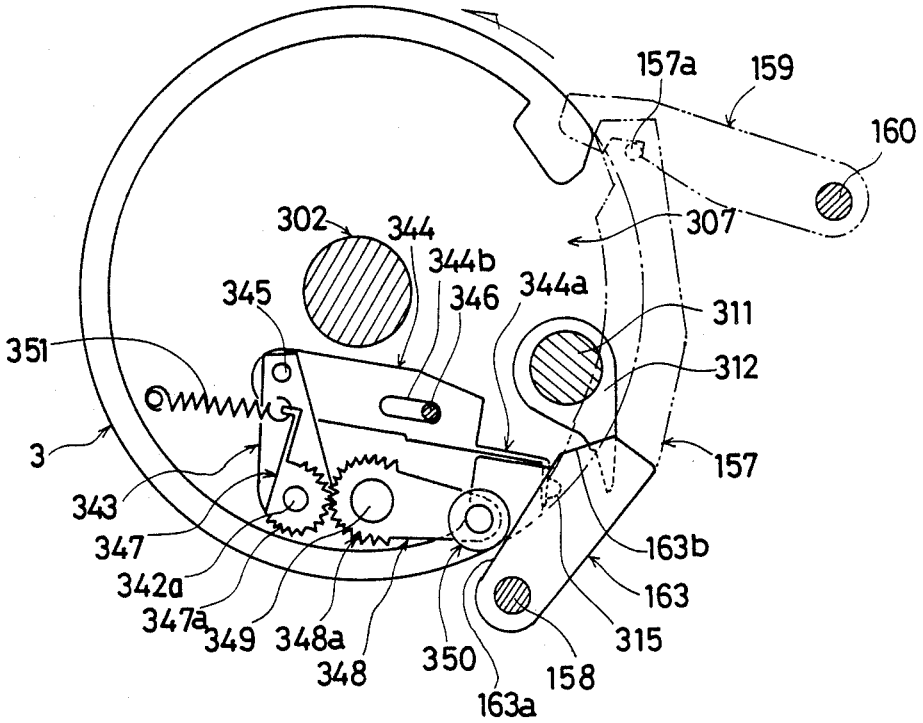
FIGS. 38(*a*) and (*b*), 39(*a*) and (*b*), and 40(*a*) and (*b*) respectively explain the operations for protruding and withdrawing of the plate extending nails.
Figure 38B:
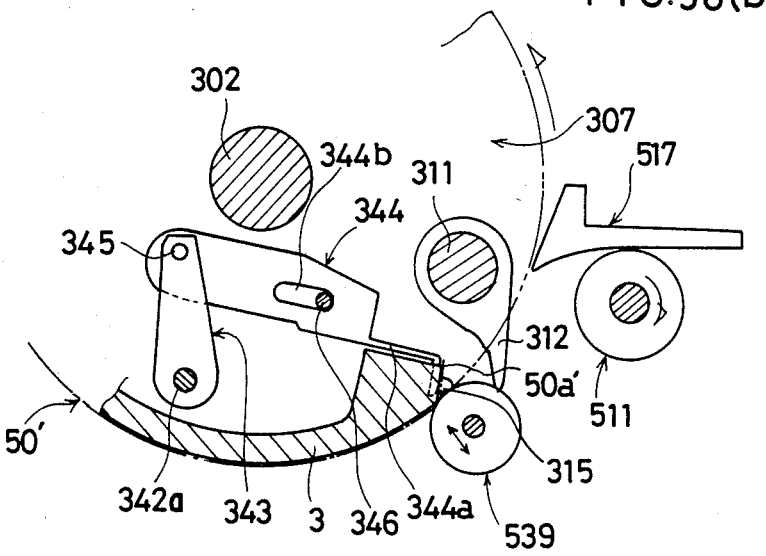

As shown in FIGS. 35(*a*), 38 through 40, the plate cylinder 3 is internally provided with the plate-head extrusion mechanism, which is comprised of the following: An end of a link 343 is secured to a shaft 342*a* set between the first and right sides 310/310 of the plate cylinder 3, in which the shaft 342*a* freely rotates itself. On the other hand, a shaft 346 set inside of the plate cylinder 3 is connected to a lengthy hole 344*b* of a link 344 having plate-extrusion nails 344*a* at the tip end so that the shaft 346 can freely slide itself, while the rear end of the link 344 and the tip end of the link 343 are connected to each other via a shaft 345 so that both links can freely rotates themselves. A plurality of links 343 and 344 are respectively provided in the direction of the rotary shaft of the plate cylinder 3 in the positions corresponding to respective plate-head positioning pins 315. When the shaft 342*a* rotates either clockwise or counterclockwise, the link 344 moves forward or backward via the link 343 to allow the plate extrusion nails 344*a* to either come out from or enter into the edge surface of aperture. The left edge of the shaft 342*a* extends itself up to the external part of the left side 310 of the plate cylinder 3. A link 347 having a gear 347*a* is secured to the edge of the extended shaft 342*a*. In addition, another link 348 having a gear 348*a* engaged with gear 347*a* is connected to a shaft 349 set to the external surface of the side 310 of the plate cylinder 3 so that the link 348 can also freely rotate itself. A cam follower 350 is set to the tip end of the link 348. In addition, a tension spring 351 is set between the tip end of the link 347 and the left side 310 of the plate cylinder 3, thus causing the shaft 342*a* to be rotated counterclockwise as shown in FIG. 38. In other words, the shaft 342*a* is rotated so that the plate extrusion nails 344*a* can be led into the edge surface of aperture of the plate cylinder 3. On the other hand, a plate-discharging cam 163 corresponding to the cam follower 350 is secured to the shaft 158 which is concurrently with the rotary shaft of the plate feeding-/discharging cam 157. This allows the plate-discharging cam 163 to rotate either clockwise or counterclockwise within a specific range pivoting the shaft 158 in conjunction with the operation of the plate feeding/discharging cam operation mechanism.

Figure 39:
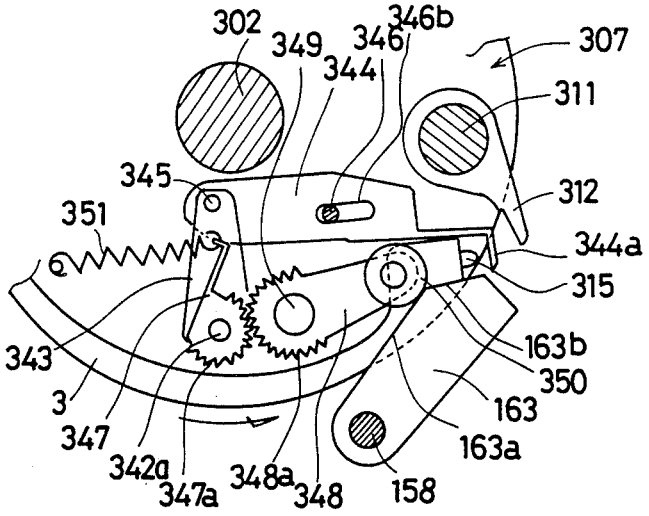
Figure 39:
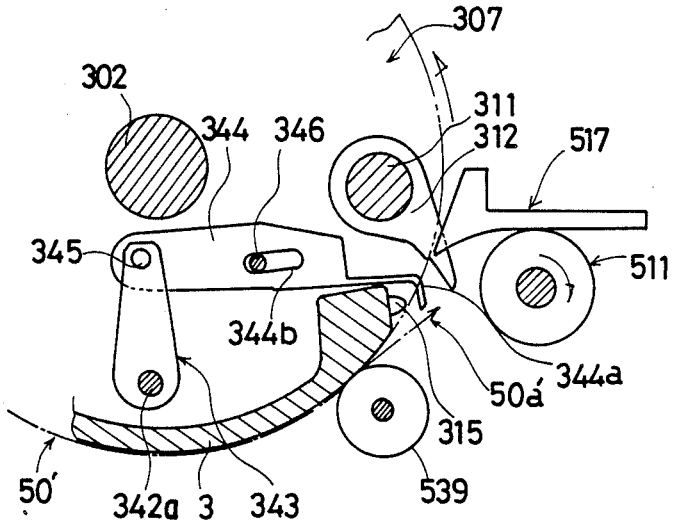
Figure 40A:
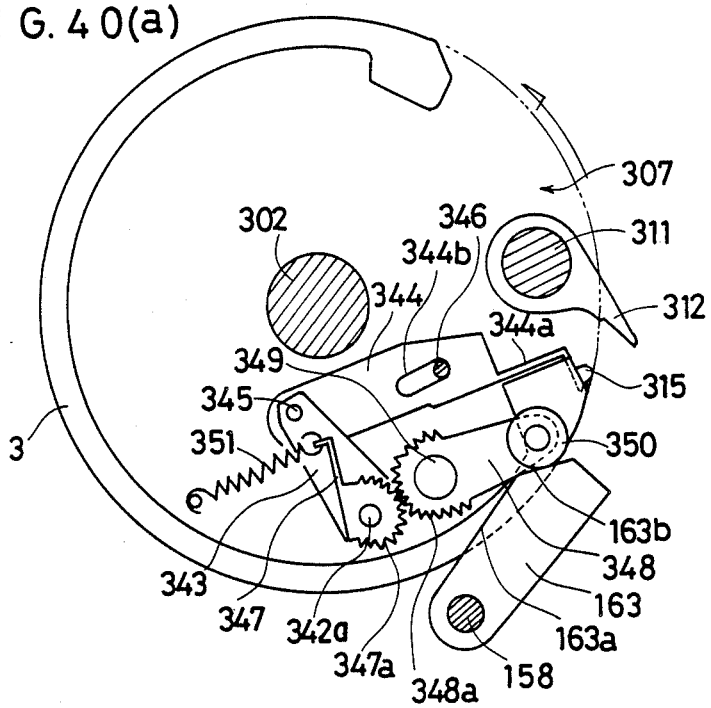
Figure 40B:
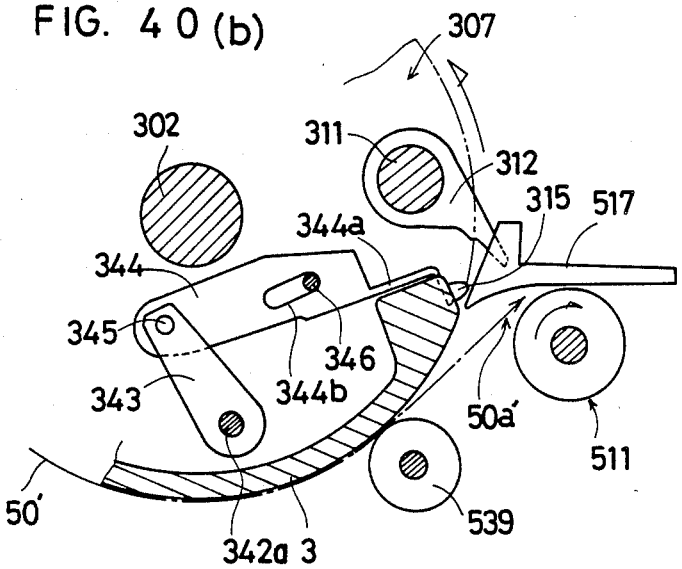

The plate-head extrusion mechanism provides the following functions. After locking the plate-discharging cam 163 at the designated position shown in FIG. 38(*a*) and then the plate-head clamping nails 312 executes "opening" operation, the cam follower 350 runs over the first cam surface 163*a* of the plate-discharging cam 163. This causes the link 348 to rotate counterclockwise pivoting the shaft 349. When the link 348 rotates counterclockwise, as shown in FIG. 39, the rotation force is transmitted from the gear 348 to the gear 347*a*, thus allowing the link 347 to rotate clockwise pivoting the shaft 342*a* against the energized force from the tension spring 351. This causes the link 343 to also rotate clockwise to activate the plate-extrusion nails 344*a* of the link 344 so that the nails 344*a* comes out of the edge surface of aperture of the plate cylinder 3. In this case, as shown in FIG. 38(*b*), if the plate head 50*a*′ of the printing plate 50′ were preliminarily latched by the plate-head positioning pins 315, the plate head 50*a*′ is extruded from the plate-head positioning pins 315 by the plate extrusion nails 344*a* as shown in FIG. 39. Then, as shown in FIG. 40(*a*), when the plate cylinder 3 continuously rotates itself, the cam follower 350 moves its position to the second cam surface 163*b* after passing through the first cam surface 163*a* of the plate-discharging cam 163. This causes the link 348 to be rotated clockwise pivoting the shaft 349 by the energized force from the tension spring 351. As a result, the links 343 and 347 respectively rotate counterclockwise to activate the plate extrusion nails 344*a* for entry into the edge surface of aperture of the plate cylinder 3.

(g) A plate-holding roller cam mechanism

As shown in FIG. 44, the right side 310 of the plate cylinder 3 is provided with a plate-holding roller cam mechanism, which is comprised of the following: A gear 352 is secured to a position close to the right edge of the nail shaft 311 inside of the plate cylinder 3. In addition, a fulcrum shaft 354 securing a small gear 353 engaged with the gear 352 at an edge is installed to the right side 310 so that it can freely rotate itself, while a link 355 is secured to the other edge of the fulcrum shaft 354. On the other hand, a plate-holding roller cam 356 is set to the right side 310 via a fulcrum pin 357 so that it can freely rotate itself. A pin 358 set to the tip end of the link 355 is engaged with a lengthy hole 356*a* of the plate-holding roller cam 356 so that it can freely slide its position.

The plate-holding roller cam mechanism provides the following functions. When the plate-head clamping nails 312 open themselves according to the procedure described above, the gear 352 secured to the nail shaft 311 rotates clockwise as shown in FIG. 44(*b*). This causes the small gear 353 and the link 355 to simultaneously rotate counterclockwise. When the link 355 rotates counterclockwise, the pin 358 set to the tip end of the link 355 slides through the lengthy hole 356*a* of the plate-holding roller cam 356. This activates the plate-holding roller cam 356 to rotate clockwise itself pivoting the fulcrum pin 357 before it is eventually set to the predermined position. Likewise, when the plate-head clamping nails 312 close themselves, operation reversing the above sequence is executed, thus allowing the plate-holding roller cam 356 to be back to the original position to reset the entire operations.

(h) Contacting and departing operations of a plate-holding roller

Figure 45:
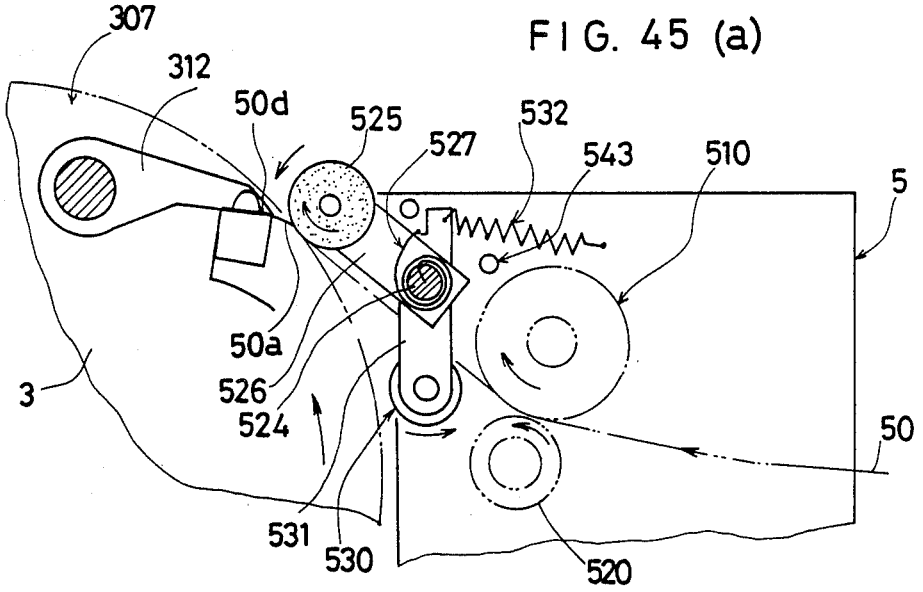
FIGS. 45(*a*) and (*b*) respectively explain the operations needed for locking the plate holding rollers.
Figure 45:
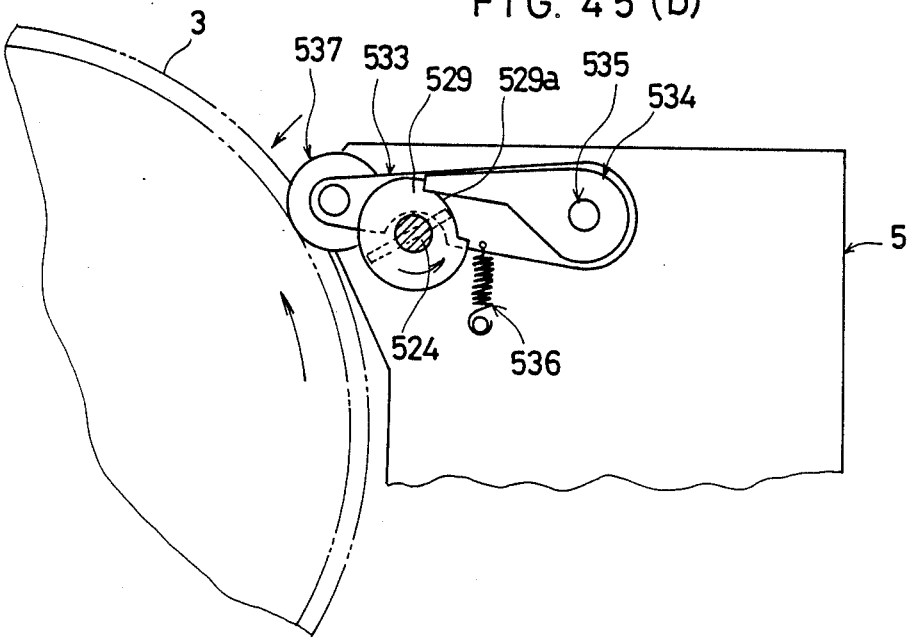

The plate-holding rollers 525 installed to the plate feeding/discharging unit 5 come into contact and depart from the plate cylinder 3 in accordance with procedure described below. As shown in FIG. 44(*d*), after the plate-holding roller cam 356 is set to the designated position and while the plate-head clamping nails 312 remains open, the plate-holding activation roller 530 runs over the plate-holding roller cam 356. This allows both the plate-holding activation arm 351 and the rotary shaft 524 to rotate counterclockwise as shown in FIG. 45(*a*), thus causing the roller-supporting arm 526 to rotate counterclockwise to allow the plate-holding rollers 525 to be set to the plate holding position. This operation is done while the plate-holding rollers 525 still remains in the aperture 307 of the plate cylinder 3. Simultaneous with the counterclockwise rotation of the rotary shaft 524, the latchet wheel 529 shown in FIG. 45(*b*) also rotates counterclockwise. When the latchet wheel 529 rotates counterclockwise by the predetermined angle, the latchet 534 falls into the concave 529*a* so that it is locked. This causes the plate-holding rollers 525 to be locked at the plate-holding position. Next, the plate-head clamping nails 312 close themselves and clamp the plate head. Then, when the plate-holding rollers 525 pass through aperture 307 while the plate cylinder 3 still rotates itself, the plate-holding rollers 525 run over the external circumference of the plate cylinder 3 to press the printing plate 50 against the plate cylinder 3. When these operations are underway, since the roller-supporting arm 526 is energized by the torsion coil spring 527 so that it is rotated counterclockwise against the rotary shaft 524, the printing plate 50 is elastically pressed against the plate cylinder 3 by the plate-holding rollers 525. Thus, in conjunction with the rotation of the plate cylinder 3, while being pressed against the plate cylinder 3 by the plate-holding rollers 525, the printing plate 50 is tightly wound onto the plate cylinder 3.

Figure 46:
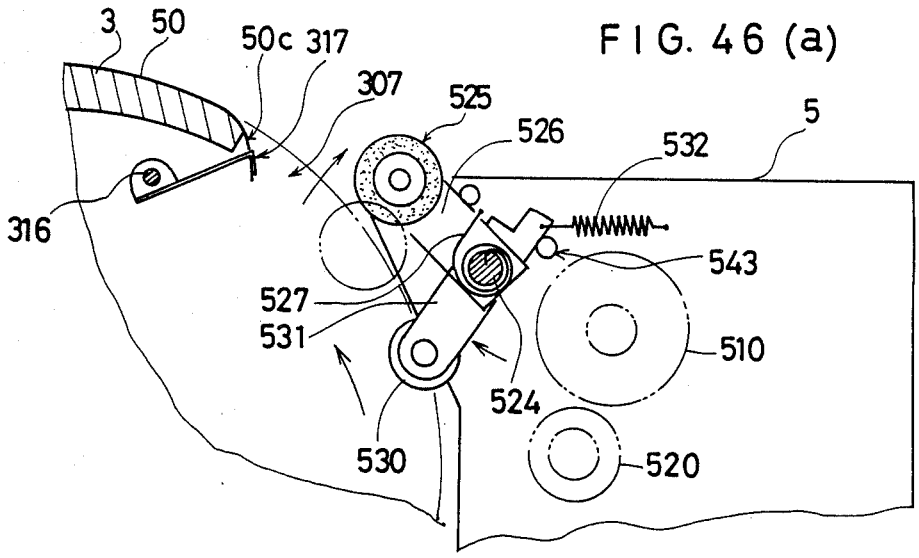
FIGS. 46(*a*) and (*b*) respectively explain the operations needed for unlocking the plate holding rollers.
Figure 46:
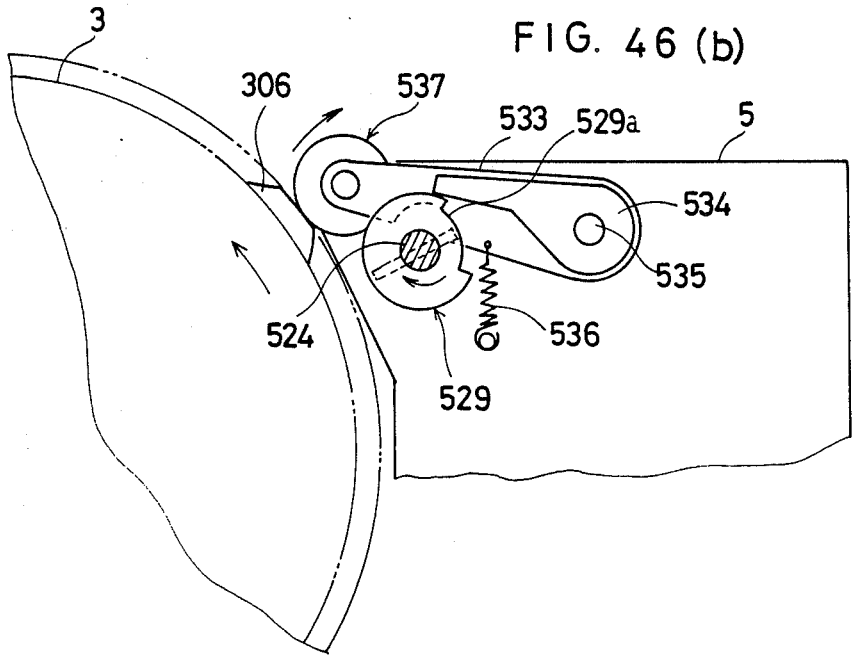

On the other hand, an unlocking cam 306 is secured to the external circumference of the plate cylinder 3 in the position opposite from an unlocking roller 537 as shown in FIG. 46(*b*). Immediately after completing the plate feeding operation, the unlocking roller 537 runs over the unlocking cam 306. This causes the latchet 534 integrally set to the unlocking arm 533 to be rotated clockwise pivoting the shaft 535, and as a result, the tip end of the latchet 534 is disengaged from the concave 529*a* of the latchet wheel 529. As shown in FIG. 46(*a*), the latchet wheel 529 is energized by the spring 532 via the shaft 524 and the arm 531 for rotating clockwise, and thus, when the latchet 534 is disengaged from the concave 529*a*, the latchet wheel 529 keeps rotating clockwise until coming into contact with the arm 531. When the shaft 524 rotates clockwise, the roller-supporting arm 526 also rotates clockwise, thus allowing the plate-holding rollers 525 to leave the plate cylinder 3.

(i) A plate-end hook-reset cam mechanism

Figure 47:
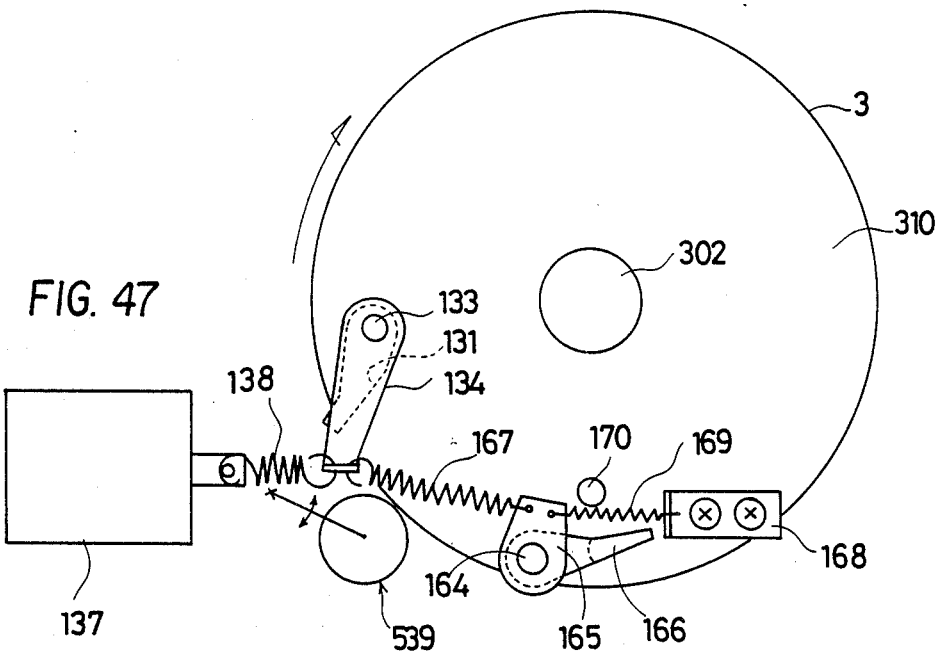
FIG. 47 explains the operations of the plate-end hookset cam mechanism.

A plate-end hook-reset cam mechanism is installed to the right-side board 102 of the printing press body 1 as shown in FIG. 47. A link 165 and a plate-end hook-reset cam 166 are respectively secured to the external and internal edges of the shaft 164 which is installed through the right-side board 102 (not shown) so that it can freely rotate itself. In addition, a spring 167 is set between the link 165 and the lever 134 (which is already described in reference to FIG. 33). In addition, another spring 169 is set between the link 165 and a spring-holder 168 which is secured to the external surface of the right-side board 102.

Figure 48:
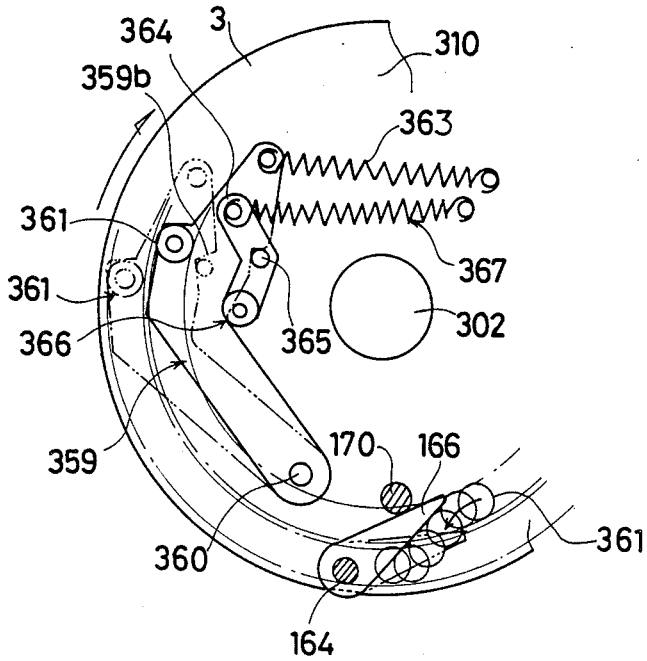

These make up the plate-end hook-reset cam mechanism, while the functions of this mechanism are described below. When the solenoid 137 is activated, the lever 134 rotates clockwise pivoting the shaft 164, thus causing the link 165 to be rotated in the counterclockwise direction pivoting the shaft 164 via the spring 167. As a result, the plate-end hook-reset cam 166 secured to the shaft 164 also rotates counterclockwise. As shown in FIG. 48, rotation of the plate-end hook-reset cam 166 is inhibited by engaging itself with the stopper 170 which projects itself inside of the right-side board 102 of the printing press body 1. The activated state of the plate-end hook-reset cam 166 lasts while the solenoid 137 remains activated. When the solenoid 137 is OFF, operations reversing the procedure described above are executed. In other words, tractive force is released from the solenoid 137 to cause the lever 134 and the link 165 to respectively rotate themselves in the direction opposite from the operations described above by effect of tensile force from the spring 169. This causes the plate-end hook-reset cam 166 to eventually return to the original position to reset the entire operations.

(j) A plate-end hook operation mechanism

Figure 49:
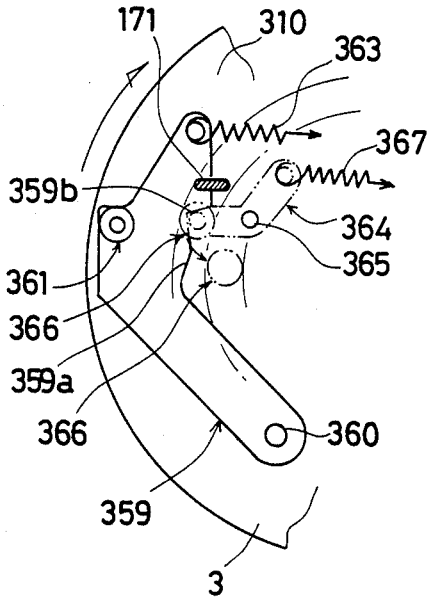

A plate-end hook operation mechanism is installed to the right side 310 of the plate cylinder 3 as shown in FIGS. 48 through 51. The plate-end hook operation mechanism is comprised of the following: As shown in FIGS. 48 and 49, a link 359 is installed to the external surface of the right-side 310 of the plate cylinder 3 via a shaft 360 so that the link 359 can freely rotate itself. A cam follower 361 is set to the external surface of the link 359, whereas a pin 362 is projectively set to the internal surface of the link 359 as shown in FIG. 51. In addition, a tension spring 363 is installed between the tip end of the link 359 and the right side 310, thus allowing the link 359 to be energized so that it can rotate clockwise pivoting the shaft 360. Another link 364 is set to the external surface of the right side 310 via a shaft 365 so that the link 364 can freely rotate. A roller 366 is set to an end of the link 364, in which the roller 366 has the shaft end engaged with internal edge 359*a* of the link 359 so that it can freely rotate. A tension spring 367 is installed between the other end of the link 364 and the right side 310, thus allowing the link 364 to be rotated clockwise pivoting the shaft 365. When the link 364 is in the position for executing clockwise rotation shown in FIG. 49, it latches the link 359 at the position where the link 359 rotates counterclockwise by a specific angle pivoting the shaft 360 against tensile force from the spring 363 by causing the edge of the roller 366 to be engaged with the concave 359*b* of the link 359, thus eventually locking the link 359.

Figure 50:
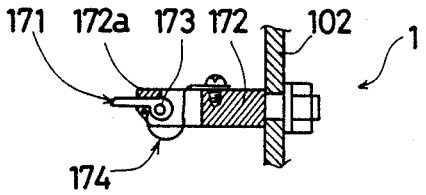
Figure 50:
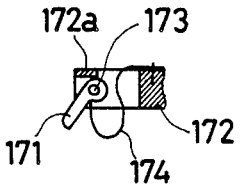

On the other hand, a plate-end hook setting cam 171 for unlocking the link 359 is installed to the printing press 1 body in the position corresponding to the link 364. As shown in FIG. 50, the plate-end hook setting cam 171 is set to the tip end of a cam-securing member 172 set to the internal surface of the right-side board 102 of the printing press body 1 via a horizontal shaft 173 so that the cam 171 can freely rotate. The plate-end hook setting cam 171 is energized by a spring 174 so that it can rotate clockwise, while the rotation of the cam 171 is constrained by a stopper member 172*a* of the cam-securing member 172 at the position at which the cam 171 is held horizontal posture. When the plate cylinder 3 rotates clockwise while the link 359 remains locked as shown in FIG. 49, the plate-end hook setting cam 171 is engaged with the link 364 to cause the link 364 to rotate counterclockwise pivoting the shaft 365, thus unlocking the link 359. Note that, when manually rotating the plate cylinder 3 in the counterclockwise direction during maintenance services, the plate-end hook setting cam 171 engages with the link 364. When this condition is present, since the cam 171 rotates counterclockwise pivoting the horizontal shaft 173 as shown in FIG. 50(*b*) due to pressure from the link 364, neither the link 364 nor the cam 171 can be damaged.

On the other hand, as described earlier, the plate-end hooks 317 are secured to the hook shaft 316 shown in FIG. 51, which is energized by a torsion coil spring 318 so that they can rotate counterclockwise, and as a result, the link 319 secured to the right edge of the hook shaft 316 is engaged with a pin 362 installed to the link 359.

Figure 52:
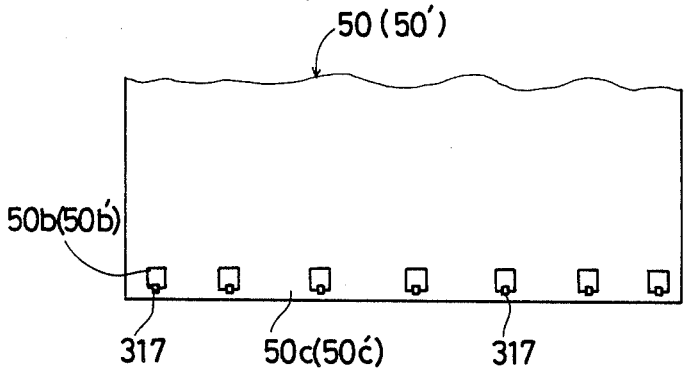

Next, function of the plate-end hook operation mechanism is described below. As shown in FIG. 48, after activating the plate-end hook-reset cam 166 by applying procedure described earlier, when the unlocked link 359 rotates itself up to the position of the plate-end hook-reset cam 166 by the clockwise rotation of the plate cylinder 3 as shown by solid line of FIG. 48, the cam follower 361 of the link 359 runs over the plate-end hook-reset cam 166. This causes the link 359 to rotate counterclockwise up to the position denoted by broken line of FIG. 48 pivoting the shaft 360 against tensile force from the spring 363. When the link 359 rotates counterclockwise, the link 364 is rotated clockwise pivoting the shaft 365 by tensile force from the spring 367. As a result, the pivoting shaft-end of the roller 366 engages with the concave 359*b* of the link 359 so that the link 359 can be locked at the position denoted by imarginary line of FIG. 48. When the link 359 rotates counterclockwise by the predetermined angle, in conjunction with this rotation, the pin 362 set to the link 359 moves to the left as shown in FIG. 51. As a result, this causes the link 319 engaged with the pin 362 rotates clockwise pivoting the hook shaft 316 against the energized force from the spring 318, thus causing the plate-end hooks 317 secured to the hook shaft 316 to rotate clockwise together with the hook shaft 316. In this case, as shown in FIGS. 52 and 53, if the printing plate 50' were mounted onto the plate cylinder 3, due to the clockwise rotation of the plate-end hooks 317, the plate-end hooks 317 are disengaged from the plate-end holes 50*c'*, thus eventually releasing the plate-end clamping operation.

After continuous rotation, when the plate cylinder 3 reaches its rotation position shown in FIG. 49, the roller 366 of the link 364 then comes into contact with the plate-end hook-setting cam 171 so that the link 364 can be rotated counterclockwise pivoting the shaft 365. As a result, the edge of the roller 366 is disengaged from the concave 359*b* of link 359 to cause the link 359 to be rotated clockwise pivoting the shaft 360 by the energized force from the spring 363. When the link 359 rotates clockwise, as shown in FIG. 51, the link 319 is disengaged from the pin 362 to allow the plate-end hooks 317 to be rotated counterclockwise by the energized force from the spring 318. As shown by the imagenary line of FIG. 51(*a*), the plate-end hooks 317 rotate counterclockwise while the plate-holding rollers 525 follows up its "contacting" operation. As a result, when the next printing plate 50 is supplied, the plate-end hook 317 then rotates counterclockwise while holding the plate-end 50*c* inside of the aperture 307 of the plate cylinder 3 by means of the plate holding rollers 525. As a result, the plate-end hooks 317 is caught by the plate-end holes 50*b*, thus allowing the plate-end 50*c* to be latched while being pulled in the direction of tangent of the external circumference of the plate cylinder 3.

(k) A mechanism for detecting a clamped printing plate and a deviated printing plate As shown in FIG. 35(*b*), a mechanism for detecting a clamped printing plate and deviated printing plate is installed to the right side of the plate cylinder 3. This mechanism is comprised of the following: A mark member 375 is set to the link 319 secured to the right edge of the hook shaft 316. The plate-cylinder supporting shaft 302 is provided with a shaft-to-shaft distance regulation member 305 so that the member 305 can correctly keep the predetermined posture against the printing press body 1. The shaft-to-shaft distance regulation member 305 is provided with a photoelectric sensor 376 in the position corresponding to the mark member 375. The surface of the mark member 375 facing photoelectric sensor 376 is photoreflective. The photoelectric sensor 376 is comprised of light-emitting and light-receptive elements. When the mark member 375 is exactly set to the position facing the photoelectric sensor 376 by the rotation of the link 319, light from the light-emitting element is reflected by the mark member 375 before being incidented to the light-receptive element.

FIGS. 53(*b*) through (*d*) respectively denote the plate-end clamped condition after feeding a printing plate. The curve line 377 denoted by means of 2-dot chained line indicates a track of the position detected by the photoelectric sensor 376 shown in FIG. 35(*b*) in accordance with the rotation of the plate cylinder 3. As shown in FIG. 35(*a*) and (*b*), when the plate end 50*c* is correctly latched by the plate-end hooks 317, the mark member 375 is off from the curve line 377, thus the mark member 375 cannot be detected by the photoelectric sensor 376. Conversely, as shown in FIG. 53(*c*), if the plate-end holes 50*b* expand by damage or the plate head is incorrectly latched, the plate-end hooks 317 latches the plate end 50*c* at the farther position of the counterclockwise rotation than that of FIG. 53(*b*). Accordingly, the mark member 375 also rotates counterclockwise pivoting the hook shaft 316 by the amount exactly corresponding to the amount rotated by the plate-end hooks 317 counterclockwise. This causes the mark member 375 to be on the curve line 377, and as a result, the photoelectric sensor 376 detects the presence of the mark member 375. Conversely, as shown in FIG. 53(*d*), if the plate-end hooks 317 don't latch plate end 50*c*, the link 319 rotates counterclockwise until it is engaged with the pin 362. Even when this operation is underway, since the mark member 375 is led to the curve line 377, the photoelectric sensor 376 correctly detects the presence of the mark member 375.

In this way, when the plate end 50*c* is correctly latched by plate-end hooks 317, the photoelectric sensor 376 doesn't detect the presence of the mark member 375, whereas the photoelectric sensor 376 detects the presence of the mark member 375 only when either the position of the printing plate 50 deviates or the plate end 50*c* don't latch, and thus, it makes possible for the control system to automatically detect the errors such as deviating of the printing plate 50 and/or the miss-latching of the plate end 50*c* in accordance with the signal from the photoelectric sensor 376. The signal from the photoelectric sensor 376 is delivered to the microprocessor 21 shown in FIG. 2, which then identifies whether the plate-winding operation is correctly executed or not. If any error exists, the operation of the printing press immediately stops by the command from the microprocessor 21.

(l) Sectional constitution of the plate cylinder

FIG. 55 denotes a sectional view of the plate cylinder 3. As shown here, corners of the aperture edge surface and external circumferential surface of the plate cylinder 3 are provided with "R" configuration. More particularly, in the position of the plate-head holding mechanism, the plate-head contacting surface 369 is substantially made of flat surface crossing the assumed broken line 371 connecting the centers of aperture 307 and plate cylinder 3 at right angle, while the corners of the plate-head contacting surface 369 and the plate-cylinder external circumferential surface 372 are respectively provided with smooth curve surface having radius $R_1$. On the other hand, in the position of the plate-end holding mechanism, aperture edge surface 373 is substantially made of flat surface crossing the assumed broken line 371 in right angle, while the corners of the aperture edge surface 373 and the plate-cylinder external circumferential surface 372 are respectively provided with smooth curve surface having radius $R_2$. The "R" configuration provides the entire system with significant advantages described below. First, the plate head 50*a* is tightly pressed against the plate-head contacting surface 369 by the plate-head clamping nails 312. Then, when the printing plate 50 is wound onto the external circumferential surface 372 of the plate cylinder 3 while being held by the plate-holding roller 525 shown in FIG. 32, the printing plate 50 is tightly wound onto the plate cylinder 3 without generating even the slightest gap. Furthermore, when the plate end 50*c* is held by plate-end hooks 317 so that it is inwardly pulled to the aperture of the plate cylinder 3, the plate winding operation can be done by tightly fitting the plate end 50*c* against the external surface of the plate cylinder 3. As a result, it is possible for the system to accurately wind the printing plate 50 onto the designated position of the plate cylinder 3. In this preferred embodiment, the radiuses $R_1$ and $R_2$ are respectively provided with 15 mm of length against 76.5 mm of the radius of the plate cylinder 3 for example.

(4) Procedure for manufacturing the printing plate and its constitution

Preceding the explanation of the automatic plate feeding/discharging operations, the procedure for manufacturing and the constitution of the printing plate 50 used for the printing press are described below. The plate 50 is manufactured by the procedure shown in FIG. 56. Concretely, as shown in FIG. 56(*a*), an original plate 51 made of multiplied photosensitive resin layers laid on polyester film base is accurately cut into a specific size using a knife. Next, as shown in FIG. 55(*b*), the plate-head position of the original plate 51 is provided with plate-head holes 50*d* in the position corresponding to the positioning pins 315 shown in FIG. 35. Likewise, plate-end holes 50*b* are provided for the plate-end position of the original plate 51 so that they correspond to the plate-end hooks 317 shown in FIG. 35*a*. The positions of the plate-head holes 50*d* and plate-end holes 50*b* are respectively determined by referring to four sides of the original plate 51 including the both sides 51*a*, the plate-end side 51*b*, and the plate-head side 51*c*.

On the other hand, a printing pattern 53 and register marks 54 are respectively drawn on the original-plate film 52 shown in FIG. 35(*c*) by applying a conventional precision register marking device. Also, in reference to the register mark 54 thus drawn, positioning holes 55 are formed at the plate-end position of the original plate film 52 in order that it corresponds to the plate-head holes 50*d*. In this case, the center positioning hole 55 is provided with perfect roundness having the identical size to that of the plate-head hole 50*d*. In consideration of the thermal expansion of the original plate film 52, both sides of the original-plate film 52 are provided with lengthy positioning holes 55 having the long axis in the horizontal direction.

Next, positioning pins (not shown) are provided through the positioning holes 55 and the plate-head holes 50*d* before laying the original-plate film 52 on the original plate 51. After completing the positioning of the printing plate, exposure process shown in FIG. 56(*e*) is then executed to allow the printing pattern 53 to be printed to the designated position of the original plate 51. After completing the exposure process, developing process shown in FIG. 56(*f*) is applied to the prepared plate, thus a complete printing plate 50 is eventually produced.

(5) Plate feeding/discharging operation

Next, the plate feeding and discharging operation before replacing the printing plate is described below. FIGS. 57A and 57B are the flowcharts describing the operation of microprocessor 21 shown in FIG. 2 when the microprocessor 21 receives the plate-replacing command signal for example from the plate-replacing key of the operation panel depressed by the operator.

When the plate-replacing command signal is generated, the microprocessor 21 then judges in the step S30 whether the command signal is acceptable, or not. If the command signal is not acceptable, the microprocessor 21 allows the entire operations to be completed. If the command signal is acceptable, operation mode proceeds to the next step S31.

When step S30 is entered, the microprocessor 21 judges whether the printing plates are set on the plate feeding/discharging trays 9 and 10 or not. Concretely, the printing plates are set by the procedure described below. See FIG. 32. The plate-head holes 50*d* of the printing plate 50 to be newly printed (hereinafter called new plate) is slightly inserted between the plate-feeding driving rollers 510 and the auxiliary plate-feeding driving rollers 520. The rollers 520 remain apart from the rollers 510 when the plate-head holes 50*d* is inserted between these. Then, both sides of the new plate 50 are properly positioned along the lateral positioning members 904 of the plate feeding/discharging tray 9 or 10 shown in FIG. 34. Likewise, the plate-end edge of the new plate 50 is properly positioned along the plate-end positioning member 903 of the plate feeding/discharging tray 9 or 10. Using the sensor 544 (see FIG. 3(*c*)) detecting the presence of the printing plate installed to the plate feeding/discharging unit 5 or 6, the microprocessor 21 judges whether the new plate 50 is set in position or not while the step S31 is underway.

If the microprocessor 21 judges that the new plates 50 are set to the plate feeding/discharging trays 9 and 10 i.e., when executing two-color printing, the operation mode proceeds to the step S33 on the condition that the state in which the inking units 7 and 8 are both correctly set in the position should be confirmed while the step S32 is still underway. When the step S33 is entered, a type-data is set to the condition "3" for example so that this can be stored in the memory. While the step S31 is underway, if the microprocessor 21 judges that the new plate 50 is merely set to the plate feeding/discharging tray 9 of the upper-stage, i.e., when executing one-color printing operation, the operation mode proceeds to the step S34 on the condition that the state in which the inking unit 7 of the upper-stage is properly set should be confirmed while the step S34 is still underway. When the step S35 is entered, a type-data is set to the condition "1" for example, which is stored in the memory. When the step S31 is underway, if the microprocessor 21 judges that the new plate 50 is merely set to the plate feeding/discharging tray 10 of the lower-stage, i.e., when executing one-color printing operation, the operation mode proceeds to the step S37 on the condition that the state in which the inking unit 8 of the lower-stage is correctly set should be confirmed while the step S36 is still underway. When the step S37 is entered, a type-data is set to the condition "2", which is then stored in the memory. In addition, when the step S31 is underway, if the microprocessor judges that the new plate 50 is not set to either of the plate feeding/discharging trays 9 and 10, i.e., when executing the plate discharging operation, the operation mode proceeds to the step S38, where a type-data is set to the condition "0" for example, which is then stored in the memory. If the designated inking unit 7 or 8 were not loaded while any of the steps S32, S34 and S36 is underway, the operation mode proceeds to the step S38 to display ERROR before discontinuing the entire operations.

After completing provision of the type-data while any of the steps S33, S35, S37 and S38 is underway, the operation mode then proceeds to the step S40 to execute mechanical initializing operation. This causes the plate cylinders 3 and 4 and the impression cylinder 11 to depart from blanket cylinder 2, and in addition, inking units 7 and 8 are set to the positions where they can depart from the plate cylinders 3 and 4.

Next, when the step S40 is entered, a low-speed motor is turned ON and a high-speed motor OFF. Thus allowing the blanket cylinder 2, the impression cylinder 11, the plate cylinders 3 and 4, and form rollers of inking units 7 and 8 to respectively start to rotate at a speed slower than the normal printing operation.

Next, when the step S42 is entered, the microprocessor 21 judges the state of the type-data stored in the memory. If the state of the type-data is judges to be "3", i.e., when feeding the upper and lower printing plates, the operation mode proceeds to the step S43 to allow the plate cylinders 3 and 4 to respectively execute the plate feeding/discharging operation. When the type-data is judged to be in the state "1", i.e., when feeding only the upper printing plate, the operation mode proceeds to the step S44 to allow the plate cylinder 3 to feed and discharge the printing plates and the plate cylinder 4 to merely discharge the printing plate. Likewise, if the type-data is judged to be in the state "2", i.e., when feeding only the lower printing plate, the operation mode proceeds to the step S45 to allow the plate cylinder 4 to feed and discharge the printing plates and the plate cylinder 3 to merely discharge the printing plate. When the type-data is judged to be in the state "0", i.e., when merely discharging the printing plates, the operation mode proceeds to the step S46 to allow both the plate cylinders 3 and 4 to merely discharge the printing plates. In this case, the difference between the plate feeding/discharging operation and the plate-discharging operation merely arises from the presence or absence of the driving force generated by the pulse motor 509 shown in FIG. 29(*d*) that rotates the plate-feeding driving rollers 510 and the auxiliary plate-feeding driving rollers 520 shown in FIG. 33. In other words, when executing the plate feeding/discharging operation, the pulse motor 509 is driven for a specific period of time using the predetermined timing to forward the printing plate, whereas the pulse motor 509 remains OFF when executing only the plate-discharging operation without feeding the printing plate at all.

After completing the entire operations needed for feeding and discharging the printing plates while the operation mode remains in the steps S43 through S46, the operation mode is entered the stap S47, in which the low-speed motor turns OFF and the high-speed motor ON, thus the slow-speed rotation of the blanket cylinder 2, the impression cylinder 11, the plate cylinders 3 and 4, and the form rollers of inking units 7 and 8 is switched to the high-speed rotation. This completes the entire operations needed for replacing the printing plates, while these sequential operations are activated by the microprocessor 21 shown in FIG. 2 when receiving the plate-replacing command signal from the key-input operation.

Referring now to the timing chart shown in FIG. 54, the plate feeding/discharging operations including those operations executed by a variety of mechanical components are described below. Note that the following describes those specific examples in which a new plate 50 is placed on the plate-feeding table 901 of the plate feeding/discharging tray 9, and yet, a printing-completed plate 50' (hereinafter called the printed plate) is wound on the plate cylinder 3, i.e., denoting the state in which the plate feeding/discharging operation is executed on the part of the plate cylinder 3. In the case of the other situations, since the plate feeding/discharging operations are executed based on the principles identical to those which are described above, the description of these is deleted.

First, on receipt of the plate-replacing command signal, when the plate cylinder 3 starts to rotate itself, the plate-discharging driving rollers 511 connected to the plate-cylinder gear 301 starts to rotate counterclockwise at a constant speed via gear mechanism as shown in FIG. 33. While the plate feeding/discharging operations are underway, the plate-discharging driving rollers 511 continues their rotation.

Next, as soon as the plate cylinder 3 reaches the predetermined rotation position at time "$t_1$", the solenoid 150 shown in FIG. 36 is activated to cause the set-lever 153 to rotate counterclockwise pivoting the shaft 151 to also rotate the plate feeding/discharging cam 157 and the plate-discharging cam 163 shown in FIG. 38 counterclockwise before being locked by the lock-lever 159.

Next, as soon as time "$t_2$"is reached, the solenoid 150 turns OFF itself, whereas the plate feeding/discharging cam 157 shown in FIG. 36 still remains being locked by the lock-lever 159, thus allowing the plate feeding/discharging cam 157 and the plate-discharging cam 163 shown in FIG. 38 to be respectively latched at the designated rotation positions.

When time "$t_3$" is reached through the rotation of the plate cylinder 3, the roller 341 of the link 338 runs over the plate feeding/discharging cam 157 as shown in FIG. 41, thus allowing the link 338 to rotate clockwise pivoting the shaft 339 to cause the link 334 to be pushed in the direction of the external surface of the plate cylinder 3 by the roller 342 before unlocking the plate-head clamping vice mechanism. This allows the nail shaft 311 to rotate counterclockwise.

Next, when time "$t_4$" reached, the solenoid 146 shown in FIG. 32 turns ON itself to activate the counterclockwise rotation of the driver-lever 140 pivoting the drive shaft 142. This cause the operation lever 521 to be rotated clockwise pivoting the driving shaft 518 before the auxiliary plate-feeding driving rollers 520 are pressed against the plate-feeding driving rollers 510. As a result, the head of the new plate 50 is nipped by the rollers 510 and 520. On the other hand, the solenoid 137 shown in FIG. 33 turns ON itself to cause the driver lever 131 to be rotated clockwise pivoting the driving shaft 133. This allows the operation lever 541 to be rotated in the counterclockwise direction pivoting the rotary shaft 538 so that the plate-holding rollers 539 can correctly be set to the position allowing its contact with the plate cylinder 3. The plate-holding rollers 539 come into contact with the plate cylinder 3 when they are moved to the aperture 307 of the plate cylinder 3. When the solenoid 137 is ON, the link 165 and the shaft 164 shown in FIG. 47 respectively rotate counterclockwise, thus allowing the plate-end hook-reset cam 166 to be set to the position shown in FIG. 48.

When time "$t_5$" is reached, the roller 320 of the link 322 shown in FIG. 41(*a*) runs over the plate feeding-/discharging cam 157 to cause the link 321 to be rotated counterclockwise together with the nail shaft 311 shown in FIGS. 41(*b*) and (*c*) so that the plate-head clamping nails 312 can open themseleves. When the nail shaft 311 rotates counterclockwise, the link 355 shown in FIG. 44 also rotates counterclockwise as shown in FIG. 44(*c*) and (*d*), thus eventually setting the plate-holding roller cam 356 in position.

Next, when time "$t_6$" is reached, as shown in FIG. 38(*b*), the plate-holding rollers 539 run over the plate cylinder 3 by passing through the aperture 307 to cause the head of the printed plate 50′ wound on the plate cylinder 3 to be nipped by the plate-holding rollers 539 and the plate cylinder 3. On the other hand, as shown in FIG. 38(*a*), the cam follower 350 runs over the plate-discharging cam 163. Then, as the plate cylinder 3 keeps on rotating itself, the plate extrusion nails 344*a* protrude themselves to extrude the plate head 50*a*′ of the printed plate 50′ from the plate-head positioning pins 315 at the moment when time "$t_7$" is reached. This disengages the head 50*a*′ of the printed plate 50′ from the state of being clamped.

Next, when time "$t_8$" is reached, as shown in FIG. 40(*a*), the cam follower 350 moves its position to the second cam surface 163*b* of the plate-discharging cam 163 so that the plate-extrusion nails 344*a* can return to the original state of withdrawal. On the other hand, the plate head 50*a*′ of the printed plate 50′ is delivered between the plate-discharging guides 517 and the plate-discharging driving rollers 511 as shown in FIG. 40(*b*). After allowing the passage of the plate head 50*a*′ of the printed plate 50′ through the plate-discharging guides 517 and the plate-discharging driving rollers 511, the printed plate 50′ is delivered to the plate-discharging table 902 of the plate-feeding/discharging tray 9 by the plate-discharging driving rollers 511 shown in FIG. 33.

Next, when time "$t_9$" is reached, as shown in FIG. 44(*d*), the plate-holding activation rollers 530 of the plate feeding/discharging unit 5 run over the plate-holding rollers cam 356 to allow the plate-holding roller 525 shown in FIG. 45(*a*) to be correctly set to the plate holding position. The contacting operation between the plate-holding activation rollers 530 and the plate-holding roller cam 356 is done while plate-holding roller 525 are exactly at the aperture 307 of the plate cylinder 3. As soon as the plate-holding rollers 525 are set to the plate holding position, the latchet 534 shown in FIG. 45(*b*) is engaged with the concave 529*a* of the latchet wheel 529 to allow the plate-holding rollers 525 to be securely locked in the plate-holding position.

Next, when time "$t_{10}$" is reached, the activated pulse motor 509 shown in FIG. 29(*d*) provided for the plate feeding/discharging unit 5 drives the main plate-feeding driving rollers 510 and the auxiliary plate-feeding driving rollers 520 to allow the new plate 50 nipped by these rollers 510 and 520 to be delivered, while the head 50*a* of the new plate 50 is first forwarded to the space 368 between the plate-head clamping nails 312 and the plate-head positioning pins 315. As soon as the plate head 50*a* is delivered to the predetermined position inside of space 368, as shown in FIG. 42, the roller 320 of the link 322 reaches the concave 157*c* of the plate feeding/discharging cam 157, thus allowing the plate-head clamping nails 312 to close itself at the moment when time "$t_{11}$" is present. Next, when time "$t_{12}$" is reached, the positioning pins 315 are first engaged with the pin holes of the plate head 50*a*, and then the plate head 50*a* is securely pressed against the plate cylinder 3 by the plate-head clamping nails 312.

While the plate head 50*a* is thus latched, as shown in FIG. 44, in conjunction with the rotation of nail shafts 311, the plate-holding roller cam 356 returns to the reset condition shown in FIG. 44(*c*) from the activated state shown in FIG. 44(*d*).

Immediately after the plate-head clamping is done, as shown in FIG. 45(*a*), the plate-holding rollers 525 run over the plate cylinder 3 after passing through the aperture 307 of the plate cylinder 3 to allow the plate-holding rollers 525 to press the new plate 50 against the plate cylinder 3.

Next, when time "$t_{13}$" is reached, the pulse motor 509 turns OFF itself, thus causing both rollers 510 and 520 shown in FIG. 32 to stop forwarding operation of the new plate 50. Then, the new plate 50 being nipped by both rollers 510 and 520 shown in FIG. 32 is drawn out of the plate-feeding table 901 by the rotation force of the plate cylinder 3. In the meantime, the pressure from the plate-holding rollers 525 against the plate cylinder 3 effectively prevents the new plate 50 from incurring even the slightest slack before the new plate 50 is eventually wound onto the plate cylinder 3. Immediately after both rollers 510, 520 have stopped the plate-forwarding operation as shown in FIG. 32, the detection means such as the encoder of pulse motor 509 for example correctly detects whether these rollers 510 and 520 are continuously rotated, or not. The microprocessor 21 shown in FIG. 2 eventually judges whether such a rotation actually occurs with these rollers 510, 520 or not by checking to see that the predetermined number of pulses are correctly output from the encoder of the pulse motor 509 within a specific period of time immediately after the pulse motor 509 is OFF in accordance with the command signal from the microprocessor 21 itself. If the rotation is detected, in other words, when the plate-head clamping nails 312 still locks the plate head 50*a*, the microprocessor 21 generates the command signal for continuously executing the plate feeding/discharging operation. Conversely, if the rotation is not detected, in other words, when the plate-head clamping nails 312 incorrectly locks the plate head 50*a*, the microprocessor 21 generates the command signal to immediately stop the operation of the motor 20 of the printing press shown in FIG. 1 for terminating the plate feeding/discharging operation on the way of the printing operation. When allowing the plate feeding/discharging operation to be continuously executed, immediately after time "$t_{13}$" is past, the lock-lever 159 is kicked upward by the roller 320 of the link 322 as shown in FIG. 42 to eventually unlock the plate feeding/discharging cam 157 and the plate-discharging cam 163 shown in FIG. 38(*a*).

Figure 43:
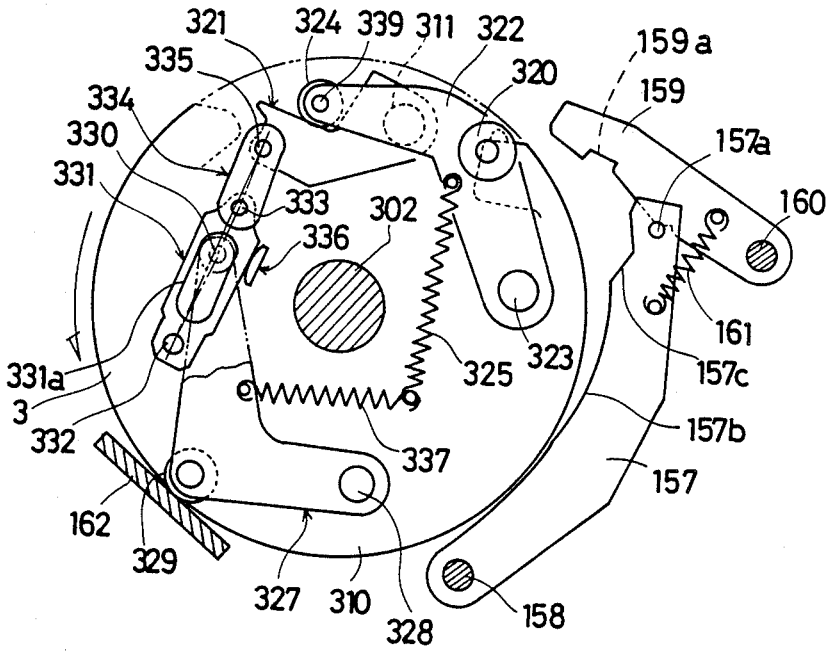
Figure 44A:
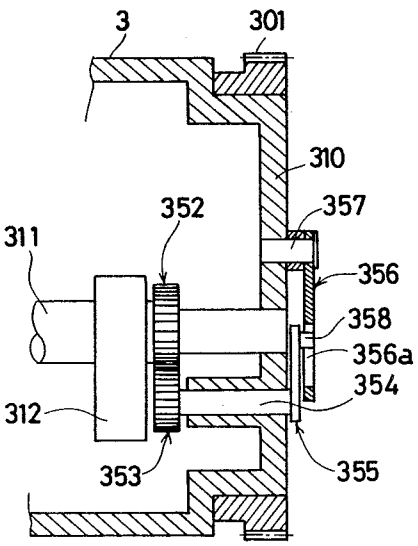
FIGS. 44(*a*), (*b*), (*c*) and (*d*) respectively explain the operations of the cam mechanism in relation to the plate-holding rollers.
Figure 44B:
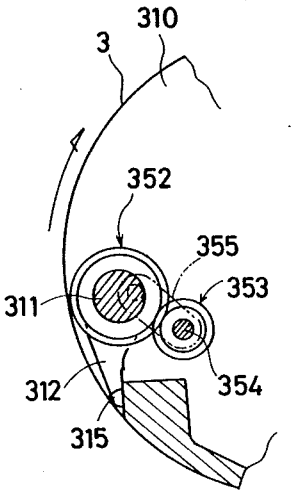
Figure 44C:
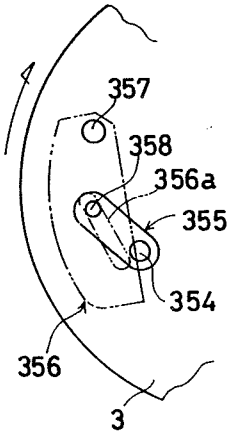
Figure 44D:
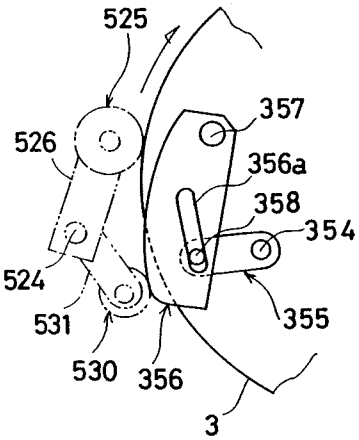

Next, when time "$t_{14}$" is reached, the plate-head clamping vice mechanism is locked. Concretely, first, as shown in FIG. 42, the roller 329 of the link 327 is pressed against the plate-head clamping-nail locking cam 162 to cause the link 327 to rotate clockwise pivoting the shaft 328 as shown in FIG. 43. As a result, the link 331 rotates clockwise pivoting the shaft 332 to move the pin 333 by a negligible distance towards inner part of the plate cylinder 3 than the straight line connecting the shaft 332 and the pin 335 across the top dead center, thus allowing the link 331 to lock itself. While the link 331 remains being locked itself, the link 321 forcibly rotates clockwise together with the nail shaft 311. This provides the plate-head clamping nails 312 with powerful pressure which allows the plate head 50*a* to be securely locked.

Next, when time "$t_{15}$" is reached, the clamped condition of the plate end of the printed plate 50' is released. Concretely, the cam follower 361 of the link 359 runs over the plate-end hook-reset cam 166 shown in FIG. 48, thus causing the link 359 to rotate counterclockwise pivoting the shaft 360, whereas the link 364 is rotated clockwise pivoting the shaft 365 by the energized force from the spring 367 so that the link 359 can securely be locked in its counterclockwise rotation position. When the link 359 rotates counterclockwise, the link 319 shown in FIG. 51 is pressed by the pin 362 of the link 359 so that it starts to rotate clockwise together with the hook shaft 316. As a result, the plate-end hooks 317 also rotates clockwise to disengage themselves from the plate-end holes 50'*b* of the printed plate 50' to completely free the printed plate 50' from the plate-end clamping mechanism.

Next, when time "$t_{16}$" is reached and then the plate-head holes 50*d'* of the printed plate 50' shown in FIG. 33 passes through the plate-holding rollers 539, the solenoid 137 turns OFF. This causes the driving lever 131 to rotate counterclockwise pivoting the driving shaft 133, thus causing the operation lever 541 to be rotated clockwise pivoting the rotary shaft 538 by the energized force from the return spring. This allows the plate-holding rollers 539 to leave the plate cylinder 3. Then, while being forwarded by the plate-discharging driving rollers 511, the printed plate 50' is eventually stored inside of the plate-discharging table 902, thus completing the operation needed for discharging the printed plate 50'. On the other hand, when the solenoid 137 turns OFF, the link 165 and the shaft 164 shown in FIG. 47 are respectively rotated clockwise by the tensile force from the spring 169, thus eventually causing the plate-end hook-reset cam 166 to also rotate clockwise before returning to reset position.

Next, when time "$t_{17}$" is reached, the end position of the new plate 50 is clamped. Concretely, as shown in FIG. 51(*a*), as soon as the plate-holding rollers 525 passe through the external circumference of the plate cylinder 3, the plate-holding rollers 525 is led inside of aperture 307 by the energized force from the spring 527 shown in FIG. 45, and at the same time, the plate-holding rollers 525 causes the plate end 50*c* of the new plate 50 to be compulsorily inserted into the circumference of the plate cylinder 3. On the other hand, the plate-end hook setting cam 171 shown in FIG. 49 engages itself with the roller 366 of the link 364 simultaneous with the timing of inserting the plate end 50*c* of the new plate 50 into the aperture 307. As a result, the link 364 starts to rotate counterclockwise pivoting the shaft 365, thus unlocking the link 359, which is then rotated clockwise pivoting the shaft 360 by the tensile force from the spring 363. When the link 359 rotates clockwise, the engagement of the link 319 with the pin 362 shown in FIG. 51(*b*) is released so that the link 319 can be rotated counterclockwise together with the hook shaft 316 by the energized force from the torsion coil spring 318, thus causing the plate-end hooks 317 to also rotate counterclockwise. Those serial operations from the engagement of the plate-end hook setting cam 171 with the roller 366 of the link 364 to the activation of the counterclockwise rotation of the plate-end hooks 317 are instantly executed. The counterclockwise rotation of the plate-end hooks 317 engage themselves with the plate-end holes 50*b* of the new plate 50, thus causing the plate end 50*c* of the new plate 50 to be eventually locked by being pulled in the direction of the tangent of the external surface of the plate cylinder 3.

When time "$t_{18}$" is reached immediately after the new plate 50 is wound onto the plate cylinder 3, the plate-holding rollers 525 start to leave the plate cylinder 3. Concretely, as shown in FIG. 46(*b*), the unlocking roller 537 kicks upwards by the unlocking cam 306 to disengage the tip end of the latchet 534 from the concave 529*a* of the latchet wheel 529. As a result, the rotary shaft 524 rotates clockwise on receipt of the tensile force from the spring 532 shown in FIG. 46(*a*) to allow the plate-holding rollers 525 to leave the plate cylinder 3.

Next, when time "$t_{19}$" is reached, the solenoid 146 shown in FIG. 32 turns OFF to cause the driver lever 140 to be rotated clockwise pivoting the drive shaft 142 by the energized force from the spring 144. This also causes the operation lever 521 to be rotated counterclockwise pivoting the driving shaft 518 by the energized force from the return spring. As a result, the auxiliary plate-feeding driving rollers 520 leave themselves from the plate-feeding driving rollers 510, thus eventually completing the entire operations needed for feeding the new plate 50.

Since the plate-feeding mechanism reflecting the preferred embodiment of the present invention executes both the feeding and discharging operations of the printing plates simultaneously while the plate cylinder 3 makes almost a full turn, it is possible for the printing press to effectively shorten time needed for replacing of the printing plates, and at the same time the double plate feeding operation can securely be prevented.

(6) Advantageous effect from the plate-mounting system embodied by the present invention As was described earlier in reference to FIG. 56, the printing plate 50 used for the printing press is provided with the plate-head holes 50*d* whose positions are accurately determined using the both sides 51*a*, the plate-end side 51*b* and the plate-head side 51*c* as the basis. The printing plate 50 is securely set to the designated position of the plate feeding/discharging tray 9 in reference to the both sides 51*a* and the plate-end side 51*b*. The plate-mounting mechanism reflecting the present invention activate the plate feeding/discharging unit 5 to forward the printing plate 50 towards the plate cylinder 3 by the predetermined distance in relation to the rotation of the plate cylinder 3 so that the plate-head holes 50*d* can be engaged with the plate-head positioning pins 315 shown in FIG. 33 set to the plate cylinder 3, thus allowing the printing plate 50 to be accurately mounted onto the plate cylinder 3.

Thus, the plate-mounting mechanism embodied by the present invention provides the plate-head holes 50*d* in reference to four sides of the printing plate 50, and yet, executes the plate-head holding operation after forwarding the printing plate 50 towards the plate cylinder 3 by the predetermined distance on the basis of these four sides. As a result, it is possible to accurately mount the printing plate 50 onto the designated position of the plate cylinder 3.

Note that the positioning of the plate-head holes 50*d* may not always be done in reference to all the four sides of the printing plate 50. In summary, the positioning may be determined in reference to at least two cross sides of the printing plate 50 such as a side 51*a* and the plate-end side 51*b* or a side 51*a* and the plate-head side 51*c* for example. If this method is employed, the plate-forwarding mechanism, i.e., the plate feeding/discharging unit 5 forwards the printing plate 50 on the basis of said two cross sides of the printing plate 50.

(7) Functions of the plate-head clamping vice mechanism and the vice-releasing mechanism For details of the constitutions and functions of the plate-head clamping vice mechansim and the vice-releasing mechanism, review of foregoing descriptions "(e). A plate-head clamping vice mechanism and a voice-releasing mechanism" and "(5) Plate feeding/discharging operation" by referring to FIG. 54. In summary, when time "$t_1$" is reached through the rotation of the plate cylinder 3, the plate feeding/discharging cam 157 is locked. Next, when time "$t_3$" is reached, the roller 341 of the link 338 runs over the plate feeding-/discharging cam 157 so that the vice mechansim is unlocked as shown in FIG. 42. Then, when time "$t_5$" is reached, the roller 320 of the link 322 runs over the plate feeding/discharging cam 157 to open the plate-head clamping nails 312 as shown in FIG. 37(*b*). Next, when time "$t_{12}$" is reached, i.e. when the roller 320 is engaged with the concave 157*c* of the plate feeding/discharging cam 157, the plate-head clamping nails 312 are closed by the energized force from the spring 326 to clamp the plate head as shown in FIG. 42. Next, when time "$t_{13}$" is reached, the roller 320 kicks the lock-lever 159 upwards to unlock the plate feeding/discharging. cam 157. When time "$t_{14}$" is reached immediately after time "$t_{13}$" is past, the roller 329 of the link 327 runs over the plate-head clamping nail locking cam 162 to securely lock the vice mechanism, thus continuously providing the plate-head clamping nails 312 with powerful pressure.

Immediately after the plate-head clamping is done, in addition to the energized force from the spring 326 shown in FIG. 37(*b*), the plate-head clamping nails 312 receive the powerful pressure from the vice mechanism, and as a result, the plate head can solidly be locked, and yet, the printing plate 50 mounted onto the plate cylinder 3 can securely be prevented from falling off while the printing operation is underway. The vice mechanism can automatically be locked and unlocked relative to the rotation of the plate cylinder 3.

(8) Function of the plate-end holding mechanism

As shown in FIGS. 51 through 53(*a*), the plate-end holding operation is executed by the procedure described below. First, the plate-end hooks 317 set to the aperture 307 of the plate cylinder 3 is engaged with the plate-end holes 50*b* of the printing plate 50 wound onto the external surface of the plate cylinder 3, and then the plate-end is pulled in the direction of the tangent of the external circumference of the plate cylinder 3 by the plate-end hooks 317 using the energized force from spring means, thus allowing the plate end to be securely held. Thus, the plate-end holding mechanism related to the present invention pulls the plate end 50*c* towards the tangent of the external surface of the plate cylinder 3 using the energized force from the spring means before securely holding it instead of bending the plate end 50*c* against the aperture edge surface of the plate cylinder 3 before holding it. As a result, even when the plate base film is made of highly rigid material such as polyester film, aluminum, or steel for example, the plate-end holding mechanism embodied by the present invention securely holds the plate-end 50*c* by effectively using the plate-end hooks 317.

(9) Function of the mechanism for detecting a clamped printing plate and a deviated printing plate As shown in FIGS. 35(*b*) and 53(*b*) through (*d*), the mechanism for detecting a clamped printing plate and a deviated printing plate comprised of the mark member 375 and the photoelectric sensor 376 is installed to the right of the plate cylinder 3. According to this plate-detection mechanism, as shown in FIG. 53(*b*), when the plate-end hooks 317 correctly locks the plate end 50*c*, the photoelectric sensor 376 doesn't detect the presence of the mark member 375. Conversely, as shown in FIG. 53(*c*) and (*d*), when the plate is either incorrectly positioned or the plate-end is not caught by the plate-end hooks 317, the photoelectric sensor 376 detects the presence of mark member 375. As a result, in accordance with the signal output from the photoelectric sensor 376, any error in conjunction with the plate-winding operation such as the position-deviated plate and/or failure of the plate holding operation can be detected automatically.

The plate detection mechanism don't limited only the constitution above mentioned. It is possible for the plate detection mechanism to apply every constitution which detects a clamped on delivered printing plate with reference to the rotational position of the plate-end hooks 317.

Note that the plate detection mechanism can concurrently be made available for detecting whether the printing plate 50 is wound onto the plate cylinder 3 or not. Specifically, when the printing plate 50 is wound onto the plate cylinder 3, the rotation position of the plate-end hooks 317 is as shown in FIG. 53(*b*), whereas the rotation position of this hooks 317 is as shown in FIG. 53(*d*) when the printing plate 50 is not wound onto the plate cylinder 3. Thus, like the operation described above, it is possible for the photoelectric sensor 376 to correctly detect the presence or absence of the printing plate 50 on the plate cylinder 3 by method of detecting the mark member 375. If the mark member 375 is detected, i.e., if absence of the printing plate 50 on the plate cylinder 3 is detected, in accordance with the command signal from the microprocessor 21, the control system inhibits the plate-holding rollers 539 shown in FIG. 33 from coming into contact with the plate cylinder 3. This rollers 539 remained in contact with the plate cylinder 3 while the plate feeding and discharging operation was underway. This inhibitive operation applied to the rollers 539 securely prevents them from coming into contact with the plate cylinder 3 on which no printing plate 50 is wound. Consequently, it is possible for the printing press to securely prevent the plate cylinder 3 from being soiled by ink adhered to the plate-holding rollers 539.

(10) Mechanical operation when error takes place with the plate-head holding operation (I)

Immediately after stopping the plate forwarding operation using the plate-feeding driving rollers 510 and 520 shown in FIG. 32 while operating the printing press, the detection means made of encoder and the like detects the rotation of both rollers 510 and 520. If no rotation is detected from these rollers 510 and 520, in other words, if the plate-head clamping nails 312 don't hold the plate head, the control system instantly stops the rotation of motor 20 on the part of the printing press shown in FIG. 1 so that the printing operation can be terminated on the way. As a result, it is possible for the entire printing system to securely prevent a variety of failures and defects from unexpectedly occurring while executing printing operations, which include the folowing: ink-soiled plate cylinder 3 caused by direct contact of the form roller with the plate cylinder 3 when the plate is incorrectly wound onto it, or damage of the plate incorrectly wound onto the plate cylinder 3 and/or failure incurring to the printing press itself due to unwanted insertion of the printing plate 50 into the machine mechanism, and the like.

(11) Function of the "R" provided portion of plate cylinder

As shown in FIG. 55, corners of the plate-head contacting surface 369 and the external circumferential surface 372 of the plate cylinder 3, and the corners of the aperture edge surface 373 of the plate-end side and the external circumferential surface 372 of the plate cylinder 3 are respectively provided with "R" configurations. As a result, even when the printing plate base is made of highly rigid materials such as polyester film, aluminum, or steel, and the like, it is possible for the printing press 1 to tightly wind the printing plate 50 onto the plate cylinder 3 without deviating its position. More particularly, first, the plate head 50*a* is tightly pressed against the plate-head contacting surface 369 using the plate-head clamping nails 312, and then, when the printing plate 50 is tightly wound onto the external circumferential surface 372 of the plate cylinder 3 using the plate-holding rollers 525, the printing plate 50 smoothly proceeds over the R-curved surface, thus allowing the printing plate 50 to be closely wound onto the plate cylinder 3. On the hand, when the plate end 50*c* is latched by being pulled in the direction of the aperture 307 of the plate cylinder 3 using the plate-end hooks 317, the printing plate 50 is closely wound onto the plate cylinder 3 by proceeding itself over the R-curved surface on the part of the plate end, thus allowing the printing plate 50 to be eventually and accurately wound onto the designated position of the plate cylinder 3 without deviating its position at all. Furthermore, since the printing plate 50 doesn't leave the external surface of the plate cylinder 3, the surface of the printing plate 50 is securely prevented from incurring soil otherwise caused by unwanted contact between the surface of the printing plate 50 and the form roller.

(12) System for controlling the plate-feeding speed

Next, the system for controlling the plate-feeding operation is described below. FIG. 58 is a representation of the allowable range of the plate-head track needed for allowing the plate-head holding mechanism to securely lock the printing plate 50 delivered from the plate-feeding mechanism of the printing press incorporating the plate-head holding mechanism and the plate-feeding mechanism. In FIG. 58, the vertical axis denotes the distance from the point at which is plate-feeding rollers execute nipping operation, i.e., the point where the plate-feeding driving rollers 510 shown in FIG. 62 and the auxiliary plate-feeding driving rollers 520 nip the printing plate 50, to the position of the plate head 50*a*, whereas the horizontal axis denotes the phase-angle $\theta$ of the plate-head clamping nails 312 against the pivot of the rotation of the plate cylinder 3 shown in FIG. 62(*a*).

When setting the vertical and horizontal axis as described above, the allowable range of the plate-head track can be determined as described below. First, the horizontally straight line "a" through "b" is determined to denote the limit for preventing the plate head 50*a* from hitting against the tip end of the plate-head clamping nails 312. On the other hand, since the plate-head clamping nails 312 are provided with the curved guide plate 374 shown in FIGS. 33 and 62 in the farthest position of the plate-pressing surface using the nail shaft 311 for the center of its curvature, the line "c" through "d" extending to position "e" is then determined to denote the limit for allowing entry of the plate head 50*a* into space 368 shown in FIG. 62(*g*). In addition, the horizontally straight line "g" through "h" is determined to denote the still condition of the printing plate 50 (i.e., the condition in which the printing plate is securely set in position) at the position where the plate head 50*a* is slightly out of the nipped point. The straight line "i" through "j" is also determined to denote the limit for preventing the plate head 50*a* from hitting against the pin 315 shown in FIG. 62(*g*) of the plate cylinder 3. In addition, the straight line "k" through "d" is determined to denote the limit for allowing the plate-head clamping nails 312 to close themselves by causing the plate-head holes 50*d* to align itself with the pin 315 of the plate cylinder 3. Consequently, in order to correctly hold the plate end 50*a*, the plate head 50*c* should reach the position (point "e") at which the plate-head clamping nails 312 completes its closing operation after passing through the area S surrouned by the lines-a-b-c-d-k-j-i-h-g-a. Note that the plate-head track denoted by straight line "e" through "f" represents the condition in which the clamped plate 50 is tightly pulled.

Now, in order to correctly and smoothly clamp the plate head using the printing press provided with the plate-head tracking allowable area S described above, a variety of conditions should fully be satisfied, which are described below.

(1) When activating the plate feeding operation, the printing plate 50 should smoothly be accelerated. Then, the plate-feeding speed should be raised to the designated high level within the shortest period of time while preventing the printing plate 50 from incurring even the slightest slip between the plate-feeding driving rollers 510 and the auxiliary plate-feeding driving rollers 520.

(2) As soon as the tip end of the plate-head clamping nails 312 passes through the extended point of the plate track as shown in FIG. 62(*e*), the printing plate 50 should be forwarded to space 368 of the plate-head clamping nails 312 at a very high speed. Then, while decelerating its speed, the printing plate 50 should softly be landed on the designated plate-holding position. This expands the flexibility of the plate-forwarding timing, thus providing a highly dependable printing press capable of effectively dealing with the stain and the wear taking place with both the plate-feeding driving rollers 510 and the auxiliary plate-feeding driving rollers 520, the stain of the printing plate 50, and the difference of the surface condition and rigidity of the printing plates themselves.

(3) The relative speed of the printing plate 50 itself when hitting against the curved guide plate 374 should be reduced to minimize possible damage incurring from shock applied.

(4) After hitting against the curved guide plate 374, the distance of forwarding the printing plate should be minimized to prevent the printing plate 50 from generating noticeable slack. This is particularly important when using such the printing plates which are relatively rigid and/or vulnerable to collapse caused by the slack.

The curved line "K" shown in FIG. 58 denotes an ideal track of the plate head fully satisfying those requirements (1) through (4) described above. Concretely, the plate head 50*a* is delivered from the position exactly above the straight line "g" through "h" without generating slip at all. The plate head 50*a* then passes through the area S before smoothly arriving at the point "d", and finally, it is forwarded at a specific speed corresponding to the line "e" through "f".

However, actually, it is rather difficult to allow the plate head 50*a* to smootly land onto the ideal position denoted by the curved line "K". To compensate for this, the preferred embodiment executes the plate-feeding control by providing conditions described below.

(I) The feeding operation of the printing plate 50 remains activated until the plate-head clamping nails 312 fully closes themselves.

(II) Amount of the slack generated by the shock from the contact of the plate head 50*a* against the curved guide plate 374 should not exceed a maximum of 2 millimeters. However, since the curved guide plate 374 is set to the position which is remote from the plate head by about 1 millimeter, the allowable amount of the slack of the printing plate 50 should actually be a maximum of 1 millimeter.

Now, therefore, taking the above requirements (I) and (II) into account, the plate-feeding speed control system reflecting the preferred embodiment of the present invention is described below in comparison with one of the conventional systems for controlling the plate-feeding speed.

As shown in FIG. 59, the conventional speed control system feeds printing plate 50 at a constant speed from the start-up of the plate forwarding operation to the completion of the plate holding operation. According to this conventional speed control system, the track l through a capable of narrowly executing plate-holding operation is applicable by setting the plate-feeding speed at 1.2 times the speed of the rotation of the plate cylinder 3. However, even if the track l through m deviates to the left by the least distance, the printing plate 50 hits against the plate-head clamping nails 312 at point "b", thus not plate-holding operation can be implemented. Conversely, even if the track 1 through m deviates to the right by the least distance, the holes of the printing plate 50 collapses between the line "k" through "d". If the track I through m deviates to the right furthermore, the printing plate 50 hit against the positioning pins 315 at position "i", thus eventually inhibiting the execution of the plate-holding operation. As a result, any conventional control system merely provides the plate-head tracks with a relatively narrow range workable. Actually, any of those conventional plate-feeding speed-control systems cannot accurately hold the printing plates during the printing operation.

Coversely, the plate-feeding speed-control system reflecting the preferred embodiment of the present invention accurately controls the plate feeding operation in accordance with the tracks "n-p-q-r-s" shown in FIG. 60, and the system accurately stops the plate-feeding operation at the designated position s. FIG. 61 denotes a relationship of the plate-feeding speed-control effects needed for realizing the tracks shown above. In FIG. 61, the horizontal axis denotes the phase-angle $\theta$ of the plate-head clamping nails 312, whereas the vertical axis denotes the ratio of the circumferential speed of the plate-feeding roller against the circumferential speed of the plate cylinder 3. In this case, the angle of the rotation of pulse motor 509 shown in FIG. 29(*d*) per pulse is 1.8°/pulse, whereas the circumferential speed of the plate-feeding roller per pulse is 0.5 mm/pulse, whereas the circumferential speed of the plate cylinder 3 is 600 mm/second, respectively, and therefore, the circumferential speed of the plate-feeding roller is equal to that of the plate cylinder 3 when the plate-feeding roller rotates at 1200 PPS of the circumferential speed.

Next, the plate-feeding operation executed by the plate-feeding speed-control system embodied by the present invention is described below. FIG. 62(*a*) denotes the state in which the plate cylinder 3 is at −6.5 of the phase angle, where the closed plate-head clamping nails 312 are at a position close to the line extended from the plate track. The plate-feeding/driving rollers 510 remain still at this moment.

Next, as shown in FIG. 62(*b*), when the plate cylinder 3 rotates to the position corresponding to 10° of the phase angle, the plate-head clamping nails 312 open themselves to stand by for executing the plate feeding-/discharging operations.

Next, as shown in FIG. 62(*c*), when the plate cylinder 3 rotates to the position corresponding to 18° of the phase angle, the main plate-feeding driving rollers 510 and the auxiliary plate-feeding driving rollers 520 respectively start to rotate for activating the plate-feeding operation. Then, as shown by the line n though p of FIG. 61, the plate-feeding speed is accelerated at a constant rate until the phase angle $\theta$ reaches 32°. When the phase angle $\theta$ is exactly at 32°, the plate-feeding speed reaches 1.77 times the circumferential speed of the plate cylinder 3. This allows the speed of feeding the printing plate 50 to be smoothly accelerated as shown by track n through p of FIG. 60 so that the plate feeding speed can reach the predetermined high level within the shortest period of time without causing slip to be generated between the plate-feeding driving rollers 510 and the auxiliary plate-feeding driving rollers 520. To securely prevent the printing plate 50 from slipping itself at the start-up moment, as shown by the broken line of FIG. 61, the plate-feeding operation may be started with a relatively slow speed.

FIG. 62(*d*) denotes the state in which the phase angle $\theta$ is at 30.2° while gradually accelerating the moving speed of the printing plate 50 itself and the tip end of the plate-head clamping nails 312 is exactly at the line extended from the track of the printing plate 50. FIG. 62(*e*) denotes the state in which the tip end of the plate-head clamping nails 312 passes through the track-extended line of the printing plate 50 when the phase angle $\theta$ is 30.5°, thus enabling the plate head 50*a* to proceed into the space 368 at a still further accelerated speed.

Now, when the phase angle $\theta$ is exactlyat 32°, as shown by the track p through q of FIGS. 34 and 35, the plate-feeding speed is then switched to a constant level corresponding to 1.77 times the circumferential speed of the plate cylinder 3. In otherwords, while the constant speed is maintained, the plate head 50*a* still proceeds itself into the space 368 at a constant speed faster than the circumferential speed of the plate cylinder 3.

Then, as soon as the phase angle $\theta$ of the plate-head clamping nails 312 reache 36°, as shown by the track q through r of FIG. 61, the plate-feeding speed is decelerated at a constant rate until the phase angle $\Gamma$ reaches 47.5°. When the phase angle $\theta$ is exactly at 47.5°, the plate-feeding speed is controlled so that it exactly corresponds to 0.82 times the circumferential speed of the plate cylinder 3. As a result, as shown by the track q through r of FIG. 60, the plate-feeding speed is gradually decelerated to allow the plate head 50*a* to softly reach the predetermined plate-holding position.

FIG. 62(*f*) denotes the state in which the plate head 50*a* proceeds into the space 368 using the gradually decelerated speed when the phase angle $\Gamma$ is exactly at 38.5°, thus causing the plate-head clamping nails 312 to close themselves. FIG. 62(*g*) denotes the state in which, when the phase angle $\theta$ is exactly at 41°, the plate head 50*a* reaches the position of the curved guide plate 374 after passing through the space 368 at a still decelerated speed. FIG. 62(*h*) denotes the state in which, when the phase angle $\theta$ is exactly at 47°, the plate-head clamping nails 312 close themselves to the position right above the positioning pins 315 so that the plate-head holes 50*d* can be engaged with positioning pins 315. Since the plate head 50*a* is allowed to come into contact with the curved guide plate 374 at a reasonably decelerated speed, the plate head 50*a* can securely be prevented from incurring the damage otherwise to be caused by impact from the curved guide plate 374. After coming into contact with the curved guide plate 374, the plate head 50*a* is first forwarded so that it generates the slack by about 1 mm before reaching the designated position "r".

Now, when the phase angle $\theta$ reaches 47.5°, as shown by the track r through s of FIGS. 60 and 61, the plate-feeding speed is switched to a constant level corresponding to 0.82 times the circumferential speed of the plate cylinder 3. While the plate-feeding speed remains constant, the plate head 50*a* is delivered to the position s bearing about 1 mm of the slack. Also, while the plate-feeding speed remains constant, as shown in FIG. 62(*i*), the plate-head clamping nails 312 fully closes themselves at the moment when the phase angle $\theta$ is exactly at 52.5°, thus allowing the plate-head holes 50*d* to be fully engaged with the positioning pins 315.

Next, when the phase angle $\theta$ reaches 61° denoted by the state shown in FIG. 62(*j*), as shown in FIGS. 60 and 61, the printing plate 50 is pulled by the rotation force of the printing plate cylinder 3. This causes pulse motor 509 shown in FIG. 29(*d*) which is substantially the plate-forwarding motor itself to rotate in conjunction with the movement of the printing plate 50. Slack which is present in the printing plate 50 is offset by its own tensile force.

The functions of the plate-feeding speed-control system related to the present invention are summarized according to respective procedures as shown below. First, the acceleration step applied to the track n through p of FIG. 61 is indispensable for smoothly leading the plate head 50*a* into the space 368. To realize this, the speed-control system feeds the plate cylnder 3 without generating slip between the plate-feeding rollers. The constant-speed step applied procedure in conjunction with the track p through g is also indispensable for allowing the plate head 50*a* to proceed to the farthest position of the space 368. It should be noted however, that the plate head 50*a* may not always be led into the farthest position of the space 368 at a constant speed, and therefore, the constant-speed step is not alway indispensable. On the other hand, the deceleration step applied to the track g through r is quite necessary for smoothly leading the plate head 50*a* into the predetermined position inside of the space 368 while effectively preventing the plate head 50*a* from forcibly hitting against the curved guide plate 374. Likewise, the constant-speed step applied to the track r through s is also quite necessary for allowing the plate-head clamping nails 312 to securely hold the plate head 50*a* by latching the plate head 50*a* at the predetermined position inside of the space 368 until the plate-head clamping nails 312 fully close themselves. In addition, the plate feeding stopping step beyond the position s is also quite necessary for offsetting the slack generated on the printing plate 50.

When executing the plate-feeding speed-control step described above, it is possible for the control system to allow unevenness related to the start-up timing and the speed of plate-feeding operation within the range defined by the plate-head tracks shown by means of the broken lines on both sides of the track n through s of FIG. 60. It is also possible for the speed-control system to properly adjust the relative speed of the plate-head tracking movement at the time of crossing the track c through d of FIG. 60 to be either equal to or slower than the conventional constant-speed applied control system. As a result, it is possible for the system related to the present invention to smoothly and stably hold the printing plate 50 without generating considerable slack.

To securely realize the significantly improved accuracy of the plate feeding operation, the preferred embodiment of the present invention introduces the constitution described below. To correctly identify the reference signal related to the timings needed for properly controlling the plate-feeding speed, the reference rotary encoder 380 corresponding to the sensor switch means 26 shown in FIG. 2 is connected to the supporting shaft 302 of the plate cylinder 3, which may be substituted by the supporting shaft 302 of the blanket cylinder 2. In accordance with the rotation of the plate cylinder 3, the encoder 360 generates the signal Z of one pulse in each full turn to the plate cylinder 3 and the signal A comprised of 240 pulses per inch (ppi) against the external circumference of the plate cylinder 3. The timing reference signal Z is delivered to the printing controller 381 corresponding to the microcomputer 21 shown in FIG. 2, whereas the other timing reference signal A is inputted to the printing controller 381 and the motor controller 382 which corresponds to the control parts 23 shown in FIG. 2.

In response to these incoming reference signals Z and A, the printing controller 381 first computes the timing needed for controlling the feeding operation of printing plate 50, and then generates the timing command signals such as the plate-feeding start-up command and/or the plate-feeding termination command to the motor controller 282.

On receipt of the plate-feeding start-up command signal from the printing controller 381, the motor controller 382 delivers the pulse motor 509 drive signal to the motor driver unit 383. Likewise, on receipt of the plate-feeding termination command signal from the printing controller 381, the motor controller 382 delivers the motor stop command signal to the motor driver unit 383. More particularly, the data needed for controlling the plate feeding speed is stored in PROM 384 (programmable read-only memory) of the motor controller 382. On receipt of the plate-feeding start-up command signal from the printing controller 381, in response to the timing reference signal A output from the reference rotary encoder 380, the data stored in PROM 384 is sequentially accessed in order of address via the address controller 385, thus allowing the pulse train signal having the specific pulse intervals corresponding to the predetermined speed characteristics to be delivered to the motor driver unit 383. Details of the pulse train signal are described later on.

The motor driver unit 383 first amplifies the pulse train signal from the motor controller 382 before activating pulse motor 509 which is made available for operating the plate-feeding driving rollers 510.

Next, referring now to the timing chart shown in FIG. 64 and the operation chart shown in FIG. 65, the functional operations of the printing press is described below. Before the printing controller 381 generates the plate-feeding command signal, the printing plate 50 is set to the designated position so that the tip end of the plate head of the printing plate 50 can be set to point P between the plate-feeding rollers 510 and 520 shown in FIG. 65. Next, the operator activates the printing press to rotate the plate cylinder 3 in the arrowed direction at a constant speed. Then, the operator inputs the plate-feeding command to the printing controller 381 by operating the plate-feeding button present in the operation control panel of the printing press. When the plate-feeding command signal is activated, the printing plate 50 is nipped by the plate-feeding driving rollers 510 and 520 before the printing controller 2981 executes the operation for controlling the delivered plates described below.

First, when the plate cylinder 29 is set to the predetermined rotation phase, the reference rotary encoder 2980 delivers the reference signal Z shown in FIG. 64(*a*) to the printing controller 381. Based on the moment when the reference signal Z is received, the printing controller 381 starts to count the signal A and then generates the operation start-up command the signal when counting up a specific value corresponding to the predetermined time $\mp t_{20}$" shown in FIG. 64(*b*). The start-up command signal is delivered to the motor controller 382, which is then activated to read the speed-control data from PROM 384 via address controller 385 in accordance with the signal A from the reference rotary encoder 380.

The speed-control data is described below. A consideration is given to the plate-feeding operation in reference to the speed curve shown in FIG. 64(*b*) for example. In conjunction with the speed curve, the acceleration period ranging from the start-up position S to the position A is quite important for smoothly leading the plate head 50*a* into the space 368 between the open plate-head clamping nails 2912 and the positioning pins 315. To securely realize this, the printing plate 50 is fed by using a specific speed faster than the circumferential speed of the plate cylinder 29 without generating slip at all between the plate-feeding driving rollers 510 and 520. The constant-speed period from the position A to position B is also quite important for allowing the plate head 50*a* to correctly proceed into the farthest position of the space 368. Likewise, the deceleration period between the position B and the position C is quite important for leading the plate head 50*a* to the predetermined plate-holding position by preventing the plate head 50*a* from forcibly hitting against the guide plate 374 present in the farthest position of the space 368. Finally, the constant-speed period ranging from the position C to the position D is also quite important for allowing the plate-head clamping nails 312 to correctly hold the plate head 50*a* at the predetermined position in the farthest position of the space 368 until the plate-head clamping nails 312 fully close themselves. Note that the distances ($l_1$, $l_2$ and $l_3$) ranging from the starting point S to the designated points A, B and C shown in FIG. 64(*b*) respectively denote the moving distance of the printing plate 50 starting from the plate-head feeding position shown in FIG. 65, point P, in which the distance $l_1$ to 20 mm, $l_2$ is 35 mm and $l_3$ is 50 mm.

FIG. 65 is the chart denoting the plate feeding operation executed by applying the speed curve described above. The positioning pins 315*a*, 315*b* and 315*c* of the plate cylinder 3 shown in FIG. 65 respectively denote positions corresponding to the points A, B and C related to the speed curve shown in FIG. 64(*b*). Concretely, the point A denotes the state in which the closed plate-head clamping nails 312 pass through the position right above the plate-feeding line, whereas the point B denotes the state in which the head of the positioning pins 315*b* pass through the position right above the plate-feeding line. Then, the plate head is inserted into the farthest position of the space 368 so that the holes 50*d* of the plate head 50*a* is correctly led to the position of the positioning pins 315*b*. On the other hand, the point C denotes the state in which the positioning pins 315*c* are engaged with the holes 50*d* of the printing plate 50, and yet, the plate-head clamping nails 312 close themselves up to the head position of the positioning pins 315*c*. When the plate cylinder 3 rotates furthermore while the above state is present, the plate-head clamping nails 312 fully close themselves, thus completing the entire operations related to the plate-feeding driving using the plate feeding rollers 510 and 520.

The data needed for securely realizing the speed curves described above is obtainable by executing the following operations. Assume that, when a pulse is delivered to the pulse motor 509, the printing plate 50 is forwarded by the plate-feeding driving rollers 510 and 520 by 0.5 mm of the distance. When this condition is present, since the distance $l_1$ between the points S and A is 20 mm, at least 40 pulses as the pulse-value $N_1$ are needed for this range. Likewise, since the distance between $l_2$ and $l_2$ is 15 mm, at least 30 pulses as the pulse-value $N_2$ are needed for the range between points A through C. Also, since the distance between $l_2$ and $l_3$ is 15 mm, at least 30 pulses as the pulse-value $N_3$ are needed for the range between the points C and D. Since the distance between the points S and A corresponds to the area designated for acceleration of the speed, the intervals of these pulses are gradually shortened. Conversely, since the distance between the points A and B corresponds to the area designated for applying the constant speed, the intervals of these pulses are equally provided. On the other hand, since the distance between the points B and C corresponds to the area designated for deceleration of the speed, the intervals of these pulses are gradually widened. Conversely, since the distance between the points C and D corresponds to the area designated for applying the constant speed, the intervals of these pulses are equally provided. PROM 384 stores the plate-feeding speed-control data generating the pulse train signal shown in FIG. 64(*c*). The plate-feeding speed-control date containing the above pulse train signal are accessed by the printing controller 381 in accordance with the plate-feeding start-up command from the printing controller 381 and the reference signal A from the reference rotary encoder 380 as well before delivery to the motor driver unit 383.

On receipt of the pulse train signal, the motor driver unit 383 first amplifies the data before driving pulse motor 509. As a result, the plate-feeding driving rollers 510 rotate at a speed corresponding to the pulse train signal so that the printing plate 50 can smoothly be delivered in accordance with the predetermined speed curve shown in FIG. 64(*b*).

As soon as the plate-head holding operating is completed by the plate-head holding mechanism, the printing-operation terminating command signal is outputted to the motor controller 382 in accordance with a specific timing which can be identified by counting the signal A as in the case of time "$t_{20}$". In response to this, the motor controller 382 delivers the plate-feeding terminating command signal to the motor driver unit 383 to eventually terminate the plate-feeding operation executed by the plate-feeding driving rollers 510 and 520. After terminating the plate-feeding operation with the plate-feeding driving rollers 510 and 520, the printing plate 50 is then drawn out following the rotation of the plate cylinder 3 before being wound onto it.

Using these plate-feeding driving rollers 510 and 520, the printing press starts to feed the printing plate 50 in accordance with the signal Z from the reference rotary encoder 380 set to the supporting shaft 302 of the plate cylinder 3. While the plate-feeding operation is underway, the plate-feeding speed is properly controlled in accordance with the plate-feeding speed-control data read from ROM 384. Using the constitution thus being described, the plate-feeding system accurately feeds the printing plate 50 to the predetermined position of the plate cylinder 3, and as a result, while preventing the plate head 50*a* from incorrectly being held, the system ensures high accuracy in executing the plate feeding operation. In addition, since the plate-feeding speed control data can be read out of PROM 384 in accordance with the reference signal A from the reference rotary encoder 380, even when the speed of the rotation of the plate cylinder 3 varies, the plate-feeding speed of the plate-feeding driving rollers 510 and 520 correctly follows the varied speed of the rotation of the plate cylinder 3 so that it also varies, thus securely improving the accuracy in the plate feeding operation furthermore. Note that when the plate cylinder 3 rotates at a constant speed, for example, when it is rotated at a constant speed by other control means, it is also possible for the present system to use either the signal from another stable oscillator like crystal oscillator for example or the signal output from an oscillator used for the control unit for controlling the rotation of the plate cylinder 3 i.e., the blanket cylinder 2, in place of the reference signal A from the reference rotary encoder 380. Even when usuing the substitutive signals mentioned above, the plate-feeding speed control system relates to the present invention can securely realize accurate control of the plate-feeding speed by correctly matching the rotation phase of the plate cylinder 3 as is done with the above preferred embodiments.

(13) Provision of the circumferential speed of the plate cylinder and the blanket cylinder FIG. 66 is the schematic chart, denoting the relationship of the plate cylinder 3, the blanket cylinder 2, and the form roller 710 while normal printing operation is underway. As shown in FIG. 66, normal printing operation is done by placing the plate cylinder 3 in contact with the blanket cylinder 2 and the form roller 710 in contact with the plate cylinder 3 for allowing the blanket cylinder 2, the plate cylinder 3, and the form roller 710 to be respectively rotated in the arrowed directions. The blanket cylinder 2, the plate cylinder 3, and the form roller 710 are connected to each other by the gear means engaged with each other at one-end of these units, while these gears are driven by the main motor set to the printing press. The diameters $D_1$, $D_2$ and $D_3$ of the blanket cylinder 2, the plate cylinder 3 and the form roller 710, are respectively designed so that the circumferential speeds of the blanket cylinder 2 and the form roller 710 are slightly faster than that of the plate cylinder 3. In this case, since the blanket cylinder 2 and the form roller 710 are made of the elastic material such as rubber, the diameters $D_1$, $D_2$ and $D_3$ are respectively determined in consideration of true roll measure. Assume that diameter $D_2$ is determined to be 153.35 mm for example, by designing $D_1$ to be 152.9 mm and $D_3$ to be 60.3 mm, respectively, both cylinders 2, 3 and the form roller 710 will be provided with the circumferential speed which is almost equal to each other. Considering these, this preferred embodiment introduces the following constitution, in which the diameter $D_1$ is determined to be 153.2 mm an $D_3$ to be 60.5 mm against 153.2 mm of the diameter $D_2$, thus providing slightly larger diameters. This provides the blanket cylinder 2 and the form roller 710 with reasonable circumferential speeds which are slightly faster than that of the plate cylinder 3. These diameters denote one of the preferred embodiments of the present invention, and thus, any diameter other than those which are shown above may freely be chosen.

The constitution of the plate-feeding mechanism thus far decribed generates a variety of advantageous effects, which are described below. First, when the blanket cylinder 2 and the form roller 710 respectively run over the external surface of the plate cylinder 3 after passing through the aperture 307 of the plate cylinder 3, due to the extraction force applied to the printing plate 50, the plate-head 50*a* may slightly be pulled by the plate-head clamping nails 312. However, even if the plate-head 50*a* may be pulled outward slightly, since the preferred embodiment of the invention reasonably determined diameters $D_1$, $D_2$ and $D_3$ of the blanket cylinder 2, the plate cylinder 3, and the form roller 710 as described above, when the blanket cylinder 2 and the form roller 710 respectively rotate over the external surface of the plate cylinder 3, the specific force is applied to the printing plate 50 so that it can be pushed backed in the direction of the plate head 50*a*. As a result, the printing plate 50 is brought back to its original position, thus securely preventing the plate head 50*a* from being disengaged, from the plate-head clamping nails 312 while executing the printing operation for a long time. In addition, the plate end 50*c* is elastically held by the energized force from the spring means of the plate-end hooks 317. As a result, even when the printing plate 50 deviates its position due to either pulling or push-back force mentioned above, such deviation can effectively be absorbed by the spring means without obstructing the plate-end holding operation at all.

(14) Mechanical operation when error takes place will the plate-head holding operation (II)

As was described earlier in conjunction with "(10) Mechanical operation when error takes place with the plate-head holding operation (I)", the present embodiment provides means for detecting the presence and/or absence of the rotation of the plate-feeding driving rollers 510 and 520. If no rotation is detected, the microprocessor 21 identifies that the plate-head clamping nails 312 don't hold the plate head 50*a*, and then causes the motor 20 of the printing press shown in FIG. 1 to instantly stop the operation. In this case, inactivation of the motor 20 can also be realized by employing the constitution described below. Concretely, using sensor 544 shown in FIG. 33, the presence or absence of the printing plate 50 is again checked when the plate-end edge portion is completely drawn out of the plate-feeding table 901 at the moment between time "$t_{16}$" and "$t_{17}$". If the plate head is correctly latched by the plate-head clamping nails 312, it indicated that the new plate 50 is already drawn out of the plate-feeding table 901, thus the presence of new plate 50 cannot be detected. If this is identified, the plate feeding and discharging operation is continuously executed. Conversely, if the plate-head clamping nails 312 don't hold the head of the new plate 50, the new plate 50 still remains on the plate-feeding table 901, thus allowing the sensor 544 to detect the presence of the new plate 50. If this is detected, the microprocessor 21 shown in FIG. 2 generates the command signal to cause the motor 20 of the printing press shown in FIG. 1 to instantly stop its operation.

Thus, if the plate head don't be hold by the plate-head clamping nails 312 engaged with either the plate cylinder 3 or 4, this faulty operation is quickly detected by the sensor 544 on the way of feeding and/or discharging plate operation, thus instantly stopping the motor 20 of the printing press itself. This emergency remedy means effectively prevents a variety of unwanted failure including the following: stained the plate cylinder 3 or 4 due to contact with the form roller while the printing plate is incorrectly wound onto either of these plate cylinders 3 and 4, damaged the printing plate and/or braked the printing press due to unwanted entry of printing plate 50 into the printing press itself. In addition, since the plate feeding/discharging system embodied by the present invention detects the failure of the plate-winding operation using the sensor 544 for selecting the plate feeding/discharging or the plate discharging operation, the plate-feeding system related to the present invention dispenses with provision of an additional sensor for detecting the failure of the plate-winding operation, thus eventually allowing itself to correctly and quickly detect the failure of the plate-winding operation by applying simplified constitution.

Note that the preferred embodiment of the present invention thus described can effectively applied not only to a two-color printing press, but also to a multicolor printing press incorporating more than three units of the plate cylinders.

(15) Functions of the inking unit and the plate feeding/discharging unit

As described earlier, the multicolor printing press reflecting the present invention is provided with two units of plate cylinders 3 and 4 vertically at the specific positions for winding the dampening-waterless plates onto themselves. In addition, this printing press body 1 is also provided with the inking units 7 and 8 and the plate-feeding/discharging units 5 and 6 commonly made available for the plate cylinders 3 and 4 so that they can individually be mounted onto and removed from the predetermined positions where opposite the plate cylinders 3 and 4.

Therefore, the multicolor printing press related to the present invention executes the printing using dampening-waterless plates, thus totally dispensing with a dampening arrangement otherwise needed for the conventional printing press. And the inking units 7, 8 are small formed because form rollers also work as ink fountain rollers. As a result, although it is capable of executing multicolor printing operation, the inking units 7 and 8 can be installed to the periphery of the plate cylinders 3 and 4 together with the plate feeding/discharging units 5 and 6 inside of the printing press, while the system can automatically feed and discharge the printing plates to and from these the printing plates cylinders 3 and 4. In addition, the preferred embodiment of the invention provides a novel mechanism allowing both the inking units 7 and 8 and the plate feeding/discharging units 5 and 6 to be freely mounted onto and removed from the printing press body 1, and as a result, it is possible for the system to easily change ink and the printing plates by replacing inking units 7 and 8 and the plate feeding/discharging units 5 and 6 with other units as required. This in turn allows the operators to easily and quickly change the objects of the printing. Concurrently, this also allows the operators to easily clean each cylinder, and to easily performe maintenance and assemblage of a printing press.

Note that the above preferred embodiment is described in reference to two-color printing press provided with two units of plate cylinders 3 and 4. It should be understood, however, that the spirit and scope of the present invention are also applicable to any multicolor printing press provided with more than three units of plate cylinders. In the preferred embodiment described above, one unit of blanket cylinder deals with two units of plate cylinders 3 and 4. However, the present invention is also applicable to any multicolor printing press which is provided with a plurality of plate cylinders in which each unit of plate cylinder individually deals with the blanket cylinder 2. Furthermore, the preferred embodiment of the present invention is also applicable to a variety of letterpress and offset printing press other than the intaglo printing press.

(16) Control of ink concentration (I)

Operation for controlling the concentration of ink to be executed at the time of startng up the printing operation, pausing the printing operation, and finishing up the printing operation is described below.

FIG. 67 is the flowchart describing the summarized operations of the microprocessor 21 shown in FIG. 2 when the printing startup command is generated by the printing startup key of the operation panel 25 shown in FIG. 2 depressed by the operator. The printing-startup command is generated in the condition in which the plate cylinders 3 and 4 shown in FIG. 1 and the impression cylinder 11 respectively remain apart from the blanket cylinder 2 while each cylinder is rotated by the main motor 20. When this condition is present, the number of the rotation of each cylinder is accurately set so that the circumferential speeds of the impression cylinder 11 and plate cylinders 3 and 4 are respectively equal to the circumferential speed of the blanket cylinder 2, and in addition, the circumferential speeds of the form rollers 710 of the inking units 7 or 8 shown in FIG. 3 are equal to the circumferntial speed of plate cylinder 3 and/or 4.

When the printing-startup command is generated, first, the step S51 is entered to automatically replace the printing plate as shown in FIG. 67. Those printed plates wound on plate cylinders 3 and 4 are then discharged onto the discharged-plate tables 902 shown in FIG. 34 of the plate feeding/discharging trays 9 and 10 through the plate feeding/discharging units 5 and 6. Replacing these printed plated, new plates designated for the printing are then wound onto the plate cylinders 3 and 4 via the plate feeding/discharging units 5 and 6 from the plate feeding table 901 of the plate feeding/discharging trays 9 and 10 shown in FIG. 34.

As soon as the plate replacement is completed, the operation mode proceeds to the step S52, in which the blanket cylinder 2 is cleaned. Concretely, detergent-solution feeding unit 18 delivers detergent solution onto the surface of blanket cylinder 2, and then wiping unit 19 wiping off residual ink from the blanket cylinder 2 together with detergent solution.

Then, the operation mode proceeds to the step S53, in which print-out step is executed. The print-out step aims at stabilizing variable concentration during print-out step as soon as possible. The print-out step is comprised of those steps shown in FIG. 68. FIG. 68 illustrates only the plate cylinder 3 by deleting the illustration of the other plate cylinder 4. However, since the plate cylinder 4 executes operations related to the control of ink concentration, which are identical to those of the plate cylinder 3, the following description merely refers to the function of the plate cylinder 3, and thus description of plate cylinder 4 is deleted. Actually, in consideration of the automatic plate feeding and discharging operation, apertures are respectively provided for part of the external surfaces of the plate cylinder 3 and the blanket cylinder 2 is well. However, since the presence or absence of the aperture doesn't substantially affect the control of ink concentration, the illustration of the aperture is deleted. Note that the flow of ink used for the printing denoted by thick solid line and the flow of the remaining ink after transferrence onto either other cylinders or a paper is denoted by the broken lines in the drawings from FIG. 68 on.

To implement the print-out step, first, an ink-feeding operation shown in FIG. 68 (*a*) is executed by causing only the form roller 710 to come into contact with the plate cylinder 3. The ink-feeding step is executed while the blanket cylinder 2 rotates itself several times. This is because it takes time corresponding to several turns of the blanket cylinder 2 until ink is applied to the printing elements of the printing plate and unnecessary ink can be removed from the non-printing elements of the printing plate. As a result, ink 758 having a greater amount than the case of executing normal printing operation is supplied to the printing plate wound on the plate cylinder 3. Since the ink-feeding step is executed when the blanket cylinder 2 is apart from the plate cylinder 3, it is possible for the system to execute the ink-feeding step in parallel with the blanket-cylinder cleaning step performed in the step S52 shown in FIG. 67. This effectively shortens time needed for implementing the printing operation.

After completing the ink-feeding step, the system operation proceeds to the transference step shown in FIG. 68 (*b*), which is executed by causing the plate cylinder 3 to come into transference with the blanket cylinder 2. Also, the transference step is executed while the blanket cylinder 2 makes a full turn. As a result, a greater amount of ink than the case of executing a normal printing operation is transferred onto the blanket cylinder 2 from the printing plate wound on the plate cylinder 3.

Next, the first printing step shown in FIG. 68 (*c*) is activated. While this step is underway, first, the supply of ink 758 to the plate cylinder 3 is discontinued by causing the form rollers 710 to leave the plate cylinder 3, while the continuous paper 12 is forwarded in the arrowed direction A by the length corresponding to one paper in the state of causing the impression cylinder 11 to come into contact with the blanket cylinder 2 before eventually executing the printing operation. The first printing step is executed while the blanket cylinder 2 makes a full turn. Consequently, ink 758 from the blanket cylinder 2 is transferred onto the continuous paper 12 so that the printing operation for one page can be executed by applying ink having a specific concentration thicker than the case of executing normal printing operation. Furthermore, in place of the ink mentioned above, ink from the printing plate wound on the plate cylinder 3 is transferred onto the blanket cylinder 2 by being distributed at a specific rate. This allows the amount of ink on both the priting plate and the blanket cylinder 2 to be adequately adjusted into the designated amount of ink for running the normal printing operation.

After completing the first printing step, the second printing step shown in FIG. 68 (*d*) is activated, which correspond to the normal-printing introduction step. When the second printing step is entered, the supply of ink to the plate cylinder 3 is resumed by causing the form roller 710 to come into contact with the plate cylinder 3, and then the continuous paper 12 is forwarded by the length corresponding to one page so that the printing operation can be implemented. This printing step lasts while the blanket cylinder 2 makes a full turn. Consequently, ink from the blanket cylinder 2 is transferred onto the continuous paper 12 to allow the printing operation to be done against a full page area using the ink concentration which is equal to the concentration applied to the normal printing operation. The printing plate wound on the plate cylinder 3 feeds ink to the blanket cylinder 2 by the amount equal to that is supplied during the normal printing operation. At the same time, the form roller 710 feeds ink to the plate cylinder 3 by the amount equal to that is supplied during the normal printing operation. Thus, ink on each cylinder is properly adjusted into the predetermined amount applicable to the normal printing operation.

The multicolor printing press related to the invention thus executes the print-out operation by first feeding more amount of ink to the printing plate than that is actually applied to the normal printing operation, and then the system activated the printing operation in the state without replenishing ink to the plate cylinder 3 so that the amount of ink on the blanket cylinder 2 and the printing plate can properly be adjusted into the optimum condition for executing the normal printing operation, thus allowing the system to quickly activate the normal printing operation. In addition, only a piece of paper is lost until the ink concentration is stable throughout the entire print-out step mentioned above.

As soon as the print-out step is completed, the step S54 shown in FIG. 67 is entered for activating the normal printing operation to be executed by the procedure described below. First, a specific amount of ink corresponding to one page transferred on the blanket cylinder 2 is applied to the continuous paper 12, and then, the system causes the impression cylinder 11 to leave the blanket cylinder 2 and stops feeding of the continuous paper 12 before laying off the printing operation for a while. Next, when the aperture of the blanket cylinder 2 correctly faces the impression cylinder 11, the system causes the impression cylinder 11 to come into contact with the blanket cylinder 2 and then resumes feeding of the continuous paper 12 before resuming the printing operation. Thus, the system causes the impression cylinder 11 to come into contact with and depart from the blanket cylinder 2 in each full turn of this blancket cylinder 2 and also the continuous paper 12 to be intermittently forwarded by the length corresponding to a full page in conjunction with the timing of executing the contact/departure operation of the impression cylinder 11 with and from the blanket cylinder 2. In this way, the printing is sequentially executed against each page of the continuous paper 12. Note that, the form roller 710, the plate cylinder 3, and the blanket cylinder 2 remain in contact with each other.

While the normal printing operation is underway, the microprocessor 21 judges in the step S55 whether "pause-in" command is generated by key operation of the operator, or not, after completing the printing of each page for example. The "pause-in" command is generated by depressing the "pause-in" key of the operation panel 25 shown in FIG. 2 by the manual input operation for example. If the "pause-in" command were not generated, the operation mode then proceeds to the step S56, and then the microprocessor 21 judges whether the number of printable paper is less by a piece than the predetermined number designated by the operator's key operation of the operation panel 25 shown in FIG. 2, i.e., whether the number of printable paper reaches (designated number—1), or not. If this is not realized, the operation mode is back to the step S54 to continue the normal printing operation. These serial operations are repeated until the number of printable paper reaches (designated number—1).

After completing the normal printing operation by the amount (designated number—1), the operation mode then proceeds from the step S56 to the step S57, in which the printing finishup step is executed. This printing finishup step is executed in accordance with the procedure shown in FIG. 69. As shown in FIG. 69 (*b*), as soon as the page corresponding to the (designated number—1) is printed by the normal printing operation shown in FIG. 69 (*a*), the form roller 710 are detached from the plate cylinder 3, and as a result, the supply of ink from the form roller 710 to the plate cylinder 3 is discontinued. Next, when the plate cylinder 3 makes about a one-half turn while the printing operation is underway, in other words, as soon as ink from the printing plate wound on the blanket cylinder 3 is completely transferred to the blanket cylinder 2, as shown in FIG. 69(*c*), the plate cylinder 3 leaves from the blanket cylinder 2. Consequently, only a negiligible amount of ink remains on the printing plate wound on the plate cylinder 3. When the blanket cylinder 2 further makes about a half-turn, i.e., when ink from the blanket cylinder 2 is completely transferred onto the continuous paper 12, as shown in FIG. 69 (*d*), the mechanism causes the impression cylinder 11 to leave the blanket cylinder 2. As a result, only a negiligible amount of ink remains on the blanket cylinder 2. Thus, while the blanket cylinder 2 makes a full turn, the printing-finishup step shown in FIGS. 69 (*b*) through (*d*) is completed. This activates the printing of the last page. When printing the last page, ink flows in the same as as that is shown in the normal printing operation. Accordingly, it is possible for the multicolor printing press related to the present invention to correctly print the last page using the identical ink concentration to that is applied to the normal printing operation, thus preventing the paper from being wasted.

Also, it is possible for the system to minimize the amount of ink remaining on the printing plate and the blanket cylinder 2 by executing the printing-finishup step mentioned above against the case in which the printing operation is discontinued by immediately detaching all the cylinders after the normal printing operation is underway as shown in FIG. 69 (*a*). As a result, the operator can easily clean the printing plate and the blanket cylinder 2 as well. In addition, since the form roller 710, the plate cylinder 3, and the impression cylinder 11 can be detached in the specific timing mentioned above, the last page can correctly be printed using the ink concentration identical to that is applied to the normal printing operation, thus preventing the paper from being wasted.

Next, as soon as the printing finishup step is completed, the step S58 is entered for discharging the printing plate. This operation is executed by discharging the printing plate from the plate cylinder 3 onto the plate-discharging table 902 of the plate feeding/discharging tray 9 via the plate feeding/discharging unit 5. Next, when the step S59 is entered, as in the preceding the step S52, the blanket cylinder 2 is cleaned, thus completing the entire printing operations.

Now, if it is necessary to provisionally discontinue the printing operation while the normal printing operation is underway for any reason such as replacement of the continuous paper 12 or for checking and confirming the concentration of the ink applied to the printed paper, an operator gives the "pause-in" command by depressing "pause-in" key of the operation panel 25 shown in FIG. 2. When the "pause-in" command is generated, the microprocessor 21 judges in the step S55 that the "pause-in" command is activated, causing the operation mode to the proceed to the step S60 for executing "pause-in" step shown in FIG. 70. After completing the printing of the entire area of the printable page at the time of generating "pause-in" command while the normal printing operatin shown in FIG. 70 (*a*) is underway, as shown in FIG. 70 (*b*), the impression cylinder 11 leaves the blanket cylinder 2 to simultaneously stop feeding of the continuous paper 12 so that the printing operation can be discontinued. Simultaneously, the system causes the form roller 710 to leave the plate cylinder 3 before discontinuing the supply of ink to the plate cylinder 3. Then, the blanket cylinder 2 and the plate cylinder 3 respectively make a one-half turn in order to transfer ink 758*d* needed for printing the next page set to the printing plate which is wound on the plate cylinder 3. As soon as the ink transfer is completed, the plate cylinder 3 leaves the blanket cylinder 2 as shown in FIG. 70 (*c*), thus allowing ink enough to print one full page to be transferred onto the blanket cylinder 2.

After completing the above "pause-in" step, the operation mode then proceeds to the step S61 in which a step needed for keeping the condition of FIG. 70 (*c*) is executed, in other words, the step S61 activates the "pause condition in which cylinder discretely keeps rotation. The "pause" condition lasts until the "pause-out" command is generated by the manual input operation of the "pause-out" key of the operation panel 25 shown in FIG. 2 for example (see the steps 61 and 62).

When the "pause-out" command is generated in the "pause" condition, the microprocessor 21 then judges in the step S62 that the "pause-out" command is activated, thus allowing the operation mode to proceed to the step S63 for executing "pause-out" step shown in FIG. 71. When the rotational position of the blanket cylinder 2 is exactly at the predetermined print-startup position while the "pause" condition shown in FIG. 70 (a) is present, as shown in FIG. 70 (b), the inpression cylinder 11 comes into contact with the blanket cylinder 2, and at the same time, the paper-feeding operation is resumed. This activate the printing operation using ink 758*d* on the blanket cylinder 2. On the other hand, the form roller 710 comes into contact with the plate cylinder 3 synchronous with the operative timing of the impression cylinder 11 when coming into contact with the blanket cylinder 2, thus allowing the printing plate wound on the plate cylinder 3 to receive ink 758*e* needed for printing the next page. After causing the blanket cylinder 2 and the plate cylinder 3 to respectively make about a one-half turn which the above condition is present, as shown in FIG. 70 (c), the plate cylinder 3 comes into contact with the blanket cylinder 2, thus allowing ink 758*e* needed for printing the next page to be transferred onto the blanket cylinder 2 following ink 758*d*. Next, the blanket cylinder 2 and the plate cylinder 3 respectively make about a one-half turn furthermore to complete a full-page printing, thus terminating the "pause-out" step. Then, the operation mode is again back to the step S54 from the steo S63 so that the normal printing operation can be entered.

As mentioned above, since the preferred embodiment of the invention activates "pause-in" step for transferring ink 758*d* enough for printing of full page onto the blanket cylinder 2 and then executes the printing of the first page immediately after resuming the printing operation using ink 758*d* before proceeding to the normal printing operation, the printing press securely equalizes the printing concentrations before executing "pause-in" step and after executing "pause-out" step. When resuming the printing operation after discontinuing the printing of the continuous paper 12, execution of these steps is indispensable.

In addition to the "pause-in" and "pause-out" steps shown in FIGS. 70 and 71, there are those means shown in FIGS. 72 and 73 for example.

First, the control system shown in FIG. 72 is described below. FIGS. 72 (*a*) through (*c*) respectively denote the "pause-in" step, wherein (*d*) and (*e*) respectively denote the "pause-out" step. When the "pause-in" command is generated during the normal printing operation shown in FIG. 72 (*a*), as soon as ink 758*f* need for printing a specific page at the time of receiving the "pause-in" command is transferred from the plate cylinder 3 onto the blanket cylinder 2, as shown in FIG. 72 (*b*), the system causes the plate cylinder 3 to leave the blanket cylinder 2 so that ink 758*f* can be transferred onto the blanket cylinder 2, thus causing ink 758*g* needed for printing the next page to remain on the plate cylinder 3. After the plate cylinder 3 is apart from the blanket cylinder 2, the next page can be printed using ink 758*f*by feeding the continuous paper 12 with the impression cylinder 11 being in contact with the blanket cylinder 2. Ink 758*g* is delivered onto the surface of the printing plate wound on the plate cylinder 3 after the form roller 710 are brought into contact with the plate cylinder 3.

Thus, after completing the printing of the designated page using ink 758*f*, as shown in FIG. 72 (*c*), the system causes the impression cylinder 11 to leave the blanket cylinder 2 and simultaneously stops the feeding operation of the continuous paper 12 so that the printing operation can be discontinued. On the other hand, synchronous with the timing of the departure of the impression cylinder 11 from the blanket cylinder 2 and simultaneous with the departure of the impression cylinder 11 from this cylinder 2, the system cause the form roller 710 to also leave the plate cylinder 3 to eventually stop the ink supply onto the surface of the printing plate. As a result, ink 758*g* needed for printing only the next page is transferred onto the surface of the printing plate wound on the plate cylinder 3.

After completing the "pause-in" step, the system enters into the "pause" condition in which the state shown in FIG. 72 (*c*) is retained.

Next, when the "pause-out" command is generated after the "pose" state is entered, the system causes the plate cylinder 3 to come into contact with the blanket cylinder 2 at the moment when the tip-end position of the plate surface (i.e., the tip edge of the printable page) correctly faces the blanket cylinder 2, and then, as shown in FIG. 72 (*d*), ink 758*g* is transferred onto the blanket cylinder 2 from the plate cylinder 3. The blanket cylinder 2 then rotates itself by about a one-half turn so that the tip edge of ink 758*g* transferred onto the blanket cylinder 2 correctly faces the impression cylinder 11, as shown in FIG. 72 (*e*), the system causes the impression cylinder 11 to come into contact with the blanket cylinder 2, and simultaneously, the operation for feeding the continuous paper 12 is resumed, thus allowing the printing operation to be resumed eventually by applying ink 758*g*. The system also causes the form roller 710 to come into contact with the plate cylinder 3 simultaneous with the contact of the impression cylinder 11 with the blanket cylinder 2. This allows the surface of the printing plate wound on the plate cylinder 3 to receive additional ink needed for printing the next page following ink 758*g*. This completes the "pause-out" operation to allow the system to proceed to the normal printing operation.

Consequently, it is possible for the printing system to execute the printing by applying the same flow of ink 758*f* as in the execution of the normal printing operation as a result of the execution of the "pause-in" step. In other words, after executing the printing operation using a specific ink concentration identical to that is applied to the normal printing operation, the system then enters the "pause" condition. In addition, since the execution of the "pause-out" step correctly regulates the flow of ink 758*g* before resuming a normal printing operation, it is possible for the system to equally maintain the ink concentrations before discontinuing and after resuming the printing operation.

Next, the control system shown in FIG. 72 is described below. FIGS. 73 (*a*) through (*d*) respectively denote the "pause-in" step, whereas FIGS. 72 (*e*) through (*g*) respectively denote the "pause-out" step.

When the "pose-in" command is generated while the normal printing operation shown in FIG. 73 (*a*) is underway, as soon as the printing of the page at the time of generating this command is completed, as shown in FIG. 73 (*b*), the form roller 710 leaves the plate cylinder 3, thus stopping the supply of ink from the form roller 710 to the plate cylinder 3. Next, when the plate cylinder 3 makes about a one-half turn in the condition in which the printing operation is still underway using ink **758*h* needed for printing one full page remaining on both the plate cylinder 3 and the blanket cylinder 2, in other words, after completing the transference of ink 758*g* from them plate cylinder 3 to the blanket cylinder 2**, as shown in FIG. 73 (*c*), the system causes the plate cylinder 3 to leave the blanket cylinder 2. Then, after the blanket cylinder 2 further rotates by about a one-half turn, i.e., after ink **758*h* is completely transferred onto the continuous paper 12 from the blanket cylinder 2**, as shown in FIG. 73 (*d*), impression cylinder 11 leaves the blanket cylinder 2, and simultaneously, operation for feeding the continuous paper 12 is discontinued to stop the printing operation. Thus, while the blanket cylinder 2 makes a full turn, the system completes the execution of the "pause-in" step shown in FIGS. 73 (*a*) through (*d*). By executing the "pause-in" step, the system completes the printing of one-full page of the continuous paper 12. Note that the "pause-in" step is exactly identical to the printing-finishup step shown in FIG. 69, and accordingly, it is possible for the system to perform printing of one page before discontinuation of the printing operation by applying a specific ink concentration exactly identical to that is applied to the normal printing operation.

After completing the "pause-in" step, the system then enters the "pause" state capable fo retaining the condition shown in FIG. 73 (*d*).

Next, when the "pause-out" command is generated while the "pause" condition is present, as shown in FIG. 73 (*e*), the form roller 710 come into contact with the plate cylinder 3 at the moment when the tip-end position of the plate surface on the plate cylinder 3, i.e., the tip edge of the page area, correctly faces the form roller 710. This allows ink **758*i* needed for printing the next page to be fed onto the printing plate wound on the plate cylinder 3. Next, when the plate cylinder 3 make about a one-half turn furthermore, in other words, when the tip end of ink 758*i* transferred onto the plate cylinder 3 is at the position to face the blanket cylinder 2**, as shown in FIG. 73 (*f*), the plate cylinder 3 is brought into contact with the blanket cylinder 2, thus allowing ink **758*i* needed for printing the next page to be transferred onto the blanket cylinder 2 from the plate cylinder 3. Next, when the blanket cylinder 2 makes about a one-half turn furthermore, in other words, when the tip end of ink 758*i* transferred onto the blanket cylinder 2 correctly faces the impression cylinder 11, the system causes the impression cylinder to come into contact with the blanket cylinder 2 so that the operation for feeding the continuous paper 12 can be activated simultaneously. This allows the system to resume the printing operation using ink 758*i***. After completing the "pause-out" operation, the system proceeds to the execution of the normal printing operation.

Consequently, it is possible for the printing system to execute the printing operation by applying the same flow of ink **758*h* as in the execution of the normal printing operation as a result of the execution of the "pause-in" step. In other words, after executing the printing operation using a specific ink concentration identical to that is applied to the normal printing operation, the system then enters the "pause" state. Furthermore, since the execution of the "pause-out" step properly regulates the flow of ink 758*i*** before resuming a normal printing operation, it is possible for the system to equally maintain the ink concentrations before discontinuing and after resuming the printing operation.

The ink concentration control system related to the present invention is thus described in reference to an offset printing press for embodying the "print-out" step, "printing finishup" step, and the "pause" step. It should be understood, however, that, in addition to the offset printing press cited above, the preferred embodiments of the present invention are also applicable to a wide variety of printing press including the letterpress and/or the lithographic press by direct printing for example. Note that the plate cylinder and the blanket cylinder make up the tranfer cylinder when the preferred embodiments are applied to an offset printing press. Conversely, only the plate cylinder makes up the ink-transfer cylinder when applying the preferred embodiment to either the letterpress or the lithographic press by direct printing.

(17) Control of the ink concentration (II)

The multicolor printing press reflecting the present invention causes the thickness of the ink film on the form roller 710 and the plate cylinder 3 to be adjusted into an optimum concentration while the ink-feeding step described above is underway, thus when starting with normal printing operation after the ink-feeding step completes, the predetermined printing concentration is immediately realized. The ink concentration control system is described below.

The sequential operations from the replacement of the printing plates to the activation of the normal printing operation on receipt of the printing startup command are already described by referring to FIG. 68. Referring now to FIGS. 74 and 75, the conditions of the ink film thickness on each cylinder while executing those operations mentioned above are described below. Note that, for better understanding of the present invention, only ideal cases are explained in the following description.

FIG. 74 denotes the condition of the ink film thickness in a moment the ink-feeding step is completed. The ink-feeding step is done to properly saturate ink 758 to be transferred onto the surface of the printing plate wound on the plate cylinder 3. Assume that the rate of transferring ink from form roler 710 to the plate cylinder 3 is 50% against "100" of the ink film thickness on the form roller 710 immediately after the ink-feeding step is completed, then the ink film thickness on the plate cylinder 3 also becomes "100". Conversely, since the blanket cylinder 2 remains apart from the plate cylinder 3, there is no ink film thickness on the blanket cylinder 2 at all, i.e. the ink film thickness is "0".

FIG. 75 denotes the condition of the ink film thickness while the normal printing operation is underway, in which various ink film thickness is indicated on the assumption that the rate of transferring ink from the form roller 710 to the plate cylinder 3 is 50%, the rate of transferring ink from the plate cylinder 3 to the blanket cylinder 2 is 50%, and the rate of transferring ink from the blanket cylinder 2 to the continuous paper 12 is 100%, respectively. When these rates are present, assume that there is "100" of the ink film thickness on the form roller 710 formed by the doctor blade 714, the thickness of ink film on the plate cylinder 3 immediately after being transferred from the form roller 710 becomes "66", whereas the thickness of ink film on the blanket cylinder 2 immediately after being transferred from the plate cylinder 3 becomes "33", thus causing the ink film thickness on the continuous paper 12 to also become "33".

A photoelectric sensor 790 is installed to the designated position of the printing press body 1 for detecting the thickness of ink film on either the plate cylinder 3 or the form roller 710. The photoelectric sensor 790 delivers the ditecting signal referring to the ink film thickness to the microprocessor 21 of FIG. 2, and then, the pushing amount of the doctor blade 714, i.e., the thickness of ink film on the form roller 710, can properly be adjusted in response to the command signal from the microprocessor 21. Concretely, while said ink-feeding step is underway, the pushing of the doctor blade 714 is controlled so that the ink film thickness on the plate cylinder 3 can become "100" according to the typical example described above. Likewise, the pushing amount of the doctor blade 714 is controlled so that the ink film thickness on the plate cylinder 3 also becomes "66" while the normal printing operation is underway.

Assume that no control is applied to the thickness of the ink film on the plate cylinder 3 while said ink-feeding step is underway. In this case, if the thickness of the ink film on the plate cylinder 3 is unstable, i.e., if the ink film thickness on the plate cylinder 3 is for example "98" which is less than "100" of the thickness of ink film at that time said ink-feeding step is compleated, the thickness of ink film on the continuous paper 12 becomes a value corresponding to $33\times98/100$ instead of "33" when the normal printing operation begins. This indicates that the thickness of the ink film thus generated is thinner than that is actually needed for the predetermined printing concentration "33". If the normal printing is executed under the condition denoted above, the photoelectric sensor 790 then detects the thickness of the ink film on the form roller 710 or the plate cylinder 3 to cause the pushing amount of the doctor blade 714 to be controlled so that the ink film thickness on the plate cylinder 3 correctly becomes "66". Consequently, the ink film thickness on the continuous paper 12 soon receives additional ink enough to make up the predetermined printing concentration "33". Nevertheless, it will cause the printing operation to be executed by using lower ink concentration for a certain while until the predetermined ink concentration is reached. Likewise, if the thickness of the ink film exceeds "100" when said ink-feeding step is completed, unlike the above case, the ink concentration applicable to the start-up of the normal printing operation becomes upper than the predetermined printing concentration "33". This causes the printing operation to be executed by an upper concentration than that is actually needed, since it also takes a certain while before reaching the predetermined ink concentration.

On the other hand, the ink concentration control system reflecting the present invention properly controls the pushing amount of the doctor blade 714 while said ink-feeding step is underway so that the ink film thickness on the plate cylinder 3 becomes the predetermined value "100". As a result, the printing system reflecting the present invention can correctly start the printing operation by applying the predetermined ink concentration "33". In addition, while the normal printing operation is underway, the system properly controls the pushing amount of the doctor blade 714 so that the ink film thickness can constantly remain "66" by activating the photoelectric sensor 790 that detects the thickness of the ink film on the plate cylinder 3, thus the ink concentration during the normal printing operation is securely held constant at the predetermined value "33".

Note that the foregoing description refers to the preferred embodiment of the multicolor printing press incorporating the doctor blade 714. It should be understood, however, that the present invention is also applicable to the printing press using reverse rollers. In addition, the present invention is applicable not only to the offset printing press, but also to the letterpress and the lithographic press by direct printing as well. When applying the present invention to an offset printing press, the printing cylinder is made of the blanket cylinder, whereas the printing cylinder is made of the impression cylinder when applying the present invention to either the letterpress or the lithorgraphic press by direct printing.

D. Paper Conveyeing System

A paper conveying system of this printing press is formed by the pin feed tractor 13 and the suction conveyer 14, to control feeding of the continuous paper 12 in relation to rotation of the blanket cylinder 2 and the (contact/separation to the blanchet cylinder 2) on the basis of commands from the microprocessor 21. The continuous paper 12 may be provided by folded paper having folds or machine folds in the vertical direction or rolled paper having no such folds, which is provided in horizontal ends with marginal punchholes to be engaged with pins of the pin feed tractor 13. The following description is made on the case of employing the folded paper.

Structure of Pin Feed Tractor

Figure 76A:
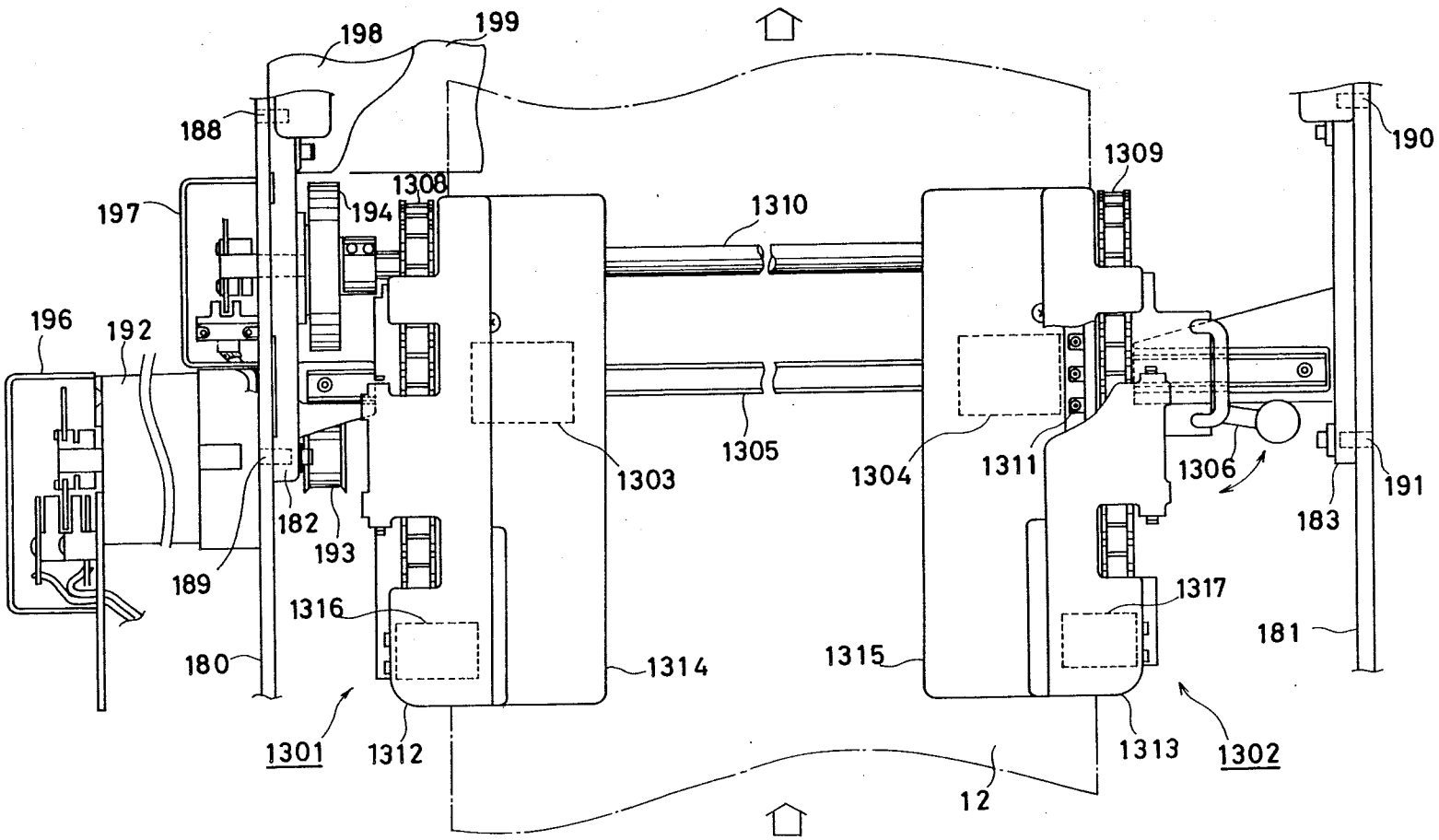
Figure 76B:
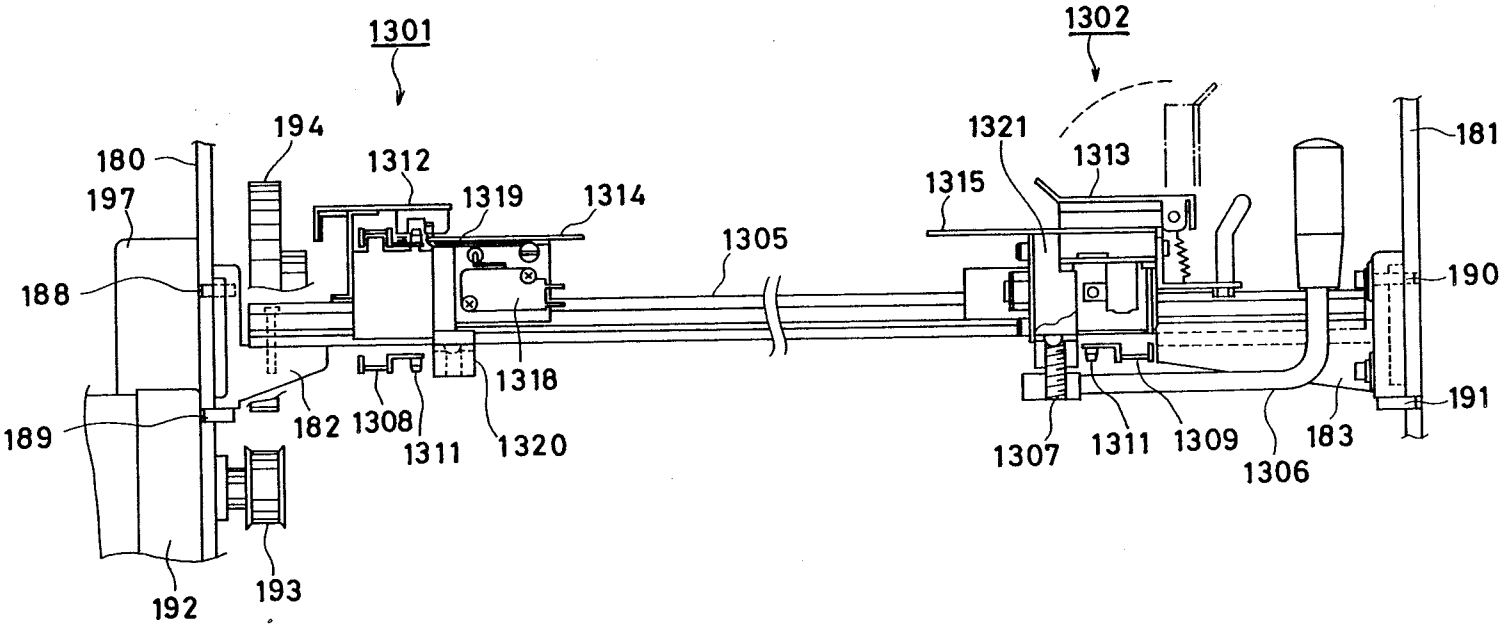
Figure 76C:
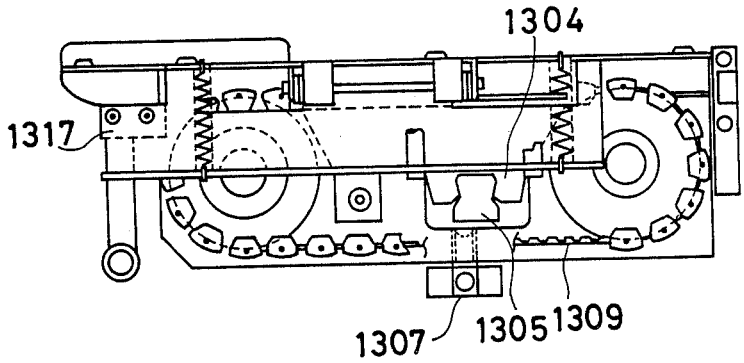

FIGS. 76A, 76B and 76C are an explanatory plan view, an explanatory front sectional view and an explanatory right side elevational view showing the mechanism of the pin feed tractor 13 according to an embodiment of the present invention. The pin feed tractor 13 is formed by making assembly reference planes of a left tractor frame 1320 and a right tractor frame 1321 in contact with reference planes of moving elements 1303 and 1304 of a high-accuracy linear bearing respectively in parallel registration and fixing the same, and mounting respective parts of left and right tractor units 1301 and 1302 on the left and right tractor frames 1320 and 1321 to unify the same. Namely, the left and right tractor units 1301 and 1302 can be registered in parallel with each other without utilizing jigs etc. The left moving element 1303 is fixed to a stationary position of a guide rail 1305 of the linear bearing while the right moving element 1304 is unfixed to be horizontally slidable along the guide rail 1305, to arbitrarily vary the interval between the left and right tractor units 1301 and 1302 with the paper width of the continuous paper 12.

Upwardly engaged with the lower part of the moving element 1304 of the right tractor unit 1302 is a screw 1307 having a flat-surface ball, which is adapted to rotate in response to rotation of a lever 1306. The lever 1306 is rotated in the anticlockwise direction to upwardly urge the screw 1307 and press the flat surface ball in its forward end against the guide rail 1305 of the linear bearing, thereby to lock the right tractor unit 1302 at a desired position by the pressing force. The left tractor 1301 is also fixed in the stationary position by a similar screw having a flat surface ball.

Figure 76D:
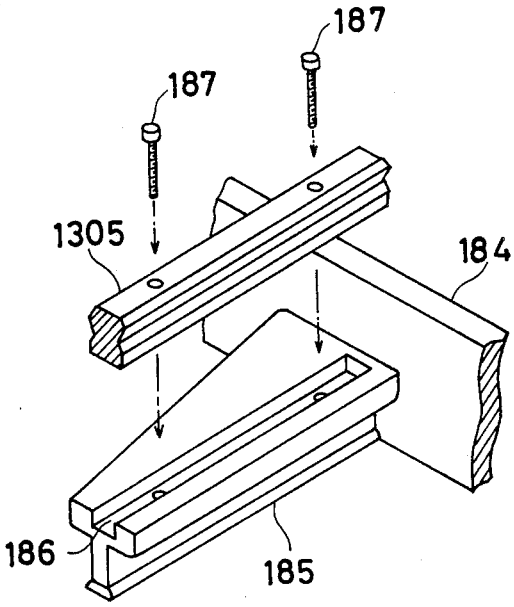
Figure 76E:
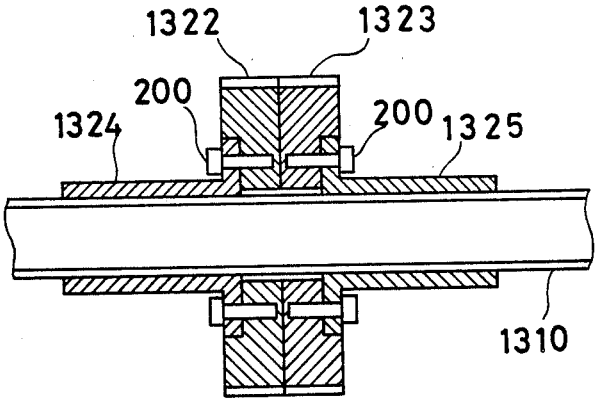
Figure 76E:
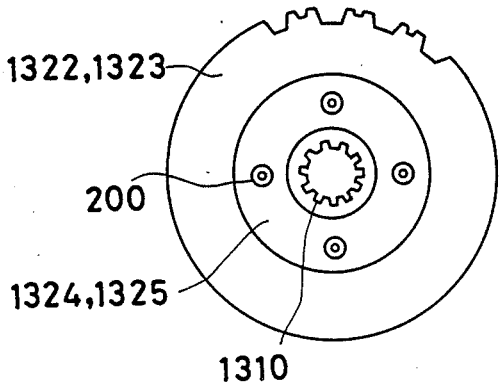

The left and right tractor units 1301 and 1302 are respectively provided with paper conveyer timing belts 1308 and 1309 which are extended along front and rear pairs of pulleys, so that horizontal front pulleys are connected with each other by a spline shaft 1310 to rotatingly drive the same thereby to synchronoously forward/reverse drive left and right paper conveyer timing belts 1308 and 1309. The left and right paper conveyer timing belts 1308 and 1309 are provided with paper feeding pins 1311 at regular interrvals, to be engaged with the horizontal marginal punchholes of the continuous paper 12 for synchronous forward/reverse drive of the paper conveyer timing belts 1308 and 1309, thereby to forward/reverse drive the continuous paper 12. In order to smoothly feed the continuous paper 12, the paper feeding pins 1311 of the left and right tractor units 1301 and 1302 must be correctly matched in phase, and such phasing of the paper feeding pins 1311 are performed as follows. As shown at FIG. 76E(*a*), left and right front pulleys 1322 and 1323 are previously engaged with left and right bearings 1324 and 1325 respectively in the exterior of the unit, and then the side surfaces of the front pulleys 1322 and 1323 are brought into contact with each other after the engagement to receive the spline shaft 1310. Phasing is performed with reference to the spline shaft 1310 and then the left and right front pulleys 1322 and 1323 are fixed to the left and right bearings 1324 and 1325 respectively by screws 200 to establish correct phase relation, and finally the pair of front pulleys 1322 and 1323 are assembled in the left and right tractor units 1301 and 1302 respectively. As shown at FIG. 76E(*b*), the fixing screws 200 are externally mounted on the front pulleys 1322 and 1323 in such a system, whereby phasing can be performed in the exterior of the printing press to facilitate easier operation in comparison with the case of phasing on the printing press and improvement in accuracy.

Paper pressing lids 1312 and 1313 are arranged on the left and right tractor units 1301 and 1302 to cover the upper surfaces of the paper feeding pins 1311 while paper receiving guide plates 1314 and 1315 are respectively arranged in the lower surface sides thereof, to hold the horizontal ends of the continuous paper 12 therebetween and guide the same so that the marginal punchholes are not disengaged from the paper feeding pins 1311.

In order to remove dust sticked to the marginal punchholes of the continuous paper 12, dust removing portions 1316 and 1317 are arranged respectively in the terminating end portions (inlet side for the continuous paper 12) of the left and right tractor units 1301 and 1302. The dust removing portions 1316 and 1317 are oppositely provided with dust removing brushes (not shown) and appropriate spaces (not shown) in the upper and lower sides of a passage plane for the continuous paper 12, which spaces are made to be connected with a suction blower (not shown) mounted on the side of the printing press body 1 by, e.g., a flexible tubular material to discharge the air from the spaces through suction by the sunction blower, thereby to suckingly discharge the dust.

A paper detecting limit switch 1318 is mounted on a central portion in the lower side of the paper receiving guide plate 1314 of the left tractor unit 1301 in the fixed side while a working spring 1319 for driving the paper detecting limit switch 1318 is upwardly projected from the left-hand end of the paper receiving guide plate 1314 so that the working spring 1319 is downwardly pressed upon setting of the continuous paper 12 to drive the paper detecting limit switch 1318, which in turn detects presence of the continuous paper 12.

The unit of the pin feed tractor 13 formed in the aforementioned manner is mounted between left and right main frames 180 and 181 of the printing press body 1 through left and right brackets 182 and 183. As shown in FIG. 76D, each of the left and right brackets 182 and 183 is formed by a frame mounting portion 184 and a rail receiving portion 185, and a groove 186 is formed in the rail receiving portion 185 to engagingly receive the guide rail 1305 of the linear bearing and fix the same by screws 187.

The left and right brackets 182 and 183 are mounted on prescribed positions of the left and right main frames 180 and 181, to be registered with reference to pairs of registration knock pins 188, 189 and 190, 191 previously formed in prescribed positions of the left and right main frames 180 and 181. The knock pins 188 and 190 are engaged with registration holes provided in the frame mounting portions 184 to restrict positions for mounting the left and right brackets 182 and 183 on the left and right main frames 180 and 181 while the knock pins 189 and 191 are adapted to restrict angles of inclination of the left and right brackets 182 and 183 in the restricted mounting positions, i.e., the angles of inclination of the pin feed tractor 13 to be mounted thereon.

The guide rail 1305 of the linear bearing is thus engagedly mounted on the rail receiving portions 185 of the left and right brackets 182 and 183 accurately registered and fixed to the prescribed positions of the left and right main frames 180 and 181 of the printing press body 1, whereby the pin feed tractor 13 can be easily mounted on a prescribed position of the printing press body 1 at a prescribed angle. When mounted on the printing press body 1, a paper set reference position $P_1$ (refer to FIG. 82) of the pin feed tractor 13 is positioned by a prescribed distance H from a printing starting position $P_2$.

As hereinabove described, the left and right tractor units 1301 and 1302 are already registered in parallel with each other and the paper feeding pins 1311 are already phased when the left and right tractor units 1301 and 1302 are respectively fixed to the moving elements 1303 and 1304 of the linear bearing while the moving elements 1303 and 1304 are only horizontally moved parallely on the guide rail 1305, and hence the said parallel relation and phasing relation after adjustment will not be damaged till the guide rail 1305 is mounted on the left and right brackets 182 and 183. Thus, no complicated re-adjustment such as parallel registration of the left and right tractor units 1301 and 1302 and phasing of the paper feeding pins 1311 is required when the unified and completely assembled pin feed tractor 13 is mounted on the printing press body 1. Further, such adjustment can easily and correctly be performed in the exterior of the printing press before the pin feed tractor 13 is mounted on the printing press body 1.

A tractor driving DC servo motor 192 is arranged in the exterior of the left main frame 180 of the printing press body 1 and a pulley 193 connected with the driving shaft of the DC servo motor 192 is provided in the interior of the left main frame 180, while a timing belt (not shown) is extended between the pulley 193 and a timing pulley 194 similarly provided in the interior of the left main frame 180. The driving system is so formed that the timing pulley 194 is registered with and fixed to the spline shaft 1310 to rotate the spline shaft 1310 in response to rotation of the DC servo motor 192 thereby to forward/reverse drive the left and right paper conveyer timing belts 1308 and 1309. A rotary encoder 196 is mounted on the driving shaft of the DC servo motor 192 to detect the number of rotation of the DC servo motor 192, i.e., paper conveying rate and another rotary encoder 197 is mounted on the rotation shaft of the pulley 194 in the exterior of the main frame 180 to detect the rotation of the spline shaft 1310, i.e., the positions of the paper feeding pins 1311.

In front of the pin feed tractor 13, upper and lower guide plates 198 and 199 are extended in immediate front of the impression cylinder 11, so that the continuous paper 12 discharged from the pin feed tractor 13 is inserted between the same and guided to the position between the blanket cylinder 2 and the impression cylinder 11.

Structure of Suction Conveyer

Figure 77A:
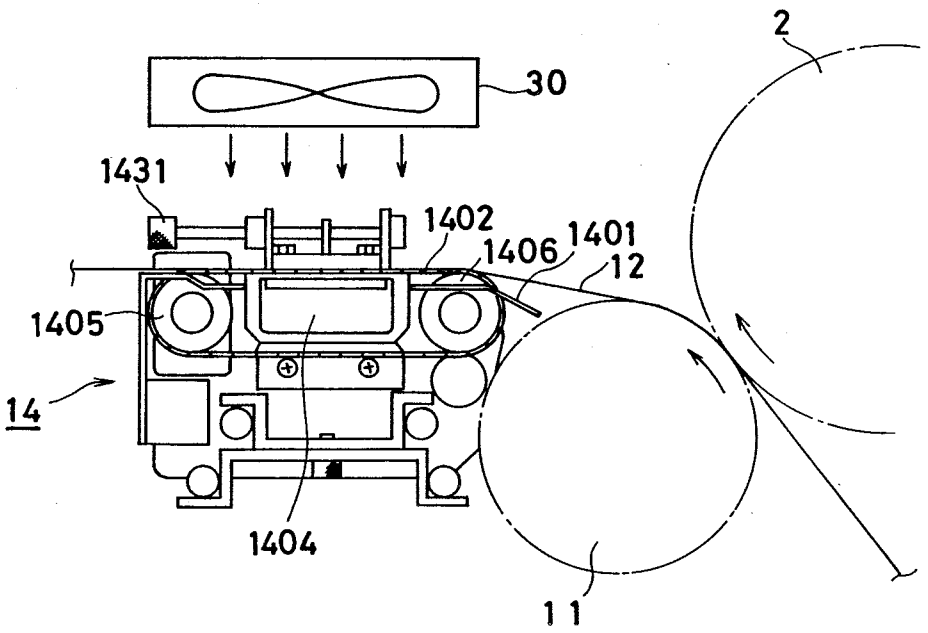

FIGS. 77A to 77D are mechanical explanatory diagrams showing an embodiment of the suction conveyer 14, which can switch suction force in three stages while its suction width is variable with the paper width. FIG. 77A is an explanatory left side elevational view showing a position for mounting the suction conveyer 14 with relation to the impression cylinder 11. As shown in FIG. 77A, the suction conveyer 14 is registered and fixed between the left and right main frames 180 and 181 of the printing press body 1 (see FIG. 77C) so that a paper guide 1401 is placed in a position slightly ahead of the top of the impression cylinder 11 in the rotational direction and a feeding plane of a conveyer belt 1402 becomes substantially horizontal to horizontally guide the continuous paper 12 obliquely moved between the blanket cylinder 2 and the impression cylinder 11. A blast means formed by a paper pressing fan 30 is provided above the suction conveyer 14 to send a blast to the upper surface of the suction conveyer 14, thereby to prevent upward separation of the continuous paper 12 from the upper surface of the suction conveyer 14 in paper feeding operation.

Figure 77B:
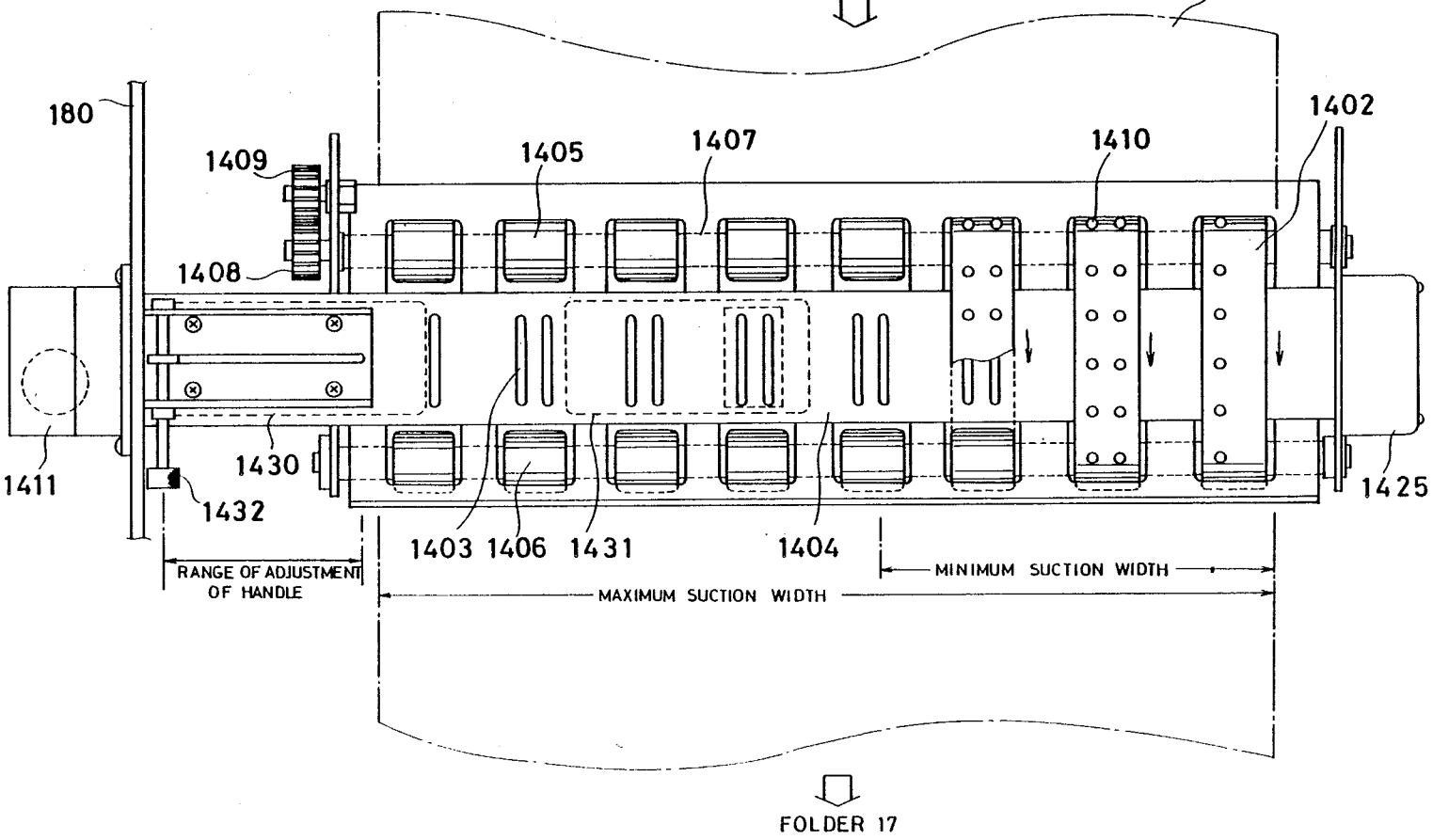
Figure 77C:
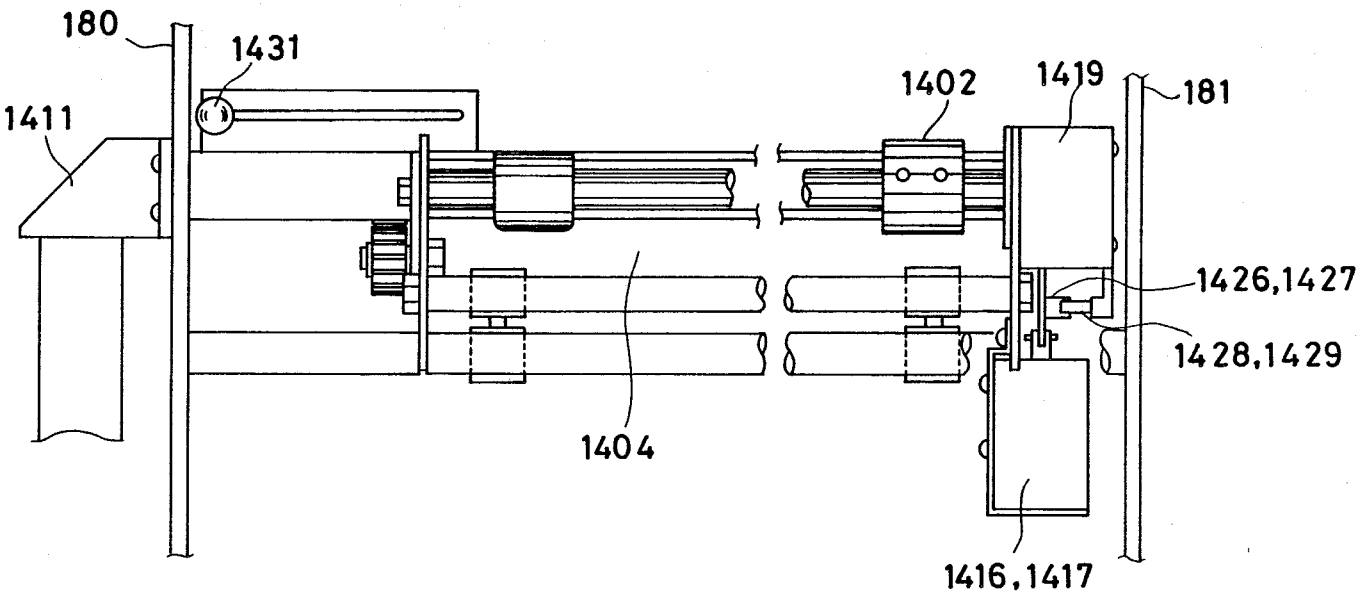
Figure 77D:
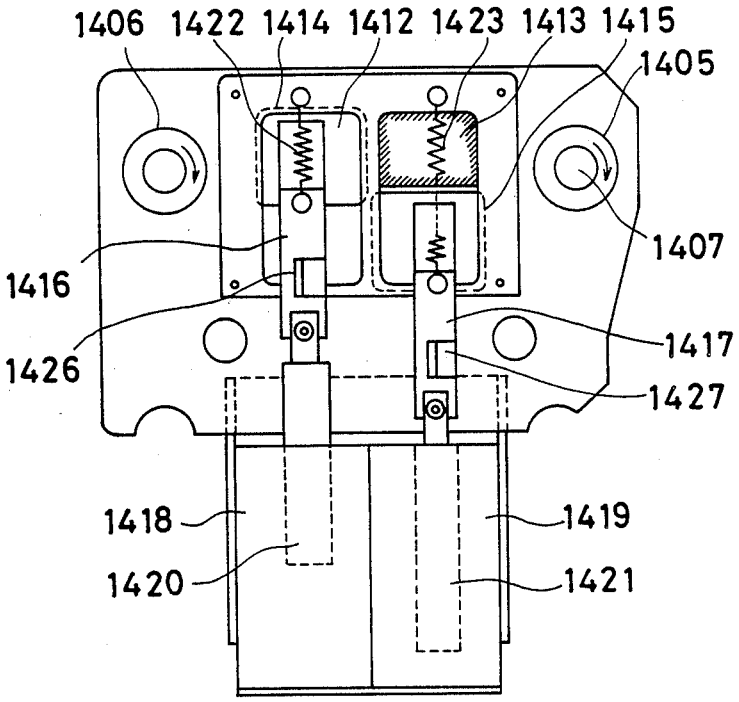

FIGS. 77B, 77C and 77D are mechanical explanatory plan, front elevational and right side elevational views of the suction conveyer 14 respectively. A suction duct 1404 having a number of suction slits 1403 in its upper surface is extended along the horizontal center of the suction conveyer 14, and a pair of pulleys 1405 and 1406 are provided per pair of suction slits 1403 in the front and rear portions of the suction duct 1404. A conveyer belt 1402 is wound around each pair of pulleys 1405 and 1406 while a gear 1408 is engagedly mounted on the left end of a common rotary shaft 1407 of the front pulleys 1405, so that the gear 1408 is engaged with a driving gear 1409 mechanically connected with the main motor 20 through, e.g., a belt to constantly feed the conveyer belt 1402 in response to rotation of the main motor 20. The conveyer belt 1402 is provided with a number of suction holes 1410 in positions corresponding to the suction slits 1403. By virtue of such structure, the continuous paper 12 discharged from the impression position between the blanket cylinder 2 and the impression cylinder 11 is guided in the direction of the folder 17 while being sucked on the upper surface of the feeding conveyer 1402.

The left end of the suction duct 1404 is connected with a suction blower (not shown) through a connecting portion 1411 provided in the exterior of the main frame 180, to suck and discharge the air in the suction duct 1404 in response to rotation of the suction blower. On the other hand, the right end of the suction duct 1404 is provided with two openings 1412 and 1413 as well as a primary shutter 1414 in correspondence to one of the openings and an secondary shutter 1415 in correspondence to the other opening. The primary and auxiliary shutters 1414 and 1415 are connected with armatures 1420 and 1421 of suction force switching solenoids 1418 and 1419 respectively through connection members 1416 and 1417, which are supplied with upward return force by return springs 1422 and 1423 respectively. The primary and secondary shutters 1414 and 1415 are adapted to close the openings 1412 and 1413 when the solenoids 1418 and 1419 are not energized, while corresponding main shutter 1414 and/or auxiliary shutter 1415 downwardly slides upon energization to open the opening 1412 and/or 1413.

Figure 77E:
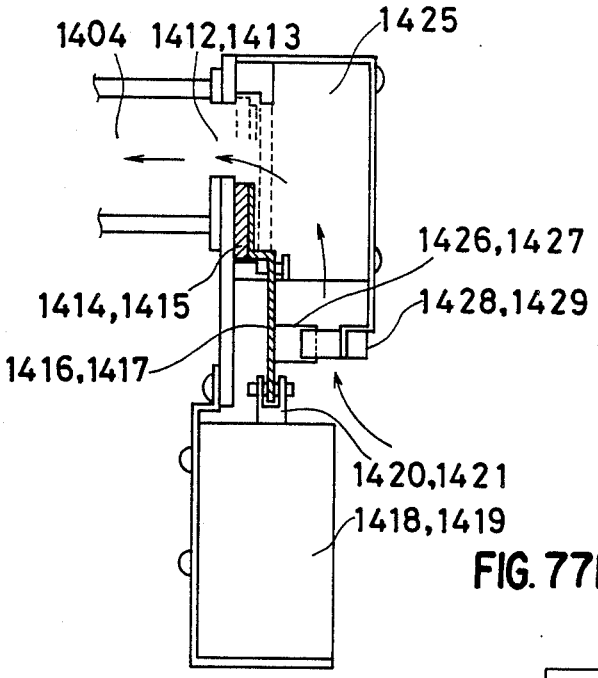
Figure 77E:
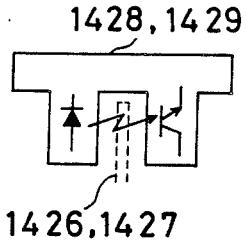

FIG. 77E is an explanatory sectional view showing the above shutter portion. The primary and secondary shutters 1414 and 1415 are provided in a shutter chamber 1425 so that external air sucked through the lower portion of the shutter chamber 1425 is introduced into the suction duct 1404 through the openings 1412 and 1413 when the primary and secondary shutters 1414 and 1415 are in "open" states. Thus, the amount of the external air sucked into the suction duct 1404 through the openings 1412 and 1413 is varied with opening/closing of the primary and secondary shutters 1414 and 1415 to adjust the amount of external air sucked through the suction holes 1410 of the conveyer belt 1402, thereby to switch the suction force in the following three stages:

| primary shutter | secondary shutter | suction force |
|---|---|---|
| closed | closed | strong |
| closed | open | medium |
| open | open | weak |

In order to detect the states of the solenoids 1418 and 1419, i.e., open/closed states of the primary and secondary shutters 1414 and 1415, dousers 1426 and 1427 are respectively provided in the connecting members 1416 and 1417 while photoelectric sensors 1428 and 1429 are respectively provided in positions (those in FIG. 77E(*a*)) to be shielded against light in an energized state, as shown in FIG. 77E(*b*).

Figure 77F:
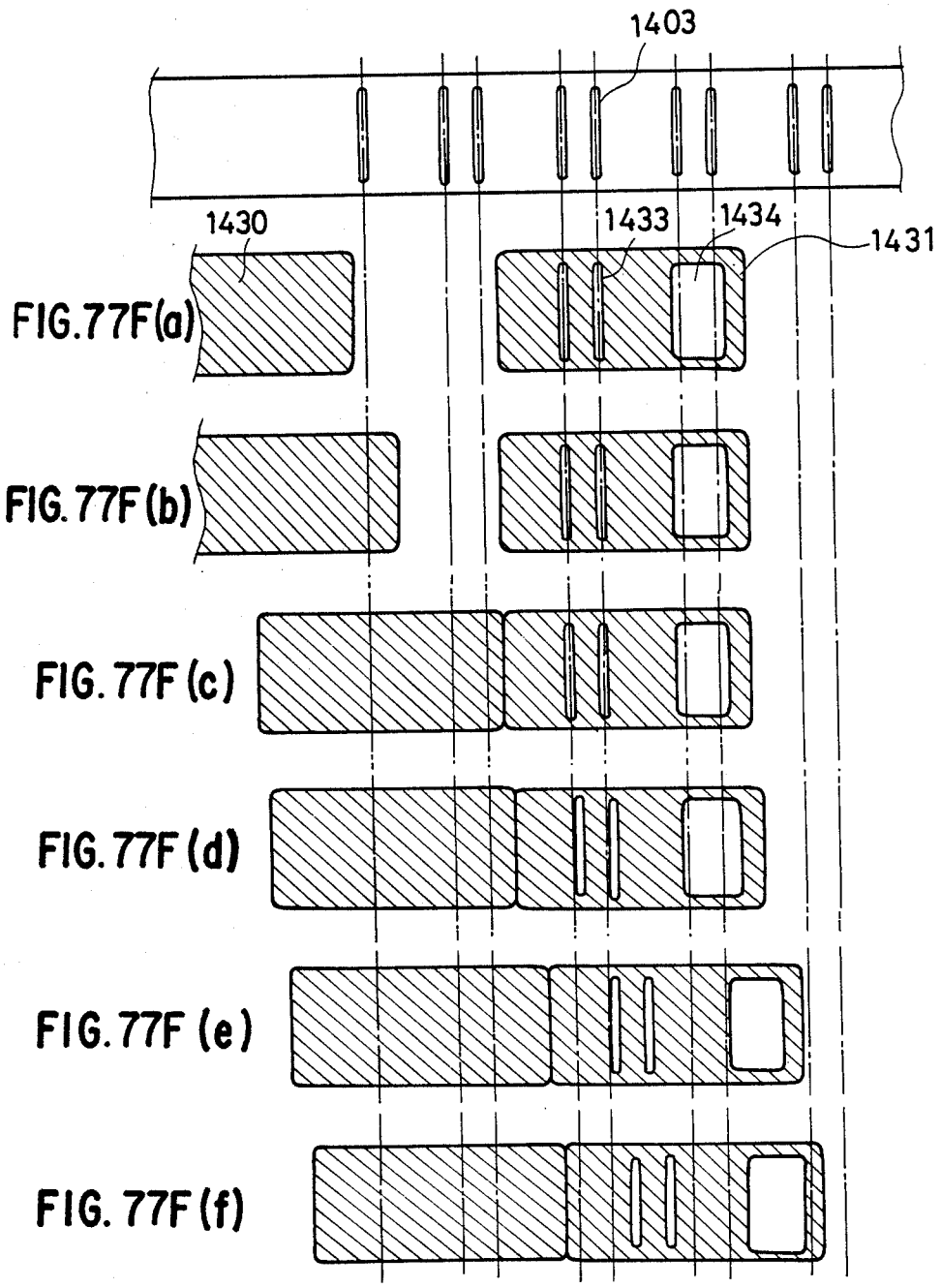
Figure 77G:
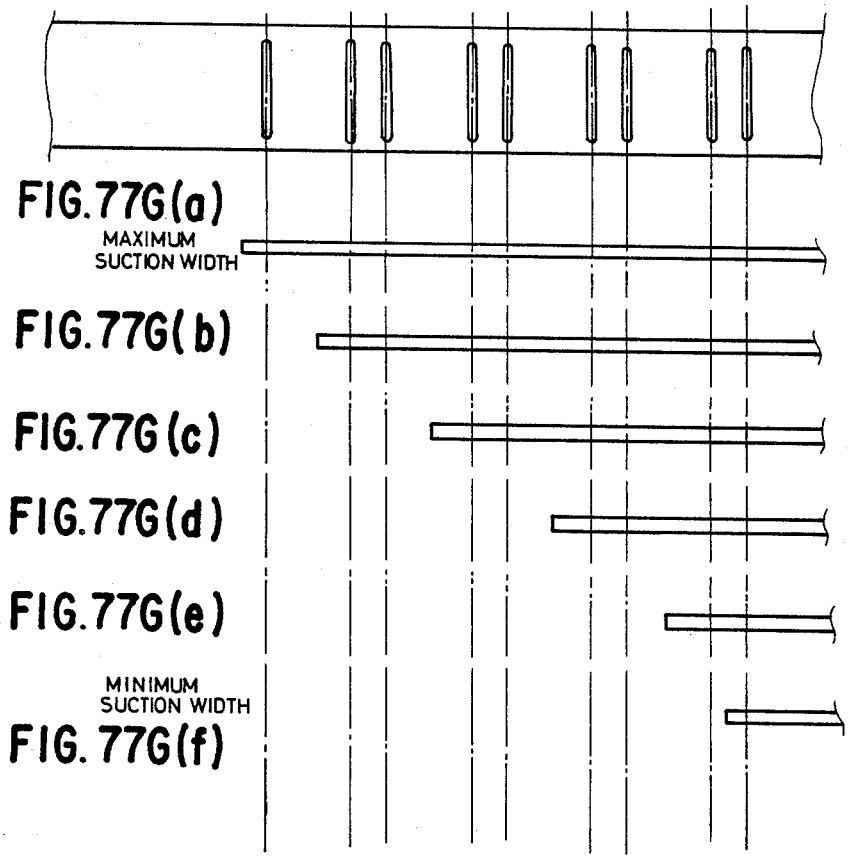

Two stages of sliders 1430 and 1431 are arranged in close contact with the left end of the upper inner side surface of the suction duct 1404 so that the first slider 1430 is slidingly moved in the right direction by a handle 1432 to close the suction slits 1403 within a prescribed range, thereby to adjust the suction width at an arbitrary level between the maximum suction width and the minimum suction width. FIG. 77F shows extrusion of the second slider 1431 following the movement of the first slider 1430 in stages. The second slider 1431 is provided with openings 1433 similarly formed with one pair of suction slits 1430 and a larger opening 1434 capable of containing another pair of suction slits 1403 formed in a corresponding position, to gradually shield the suction slits 1403 from the left-hand side by being pressed in the right-hand direction. Lateral bars in FIG.

77G illustrate the manner of variation of the suction width in the respective steps as shown in FIG. 77F. Thus, a large shielding amount can be obtained by a small amount of movement. The second slider 1431 is engaged with a return means such as a spring (not shown) to return to its original position (position shown at FIGS. 77(*a*) and (*b*)) when no pressing force is applied from the first slider 1430.

Contact/Separation Mechanism

FIG. 78A is an explanatory diagram showing a mechanism for making the impression cylinder 11 in contact with/separated from the blanket cylinder 2. As shown in FIG. 78A, the impression cylinder 11 is arranged to be rotatable about a support shaft 1102 through left and right bearings 1101, and is driven by engagement of a gear 1103 provided on one end portion thereof with a gear 201 provided on one end portion of the blanket cylinder 2 driven by the main motor 20, as hereinabove described. In other words, the impression cylinder 11 is continuously rotatingly driven regardless of the states of contact/separation. Both ends of the support shaft 1102 define eccentric shafts 1104 and 1105, which are supported by eccentric shaft bearing portions 4150 and 4151 provided in the exterior of the left and right main frames 180 and 181. The left eccentric shaft 1104 is connected through a helical coupling 4152 with the rotaty shaft of an impression cylinder pulse motor 4153, which in turn rotatingly drives the left eccentric shaft 1104 to move the position of the support shaft 1102 and responsively change the distance between the shafts of the impression cylinder 11 and the blanket cylinder 2, thereby to make the impression cylinder 11 in contact with/separated from the blanket cylinder 2.

FIG. 78B typically illustrates the states of contact-/separation, where FIG. 78B(*d*) shows the state of separation and FIGS. 78B(*b*) and (*c*) show the states of contact. Referring to FIG. 78B, a point B denotes the center of the blanket cylinder 2, a point I denotes the center of the support shaft 1102 (center of rotation of the impression cylinder 11) and a point S denotes the center of the left/right eccentric shaft 1194/1105 (center of oscillation of the impression cylinder 11). In the separated state as shown in FIG. 78(*a*), straight lines SI and BI form a large angle as shown, and this angle is gradually reduced as the left eccentric shaft 1104 is rotated in the anticlockwise direction by the impression cylinder pulse motor 4153, while the impression cylinder 11 is responsively oscillated in the anticlockwise direction about the point S to gradually reduce the distance between the shafts of the impression cylinder 11 and the blanket cylinder 2 (distance between points B and I). When the line SI reaches a position as shown at FIG. 78B(*b*), the impression cylinder 11 comes into contact with the blanket cylinder 2, while the impression cylinder pulse motor 4153 is further driven in order to apply appropriate printing pressure to make the center I of rotation of the impression cylinder 11 further approach the center B of the blanket cylinder 2 till the line SI is in a state as shown in FIG. 78B(*c*) immediately before overlapping the line BI, i.e., further reduce the intershaft distance, to set the position of the impression cylinder 11 as a contact position.

In order to vary the printing pressure with the types of printed materials, the impression cylinder pulse motor 4153 may be driven between the anglese of rotation of the eccentric shafts as shown at FIGS. 78(*b*) and (*c*) for example, thereby to appropriately vary the distance between the shafts of the impression cylinder 11 and the blanket cylinder 2. However, when, for example, the impression cylinder 11 is to retained in a state approximate to the eccentric shaft rotation angle as shown at FIG. 78B(*b*), i.e., when the printing pressure is relatively weak, repulsive force from the blanket cylinder 2 is applied as extremely large moment to the impression cylinder pulse motor 4153 as obvious from the positional relation as shown at FIG. 78B(*b*) and an extremely large-sized pulse motor is required to stably retain such large repulsive force. Thus, such retaining of the impression cylinder 11 is not necessarily practical although it is possible.

In a preferred embodiment of the present invention, therefore, the position shown at FIG. 78B(*c*) is previously set as the contact position as hereinabove described, and the printing pressure is adjusted by a printing pressure adjusting spring mechanism as hereinafter described. The line SI is substantially aligned with the line BI at the position as shown at FIG. 78B(*c*), and hence the repulsive force from the blanket cylinder 2 is applied merely as extremely small moment to the impression cylinder pulse motor 4153. Therefore, a small-sized pulse motor can be employed. The moment applied to the impression cylinder motor 4153 becomes zero when the line SI is aligned with the line BI to reach the top dead center, whereas the rotation of the impression cylinder pulse motor 4153 urged by the repulsive force from the blanket cylinder 2 is instably directed to remarkably damage stability of the mechanism. Thus, it is important to select the position slightly ahead of the top dead center as the contact position as shown at FIG. 78B(*c*), and the lines BI and SI form an angle of about 5° in a preferred embodiment.

Advantages of such employment of the pulse motor as the driving part for the contact/separation mechanism for the impression cylinder 11 are as follows: First, contact/separation sppeds can be easily controlled to reduce impacts applied to the printing press, thereby to increase the life of the printing press. Second, the cylinders can be in contact with/separated from each other at an arbitrary phase, to readily cope with variation in the vertical length of the paper to be printed. Third, the impression cylinder 11 can be retained in a separated position in case of rotating the balanket cylinder 2 while stopping paper feeding for printing continuous paper, whereby no unnecessary tension acts on the continuous paper to damage the marginal punchholes engaged with the pins 1311 of the pin feed tractors 13. Fourth, step-out is caused against retaining force of the impression cylinder pulse motor 4153 when excessive printing pressure is applied, whereby the impression cylinder 11 is naturally separated from the blanket cylinder 2 to serve as a safety device.

Figure 78C:
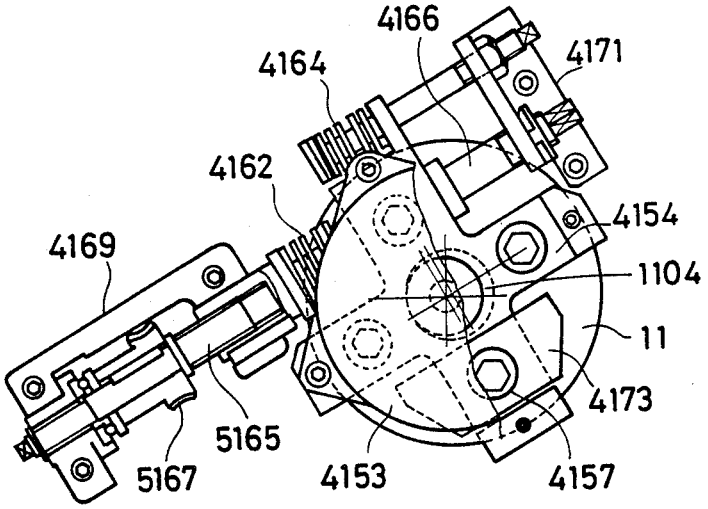
Figure 78D:
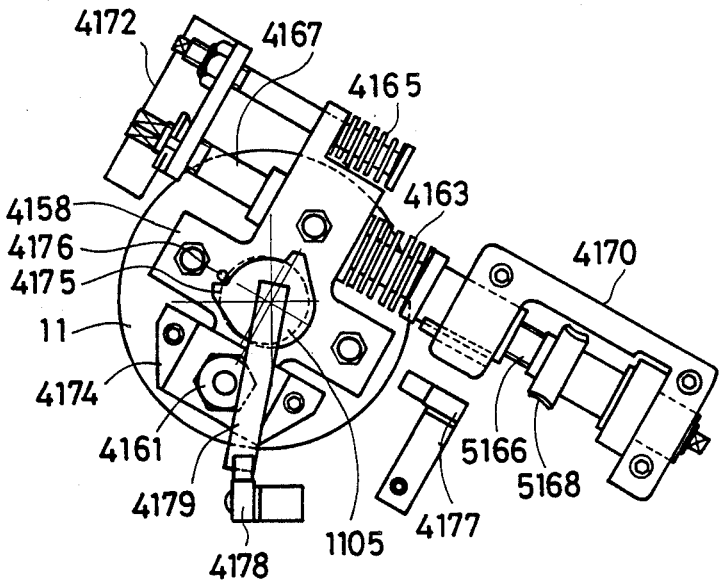

Description is now made on the printing pressure adjusting spring mechanism with reference to FIGS. 78A, 78C and 78D. FIG. 78C is a left side elevational view of the mechanism as shown in FIG. 78A, and FIG. 78D is an explanatory right side elevational view thereof. As shown in FIGS. 78A, 78C and 78D, a cross-shaped printing pressure arm 4154 is mounted in the exterior of the left main frame 180 to be rotatable about the support shaft 4157 through a thrust bearing 4155 and a needle bearing 4156 for adjusting the printing pressure, while the support shaft 4157 is reinforced by a pin block 4173 and fixed to the left main frame 180. In correspondence to this, another cross-shaped printing pressure arm 4158 is arranged in the exterior of the right main frame 181 to be rotatable about a support shaft 4161 through a thrust bearing 4159 and a needle bearing 4160, while the support shaft 4161 is reinforced by a pin block 4174 and fixed to the right main frame 181. The left eccentric shaft bearing portion 4150 is inserted in a through-hole defined in the center of the left printing pressure arm 4154 to receive the left eccentric shaft 1104, while the right eccentric shaft bearing portion 4151 is inserted in a through-hole defined in the center of the right printing pressure arm 4158 to receive the right eccentric shaft 1105, so that the support shaft 1102 is oscillated responsively to oscillation of the left and right printing pressure arms 4154 and 4158 and the impression cylinder 11 is responsively oscillated to vary pressing force against the blanket cylinder 2, i.e., the printing pressure. The impression cylinder pulse motor 4153 is placed on and fixed to the left printing pressure arm 4154, to be oscillated with the same. The left and right printing pressure arm 4154 and 4158 are urged in the same oscillation direction (contact direction) by left and right printing pressure primary compression springs 4162 and 4163 and left and right printing pressure secondary compression springs 4164 and 4165, while the range of oscillation is restricted by left and right impression cylinder stoppers 4166 and 4167. When the rotational phase of the impression cylinder pulse motor 4153 is in the separated position (at the phase of FIG. 78B(*a*)), the left and right printing pressure arms 4154 and 4158 are pressed against the impression cylinder stoppers 4166 and 4167 respectively, while the left and right printing pressure arms 4154 and 4158 are separated from the impression cylinder stoppers 4166 and 4167 by the repulsive force form the blanket cylinder 2 when the rotational phase of the impression cylinder pulse motor 4153 is in a contact position (at the phase of-FIG. 78B(*c*)) to be stopped in a position with the repulse force from the blanket cylinder 2 and that of the compression springs 4162 to 4165 being balanced. Thus, the compression springs 162 to 165 are varied in repulsive force to arbitrarily adjust the printing pressure.

In this embodiment, left and right printing pressure adjusting screws 5165 and 5166 are provided in relation to the left and right printing pressure primary compression springs 4162 and 4163 respectively as means for varying the repulsive force of the compression springs 4162 to 4165, thereby to continuously vary the left and right printing pressure primary comrpession springs 4162 and 4163 in condensation. The left and right printing pressure adjusting screws 5165 and 5166 are interlockingly driven by a common driving mechanism (not shown) respectively through left and right printing pressure adjusting worm wheels 5167 and 5168, thereby to obtain equivalent printing pressure levels. The left and right printing pressure adjusting screws 5165 and 5166 and the printing pressure adjusting worm wheels 5167 and 5168 are fixed to the left and right main frames 180 and 181 respectively through left and right printing pressure adjusting brackets 4169 and 4170. The left and right impression cylinder stoppers 4166 and 4167 and the support shafts for the left and right printing pressure secondary compression springs 4164 and 4165 are respectively fixed to the left and right main frames 180 and 181 through the left and right brakets 4171 and 4172 respectively. According to this embodiment, constant printing pressure is previously secured by the left and right printing pressure secondary compression springs 4164 and 4165 while the left and right printing pressure primary compression springs 4162 and 4163 are varied in condensation to adjust the printing pressure, whereby the left and right printing main compression springs 4162 and 4163 may not be so much strong in force and operation for varying the condensation, i.e., adjustment of the printing pressure is easy.

In order to restrict the range of rotation of the impression cylinder pulse motor 4153 between the separated position and the contact position, a stopper 4175 is mounted on the left eccentric shaft 1105 as shown in FIG. 78D while the variable range of the stopper 4175 is restricted at a prescribed angle by a stopper pin 4176. In order to detect the rotational phase of the impression cylinder pulse motor 4153 within the said range, a separated position photosensor 4177 and a contact position photosensor 4178 are arranged on the left main frame 181 at a prescribed angle while a sensor dog 4179 is mounted on the left eccentric shaft 1105 to act on the photosensors 4177 and 4178, thereby to detect the time when the impression cylinder pulse motor 4153 reaches the rotational phase corresponding to the separated position and the time when the same reaches that corresponding to the contact position.

Structure of Folder

Figure 79B:
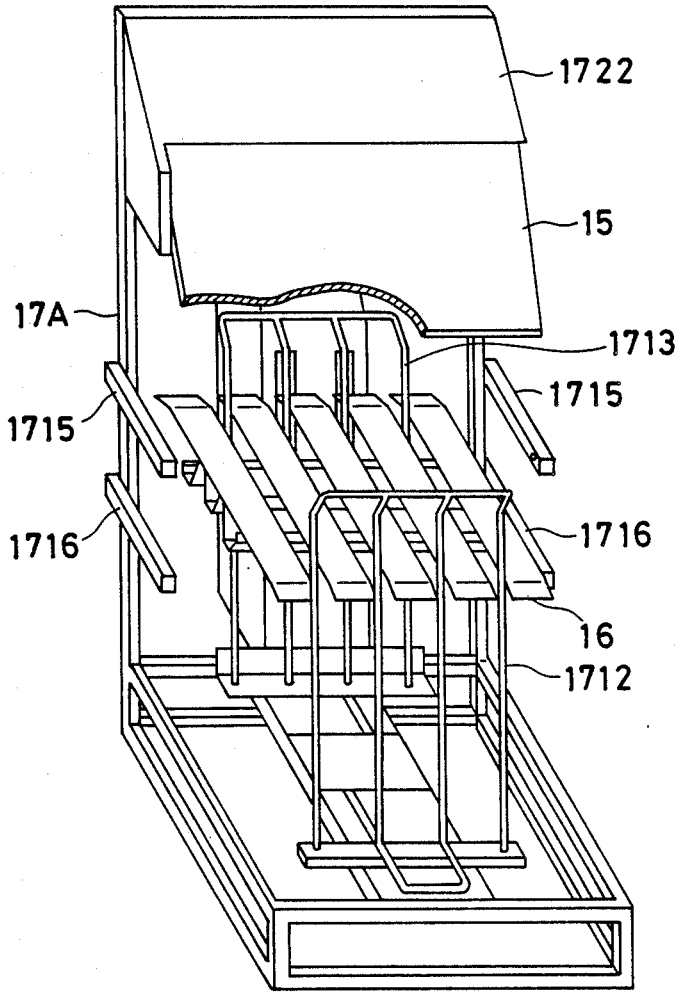

The folder 17 is arranged in front of the printing press body 1 to fold and store the printed continuous paper 12 discharged from the paper conveying system in the aforementioned mechanism. FIGS. 79A(*a*) and (*b*) shows an embodiment of this folder 17, and FIG. 79B is an explanatory perspective view thereof. The folder 17 according to this embodiment is adapted to correctly fold and store the printed continuous paper 12 continuously regardless of the vertical length thereof.

A feed screw 1702 is vertically extended in a rear box 1701 of the folder 17, to be driven by a table elevating motor 1703 placed in the lowermost part of the rear box 1701. The feed screw 1702 engagingly supports a base portion 1708 of a pair of table support members 1706 and 1707 frontwardly extending through two longitudinal openings 1704 and 1705 provided in a parallel manner in the front panel of the rear box 1701, so that the base portion 1708 are vertically moved along rotation of the feed screw 1702 to vertically move a delivery table 16 placed on the support members 1706 and 1707 through a leg portion 1709. In order to facilitate stable movement of the delivery table 16, a guide bar 1710 is extended in parallel with the feed screw 1702 to be engaged with sliding members 1711 provided in front central positions of the base portion 1708.

In order to vary horizontal effective length of the delivery table 16 with the vertical size of the continuous paper 12, a plurality of recesses are defined in front and rear end portions of the delivery table 16 while a plurality of thin rod members vertically extending through the said recesses are connected in the upper and lower positons to define front and rear frmes 1712 and 1713, which are horizontally slidable along a frame retaining portion 1714.

In order to detect the upper plane level of the continuous paper 12 placed on the delivery table 16, light emitting and receiving sides of first and second paper plane detecting photoelectric sensors 1717 and 1718 are arranged in parallel with the table plane in forward ends of horizontal pairs of support members 1715 and 1716 frontwardly extending from a rear body frame 17A of the folder 17 to hold the paper placing part, to shield the continuous paper 12 against light when the upper plane thereof reaches a prescribed level. The first and second paper plane detecting photoelectric sensors 1717 and 1818 are arranged at prescribed levels with reference to the lower end of a paddle 15, so that either the photoelectric sensor 1717 or 1718 is selected in response to the vertical size of the continuous paper 12 in folding operation. The table elevating motor 1703 is driven in response to detection of light shielding, to slightly lower the delivery table 16 thereby to continuously retain the upper plane of the continuous paper 12 at the first or second prescribed level, for facilitating appropriate folding operation in response to the vertical size of the continuous paper 12 with control of the swing angle of a swing guide (paddle) 15 as hereinafter described.

In order to restrict the range of vertical movement of the delivery table 16, first and second table upper limit switches 1719 and 1720 as well as a table lower limit switch 1721 are provided in prescribed positions of the rear box 1701 while a working member 1729 for driving the limit switches 1719, 1720 and 1721 is mounted on a corresponding position of the base portion 1708. The first and second table upper limit switches 1719 and 1720 respectively correspond to the first and second paper plane detecting photoelectric sensors 1717 and 1718, and mounting positions thereof are set in such a manner that, when the delivery table 16 reaches the first or second upper limit position with no paper being placed thereon, the upper surface of the delivery table 16 is slightly lower than the deteceting position of the corresponding one of the first and second paper plane detecting photoelectric sensors 1717 and 1718.

An upper top plate 1722 of the folder 17 is frontwardly inclinedly mounted so that the continuous paper 12 discharged from the printing press body 1 is received on the delivery table 16 slidably along its upper surface. The horizontally movable swing guide (paddle) 15 is provided in the front end of the top plate 1722 while a paddle pulse motor 1723 is arranged in a lower space of the top plate 1722 to rotatingly drive a swing shaft 1726 of the paddle 15 through a timing belt 1725 and a timing pulley 1724, thereby to horizontally swing the paddle 15 at desired timing for folding the continuous paper 12 and piling up the same on the delivery table 16.

The swing angle of the paddle 15 is varied with the vertical size of the continuous paper 12, and a standby position sensor 1727 is provided approximately to the paddle pulse motor 1723 to detect a standby position forming the basis of the range of swing movement of the paddle 15, while a sensor dog 1728 acting on the standby position sensor 1727 is mounted on the rotary shaft of the paddle pulse motor 1723.

Figure 79C:
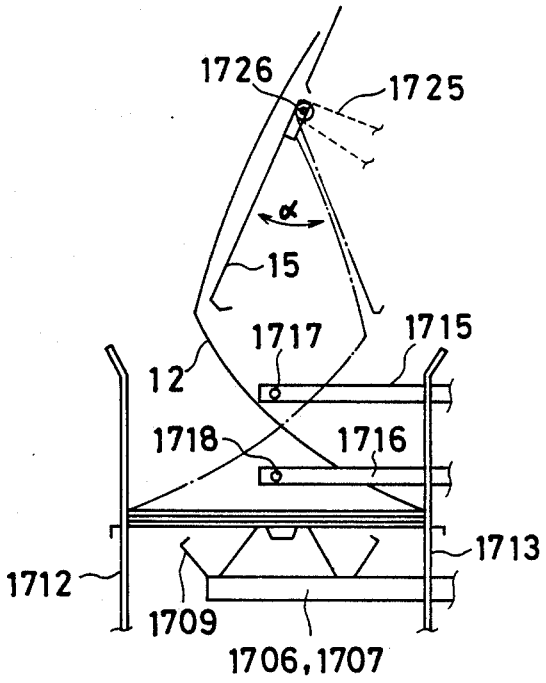
Figure 79D:
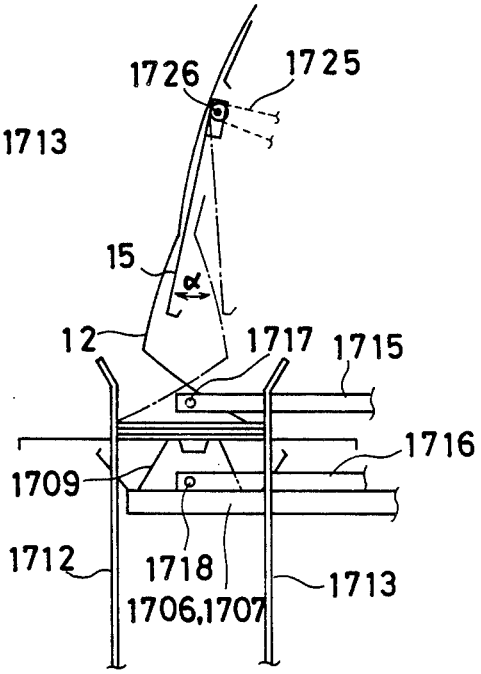

FIGS. 79C and 79D are explanatory diagrams showing examples of setting the swing angle of the paddle 15 and the upper limit position of the delivery table 16 with variation in the vertical size of the continuous paper 12. When the vertical size of the continuous paper 12 is long as shown in FIG. 79C, the swing angle $\alpha$ of the paddle 15 is set at a large value while the second upper limit position is selected for the delivery table 16 to define a relatively long interval between the lower end of the paddle 15 and the paper plane on the delivery table 16. When the vertical size of the continuous paper 12 is short as shown in FIG. 79D, the swing angle $\alpha$ of the paddle 15 is set at a relatively small value while the first upper limit position is selected from the delivery table 16, to define a relatively short interval between the lower end of the paddle 15 and the paper plane on the delivery table 16. Thus, appropriate folding operation is enabled in response to the vertical size of the continuous paper 12. The paper plane detecting sensors 1717 and 1718 and the table upper limit switches 1719 and 1720 may be increased in number in response to the range of the vertical size of the continuous paper 12 to be employed.

Initialization

Description is now made on paper feeding and receiving operations through use of the paper conveying system and the folder in the aforementioned structure. When power is applied, the microprocessor 21 executes initialization sequence to reset the respective mechanical parts at initial positions. In order to initialize the pin feed tractor 13, the microprocessor 21 rotates the DC servo motor 192 in an appropriate number with reference to signals from rotary encoders 196 and 197, to reset the paper feeding pins 1311 at initial positions. In initialization of the suction conveyer 14, energization of the suction blower (not shown) is started while, with respect to the suction force switching solenoids 1418 and 1419, only the solenoid 1419 corresponding to the secondary shutter 1415 is energized, whereby the suction conveyer 14 starts sucking operation in a "medium" state of suction force with the secondary shutter 1415 being open. The conveyer belt 1402 remains stopped.

FIG. 80 is a flow chart showing the operation of the microprocessor 21 for resetting the impression cylinder 11 in the separated position. Referring to FIGS. 78 and 80, an impression cylinder shaft being in an arbitrary position is sufficiently rotated in a contact direction so that the sensor dog 4179 is necessarily in a position closer to the contact side than the separated position photosensor 4177 at a step S100. Thus, the eccentric support shaft 1102 is rotated by the impression cylinder pulse motor 4153 in the contact direction to move the impression cylinder 11 in the contact direction by, e.g., about 10 pulses. The angle of rotation in the contact direction is previously set so that the sensor dog 4179 in a separated side stop position (i.e., closest to the separated side) restricted by the stopper 4175 is rotated in the contact side over the separated position photosensor 4177.

At a step S101, a determination is made as to whether or not the separated position photosensor 4177 detects the separated position, and if the determination is of no, the process is advanced to a step S102 to move the impression cylinder 11 further by one pulse in the separated direction. Such operation is kept until the separated position is detected, and then the process is advanced to a step S103. The separated position photosensor 4177 has already been driven at this time, whereas the impression cylinder 11 is moved further by one pulse in the separated direction, in order to ensure the operation. The impression cylinder 11 is always reset in a prescribed separated position by the aforementioned algorithm.

The impression cylinder pulse motor 4153 is stopped in a correct step stop position, whereby the operation of the impression cylinder pulse motor 4153 is ensured thereafter so that the rotational phase of the impression cylinder pulse motor 4153, i.e., the contact/separated positions of the impression cylinder 11 can be correctly detected by merely counting driving pulses, to simplify contact/separation control of the impression cylinder 11 with respect to the blanket cylinder 2. When, for example, rotation of the impression cylinder pulse motor 4153 is forcibly prevented by a rotation preventing mechanism such as a stopper to process the stopped position as a separated position, the separated position of the impression cylinder 11 is always reset in a prescribed position. However, the impression cylinder pulse motor 153 is not necessarily stopped in a correct step stop position, i.e., the same may be stopped in a position between steps, and the operation thereafter is instabilized in such case, whereby it is difficult to correctly detect the rotational phase of the impression cylinder phase motor 4153 by merely counting the driving pulses. Thus, in view of facilitation of contact/separation control for the impression cylinder 11 with respect to the blanket cylinder 2 with simple structure, the method for resetting the separated position by the aforementioned algorithm employing the separated position photosensor 4177 is effective.

FIG. 81 is a flow chart showing the operation of the microprocessor 21 for resetting the paddle 15 in a zero position. At a step S104, a determination is made as to whether or not the standby position sensor (zero position sensor) 1727 detects the zero position, and if the determination is of no, the process is advanced to a step S105 to rearwardly move the paddle 15 by one pulse by the paddle pulse motor 1723. This operation is kept until the zero position is detected, to complete initialization of the paddle 15 upon detection.

Setting of Continuous Paper

In preparation for printing, the operator sets the continuous paper 12 on the pin feed tractor 13 and inputs vertical size data of the set continuous paper 12 and peak/valley data representing peak folding/valley folding of paper ends through the operation panel 25. In setting of the continuous paper 12, the operator opens the paper pressing lids 1312 of the left and right tractors while rotating the lever 1306 in a loosening direction, i.e., in the clockwise direction to release the right tractor unit 1302 in the moving side to engage the marginal punchholes of the continuous paper 12 with the paper feeding pins 1311 of the left and right tractors while adjusting the horizontal tractor width in correspondence to the paper width so that the paper top end is in paper set reference positions. Then the operator rotates the lever 1306 in a tightening direction, i.e., in the unticlockwise direction to lock the right tractor unit 1302 in the moving side while closing the paper pressing lids 1312 and 1313, thereby to complete setting of the continuous paper 12.

FIG. 82 is an explanatory diagram showing a paper end setting position of the pin feed tractor 13 for the continuous paper 12. The top end of the continuous paper 12 is always set at the paper set reference position $P_1$ of the pin feed tractor 13 regardless of its vertical size. As hereinabove described, the pin feed tractor 19 is so registered that the paper set reference position $P_1$ is separated by the prescribed interval H from the printing start position $P_2$ and mounted on the printing press body 1, whereby the top end of the continuous paper 12 is before the printing start position $P_2$ by the interval H upon completion of paper setting. When paper passage of the continuous paper 12 thus set is completed or the continuous paper 12 is in a standby state for subsequent printing during the printing process, the fold or machine fold of the continuous paper 12, i.e., the head of a page to be subsequently printed is in a standby position $P_3$ before the printing start position $P_2$ by an approach interval $H_1$. Thus, the positions $P_1$ and $P_3$ respectively form the bases of paper setting and paper feeding in the printing process and must be detectable by an encoder, and hence the interval $H_2$ between $P_1$ and $P_3$ must be set in response to the characteristic of the encoder as employed. When, for example, the minimum unit of detection by the encoder is $\frac{1}{2}$ inch, the interval $H_2$ must be intergral times as long as $\frac{1}{2}$ inch. The aforementioned prescribed interval H is obtained by adding the required approach interval $H_1$ to the said interval $H_2$, to decide the mounting position of the pin feed tractor 13. The paper feed pins 1311 of the pin feed tractor 13 are so adjusted that the head of the continuous paper 12 is in the position $P_1$ upon being set with detection of rotation.

Paper Passage Operation

When the continuous paper 12 is set in the pin feed tractor 13, the process is then advanced to paper passage operation. FIG. 83 is a flow chart showing the operation of the microprocessor 21 for executing paper passage sequence. The paper passage is started by putting a paper passage key of the operation panel 25 to work, whereby a determination is made as to whether or not a paper passage command is acceptable at a step S106. When, for example, data on the vertical size of the continuous paper 12 and peak/valley data etc. are not yet inputted and the paper passage sequence cannot be executed, the process is advanced to a step S107 to make error display on the operation panel 25 and complete the operation.

When the paper passage command is acceptable, the process is advanced from the step S106 to a step S108, to initialize the respective mechanical parts. The step S108 is provided for such case where the process is advanced to the paper passage routine from other routine such as washing of the blanket cylinder 2. Thus, when paper passage is executed immediately after power supply, no operation is performed at the step S108 since the respective parts are already initialized in response to the power supply.

Then the main motor 20 is started at steps S109 and S110. The main motor 20 is formed by a low-speed motor and a high-speed motor, so that the low-speed motor is turned on at the step S109 and then the same is turned off after a lapse of a prescribed time while the high-speed motor is turned on at the step S110, to complete starting of the main motor 20. Thus, the driving system by the main motor 20 is so driven that the conveyer belt 140 of the suction conveyer 14 starts conveyance at a prescribed speed while the blanket cylinder 2, the impression cylinder 11, the plate cylinders 3 and 4 and inking rollers in the inking units 7 and 8 start rotation at prescribed speeds. At this time, the impression cylinder 11 is reset in the separated position with respect to the blanket cylinder 2.

Then, at a step S111, the DC servo motor 192 of the pin feed tractor 13 is driven at a low speed and the pin feed tractor 13 starts the paper feeding at a low speed of, e.g., $\frac{1}{4}$ of that in the printing process. Simultaneously starting of the paper feeding, the microprocessor 21 starts tracking of the paper end position of the continuous paper 12 on the basis of a hard wear timer contained therein. Then the microprocessor 21 moves the paddle 15 in association with the paper feeding as hereinafter described to set the paper end on the delivery table 16 at a step S112, and then the process is advanced to a step S113 to stop the continuous paper 12 by stopping driving of the DC servo motor 192 of the pin feed tractor 13, thereby to complete the paper passage.

FIG. 84 is an explanatory diagram showing the case of inserting the continuous paper 12 between the blanket cylinder 2 and the impression cylinder 11. The blanket cylinder 2 is formed by closely winding a sheet member 203 on the side surface of a blanket cylinder body 202 having an opening 201, and both ends of the sheet member 203 are fixed to end portions 204 and 205 of the opening 201 by a number of set screws (not shown) provided in the longitudinal direction. The blanket cylinder 2 is driven by the main motor 20 to rotate at a constant speed of, e.g., 4500 rpH while the impression cylinder 11 to be in contact with the blanket cylinder 2 is driven by the blanket cylinder 2 through gears engaged in single end sides thereof to rotate at a speed responsive to the cylinder diameter ratio of the impression cylinder 11 to the blanket cylinder 2.

The impression cylinder 11 is reset in the separated position with respect to the blanket cylinder 2 in response to the power supply, and the paper end of the continuous paper 12 fed by the pin feed tractor 13 passes through a clearance between the blanket cylinder 2 and the impression cylinder 11. The paper feeding speed for the continuous paper 12 must be equivalent to the circumferential speed of the blanket cylinder 2 and the impression cylinder 11 in the printing process, whereas the paper feeding speed in the passage of the continuous paper 12 is set at an extremely low speed such as $\frac{1}{4}$ of that in the printing process, and hence the continuous paper 12 is urged to progress by the blanket cylinder 2 and the impression cylinder 11 while being in contact with the impression cylinder 11 by its own weight to be fed toward the suction conveyer 14 by the rotation thereof.

If the continuous paper 12 is fed at a speed identical to or faster than the circumferential speed of the blanket cylinder 2, the continuous paper 12 will enter the opening 201 of the blanket cylinder 2 unless the locus of the paper end and the phase of the blanket cylinder 2 are strictly controlled. Further, when a delivery roller 206 is provided as shown by the phantom line to separate the continuous paper 12 from the blanket cylinder 2 in the printing process, the forward end of the continuous paper 12 will be crushed by running against the delivery roller 206. Thus, it is extremely important to make the paper feeding speed for the continuous paper 12 slower than the circumferential speed of the blanket cylinder 2 in paper passage, in order to enable automatic paper passage without performing any complicated control and without crushing the paper end of the continuous paper 12 even if the delivery roller 206 is provided.

The continuous paper 12 thus passed through the clearance toward the blanket cylinder 2 and the impression cylinder 11 is guided toward the folder 17 by the suction conveyer 14. The conveyance speed of the conveyer belt 1402 of the suction conveyer 14 is previously set at an appropriate constant value faster than the paper feeding speed in the printing process. Since the current paper feeding speed is $\frac{1}{4}$ of that in the printing process, the continuous paper 12 is conveyed with tension applied by the suction conveyer 14. Such tension is varied with the suction force of the suction conveyer 14, while the tension is applied to the marginal punchholes of the continuous paper 12 engaged with the paper feeding pins 1311 of the pin feed tractor 13 in paper passage, and hence the suction force is set at the "medium" stage to prevent the marginal punchholes from breakage. As hereinabove described, the primary shutter 1414 of the suction conveyor 14 is in a "closed" state and the secondary shutter 1415 is in an "open" state in the initialization sequence upon power supply, to start medium sucking.

Position Setting of Paddle and Delivery Table

In response to the application of power to the paper passage key of the operation panel 25, the paddle 15 and the delivery table 16 of the folder 17 are set in prescribed positions. FIG. 85 is a flow chart showing the operation of the microprocessor 21 for setting the paddle position, and FIG. 86 is an explanatory diagram typically showing the set position and swing angle of the paddle 15. The swing angle $\alpha$ is varied with the vertical size of the continuous paper 12, and the microprocessor 21 sets a count value corresponding to, e.g., a required swing angle $\alpha$ in a counter (not shown) on the basis of vertical size data inputted through the operation panel 25. The paddle 15 is swung between a "front" position and a "rear" position about a position separated by a central angle $\beta$ from a reset position, and upon application of power to the paper passage key, the microcomputer 21 operates $\beta-\alpha/2$ at a step S114. This angle is required to move the paddle 15 from the reset position to the "rear" position, and the microprocessor 21 drives the paddle pulse motor 1723 by pulses corresponding to the operated angle at a step S115 to move the paddle 15 of the "rear" position, thereby to complete setting of the paddle 15 in the initial position.

Figure 87B:
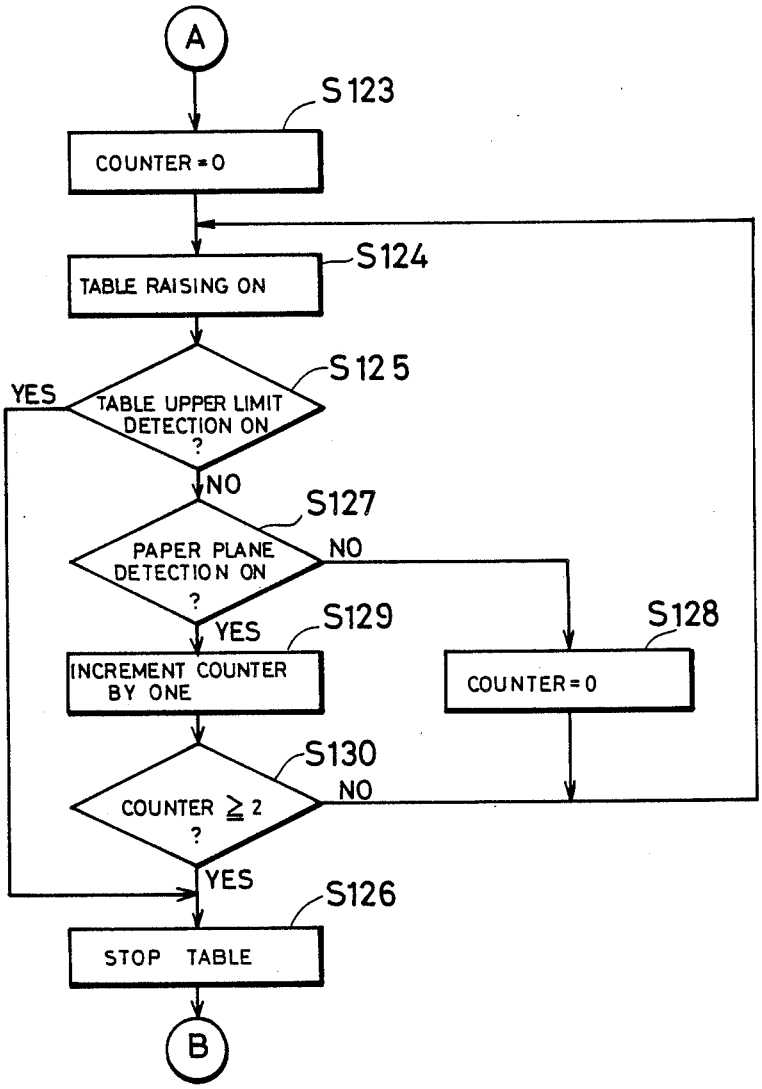
Figure 88A:
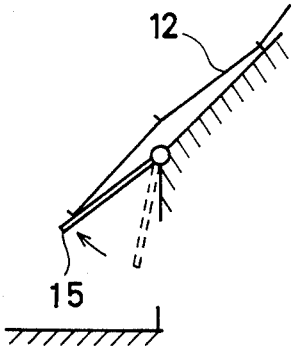
Figure 88B:
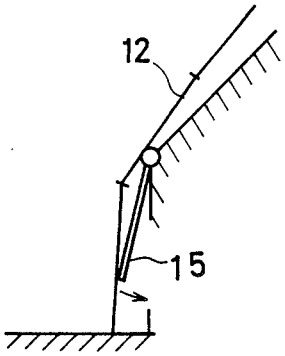
Figure 88C:
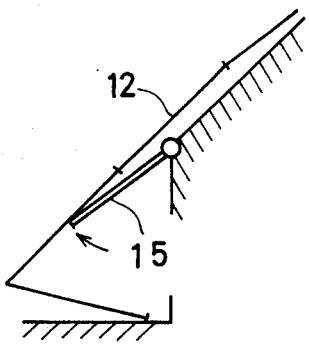
Figure 88D:
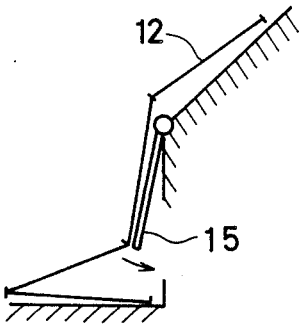
Figure 88E:
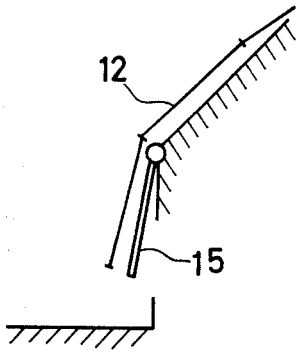
Figure 88F:
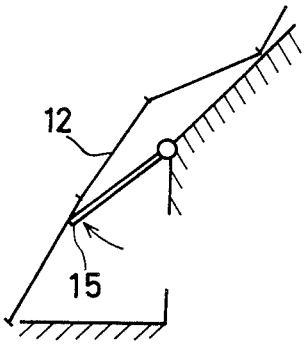
Figure 88G:
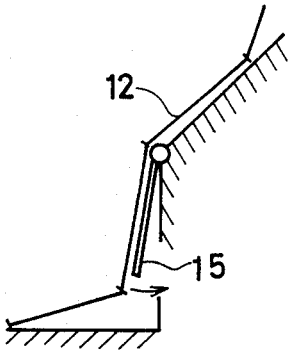
Figure 88H:
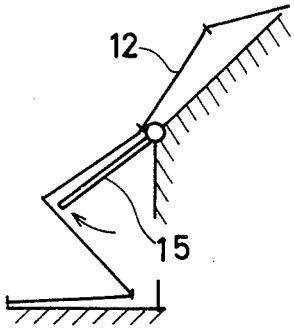

FIG. 87 is a flow chart showing the operation of the microprocessor 21 for setting the delivery table 16 in an initial position. The upper limit position of the delivery table 16 is varied with the vertical size of the continuous paper 12, and the microprocessor 21 selects one of two upper limit positions (those corresponding to the first and second table upper limit switches 1719 and 1720) on the basis of the vertical size data inputted through the operation panel 25. It is assumed here that the first upper limit position corresponding to the first table upper limit switch 1719 is selected for convenience of illustration. Upon application of power to the paper passage key, a determination is made at a step S116 as to whether or not the output of the first table upper limit switch 1719 is ON, i.e., whether or not the delivery table 16 is in the upper limit position, and if the determination is of yes, the process is advanced to a step S117 to determine whether or not the output of the first paper plane detecting photoelectric sensor 1717 is ON, i.e., whether or not 2 paper in preceding printing process remains on the delivery table 16. If no paper remains on the delivery table 16, the output of the first paper plane detecting photoelectric sensor 117 is OFF and setting of the table position is completed at this time.

If the paper remains on the delivery table 16, the output of the first paper plane detecting photoelectric sensor 1717 is ON and the process is advanced from the step S117 to a step S118 to drive the table elevating motor 1703, thereby to downwardly move the delivery table 16 by a prescribed level. During the downward movement of the delivery table 16, supervision is performed at a step S119 as to whether or not the output of the table lower limit switch 1721 is ON, i.e., whether or not the delivery table 16 reaches the lower limit position, and if the delivery table 16 reaches the lower limit position, the process is advanced to a step S120 to stop driving of the table elevating motor 1703 to stop the delivery table 16, while performing error display on the operation panel 25.

During the downward movement of the delivery table 16, further, supervision is performed at a step S121 as to whether or not the output of the first paper plane detecting photoelectric sensor 1717 is ON, and if the same is ON, the process is again returned to the step S118 to further downwardly move the delivery table 16, and when the output becomes OFF, the process is advanced to a step S122 to stop the delivery table 16 thereby to stop the setting of the table position. Thus, the upper plane of the paper remaining on the delivery table 16 is set at the prescribed level.

If the output of the first table upper limit switch 1719 is not ON at the step S116, the delivgery table 16 has not yet reached the upper limit position, and hence the process is advanced to a step S123 to reset the counter (not shown) at zero, and then the table elevating motor 1703 is driven at a step S124 to lift up the delivery table 16 by a prescribed level. During the upward movement of the delivery table 16, supervision is performed as to whether or not the output of the first table upper limit switch 1719 is ON, and when the same is ON, the process is advanced to a step S126 to stop the delivery table 16, to thereafter perform the aforementioned operation of the step S118 and so forth. When no paper remains on the delivery table 16 at this time, the output of the first paper plane detecting photoelectric sensor 1717 is OFF and hence the process is immediately advanced from the step S121 to the step S122 to stop the delivery table 16. When the paper remains on the delivery table 16, the delivery table 16 is stopped when the upper plane of the remaining paper reaches the prescribed level by the aforementioned operation.

During upward movement of the delivery table 16, further, supervision is performed at a step S127 as to whether or not the output of the first paper plane detecting photoelectric sensor 1717 is ON, and if the determination is of no, the process is advanced to a step S128 to reset the counter at zero and then again returned to the step S124 to upwardly move the delivery table 16. When the said output is ON, the process is advanced to a step S129 to increment the counter by one and then a determination is made at a step S130 as to whether or not the count value of the counter exceeds two. At this step S130, a determination is made as to whether or not the ON output of the paper plane detecting photoelectric sensor 1717 is continuously obtained, and hence, if the count value of the counter exceeds two, the paper plane is continuously detected by two or more times and a determination is made that the detection is not erroneous and the process is advanced to the step S126 to stop the delivery table 16. And then the aforementioned operation of the step S118 and so forth are performed, thereby to set the upper plane of the paper remaining on the delivery table 16 at the prescribed level.

When the count value of the counter is one at the step S130, for example, the first paper plane detecting photoelectric sensor 1717 may have detected a slant portion of the remaining paper passed in the printing press body 1 from the paddle 15 to the delivery table 16, and hence the process is again returned to the step S124 to again upwardly move the delivery table 16, and if the output of the first plane detecting photoelectric sensor 1717 is again ON, the process is advanced to the step S126 and so forth as hereinabove described, to set the upper plane of the remaining paper at the prescribed level.

Setting of Paper End

As hereinabove described, the paddle 15 is set in the "rear" position in response to the application of power to the paper passage key of the operation panel 25 and the delivery table 16 or the upper plane of the paper remaining on the delivery table 16 is set at the prescribed level, to receive the continuous paper 12 fed by the pin feed tractor 13 and the suction conveyer 14. FIG. 88 is an explanatory diagram typically showing the manner of paper end setting upon reaching of the forward end of the continuous paper 12 to the folder 17, wherein (a) to (d) show the case of "valley" folding of the paper head and (e) to (e) show the case of "peak" folding of the paper head.

As hereinabove described, the microprocessor 21 tracks the paper end position simultaneously with the starting of paper feeding, and when the peak/valley data inputted through the operation panel 25 is about "valley", the microprocessor 21 drives the paddle pulse motor 1723 before the paper end reaches the folder 17 and after the paddle 15 is completely set in the initial position to swing up the paddle 15 to the "front" position. The microprocessor 21 moves the paddle 15 in the "rear" position at such timing that the paper head is conveyed to a position as shown at FIG. 88(*a*), i.e., slightly ahead of the forward end of the paddle 15. At this time, the first page of the continuous paper 12 is moved to the "rear" position following the paddle 15 through an air current in the rear surface of the paddle 15 backwardly moved to the "rear" position. In order to avoid influence by wind pressure for returning the continuous paper 12 to the "front" position, the width of the paddle 15 is preferably wider than that of the continuous paper 12. Then the continuous paper 12 enters the state as shown at (b). Thereafter the paddle 15 is successively swung between the "front" position and the "rear" position at such timing as shown at (c) and (d) where the continuous paper 12 progresses substantially page by page, and the paper end setting is completed in the state as shown at (d).

When the head of the continuous paper 12 is folded in a "peak" manner, the operation of the paddle 15 is inverted. In other words, the microprocessor 21 will not drive the paddle 15 till the timing as shown at FIG. 88(*e*), but maintains the same being set at the "rear" position. Then the microprocessor 21 drives the paddle pulse motor 1723 at the timing (e) to move the paddle 15 from the "rear" position to the "front" position. Then the continuous paper 12 enters the state as shown at (f). Thereafter, the paddle 15 is successively swung between the "rear" position and the "front" position at the timing as shown at (g) and (h) where the continuous paper 12 progresses substantially page by page, and the paper end setting is completed in the state as shown at (h).

FIG. 89 is a flow chart showing the operation of the microprocessor 21 for driving the paddle 15. This program is called and executed at appropriate timing, and such timing may be based on, e.g., the hard timer contained in the microprocessor 21 or an output signal from a reference rotary encoder 31 (FIG. 90) mounted on the rotary shaft of the blanket cylinder 2. In order to move the paddle 15, a determination is made at a step S131 as to whether the paddle 15 is currently in the "front" position or in the "rear" position. Such discrimination can be made by setting a flag with respect to, e.g., the "front" position. When the paddle 15 is in the "front"

position, the process is advanced to a step S132 to rearwardly drive the paddle pulse motor 1723 by pulses responsive to the count value corresponding to the swing angle set in the counter to move the paddle 15 to the "rear" position, and then the process is advanced to a step S133 to record the position of the paddle 15 as "rear", thereby to complete the operation. When the paddle 15 is currently in the "rear" position, the process is advanced to steps S134 and S135 from the step S131, to frontwardly move the paddle 15 through operation similar to the above.

Printing

When the paper passage is completed and the paper end of the continuous paper 12 is set in the folder 17 as hereinabove described, the low-speed paper feeding is stopped, i.e., the DC servo motor 192 of the pin feeder tractor 13 is stopped and the main motor 20 enters a standby state for a subsequent command while maintaining rotation. At this time, the head (fold or machine fold) of the first page of the continuous paper 12 to be printed is in the prinitng standby position $P_3$ as shown in FIG. 82.

When a printing key of the operation panel 25 is put into work, the process is advanced to a printing program to successively execute respective routines such as plate exchange, blanket cylinder cleaning, first impression, stationary printing and last impression. In response to the application of power to the printing key, the paper pressing fan 30 starts rotation. The paper pressing fan 30 is stopped in response to completion of the printing program or turn-off of the output of the paper detecting limit switch 1318 mounted on the pin feed tractor 13.

In the plate exchange routine, printing plates (not shown) previously placed on the plate feeding/discharging trays 9 and 10 are windingly mounted on the corresponding plate cylinders 3 and 4 through the corresponding plate feeding/discharging units 5 and 6, while old printing plates (not shown) that have been wound on the plate cylinders 3 and 4 are simultaneously discharged on discharging trays of the plate feeding-/discharging trays 9 and 10. In case of monochromatic printing, such plate discharge is performed only on a required side.

In a blanket cylinder cleaning routine, the detergent solution feeding unit 18 supplies a detergent solution to the blanket cylinder 2 at appropriate timing and the wiping unit 19 wipes the detergent solution simultaneously with intermittent supply of the detergent solution, and thereafter the supply of the detergent solution is stopped to perform only the wiping operation, thereby to complete washing of the blanket cylinder 2.

Then, in a first impression routine, actual printing is performed by about two pages while appropriately controlling the timing of contact between the form rollers in the inking units 7 and 8 and the plate cylinders 3 and 4 and the timing of transfer from the plate cylinders 3 and 4 to the blanket cylinder 2 to adjust the volume of ink on the plate cylinders 3 and 4 and the blanket cylinder 2 for approximating printing density to a stationary value, thereby to enter a stationary printing routine.

In the stationary printing routine, the impression cylinder 11 is brought into contact with/separated from the blanket cylinder 2 at appropriate timing matched in phase with the blanket cylinder 2 so that the continuous paper 12 is intermittently fed in association with the said timing to perform printing on a page per rotation of the blanket cylinder 2. The number of printing is previously set through the operation panel 25, and when the printing reaches the set number, at last impression routine similar to the aforementioned first impression routine is executed to reduce the ink volume on the blanket cylinder 2 nearly to zero thereby to complete the printing process. Then plate discharging and blanket cylinder cleaning routines are executed and then rotation of the main motor 20 is stopped to complete the printing program, and the system enters a standby state for a subsequent command.

Intermittent Feed Control of Continuous Paper

FIG. 90 is a control block diagram for intermittently feeding the continuous paper 12 in the stationary printing process. The entire control system of this printing press is hereinabove described with reference to FIG. 2, and FIG. 90 particularly shows only the system for controlling intermittent feeding of the continuous paper 12 in detail. In order to recognize reference timing required for the intermittent feed control and other control, a reference rotary encoder 31 is connected to the rotary shaft of the blanket cylinder 2 to derive a Z signal of one pulse per rotation of the blanket cylinder 2 and an A signal of, e.g., 240 pulse/inch (ppi) on the circumference of the blanket cylinder 2. The timing reference signals Z and A are supplied to a printing control unit 32.

On the other hand, a vertical size input device 33 is provided as a part of the operation panel 25 (FIG. 2) for example, to fetch the data on the vertical size of the continuous paper 12 as hereinabove described. A data signal representing the vertical size data is supplied to the printing control unit 32. On the basis of the timing reference signals Z and A and the vertical size data signal, the printing control unit 32 calculates the timing required for controlling intermittent feeding of the continuous paper 12, to provide a required timing command signal to the motor control unit 34 and a motor driver 36 of the impression cylinder pulse motor 4153. In response to the timing command signal from the printing control unit 32, the motor drive 36 drives the impression cylinder pulse motor 4153 to bring the impression cylinder 11 into contact with/separated from the blanket cylinder 2.

As hereinabove described, the DC servo motor 192 for driving the pin feed tractor 13 is provided with the rotary encoder 196 (FIG. 76A), which derives a B signal of, e.g., 240 ppi with respect to paper feeding strength and a D signal of 2 ppi. The motor control unit 34 receives the A signal from the reference rotary encoder 31 in the blanket cylinder 2 side and the B signal from the rotary encoder 196 in the pin feed traactor 13 side and continuously compares the same to output a driving signal to a motor driving unit 35. The timing for starting/stopping the operation of the motor control unit 34 is instructed by the aforementioned timing command signal from the printing control unit 32. The motor driving unit 35 amplifies the said driving signal outputted from the motor control unit 34 to drive the DC servo motor 192. Further, the motor driving unit 35 detects the leading edge of the D signal (outputted per ½ inch of the continuous paper 12, as hereinabove described) from the rotary encoder 196, for controlling a stop (detention) position so that the continuous paper 12 is started from a correct starting position in every page. The stop position is controlled in the unit of ½ inch since the vertical size of the folded continuous paper 12 is generally integral times as long as 178 inch.

FIG. 91 is a timing chart showing operations of the respective mechanical parts for intermittently feeding the continuous paper 12 in the stationary printing porcess. As hereinabove described, the output signals Z and A from the reference rotary encoder 31 are employed as timing reference signals. The current phase of the blanket cylinder 2 can be recognized by the output signals Z and A as shown at FIG. 91(*g*). "00" indicates that the top of the blanket cylinder 2 is in the printing starting position, and a terminating end 205 (refer to FIG. 84) of the opening 201 of the blanket cylinder 2 is in the contact position of the blanket cylinder 2 and the impression cylinder 11 at such timing. Slant-line portions at FIG. 91(*g*) show the timing of passage of the opening 201 through the printing starting position, and $\frac{1}{4}$ of the entire circumferential length of the blanket cylinder 2 is the opening and the remaining $\frac{3}{4}$ is effective circumferential length of the blanket cylinder 2 in the shown example.

The impression cylinder 11 is brought into contact with the blanket cylinder 2 in an interval between times $t_1$ and $t_2$. As shown at FIG. 91(*c*), the impression cylinder pulse motor 4153 (FIG. 78C) is driven toward the contact side at the time $t_1$ slightly after passage of a beginning end 204 of the opening 201 of the blanket cylinder 2 through the printing start position to gradually accelerate and again gradually slow down the driving, thereby to slowly move the impression cylinder 11 to the contact position in the relatively long interval to the time $t_2$ at which a terminating end 205 of the opening 201 approaches the printing start position. Such driving is performed by supplying a driving command from the printing control unit 32 to the motor driver 36, while the printing control unit 32 recognizes the driving timing by counting the A signal received from the reference rotary encoder 31.

At the time $t_2$ when the impression cylinder 11 reaches the contact position, the opposite blanket cylinder 2 is in the phase of the opening, and hence the continuous paper 12 is not nipped between the blanket cylinder 2 and the impression cyliner 11. The continuous paper 12 is nipped when the terminating end 205 (refer to FIG. 84) of the opening 201 reaches the printing start position, i.e., at the timing of "00", to start the printing process.

When the impression cylinder 11 comes into contact with the blanket cylinder 11, i.e., at the time $t_2$, the DC servo motor 192 of the pin feed tractor 13 is in a non-driven state as shown at FIG. 91(*b*), and the continuous paper 12 is in a printing standby state with stoppage of the pin feed tractor 13. The pin feed tractor 13 is subjected to detention of rotation at a time $t_8$ as hereinafter described, and the head (fold or machine fold) of a first page of the continuous paper 12 to be subsequently printed is in the printing standby position $P_3$ as shown in FIG. 92 at this time. With respect to the suction switching solenoids 1418 and 1419 of the suction conveyer 14, they are in the initial state and only the solenoid 1419 for the secondary shutter is energized initial state as shown at (d) and (e), and hence the primary shutter 1414 is in a "closed" state and the secondary shutter 1415 is in an "open" state while the suction force of the suction conveyer 14 is on the "medium" stage as shown at (f). Since the conveyer belt 1402 of the suction conveyer 14 is driven by the main motor 20 to constantly travel in the paper discharging direction, the continuous paper 12 is supplied with appropriate tension between the pin feed tractor 13 and the suction conveyer 14. The suction force in the "medium" stage in the printing standby state is selected to be in a value capable of providing such large tension that the marginal punchholes of the continuous paper 12 engaged with the paper feeding pins 1311 of the pin feed tractor 13 are not broken.

When the reference encoder 31 outputs the Z signal at a time $t_3$ slightly ahead of "00" for starting the printing process as shown at (a), the printing control unit 32 starts counting of the A signal on the basis of the said time $t_3$ to generate a start signal at a count value corresponding to a predetermined timing $t_4$, thereby to supply the same to the motor control unit 34. The motor control unit 34 is activated by the said signal to supply a driving signal for realizing acceleration in accordance with a predetermined speed characteristic to the motor driving unit 35 while comparing the signal A from the reference rotary encoder 31 with the signal B from the rotary encoder 196. The motor driving unit 35 releases the detension at the teime $t_4$ while receiving the above mentioned driving signal to drive the DC servo motor 192, whereby the pin feed tractor 13 is accelerated in a forward rotation direction in accordance with a prescribed speed curve. Simultaneously with driving of the pin feed tractor 13, energization of the solenoid 1419 for the secondary shutter is stopped as shown at (d) to make the secondary shutter 1415 enter a "closed" state and bring the suction force of the suction conveyer 14 into the "strong" state as shown at (e). Thus, feeding of the continuous paper 12 is started with extremely strong tension, and the feeding speed for the head of the first page to be printed started from the printing standby position $P_3$ as shown in FIG. 82 reaches a level V identical to the circumferential speed of the blanket cylinder 2 immdiately in front of the printing starting porition P2 (timing "00"). At the timing of "00" after a moment therefrom, the head of the first page reaches the printing start position $P_2$ to be nipped between the blanket cylinder 2 and the impression cylinder 11, and the first page of the continuous paper 12 is subjected to printing in an interval between the timing of "00" and a time $t_5$ when a prescribed printing interval (corresponding to the vertical length of one page) is completed.

The distance of movement from the time $t_4$ to "00", i.e., approach distance corresponds to the area of a slant line portion X1 as shown at (b) is controlled by the motor control unit 34 to be always constant.

During the printing process, the continuous paper 12 is nipped by the blanket cylinder 2 and the impression cylinder 11 for conveyance while the paper feeding speed of the pin feed tractor 13 is correctly controlled by the motor control unit 34. The paper feeding speed at this time is preferably slightly faster by, e.g., about 0.2% than the speed for conveying the continuous paper 12 nipped between the blanket cylinder 2 and the impression cylinder 11, i.e., the surface speed of the blanket cylinder 2, so that the continuous paper 12 is safely fed without being torn. As hereinabove described, the continuous paper 12 is supplied with extremely strong tension by the suction force in the "strong" stage during the printing process, whereby the continuous paper sticked to the blanket cylinder 2 by viscosity of the ink can be easily separated from the same. Thus, there is no need to provide a delivery roller 206 as shown by the phantom line in FIG. 11, particularly effectively in case of performing printing over the entire width of the continuous paper 12.

At the time $t_5$ when the printing interval is terminated, the printing control unit 32 supplies a separation command signal to the motor driver 36, to start driving of the impression cylinder pulse motor 4153 in the separated side as shown at (c). The time $t_5$ can be correctly recognized by counting the signal A of the reference rotary encoder 31 by a prescribed number responsive to the vertical size. Dissimilarly to the case of contact, the signal is made to quickly rise and fall in a relatively short interval to achieve quick separation. At a time $t_6$ when the impression cylinder 11 is returned to the separated position, which time $t_6$ can be recognized by counting the signal A similarly to $t_5$ (this also applies to $t_6$ to $t_8$ as hereinafter described), the printing control unit 32 outputs a stop command signal to the motor control unit 34. In response to the stop command signal, the motor control unit 34 supplies a driving signal for achieving deceleration in accordance with a predetermined speed characteristic to the motor driving unit 35 while comparing the signal A from the reference rotary encoder 31 with the signal B from the rotary encoder 196. The motor driving unit 35 receives the driving signal to delecerate the DC servo motor 192, whereby the pin feed tractor 13 is decelerated along a prescribed speed curve as shown at (b). The amout of overrun of the continuous paper 12 caused before the pin feed tractor 13 is completely stopped is represented by the area of a slant line portion X2. In this case, the main shutter solenoid 1418 and the secondary shutter solenoid 1419 of the suction conveyer 14 are commonly energized at the time $t_6$ as shown at (d) and (e), to commonly open the primary shutter 1414 and the secondary shutter 1415 and reduce the suction force to the "weak" stage as shown at (f), thereby to minimize the tension applied on the continuous paper 12.

Then the printing control unit 32 supplies an reverse rotation command signal to the motor control unit 34 at a time $t_7$ when the feeding speed of the pin feed tractor 13 reaches zero. In response to the inverse rotation command signal, the motor control unit 34 supplies a driving signal for realizing reverse rotation in accordance with a predetermined speed characteristic to the motor driving unit 35. The motor driving unit 35 receives the driving sisgnal to inversely drive the DC servo motor 192, whereby the pin feed tractor 13 is inversely rotated along a prescribed reverse rotation speed curve as shown at (b). The amount of reverse rotation at this time corresponds to an area Y which is previously set so that relation $Y=X_1+X_2$ holds. At a time $t_8$ when the inverse rotation is terminated, the head of a next page of the continuous paper 12 is in the printing standby position $P_3$ as shown in FIG. 82. In other words, the continuous paper 12 is returned by a distance corresponding to the approach distance $X_1$ (between $t_4$ and "00") and the overrun distance $X_2$ (between $t_5$ and $t_7$) by reverse feeding in the interval between $t_7$ and $t_8$.

As to the reverse operation, the continuous paper 12 must be returned by Y when printing is made entirely over the vertical size of the continuous paper 12 as hereinabove described, while such reverse rotation is not required when, for example, a printing inhibited area (non-printed area) exceeding the returning distance Y is provided at the head of each page of the continuous paper.

During the inverse feeding, the suction force of the suction conveyer 14 is in the "weak" stage so that no excessive load is applied to the marginal punchholes of the continuous paper 12 engaged with the paper feeding pins 1311 of the pin feed tractor 13, while the paper pressing fan 30 prevents upward separation of the continuous paper 12 from the upper surface of the suction conveyer 14. At the time $t_8$ when the paper feeding is terminated, the primary shutter solenoid 1418 is released from energization to close the primary shutter 1414 as shown at FIG. 91(*d*), and the suction force is switched to the "medium" stage as shown at (f) to be in a standby state for printing of a subsequent page. At the time $t_8$, further, the printing control unit 32 outputs a stop command signal to the motor control driving unit 35, which responsively performs such control (detention) that the head (fold or machine fold) of the subsequent page of the continuous paper 12 is not displaced from the printing standby position $P_3$ in the printing standby state, through the signal D from the rotary encoder 196.

When the vertical size data of the continuous paper 12 inputter from the vertical size input device 33 is varied in the aforementioned printing sequence, the interval between the times "00" and $t_5$ in FIG. 91 may be varied in response thereto. The memory capacity may be saved by making acceleration and deceleration characteristics of the paper feeding in common thereby to expand/contract only the constant speed portion in variation of the vertical size. In the aforementioned embodiment, the paper feeding speed of the pin feed tractor 13 and the contact/separation of the impression cylinder 11 are controlled on the basis of the signals from the reference rotary encoder 31 mounted on the rotary shaft of the blanket cylinder 2, whereby the paper feeding speed of the pin feed tractor 13 and the contact/separation timing of the impression cylinder 11 are varied with variation of the rotation speed of the blanket cylinder 2, to realize excellent printing position accuracy without deviation of the printing position. However, in case where rotation of the blanket cylinder 2 is absolutely constant (e.g., constantly rotated by another control means), the signal A of the reference rotary encoder 31 may be replaced by the output of another stable oscillator such as a crystal oscillator or that of an oscillator employed in the control unit for controlling the rotation of the blanket cylinder 2, to achieve control responsive to the rotational phase of the blanket cylinder 2, similarly to the above embodiment.

The above description has been made on a standard control method of repeating per-page printing. The printing control unit 32 as shown in FIG. 90 is a control unit having an excellent judgement function implemented by, e.g., a microcomputer, and the same can readily realize such control of changing the printing start position and printing every several pages. The printing start position can be changed by changing the start time $t_4$ for the pin feed tractor 13 as shown in FIG. 91. When, for example, skip printing is made on every other page of the continuous paper 12 having relatively small vertical size, control may be so performed that, after a page is completely printed in the sequence as shown in FIG. 91, the head of a subsequent page skipped by one page comes to the printing standby position $P_3$ as shown in FIG. 82 during an interval between separation of the impression cylinder 11 and generation of a subsequent Z signal from the rotary encoder 31. Such control is enabled by simply controlling the pin feed tractor 13 and the contact/separation timing of the impression cylinder 11 by the printing control unit 32. Further, the continuous paper 12 can be fed at a high speed in the skip printing process for example, by controlling the speed of the pin feed tractor 13.

Signal Processing for Improving Printing Position Accuracy

In order to obtain high printing position accuracy in the aforementioned printing press, it is necessary to completely synchronize the rotational phase of the blanket cylinder 2 with the driving timing of the pin feed tractor 13. In other words, the paper feeding speed for the continuous paper 12 must sufficiently correctly follow variation in the rotation speed of the blanket cylinder 2, so that the printing position is not displaced. Thus, the reference rotary encoder 31 is connected to the rotary shaft of the blanket cylinder 2 in the aforementioned embodiment, to derive the signal Z of one pulse per rotation of the blanket cylinder 2 and the signal A of 240 ppi on the circumference of the blanket cylinder 2 along the rotation of the blanket cylinder 2.

However, in order to realize sufficiently high printing accuracy, the signal A is preferably formed by a pulse signal of higher accuracy, such as a signal of one or more pulses per 0.1 mm of the circumference of the blanket cylinder 2. In order to obtain such an signal A, however, required is a rotary encoder having an extremely large number of output pulsese, e.g., in the order of several thousands to several ten thousands in a rotaion. It is difficult to manufacture such an encoder in practice, and even if such an encoder is provided, the blanket cylinder 2, which is largely decelerated by means such as gears in general, cannot be smoothly rotated, whereby the rotary encoder cannot generate pulses in cycles as obtained by calculation. When, in another means, the reference rotary encoder 31 is accelerated through the rotary shaft of the blanket cylinder 2 by gears or belts, the rotation thereof is varied in relatively short cycles by vibration etc. of the gears or belts, and the output thereof is inevitably generated as a signal including excessive frequency variation. When such a signal is adapted to control a motor, particularly a DC motor or the like responsive at a high speed may follow the undesired frequency variation included in the rotary encoder output to further amplify the variation, whereby correct control cannot be performed.

In order to solve the aforementioned problem, employed is a pulse signal processing unit which can multiply a pulse signal being small in pulse number, i.e., relatively low in frequency outputted from a pulse signal generator mounted on an object including slight variation in displacement speed such as the blanket cylinder 2 and output as a pulse signal of relatively high frequency including only frequency variation corresponding to the speed variation of the object, to control driving timing of the pin feed tractor 13 by the multiplied pulse signal. FIG. 92 is a control block diagram showing the structure therefor, in which a pulse signal processing unit 37 is added to the structure as shown in FIG. 90. A reference rotary encoder 31 is mounted on the rotary shaft of a blanket cylinder 31 to derive a Z signal of one pulse per rotation of the blanket cylinder 2 and an A signal of 60 pulses per inch of the circumference of the blanket cylinder 2 (i.e., $f_1=60$ pulse/inch (ppi)), along rotation of the blanket cylinder 2.

Within these reference signals, the Z signal is supplied to a printing control unit 32 and the A signal is supplied to the pulse signal processing unit 37. On the basis of the A signal supplied from the reference rotary encoder 31, the pulse signal processing unit 37 generates a signal of $N\times f_1$ (signal of 1920 ppi when N=32, for example) required by a motor control unit 34 and a signal of $N/M\times f_1$ (signal of 240 ppi when N/M=4, for example) required for a printing control unit 32. The pulse signal processing unit 37 is further adapted to remove variation components of relatively high frequency included in the A signal, which may exert bad influence on control of a DC servo motor 192.

On the basis of the aforementioned Z signal and $N/M\times f_1$ signal, i.e., being reset per Z signal, the printing control unit 32 counts the $N/M\times f_1$ signal to calculate the timing required for intermittently feeding the continuous paper 12, thereby to supply a required timing command signal to the motor control unit 34 and the motor driver 36 of the impression cylinder pulse motor 4153. In response to the timing command signal from the printing control unit 32, the motor driver 36 drives the impression cylinder pulse motor 4153, to make the impression cylinder 11 in contact with/separated from the blanket cylinder 2. The DC servo motor 192 is provided with a rotary encoder 196, which derives the B signal of, e.g., 240 ppi with respect to the paper feed length as hereinabove described and the D signal of 2 ppi. The motor control unit 34 receives the $N\times f_1$ signal and the B signal and continuously compares the same to output a driving signal for realizing a predetermined paper feed speed characteristic to the motor driving unit 35. The timing for starting/stopping the operation of the motor driving unit 34 is instructed by the aforementioned timing command signal from the printing control unit 32. The motor driving unit 35 amplifies the driving signal to drive the DC servo motor 192, whereby the pin feed tractor 13 is driven in accordance with a predetermined speed curve to intermittently feed the continuous paper 12 at prescribed timing. Further, the motor driving unit 35 detects the leading edge of the D signal of the rotary encoder 196 to control the stop (detention) position for starting forwarding of the continuous paper 12 from a correct starting position of every page, as hereinabove described.

In order to improve printing accuracy in the aforementioned intermittent feeding control for the continuous paper 12, the signal as the control timing reference, i.e., the $N\times f_1$ signal and $N/M\times f_1$ signal must sufficiently regenerate slight variation in rotation speed of the blanket cylinder 2. In other words, the signals multiplied by N and N/M respectively in the pulse signal processing unit 37 must correctly reflect frequency variation (preferably limited to that based on variation in rotation speed of the blanket cylinder 2) in the A signal before multiplication.

FIG. 93 is a block diagram showing an embodiment of a pulse signal processing circuit 37 for realizing such pulse processing. The pulse signal processing circuit 37 includes a PLL circuit 38, which receives an A signal (frequency f1) from a reference rotary encoder 31 to remove unnecessary frequency variation components from the A signal and multiply the same by N thereby to derive an $N\times f_1$ signal, which in turn is frequency-divided by 1/M through a frequency divider 39, so as to derive an $N/M\times f_1$ signal.

Referring to FIG. 93, the A signal from the reference rotary encoder 31 is supplied to one input of a phase detector 40. The other input of the phase detector 40 is supplied with a signal obtained by frequency-dividing the output signal $N\times f_1$ from the PLL circuit 38 to 1/N by a variable frequency divider 41, in a feedback manner. The phase detector 40 compares the both input signals to perform phase detection, and the output thereof is supplied to a low-pass filter 42 formed by an integration circuit. As hereinafter described, the time constant of the integration circuit of the low-pass filter 42 is previously set so that relatively high frequency variation components are removed from the A signal and the output signal $N \times f_1$ from the PLL circuit 38 correctly follows relatively low frequency variation components in the A signal.

The output of the low-pass filter 42 is supplied to a voltage control oscillator 43 as a control signal, which in turn oscillates at frequency responsive to the control signal. The oscillation output is frequency-divided by the variable frequency divider 41 and subjected to feedback to the phase detector 40 and compared with the A signal for phase locking, as hereinabove described. When the frequency divisional ratio N of the variable frequency divider 41 is arbitrarily varied in this loop, a pulse signal of relatively high frequency can be arbitrarily obtained from the output signal (A signal) of the reference rotary encoder 31 which is in relatively low frequency.

At this time, the time constant of the integration circuit of the low-pass filter 42 is appropriately selected so as to remove the relatively high frequency variation components included in the A signal of the reference rotary encoder 31, while the output signal of the PLL circuit 38 can correctly follow other frequency variation components, i.e., variation components in the rotation speed of the blanket cylinder 2.

FIG. 94 is an explanatory diagram showing such a manner.

Figure 94A:
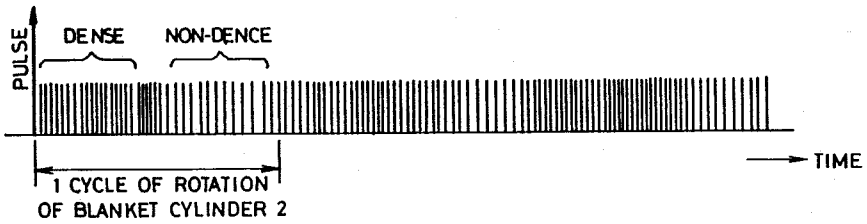
Figure 94B:
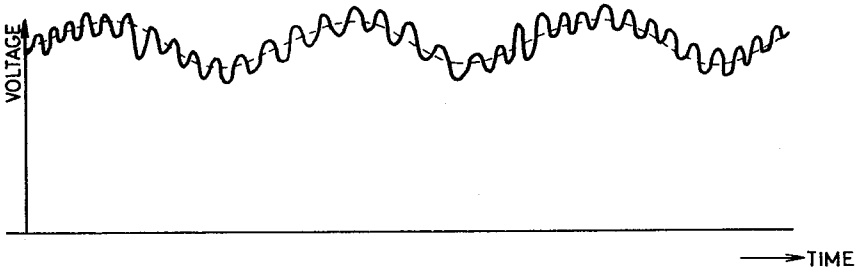

As shown at FIG. 94(A), the A signal outputted from the reference rotary encoder 31 is varied in density with variation in load torque with respect to every rotation of the blanket cylinder 2, while including variation components of higher frequency caused by vibration specific to the mechanism, though not shown in the figure. In order to clearly recognize such frequency variation, the A signal outputted from the rotary encoder 31 as shown at FIG. 94(A) is subjected to frequency-voltage conversion to obtain a voltage waveform as shown at FIG. 94(B). With reference to the voltage waveform, it is understood that the A signal includes both of relatively high frequency variation components and relatively low frequency variation components.

Figure 94C:
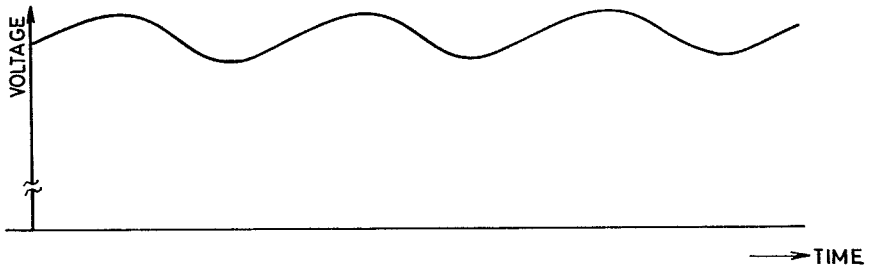

Assuming that the A signal outputted from the reference rotary encoder 31 and the $N \times f_1$ output signal for the pulse signal processing unit 37 are subjected to frequency-voltage conversion respectively by F-V converters while actually driving the printing press and changing the time constant of the low-pass filter 42 while comparing the voltage waveforms, the relation therebetween becomes that as shown at FIG. 94(B) and (C) at a time constant within a given range. Namely, the $N \times f_1$ output signal from the pulse signal processing unit 37 includes absolutely no relatively high frequency variation component at this time as shown at FIG. 94(C), while correctly following the aforementioned relatively low frequency variation components based on the variation in the rotation speed of the blanket cylinder 2. Thus, the time constant of the low-pass filter 42 is set at such a value, thereby to make the paper feed timing for the contiuous paper 12 varied correctly following only the variation in the rotation speed of the blanket cylinder 2 in the circuit as shown in FIG. 92.

Serial Lowering of Delivery Table

The continuous paper 12 intermittently fed for printing in the aforementioned manner and discharged from the printing press body 1 is sequentially folded by the folder 17 to be piled up for storage. The microprocessor 21 executes the paddle swinging program as shown in FIG. 89 every time the zero point pulse (Z signal) is outputted from the reference rotary encoder 31 mounted on the rotary shaft of the blanket cylinder 2, to swing the paddle 15 alternately in the "front" and "rear" positions at the swing angle $\alpha$ (refer to FIG. 86) responsive to the vertical size of the continuous paper 12 upon completion of printing per page. The operation at this time is similar to that described above with reference to paper passage.

The delivery table 16 is gradually lowered as the continuous paper 12 is piled up. FIG. 95 is a flow chart showing the operation of the microprocessor 21 for lowering the delivery table 16. The microprocessor 21 executes this program every time the aforementioned zero point pulse (z signal) is outputted from the reference rotary encoder 31 of the blanket cylinder 2. The level of the paper upper plane is selected in response to the vertical size data as hereinabove described with reference to paper passage, and the following description is made on the case where the level of the paper upper plane is selected in correspondence to the first paper plane detecting photoelectric sensor 1717 similarly to the above case.

At a step S136, a determination is made as to whether or not the output of the first paper plane detecting photoelectric sensor 1717 is ON, i.e., whether or not the paper upper plane reaches a prescribed level. If the determination is of no, the process is advanced to a step S137 to reset a counter (not shown) at zero thereby to complete the operation. If the paper upper plane reaches the prescribed level, the output of the first paper plane detecting photoelectric sensor 1717 is ON and the process is advanced from the step S136 to a step S138, to increment the counter by one. Then, at a step S139, a determination is made as to whether or not the count value of the counter exceeds five, i.e., whether or not the output of the first paper plane detecting photoelectric sensor 1717 continuously becomes ON five or more times. Such condition of detection in a plurality of times is so made as to avoid erroneous operation in case where the first paper plane detecting photoelectric sensor 1717 detects the slant portion of the continuous paper 12 hanging from the paddle 15. Namely, the slant portion of the continuous paper 12 will not be detected continuously five or more times since the same is always swung in the horizontal direction.

When the count value of the counter exceeds five, the paper upper plane on the delivery table 16 reaches the prescribed level, whereby the process is advanced from the step S139 to a step S140 to downwardly drive the table elevating motor 1703 for a prescribed period, thereby to lower the delivery table 16 by a prescribed distance (e.g., by 5 mm). Then the counter is reset at zero at a step S141, to terminate the operation. If the count value is less than five, the operation is terminated without lowering the delivery table 16, while the counter is not reset at this time, and the delivery table 16 is lowered when the count value exceeds five in repeated execution of this program thereafter. Thus, the paper upper plane is continuously retained at the level responsive to the vertical size of the continuous paper 12.

Although the apparatus for intermittently feeding continuous paper according to the present invention is applied to an offset printing press having a blanket cylinder in the above description, the present invention is also applicable to a printing press in such a system of employing plate cylinders as transfer cylinders for direct printing, to obtain an effect similar to that of the above embodiment.

E. Cleaning of Blanket Cylinder

In a general offset printing press, the blanket cylinder is periodically cleaned during the printing process in order to maintain good printing quality. When the printing plates are replaced, the blanket cylinder must be cleaned to remove ink remaining on the surface thereof, as a matter of course. In the printing press according to the present invention, therefore, a blanket cylinder cleaning routine is inserted in a series of printing program to enable high-speed cleaning of the blanket cylinder.

The printing program is started in response to application of power to the printing key of the operation panel 25, to sequenially execute printing plate replacement, blanket cylinder cleaning and printing routines. The printing plate relacement and blanket cylinder cleaning routines are executed in a state of separating the blanket cylinder 2, the plate cylinders 3 and 4, the inking units 7 and 8 and the impression cylinder 11 from each other. In the printing plate replacement routine, old printing plates wound around the plate cylinders 3 and 4 are replaced by new printing plates placed on the plate feeding/discharging trays 9 and 10 through the plate feeding/discharging units 5 and 6, and then the blanket cylinder 2 is cleaned in the blanket cylinder cleaning routine to remove the residue of the ink employed in the preceding printing process, in preparation for the subsequent printing routine. Then the blanket cylinder 2, the plate cylinders 3 and 4 and the inking units 7 and 8 are brought into contact with each other to perform printing with supply of ink. In the printing routine, the impression cylinder 11 is made in contact with/separated from the blanket cylinder 2 at appropriate timing in phase with the blanket cylinder 2, while the continuous paper 12 is intermittently fed in association with the said timing, to perform printing on a page per rotation of the blanket cylinder 2. The number of sheets to be printed is previously set through the operation panel 25 to terminate the printing routine when the set number is satisfied. Then a printing plate discharging routine and another blanket cylinder cleaning routine are executed to stop rotation of the main motor 20, thereby to wait for a subsequent command.

FIG. 96 is a schematic explanatory diagram showing an embodiment of a blanket cylinder cleaning mechanism according to the present invention, which is employed for executing the aforementioned blanket cylinder cleaning routine. This blanket cylinder cleaning mechanism comprises a detergent solution feeding unit 18 for feeding a detergent solution to the blanket cylinder 2 and a wiping unit 19 for wiping out the detergent solution, which are detachably arranged in the said order closely on the circumference of the blanket cylinder 2 along the rotational direction thereof, while a detergent solution supply unit 41 is connected with the detergent solution feeding unit 18 through a feeding/discharging pipe 42 for supplying the detergent solution to the detergent solution feeding unit 18.

The detergent solution supply unit 41 is formed by a storage tank 4101 for storing the detergent solution and a feeding/discharging pump 4102 with no check valve interposed between the storage tank 4101 and the feeding/discharging pipe 42. The feeding/discharging pump 4102 sucks the detergent solution stored in the storage tank 4101 to supply the same to the detergent solution feeding unit 18 in order to start the cleaning process, while the feeding/discharging pump 4102 is intermittently driven to maintain the detergent solution in the detergent solution feeding unit 18 at constant volume during the cleaning process. Upon completion of the cleaning process, driving of the feeding/discharging pump 4102 is stopped to automatically discharge the detergent solution from the detergent solution feeding unit 18 by its own liquid pressure, to return the same in the storage tank 4101 through the feeding/discharging pipe 42 and the feeding/discharging pump 4102. A liquid surface sensor (not shown) is provided in the storage tank 4101 to detect whether or not the detergent solution exceeds prescribed volume.

FIG. 97 is an explanatory plan view showing the mechanism of the detergent solution feeding unit 18. Referring to FIGS. 96 and 97, the detergent solution feeding unit 18 is formed by a solvent applying roller 1803 provided between upper front portions of left and right frames 1801 and 1802, a suction roller 1804 arranged in a sllightly rearward non-contact positon and a liquid tank 1805 arranged entirely over the lower parts of the left and right frames 1801 and 1802 to receive the suction roller 1804. Front ends of the left and right frames 1801 and 1802 and the liquid tank 1805 are obliquely formed along the circumference of the blanket cylinder 2, not to be in contact with the same upon mounting.

An upper lid 1806 is horizontally provided above the rear upper end of the liquid tank 1805, while a reed switch 1807 is provided in the vicinity of the left end of the upper lid 1806 to be extended into the liquid tank 1805 and a ring-shaped float member 1808 is freely engaged with the reed switch 1807 in the liquid tank 1805. A magnet 1809 is mounted on the upper surface of the float member 1808, so that the read switch 1807 is driven when the liquid surface of the detergent solution in the liquid tank 1805 reaches a prescribed level and the float member 1808 is upwardly moved to a prescribed position. The feeding/discharging pump 3102 with no check valve is stopped/driven in response to presence/non-presence of such a detection signal to supply the detergent solution from the storage tank 3101 to the liquid tank 1805 every time the liquid surface is lowered from the prescribed level, thereby to maintain the liquid surface of the detergent solution in the liquid tank 1805 always at the prescribed level in the cleaning process.

A support bar 1810 is horizontally extended between rear upper end portions of the left and right frames 1801 and 1802, such that the left end of the support bar 1810 is received in a cylinder 1812 containing a contact/separation spring 1811 while a fork member 1813 (see FIG. 98) is frontwardly projected in the vicinity of the right end of the support bar 1810. Engaging projections 1814 and 1815 are respectively provided on the left end of the cylinder 1812 and the right end of the support bar 1810 to be engaged with contact holes formed in prescribed positions of the left and right main frames 180 and 181 of the printing press body 1 while the recess of the fork member 1813 is engaged with a contact pin 5173 inwardly projected from the exterior of a vertical slit-like through hole 5172 provided on a prescribed position of the right main frame 181, thereby to mount the detergent solution feeding unit 18 on the printing press body 1. At this time, a limit switch (not shown) is driven to indicate that the detergent solution feeding unit 18 is correctly mounted on the printing press body 1. After the detergent solution feeding unit 18 is mounted on the printing press body 1, the forward end of a flexible drain hose 1814 rearwardly drawn out from the lower left end of the liquid tank 1805 is inserted in the inner end of a coupling 5174 received through the left main frame 180 of the printing press body 1, so that the feeding/discharging pipe 42 connected with the outer end of the coupling 5174 communicates with the liquid tank 1805 to enable movement of the detergent solution between the storage tank 3101 and the liquid tank 1805.

FIG. 98 is an explanatory right side elevational view showing a state in which the detergent solution feeding unit 18 is mounted on the printing press body 1, such that the detergent soltion feeding unit 18 is registered between the left and right main frames 180 and 181 of the printing press body 1 through the support bar 1810 and the contact pin 5173. The contact pin 5173 is vertically movable between a first position A shown by the solid line and a second position B shown by the dotted line along the vertical slit-like throuth hole 5172 formed in the right main frame 181, so that the detergent solution feeding unit 18 is rotated by a slight angle about the support bar 1810 with movement of the contact pin 5173. By virtue of such a mechanism, the solvent applying roller 1803 is separated from the blanket cylinder 2 when the contact pin 5173 is in the first position A, while the solvent applying roller 1803 is in contact with the blanket cylinder 2 when the contact pin 5173 is in the second position B.

FIG. 99 is an explanatory diagram showing a driving mechanism for moving the contact pin 5173 along the vertical slit-like through hole 5172. In this driving mechanism, the contact pin 5173 received in the vertical slit-like through hole 5172 is in contact with the front bottom portion of an L-shaped member 5174 in the exterior of the right main frame 181 while a movement supporting point 5175 for the L-shaped member 5174 is provided in the rear bottom portion thereof, and the upper end of the L-shaped member 5174 is connected to the armature of a solenoid 5176 to be horizontally swung thereby to slightly move the contact pin 5173 in the vertical direction. A tension coil spring 5161 is mounted on the right end porton of the L-shaped member 5174 to continuously pull the L-shaped member 5174 through the movement supporting point 5175 in such a direction that the detergent solution feeding unit 18 is separated from the blanket cylinder 2, while an end of the tension coil spring 5161 is engaged with a pin 5162 which is fixed to the right main frame 181. A contact position stopper 5163 and a separated position stopper 5164 are arranged with interposition of the L-shaped member 5174, so that the detergent solution feeding unit 18 is not swung over a prescribed distance. A limit switch (not shown) is provided to operate in response to the swinging movement of the L-shaped member 5174, so that the microprocessor 21 can detect the state of the solenoid 5176.

Rotary shafts of the solvent applying roller 1803 and the suction roller 1804 are interlocked by a driving belt 1816 in the exterior of the right frame 1802 of the detergent solution feeding unit 18, so that the suction roller 1804 is rotated in response to coupled rotation of the solvent applying roller 1803 in contact with the blanket cylinder 2, to suck the detegent solution from the liquid tank 1805 along the circumference of the suction roller 1804. The suction roller 1804 and the solvent applying roller 1803 are separated by such a small distance d that these rollers are connected by surface tesion of the detergent solution, whereby the detergent solution sucked in response to the rotation of the suction roller 1804 is partially moved from the circumference of the suction roller 1804 to that of the solvent applying roller 1803 to form a uniform liquid film, to be uniformly fed to the entire surface of the blanket cylinder 2. The amount of moveent of the detergent solution from the suction roller 1804 to the solvent applying roller 1803 is varied with the value of the small distance d, which is chaned to adjust the amount of the solvent fed from the solvent applying roller 1803 to the blanket cylinder 2. In general, the small distance d is previously set at an optimum value.

The solvent applying rollr 1803 intermittently comes into contact with the blanket cylinder 2 during the blanket cylinder cleanig process, and hence the ink remaining on the blanket cylinder 2 is adhered to the surface of the solvent applying roller 1803. However, the ink thus adhered to the surface of the solvent applying roller 1803 is not directly mixed into the detergent solution in the liquid tank 1805 through provision of the aforementioned small distance d while the amount of mixture thereof can be minimized through the function of the small distance d, whereby the detergent solution in the liquid tank 1805 can be effectively prevented from contamination by the ink remaining on the blanket cylinder 2.

The solvent applying roller 1803 and the suction roller 1804 are preferably made of a metal material, for example. The metal material is small in affinity for the ink in comparison with a rubber material etc., and hence the same can effectively reduce the amount of ink moved from the blanket cylinder 2 to the solvent applying roller 1803 as well as effectively prevent contamination of the detergent solution in the liquid tank 1805, while the same shows substantially no secular change (change in the form caused by surface deterioration and repeated use) and can always uniformly maintain the surface liquid film. Further, the metal material can easily control a slight pressure (kiss touch) applied on the blanket cylinder 2 in comparison with an elastic material such as rubber, whereby the detergent solution can be uniformly fed to the blanket cylinder 2.

Another preferable material for the solvent applying roller 1803 is a viscous material having no affinity for ink such as silicon rubber, and in this case, the solvent applying roller 1803 may also serves as a disposal roller as follows. That is, the solvent applying roller 1803 is separated from the blanket cylinder 2 in execution of the printing routine in general case while, when the solvent applying roller 1803 is made of silicon rubber, for example, the solenoid 5176 is intermittently or continuously energized in response to the amount of dust on the blanket cylinder 2 during execution of the printing routine to stop the contact pin 5173 in the second position B to responsively make the solvent applying roller 1803 in contact with the blanket cylinder 2 in a desired mode, thereby to suck the dust adhered to the surface of the blanket cylinder 2 during the printing process onto the surface of the solvent applying roller 1803 through viscosity of the silicon rubber. The dust thus sucked is gradually collected in the liquid tank 1805 through the suction roller 1804 during the blanket cylinder cleaning process, whereby the surface of the solvent applying roller 1803 is not filled with the dust adhered thereto. Movement of the ink remaining on the surface of the blanket cylinder 2 is effectively privented in the cleaning process so far as the solvent applying roler 1803 is made of a material having substantially no affinity for ink such as silicon rubber.

FIG. 100 is an explanatory developed plan view along central lines of three rollers of the wiping unit 19. Referring to FIGS. 96 and 100, the wiping unit 19 is formed by a dry web roll 1903 and a take-up roller 1904 parallely arranged in a frame 1901 having two handles 1902 in horizontal rear end portions. A web 1905 of the dry web roll 1903 is wound around a rubber roller 1906 arranged in the front lower end of the frame 1901 to be taken up by the take-up roller 1904, which in turn is rotated to draw out the web 1905 from the dry web roll 1903 so that the same is successively taken up by the take-up roller 1904 through the circumference of the rubber roller 1906.

Respective both ends of the dry web roll 1903 and the take-up roller 1904 are engagingly supported by horizontal pairs of short shafts 1907, 1908 and 1909, 1910, so that the rightside short shafts 1908 and 1910 are horizontally reciprocable through functions of web contact-/separation springs 1911 and 1912 to enable replacement of the web roll 1903 and disengagement of the take-up roller 1904 after taking up the web 1905.

A brake applying spring 1913 is wound around the left end of the left short shaft 1907 for the dry web roll 1903 to press a brake shoe 1914, to apply approriate braking force to rotation of the dry web roll 1903 so that the web 1905 is taken up by the take-up roller 1904 with prescribed tension.

A driving gear 1915 and a one-way clutch 1916 are arranged on the left end of the left short shaft 1909 for the take-up roller 1904 so that rotation of the driving gear 1915 is restricted to one direction to provent inverse rotation of the take-up roller 1904. A driving motor 1917 is arranged at the central portion in a left space of the frame 1901 so that a gear 1918 mounted on the rotary shaft of the driving motor 1917 is engaged with the aforementioned driving gear 1915 to rotatingly drive the take-up roller 1904, which in turn takes up the web 1905 in response to rotation of the driving motor 1917.

In the exterior of left and right side plates of the frame 1901, pairs of guide bars 1919, 1920 and 1921, 1922 are provided on diagnal positions (see FIG. 101) to serve as positional guide members for mounting the wiping unit 19 on the printing press body 1, while contact members 1923 and 1924 are provided in upper forward end portions for registration in mounting on the printing press body 1.

FIG. 101 is an explanatory left side elevational view showing the wiping unit 19 mounted on the printing press body 1. As shown in FIG. 101, a guide rail 5177 is obliquely provided from the left upper portion to the right lower portion in the interior of the left and right main frames of the printing press body 1, so that the guide bars 1919 and 1920 (and 1921 and 1922 in the right-hand end) of the wiping unit 19 are horizontally pressed from left to right into upper and lower opening portions 5178 and 5179 of the guide rail 5177, thereby to mount the wiping unit 19 on the printing press body 1 between the left and right main frames. At this time, a limit switch (not shown) is driven to indicate that the wiping unit 19 is correctly mounted on the printing press body 1.

In such a mounting state, contact members 1923 and 1924 on the horizontal front edns of the frame 1901 of the wiping unit 19 are placed on a support roller 5180 provided in the interior of the left and right frames of the printing press body 1, and the lower ends of the contact members 1923 and 1924 are obliquely formed to enable such placement. The support roller 5180 is mounted on a fulcrum shaft 5182 at the forward end of an arm 5181, whose lower end is connected with the armature of a latching solenoid 5183 to be horizontally swung about the fulcrum shaft 5182 to vertically move the support roller 5180 to responsively move the wiping unit 19 in the vertical direction along the guide rail 5177. When the latching solenoid 5183 is in a first state I with its armature being projected, the support roller 5180 is in a position (first position I) as shown in FIG. 101, so that the wiping unit 19 is downwardly moved slidably along the guide rail 5177 by its own weight while the web 1905 wound around the rubber roller 1904 is pressed against the blanket cylinder 2 by the own weight of the wiping unit 19 and positional restreiction by a stopper 5184. When the latching solenoid 5183 is in a second state II with its armature being pulled back, the support roller 5180 is moved to an upper position (second position II), and the wiping unit 19 is responsively lifted up so that the rubber rollber 1904 is separated from the blanket cylinder 2, while the guide bars 1919 to 1922 of the wiping unit 19 are in disengageable positions, i.e. the opening portions 5178 and 5179 of the guide rail 5177. The support roller 5180 is always in the upper position (second position II) when mounting/demounting the wiping unit 19.

The dry web 1905 is preferably made of paper of long-fiber 100% pulp. This material is optimum as a solvent absorbing material in view of improvment in cleaning ability, since the same can quickly absorb the solvent similarly to cotton while producing no flocks such as that of the cotton. Examples of commercially available materials are "Impact Cellulose" (trade means) by Scot Paper Co., ltd., "High Loft No. 3051" (trade name) by Sanyo Scot Co. and the like.

FIG. 102 is a flow chart showing operation of the microprocessor 21 for executing the blanket cylinder cleaning routine. The blanket cylinder 2 is automatically cleaned continuously to other routine as a process of the printing program as hereinabove described, while the same can be independently cleaned by supply of power to a blanket cylinder cleaning key on the operation panel 25. When power is supplied to the blanket cylinder cleaning key, verifications are made at a step S201 as to whether or not a blanket cylinder cleaning command is acceptable, i.e., whether or not the detergent solution feeding unit 18 and the wiping unit 19 are correctly mounted on the printing press body 1 and as to whether or not sufficient volume of detergent solution is stored in the storage tank 3101 etc. Such verifications are made on the basis of output signals from the aforementioned limit switches (not shown) and the liquid surface sensor provided in correspondence to respective mechanisms. If the blanket cylinder cleaning command is not acceptable, the blanket cylinder cleaning routine is terminated without cleaning the blanket cylinder 2.

When the command is acceptable, the process is advanced from the step S201 to a step S202, to set the respective mechanical parts in initial states. At this time, the plate cylinders 3 and 4 and the impression cylinder 11 are set in states separated from the blanket cylinder 2, while the detergent solution in the storage tank 3101 is sucked by the feeding/discharging pump 3102 to be supplied to the liquid tank 1805 through the feeding-/discharging pipe 42 and the drain hose 1814.

Then, at a step S203, a determination is made as to whether or not a high-speed motor of the main motor 20 is already turned on. The main motor 20 is formed by a low-speed motor for starting the same and the high-speed motor for stationary driving, and the dtermination at the step S203 is made as to whether or not the main motor 20 is stationary driven with the high-speed motor being turned on. When the main motor 20 is not in the stationary driven state, the process is advanced to a step S204 to turn on the low-speed motor, and then the low-speed motor is turned off and the high-speed motor is turned on after a lapse of a prescribed period at a step S205, to drive the main motor 20 in the stationary state. Thus, the driving system through the main motor 20, i.e., the blanket cylinder 2, the plate cylinders 3 and 4, the impression cylinder 11 and the like are started for rotation. Then the process is advanced to a step S206, to clean the blanket cylinder 2. When the main motor 20 is already in the stationary driven state with the high-speed motor being turned on, the process is directly advanced from the step S203 to the step S206.

FIG. 103 is a timing chart showing blanket cylinder cleaning operation performed at the step S206. In FIG. 103, "00" denotes output timting of the zero point pulse from the reference rotary encoder mounted on the rotary shaft of the blanket cylinder 2, which zero point pulse is outputted in the unit of one per rotation of the blanket cylinder 2 as deacribed in the above.

A first rotation of the blanket 2, the latching solenoid 5183 (see FIG. 101) for moving the wiping unit 19 is in the second state II with its armature being pulled back as shown at (a) and the support roller 5180 is in the upper second position II, whereby the web 1905 wound around the rubber roller 1906 on the front end of the wiping unit 19 is separated from the blanket cylinde 2. In this state, the solenoid 5176 (see FIG. 99) for moving the detergent solution feeding unit 18 is energized for a period of about $\frac{3}{4}$ of one rotation cycle of the blanket cylinder 2 as shown at (b) to pullback the armature and downwardly move the contact pin 5173, thereby to make the solvent applying roller 1803 in contact with the blanket cylinder 2 over the entire circumference except for the opening portion 201. Simultaneously with the contact, the solvent applying roller 1803 is followingly rotated and the suction roller 1804 interlocked therewith by the driving belt 1816 is also rotated in response thereto, to suck the detergent solution from the liquid tank 1805 and feed the same to the surface of the blanket cylinder 2. Thus, only feeding of the detergent solution to the entire surface of the blanket cylinder 2 is performed at the first rotation of the blanket cylinder 2.

Immediately before the first rotation is completed, the latching solenoid 5183 for moving the wiping unit 19 is energized as shown at (a) to project the armature (first state I) so that the support roller 5180 is moved to the lower first position I to make the web 1905 wound around the rubber roller 1906 in contact with the blanket cylinder 2. The surface of the blanket cylinder 2 is wiped out by the dry web 1905 after the second rotation thereof. During the wiping process, the motor 1917 (see FIG. 100) for taking up the web 1905 is intermittently driven at the first stage of each rotation cycle as shwon at (c), to take up the web 1905 on the take-up roller 1904 while intermittently feeding the same. Thus, the web 1905 is renewed by appropriate length per rotation of the blanket cylinder 2, so that the surface of the blanket cylinder 2 is always wiped out by the web 1905 in a clean state.

In first N rotation cycles during the wiping process through the web 1905, the solenoid 5176 for moving the detergent solution feeding unit 18 is intermittently energized at the first stage of each rotation cycle as shown at (b), to intermittently feed the detergent solution to a part of the circumference of the blanket cylinder 2 while controlling the period in which the solvent applying roller 1803 is in contact with the blanket cylinder 2. The detergent solution is thus intermittently fed while controlling the contact period, thereby to continuously maintain the detergent solution in appropriate volume. Other factors for varying the feed volume of the detergent solution are the value of the small distance d between the suction roller 1804 and the solvent applying roller 1803, the rotation frequency of the suction roller 1804, the contact pressure between the suction roller 1804 and the blanket cylinder 2 and the like, and the aforementioned contact period is determined from a total view including setting of such values. Thus, during N rotation cycles after the second rotation of the blanket cylinder 2, the blanket cylinder is wiped in a wet wiping manner with feeding of the detergent solution. In a preferred embodiment of the present invention, the number N is equal to 7.

During final K rotation cycles, the solenoid 5176 for moving the detergent solution feeding unit 18 is not energized as shown at (b), whereby dry wiping is performed by the web 1905 without feeding the detergent solution. After the detergent solution remaining on the surface of the blanket cylinder 2 is thus wiped out to dry the blanket cylinder 2, the latching solenoid 5183 for moving the wiping unit 19 is energized at the last timing of the K-th rotation to pull back the armature (second state II) and the support roller 5180 is moved to the upper second position II to separate the web 1905 wound around the rubber roller 1906 from the blanket cylinder 2, to complete the blanket cylinder cleaning routine. The number K is equal to 2 in a preferred embodiment.

In the blanket cylinder cleaning mechaism as hereinabove described, the detergent solution is fed at once over the prescribed width to be cleaned through the roller arranged in parallel with and closely oppositely to the cylinder in a rotatable manner, whereby the detergent solution can be uniformly fed to the entire surface of the cylinder to be cleaned at once in appropriate volume. Further, the surface of the cylinder is at once wiped while renewing a liquid absorbing sheet, whereby a high cleaning effect can be obtained in a short period. In addition, the detergent solution is fed in appropriate volume to save the amount of use of the liquid absorbing sheet, while the wiping means is provided on a direct downstream side of the detergent solution feeding roller to prevent evaporation of the detergent solution, whereby a further uniform wiping effect can be obtained.

Although the present invention has been described and illustraed in detail, it is clearly understood that the same is by way of illustration and example only and is not to be taken by way of limitation, the spirit and scope of the present invention being limited only by the terms of the appended claims.

What is claimed is:

1. A multicolor printing press executing printing operations with waterless printing plates, said multicolor printing press comprising:

a printing press body;

a plurality of plate cylinders being set to predetermined positions of said printing press body;

a plurality of inking devices each commonly being compatible with each plate cylinder and installed to said printing press body so that each of said inking devices can individually and freely be mounted onto and removed from said printing press body; and a plurality of plate feeding and discharging devices each commonly being compatible with each of said plate cylinders and means for installing said plate feeding and discharging devices to said printing press body so that each said plate feeding and discharging device can individually and freely be mounted onto and removed from said printing press body wherein each said inking device includes:

a frame;

a form roller mounted on said frame;

an ink distributing roller mounted to said frame; and a roller operating mechanism mounted to said frame for pressing said ink distributing roller against said form roller;

driving means being provided at said printing press body for driving said roller operating mechanism;

said ink distributing roller being pressed against said form roller by engaging said driving means with said roller operating mechanism in conjunction with mounting said inking device onto said printing press body, wherein said roller operating mechanism includes:

a driving lever connected pivotally to said frame of said inking device; and a linkage connected between said driving lever and a roller shaft of said ink distributing roller enabling said ink distributing roller to be pressed against and released from said form roller in conjunction with movement of said driving lever;

said driving means comprising a spring mounted to said printing press body, said spring causing said driving lever to pivot from a raised position by mounting said inking device onto said printing press body.

2. A multicolor printing press executing printing operations with waterless printing plates, said multicolor printing press comprising:

a printing press body;

a plurality of plate cylinders being set to predetermined positions of said printing press body;

a plurality of inking devices each commonly being compatible with each plate cylinder and installed to said printing press body so that each of said inking devices can individually and freely be mounted onto and removed from said printing press body; and a plurality of plate feeding and discharging devices each commonly being compatible with each of said plate cylinders and installed to said printing press body so that each of said plate feeding and discharging devices can individually and freely be mounted onto and removed from said printing press body, wherein each said inking device includes a frame; and a form roller having a roller shaft and mounted to said frame by said roller shaft;

said multicolor printing press further comprising:

a blanket cylinder mounted to said printing press body;

means for moving said each plate cylinder so that said each plate cylinder can come into and out of contact with said blanket cylinder;

means being provided to said printing press body for holding a front end portion of said frame of each said inking device so that the frame can pivot about its front end portion;

driving means being provided to said printing press body for holding a rear end portion of said frame of each said inking device to move the rear end portion of said frame so that each said form roller can come into and out of contact with each said plate cylinder;

shaft-to-shaft distance regulating members being held at one end thereof by rotational shafts of said plate cylinders respectively, each said shaft-to-shaft distance regulating member including at an other end portion thereof a roller-shaft retention part for connection to the roller shaft of each said form roller; and means being provided on said printing press body for holding each shaft-to-shaft distance regulating member so that each said roller-shaft retention part faces the roller shaft of each said form roller;

each said shaft-to-shaft distance regulating member connected to the roller shaft of each said form roller by each said roller-shaft retention part to provide contact-pressure between each said form roller and each said plate cylinder when said driving means causes each said form roller to come into contact with each said plate cylinder to thereby maintain a distance between the rotational shaft of each said plate cylinder and the roller-shaft of each said form roller at a predetermined value.

3. A method of controlling printing ink concentration for a multicolor printing press including a printing press body; a plurality of plate cylinders mounted to said printing press body; a plurality of inking devices respectively associated with said plate cylinders and mounted to said printing press body; a plurality of plate feeding and discharging devices respectively associated with said plate cylinders and mounted to said printing press body; a blanket cylinder mounted to said printing press body; an impression cylinder mounted to said printing press body; means for driving said impression cylinder, said blanket cylinder, each said plate cylinder and each said form roller; means for moving each said inking device being mounted to said printing press body so that each form roller can come into and out of contact with each said plate cylinder; means for moving each plate cylinder so that each plate cylinder can come into and out of contact with said blanket cylinder; means for moving said impression cylinder so that said impression cylinder can come into and out of contact with said blanket cylinder; a carrier means for carrying a continuous paper inserted between said impression cylinder and said blanket cylinder, and input means for inputting information to initiate a printing operation; said control method comprising:

a first step of driving said impression cylinder, said blanket cylinder, each said plate cylinder and each said form roller apart from each other in response to a start command from said input means;

a second step of feeding a greater amount of ink than a standard amount of each said plate cylinder from each said form roller by causing each said plate cylinder to rotate in contact with said each form roller in response to a printing start-up command from said input means;

a third step of transferring a greater amount of ink than a standard amount to each said blanket cylinder from each said plate cylinder by causing each said plate cylinder to rotate in contact with said blanket cylinder after completing said second step;

a fourth step of causing each said form roller to depart from each said plate cylinder while causing said impression cylinder to come into contact with said blanket cylinder after completing said third step;

a fifth step of printing one page on said continuous paper by causing said blanket cylinder and each said plate cylinder to rotate respectively while said continuous paper is carried by said carrier means after completing said fourth step; and a sixth step of causing each said form roller to come into contact with each said plate cylinder after completing said fifth step.

4. The control method of printing-concentration in accordance with claim 3, said control method further comprising:

a seventh step of inputting information as to a number of printable paper by said input means;

an eighth step of departing each said form roller from each said plate cylinder when a printing for a previous page of a last page corresponding to the number of printable paper inputted by said seventh step completes after completing said sixth step;

a ninth step of causing each said plate cylinder and said blanket cylinder to rotate about one-half in the condition in which said continuous paper is carried by said carrier means for printing a half area of said last page on said continuous paper after completing said eighth step;

a tenth step of causing each said plate cylinder to depart from said blanket cylinder after completing said ninth step;

an eleventh step of causing said blanket cylinder to rotate about one-half in the condition in which said continuous paper is carried by said carrier means for printing a remaining half area of said last page on said continuous paper after completing said tenth step; and a twelfth step of causing said impression cylinder to depart from said blanket cylinder after completing said eleventh step.

5. The control method of printing-concentration in accordance with claim 4, said control method further comprising:

a thirteenth step of inputting a pause-in command by said input means after completing said sixth step;

a fourteenth step of causing said impression cylinder to depart from said blanket cylinder and stopping to carry said continuous paper by said carrier means while causing each said form roller to depart from each said plate cylinder after completing a printing of an entire area of a printable page at the time of generating said pause-in command in response to said pause-in command; and a fifteenth step of causing each said plate cylinder to depart from said blanket cylinder when each said plate cylinder and said blanket cylinder rotate about one-half respectively so as to complete a transference of ink from each said plate cylinder to said blanket cylinder after said fourteenth step.

6. The control method of printing-concentration in accordance with claim 5, said control method further comprising:

sixteenth step of inputting a pause-out command by said input means after said fifteenth step;

a seventeenth step of causing said impression cylinder to come into contact with said blanket cylinder so that a printing can be resumed from a top-end area of a printable page in response to said pause-out command;

an eighteenth step of starting to carry said continuous paper by said carrier means while causing each said form roller to come into contact with each said plate cylinder at the same time that said impression cylinder comes into contact with said blanket cylinder in said seventeenth step; and a nineteenth step of causing each said plate cylinder to come into contact with said blanket cylinder when each said plate cylinder and said blanket cylinder rotate about one-half respectively after completing said eighteenth step.

7. The control method of printing-concentration in accordance with claim 6, each said inking device further comprising a doctor blade capable of freely moving itself forward and backward against an external surface of each said form roller;

said multicolor printing press further comprising a second sensor means for detecting an ink film thickness on each said plate cylinder, and means for adjusting a pushing amount of each said doctor blade against said each form roller on the basis of a detecting signal from said second sensor means;

said control method of printing-concentration further comprising:

a twentieth step of detecting the ink film thickness on each said plate cylinder by said second sensor means after completing said second step; and a twenty-first step of adjusting the pushing amount of each said doctor blade against said each form roller so that the ink film thickness on each said plate cylinder can match predetermined ink film thickness on the basis of the detecting signal from said second sensor means.

8. A multicolor printing press executing printing operations with waterless printing plates, said multicolor printing press comprising:

a printing press body;

a plurality of plate cylinders being set to predetermined positions of said printing press body;

a plurality of inking devices each commonly being compatible with each plate cylinder and means for detachably installing to said printing press body each of said inking devices such that said inking devices can individual and freely be mounted into an operative mounting position and completely removed from said printing press body; and a plurality of plate feeding and discharging devices each having means commonly being compatible with each of said plate cylinders and installed to said printing press body so that each of said plate feeding and discharging devices can individually and freely be mounted onto and removed from said printing press body wherein each said inking device includes:

a frame;

a form roller mounted on said frame;

an ink distributing roller mounted to said frame; and a roller operating mechanism mounted to said frame for pressing said ink distributing roller against said form roller;

driving means mounted to said printing press body for driving said roller operating mechanism upon contact with said roller operating mechanism when said inking device is in its operative mounted position on the printing press body;

said roller operating mechanism including means for pressing said ink distributing roller against said form roller upon engagement of said driving means with said roller operating mechanism in conjunction with mounting said inking device onto said printing press body.

9. The multicolor printing press in accordance with claim 8, wherein each said ink distributing roller is capable of freely oscillating in the direction of a roller shaft thereof while said ink distributing roller remains in contact with an external surface of said form roller;

said ink distributing roller being provided with a blasted surface having smooth and fine concave and convex regions.

10. The multicolor printing press in accordance with claim 8, wherein each said inking device includes:

said form roller having a roller shaft and an elastic part formed so as to surround said roller shaft; and a doctor blade which adjusts a thickness of an ink film formed on a surface of said form roller by adjusting a force exerted by said doctor blade against the surface of said form roller;

said elastic part including multiple layers having an external elastic layer and a softer internal elastic layer.

11. The multicolor printing press in accordance with claim 10, wherein said elastic part is a double-layer construction having said internal layer being a soft-elastic material and said external layer being a hard-elastic material.

12. The multicolor printing press in accordance with claim 8, wherein each said inking device includes:

said form roller having a roller shaft and an elastic part formed so as to surround said roller shaft;

a pair of holding plates secured to both ends of said roller shaft to press both end faces of said elastic part except for peripheral areas of said both end faces;

a doctor blade capable of freely moving forward and backward against an external surface of said form roller; and a pair of edge-sealing plates each being installed to both ends of said doctor blade to press against said peripheral areas of both end faces of said elastic part to close apertures formed on both sides of an ink-pooling space formed between said doctor blade and said form roller.

13. The multicolor printing press in accordance with claim 12, wherein said edge-sealing plates are held so that they can freely slide their positions in the direction of the width of said doctor blade and can freely be secured to any optional position via sliding movement.

14. The multicolor printing press in accordance with claim 8, wherein each said inking device includes:

said form roller capable of freely coming into and out of contact with said plate cylinder;

a doctor blade capable of freely moving itself forward and backward against said form roller; and an ink-pooling space formed between the external surface of said form roller and the upper surface of said doctor blade.

15. The multicolor printing press in accordance with claim 8, wherein each said inking device includes:

a doctor blade capable of freely moving itself forward and backward against said form roller;

an eccentric roller;

means for supporting said eccentric roller so that said eccentric roller can freely eccentrically rotate; and control means for controlling the rotation of said eccentric roller, said eccentric roller adjusting a pushing force of said doctor blade against said form roller in accordance with its own eccentric rotation.

16. The multicolor printing press in accordance with claim 15, wherein upon defining a contact point between said eccentric roller and said doctor blade as a point of application and defining a center of rotation of said eccentric roller as an original point, the phase of rotation of said eccentric roller is predetermined so that a distance between said point of application and said original point in the direction of perpendicular to the pushing direction of said doctor blade can be shortened as a function of increasing pushing force of said doctor blade.

17. The multicolor printing press in accordance with claim 15, wherein a maximum pushing force of said doctor blade generated by the rotation of said eccentric roller is a predetermined specific value preventing permanent deformation of said form roller.

18. The multicolor printing press in accordance with claim 8, wherein each said inking device includes:

a doctor blade movable against an external surface of said form roller; and an ink-pooling space formed between the external surface of said form roller and an upper surface of said doctor blade;

said multicolor printing press further comprising:

first sensor means installed at said printing press body for detecting an amount of residual ink within said ink-pooling space without contacting the residual ink for outputting a signal corresponding to the amount of residual ink; and means for outputting a specific signal indicative that the amount of residual ink is less than a predetermined value by determining the amount of residual ink in accordance with the signal output from said first sensor means.

19. The multicolor printing press in accordance with claim 18, wherein said first sensor means is a photoelectric sensor.

* * * * *